US007969372B2

(12) United States Patent
Miyashita et al.

(10) Patent No.: US 7,969,372 B2
(45) Date of Patent: Jun. 28, 2011

(54) ANTENNA APPARATUS UTILIZING SMALL LOOP ANTENNA ELEMENT HAVING MINUTE LENGTH AND TWO FEEDING POINTS

(75) Inventors: Norihiro Miyashita, Nara (JP); Yoshishige Yoshikawa, Nara (JP)

(73) Assignee: Panasonic Corporation, Osaka (JP)

( * ) Notice: Subject to any disclaimer, the term of this patent is extended or adjusted under 35 U.S.C. 154(b) by 309 days.

(21) Appl. No.: 12/376,223

(22) PCT Filed: Aug. 3, 2007

(86) PCT No.: PCT/JP2007/065258

§ 371 (c)(1),
(2), (4) Date: Feb. 3, 2009

(87) PCT Pub. No.: WO2008/016138

PCT Pub. Date: Feb. 7, 2008

(65) Prior Publication Data

US 2009/0315792 A1 Dec. 24, 2009

(30) Foreign Application Priority Data

| | | |
|---|---|---|
| Aug. 3, 2006 | (JP) | 2006-211982 |
| Sep. 7, 2006 | (JP) | 2006-242438 |
| Nov. 20, 2006 | (JP) | 2006-312586 |
| Dec. 4, 2006 | (JP) | 2006-326597 |
| Feb. 20, 2007 | (JP) | 2007-038987 |
| May 10, 2007 | (JP) | 2007-125330 |
| Jun. 22, 2007 | (JP) | 2007-164604 |

(51) Int. Cl.
*H01Q 11/12* (2006.01)
*H01Q 21/00* (2006.01)

(52) U.S. Cl. ..... 343/742; 343/867

(58) Field of Classification Search ..... 343/741, 343/742, 866, 867

See application file for complete search history.

(56) References Cited

U.S. PATENT DOCUMENTS 4,862,181 A 8/1989 Ponce De Leon et al.

(Continued)

FOREIGN PATENT DOCUMENTS

JP 53-30977 B 8/1978

(Continued)

OTHER PUBLICATIONS

Partial English translation of Institute of Electronics and Communication Engineers of Japan (IECE) editor, "Antenna Engineering Handbook", pp. 59-63, Ohm-sha Ltd., First Edition, issued on Oct. 30, 1980, 9 pages.

*Primary Examiner* — Hoang V Nguyen

(74) *Attorney, Agent, or Firm* — Brinks Hofer Gilson & Lione

(57) ABSTRACT

The small loop antenna element of the antenna apparatus includes loop antenna portions that have a predetermined loop plane and radiate a first polarized wave component parallel to the loop plane, and at least one connecting conductor that is provided in a direction orthogonal to the loop plane and connects the plurality of loop plane portions to radiate a second polarized wave component orthogonal to the first polarized wave component. In the case of the antenna apparatus located adjacent to a conductor plate, by making the maximum value of the antenna gain of the first polarized wave component and the maximum value of the antenna gain of the second polarized wave component substantially identical when the distance between the antenna apparatus and the conductor plate is changed, a composite component of the first and second polarized wave components are made substantially constant regardless of the distance.

13 Claims, 76 Drawing Sheets

U.S. PATENT DOCUMENTS

| | | | | |
|---|---|---|---|---|
| 5,113,196 | A | 5/1992 | Ponce De Leon et al. | |
| 5,280,631 | A | 1/1994 | Nakahi et al. | |
| 5,300,938 | A | 4/1994 | Maroun et al. | |
| 5,767,813 | A | 6/1998 | Verma et al. | |
| 5,784,032 | A | 7/1998 | Johnston et al. | |
| 5,850,200 | A | 12/1998 | Johannessen et al. | |
| 5,945,959 | A | 8/1999 | Tanidokoro et al. | |
| 6,061,025 | A | 5/2000 | Jackson et al. | |
| 6,133,886 | A | 10/2000 | Fariello et al. | |
| 6,154,177 | A | 11/2000 | Saito et al. | |
| 6,204,819 | B1 | 3/2001 | Hayes et al. | |
| 6,577,239 | B2 | 6/2003 | Jespersen | |
| 6,697,025 | B2 * | 2/2004 | Koyanagi et al. | 343/741 |
| 6,956,480 | B2 | 10/2005 | Jespersen | |
| 6,987,485 | B2 | 1/2006 | Ito et al. | |
| 7,038,635 | B2 | 5/2006 | Fukushima et al. | |
| 7,250,910 | B2 | 7/2007 | Yoshikawa et al. | |
| 2002/0018021 | A1 | 2/2002 | Koyanagi et al. | |
| 2003/0122671 | A1 | 7/2003 | Jespersen | |

FOREIGN PATENT DOCUMENTS

| | | | |
|---|---|---|---|
| JP | 5-347617 | A | 12/1993 |
| JP | 7-44492 | B | 5/1995 |
| JP | 9-130132 | A | 5/1997 |
| JP | 10-41936 | A | 2/1998 |
| JP | 10-126141 | A | 5/1998 |
| JP | 11-88246 | A | 3/1999 |
| JP | 11-136025 | A | 5/1999 |
| JP | 2000-244219 | A | 9/2000 |
| JP | 2001-127540 | A | 5/2001 |
| JP | 3206825 | B | 7/2001 |
| JP | 2001-326514 | A | 11/2001 |
| JP | 2002-43826 | A | 2/2002 |
| JP | 2002-57789 | A | 2/2002 |
| JP | 2002-204114 | A | 7/2002 |
| JP | 2004-242179 | A | 8/2004 |
| JP | 2005-109609 | A | 4/2005 |
| JP | 2007-51471 | A | 3/2007 |
| WO | WO 2004/070879 | A1 | 8/2004 |
| WO | WO 2007/026745 | A1 | 3/2007 |

* cited by examiner

ANTENNA GAIN [dB]
Com
V
H
QUARTER WAVELENGTH
HALF WAVELENGTH
DISTANCE D

ANTENNA GAIN [dB]
Com
V
H
QUARTER WAVELENGTH
HALF WAVELENGTH
DISTANCE D

ANTENNA GAIN [dB]
Com
V
H
QUARTER WAVELENGTH
HALF WAVELENGTH
DISTANCE D

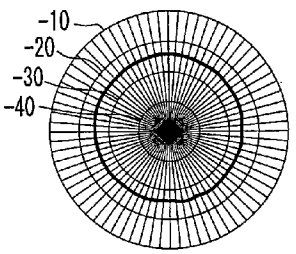
Fig.32(a) Ad=-10dB
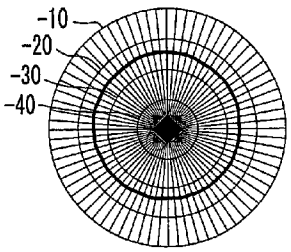
Fig.32(b) Ad=-9dB
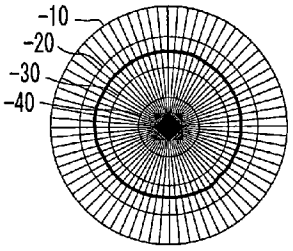
Fig.32(c) Ad=-8dB
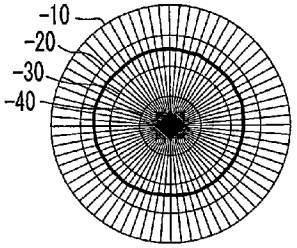
Fig.32(d) Ad=-7dB
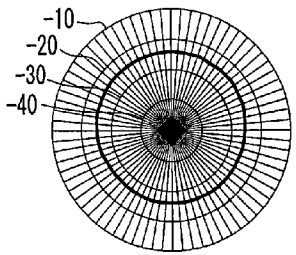
Fig.32(e) Ad=-6dB
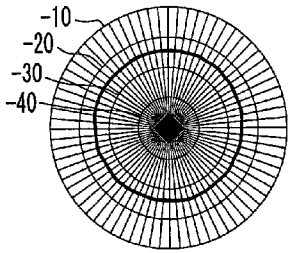
Fig.32(f) Ad=-5dB
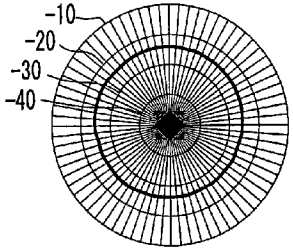
Fig.32(g) Ad=-4dB
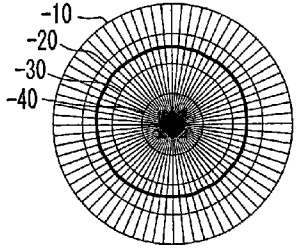
Fig.32(h) Ad=-3dB
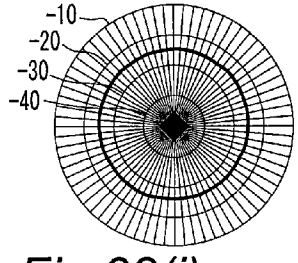
Fig.32(i) Ad=-2dB
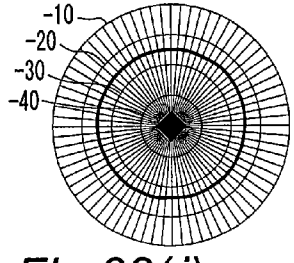
Fig.32(j) Ad=-1dB

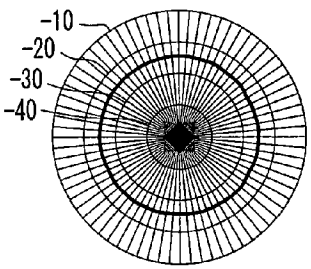
Fig.33(a) Ad=0dB
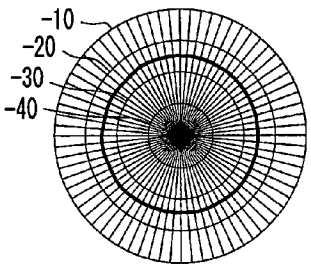
Fig.33(b) Ad=1dB
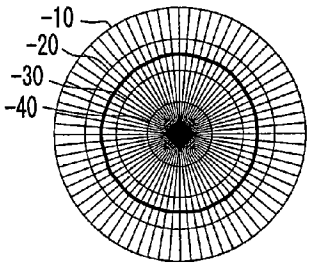
Fig.33(c) Ad=2dB
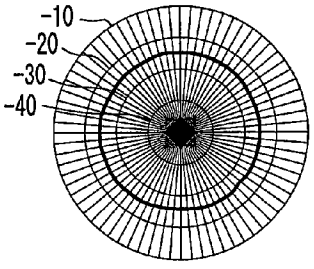
Fig.33(d) Ad=3dB
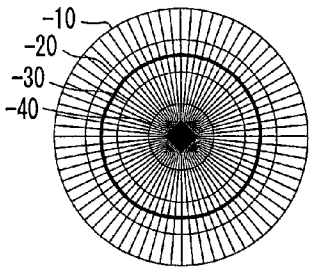
Fig.33(e) Ad=4dB
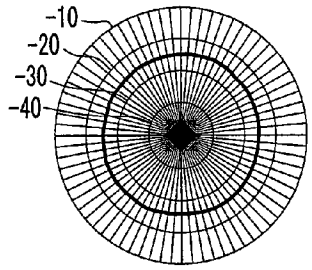
Fig.33(f) Ad=5dB
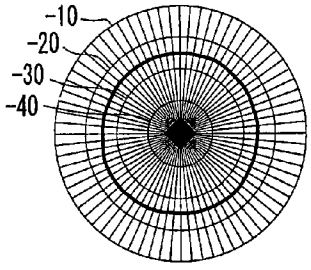
Fig.33(g) Ad=6dB
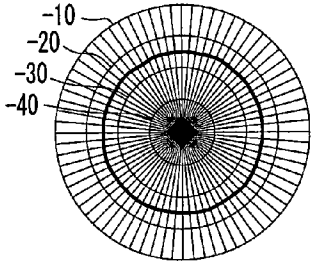
Fig.33(h) Ad=7dB
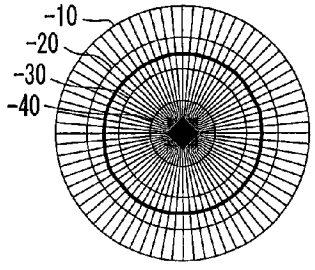
Fig.33(i) Ad=8dB
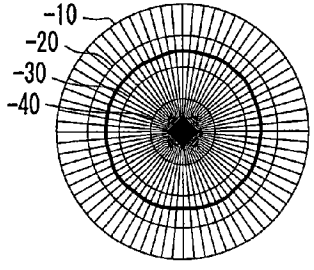
Fig.33(j) Ad=9dB
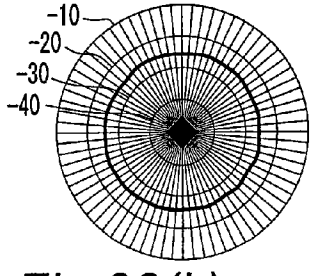
Fig.33(k) Ad=10dB

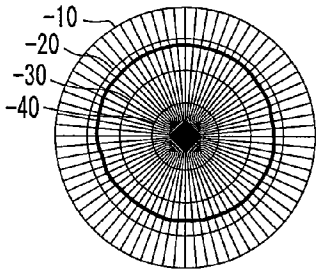
Fig.34(a) Ad=-10dB
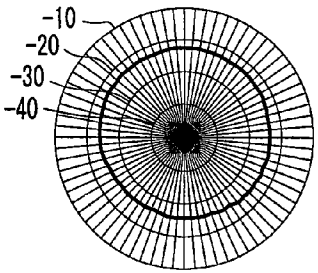
Fig.34(b) Ad=-9dB
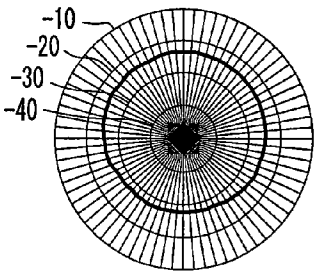
Fig.34(c) Ad=-8dB
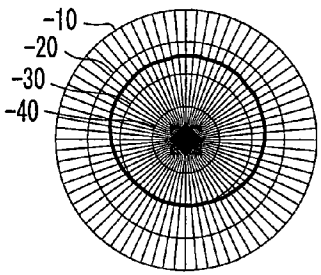
Fig.34(d) Ad=-7dB
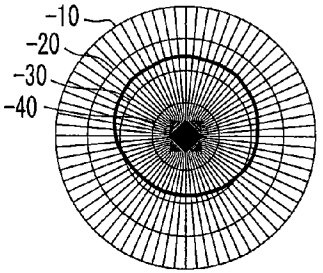
Fig.34(e) Ad=-6dB
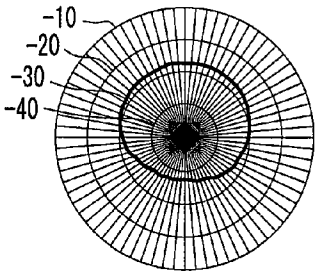
Fig.34(f) Ad=-5dB
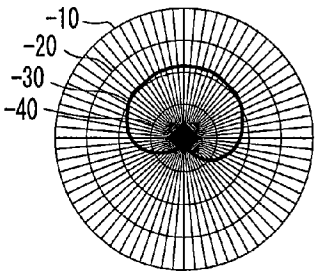
Fig.34(g) Ad=-4dB
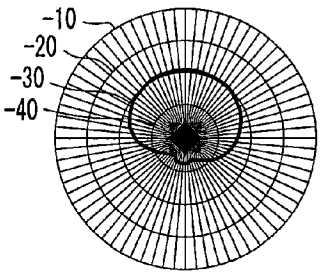
Fig.34(h) Ad=-3dB
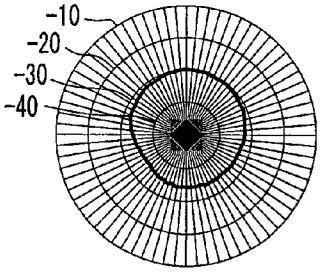
Fig.34(i) Ad=-2dB
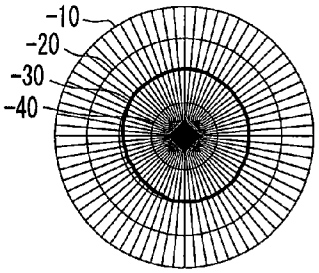
Fig.34(j) Ad=-1dB

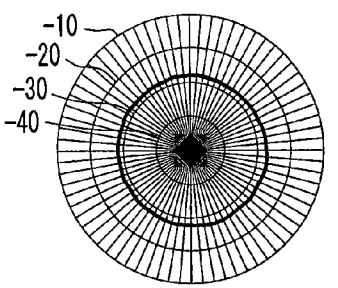
Fig.35(a) Ad=0dB
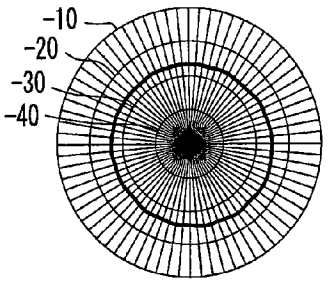
Fig.35(b) Ad=1dB
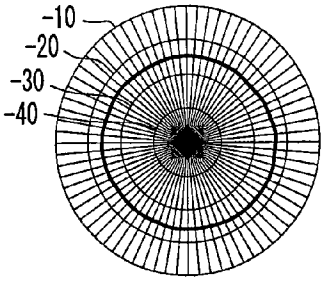
Fig.35(c) Ad=2dB
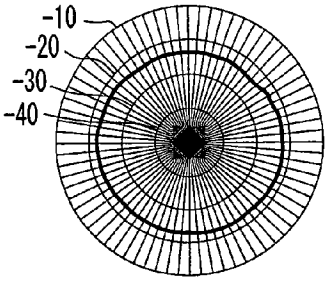
Fig.35(d) Ad=3dB
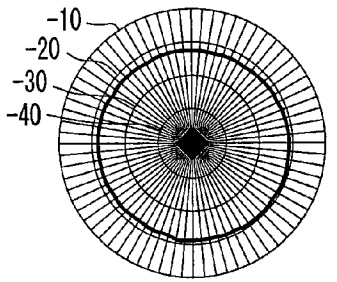
Fig.35(e) Ad=4dB
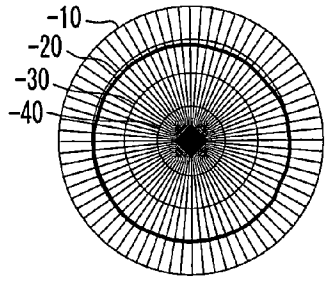
Fig.35(f) Ad=5dB
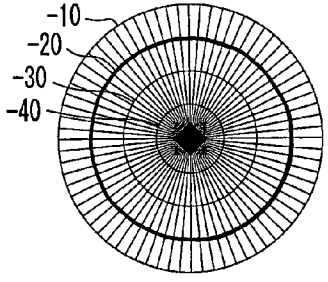
Fig.35(g) Ad=6dB
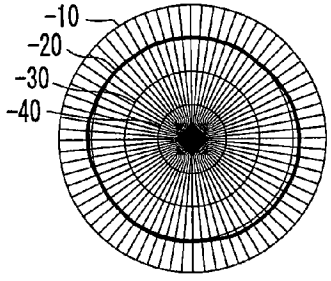
Fig.35(h) Ad=7dB
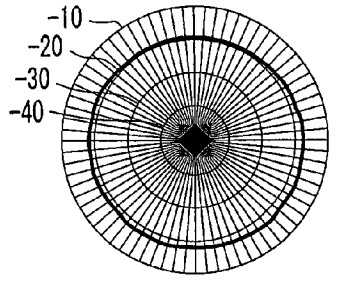
Fig.35(i) Ad=8dB
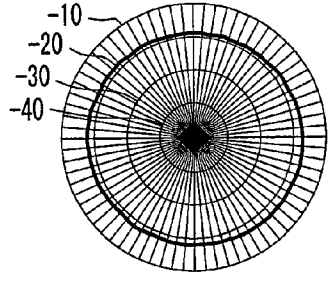
Fig.35(j) Ad=9dB
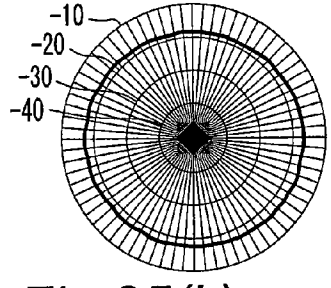
Fig.35(k) Ad=10dB

ANTENNA APPARATUS UTILIZING SMALL LOOP ANTENNA ELEMENT HAVING MINUTE LENGTH AND TWO FEEDING POINTS

TECHNICAL FIELD

The present invention relates to an antenna apparatus that employs small (or minute) loop antenna elements and to an antenna system that employs the antenna apparatus.

BACKGROUND ART

In recent years, development of personal authentication techniques by a wireless communication system has been promoted for securing an information security. In concrete, with wireless communication equipment carried by a user and wireless communication equipment provided for a physical object such as a personal computer, a portable telephone, a vehicle or the like, authentication is consistently performed by the wireless communication systems. When the physical object enters a certain range of peripheries of the user, control of the physical object is enabled. When the physical object goes out of the certain range of peripheries of the user, control of the physical object is disabled. In order to judge whether or not the physical object exists within the certain range of peripheries of the user, it is necessary to measure a distance between the physical object and the user by a wireless communication apparatus at the time of wireless authentication communication.

Moreover, there is measurement by received field intensity as a simplest distance measurement method. No specific circuit is necessary for the distance measurement, and the distance can be measured by utilizing wireless communication equipment for wireless authentication. However, since the user carries the wireless communication apparatus or an authentication key device, the gain of the mounted antenna is strongly influenced by conductors such as the human body. Moreover, when it is used in a multipath environment, the antenna suffers an influence of fading.

For the above reasons, a phenomenon that the received field intensity rapidly decreases due to the surrounding environment occurs. Consequently, a relation between the distance and the received field intensity such that the received field intensity decreases as the distance increases collapses, and distance measurement accuracy largely deteriorates. Moreover, the antenna gain falls below the necessary antenna gain during the authentication communication, and this incurs a decrease in the communication quality. Conventionally, a method for using a small loop antenna having a structure such that, even if a conductor is located adjacent to the antenna, a loop plane is perpendicular to the conductor is proposed as a method for avoiding the influence of the conductor on the antenna in order to prevent the rapid decrease in the gain (See, for example, FIG. 1 of Patent Document 1 and FIG. 2 of Patent Document 2). Moreover, a method for radiating a different polarized wave component has been proposed as a method for preventing the influence of fading (See, for example, FIG. 4 of Patent Document 1).

Patent Document 1: Japanese patent laid-open publication No. JP 2000-244219 A.

Patent Document 2: Japanese patent laid-open publication No. JP 2005-109609 A.

Patent Document 3: International Publication WO2004/070879.

Non-Patent Document 1: Editor of The Institute of Electronics, Information and Communication Engineers, "Antenna Engineering Handbook", pp. 59-63, Ohmsha, Ltd., First Edition, as issued on Oct. 30, 1980.

PROBLEMS TO BE SOLVED BY THE INVENTION

However, since the antenna gain changes depending on when the conductor is adjacent to the antenna or when the conductor is apart from the antenna by the methods of Patent Documents 1 and 2, there has been such a problem that a constant antenna gain has not been able to be obtained regardless of a distance from the antenna to the conductor. In particular, there has been a problem that the variation in the antenna gain due to the distance to the conductor cannot be avoided even if the influence of fading can be avoided by the method of Patent Document 1.

The first object of the invention is to solve the above problems and provide an antenna apparatus that employs small loop antenna elements, capable of obtaining a substantially constant gain regardless of the distance from the antenna apparatus to the conductor and preventing degradation in the communication quality.

The second object of the invention is to solve the above problems and provide an antenna system having an antenna apparatus for an authentication key and an antenna apparatus for objective equipment, which has a small variation in the antenna gain of an authentication key device when the distance between the antenna apparatus and the conductor changes and is able to avoid the influence of fading.

MEANS FOR SOLVING THE PROBLEMS

According to the first aspect of the present invention, there is provided an antenna apparatus including a small antenna element, and balanced signal feeding means. The small loop antenna element has a predetermined small length and two feeding points, and the balanced signal feeding means feeds two balanced wireless signals having a predetermined amplitude difference and a predetermined phase difference, to two feeding points of the small loop antenna element. The small loop antenna element includes a plurality of loop antenna portions, at least one connecting conductor, and setting means. The loop antenna portions has a predetermined loop plane, and the loop antenna portions radiates a first polarized wave component parallel to the loop plane. The connecting conductor is provided in a direction perpendicular to the loop plane, connects the plurality of loop antenna portions, and radiates a second polarized wave component orthogonal to the first polarized wave component. The setting means, in the case of the antenna apparatus located adjacent to the conductor plate, makes a maximum value of an antenna gain of the first polarized wave component and a maximum value of an antenna gain of the second polarized wave component substantially identical when a distance between the antenna apparatus and the conductor plate is changed. This leads to making a composite component of the first polarized wave component and the second polarized wave component substantially constant regardless of the distance.

In the above-mentioned antenna apparatus, the setting means sets at least one of the amplitude difference and the phase difference, so that the maximum value of the antenna gain of the first polarized wave component and the maximum value of the antenna gain of the second polarized wave component are made substantially identical when the distance is changed.

In addition, in the above-mentioned antenna apparatus, the setting means includes control means for controlling at least one of the amplitude difference and the phase difference, so that the maximum value of the antenna gain of the first polarized wave component and the maximum value of the antenna gain of the second polarized wave component are made substantially identical when the distance is changed.

Further, in the above-mentioned antenna apparatus, the setting means sets at least one of a dimension of the small loop antenna element, a number of turns of the small loop antenna element and an interval between the loop antenna portions, so that the maximum value of the antenna gain of the first polarized wave component and the maximum value of the antenna gain of the second polarized wave component are made substantially identical when the distance is changed.

In addition, in the above-mentioned antenna apparatus, the small loop antenna element includes first, second and third loop antenna portions provided parallel to the loop plane. The first loop antenna portion includes first and second half-loop antenna portions, each having a half turn, and the second loop antenna portion includes third and fourth half-loop antenna portions, each having a half turn. The third loop antenna portion has one turn. The antenna apparatus further includes first, second, third, and fourth connecting conductor portions. The first connecting conductor portion is provided in a direction orthogonal to the loop plane, and the first connecting conductor portion connects the first half-loop antenna portion with the fourth half-loop antenna portion. The second connecting conductor portion is provided in the direction orthogonal to the loop plane, and the second connecting conductor portion connects the second half-loop antenna portion with the third half-loop antenna portion. The third connecting conductor portion is provided in the direction orthogonal to the loop plane, and the third connecting conductor portion connects the third loop antenna portion with the fourth half-loop antenna portion. The fourth connecting conductor portion is provided in the direction orthogonal to the loop plane, and the fourth connecting conductor portion connects the third loop antenna portion with the third half-loop antenna portion. One end of the first half-loop antenna portion and one end of the second half-loop antenna portion are used as two feeding points.

Further, in the above-mentioned antenna apparatus, the small loop antenna element includes first, second and third loop antenna portions provided parallel to the loop plane. The first loop antenna portion includes first and second half-loop antenna portions, each having a half turn. The second loop antenna portion comprises third and fourth half-loop antenna portions, each having a half turn. The third loop antenna portion has one turn. The antenna apparatus includes first, second, third and fourth connecting conductor portions. The first connecting conductor portion is provided in a direction orthogonal to the loop plane, and the first connecting conductor portion connects the first half-loop antenna portion with the third half-loop antenna portion. The second connecting conductor portion is provided in the direction orthogonal to the loop plane, and the second connecting conductor portion connects the third half-loop antenna portion with the third loop antenna portion. The third connecting conductor portion is provided in the direction orthogonal to the loop plane, and the third connecting conductor portion connects the second half-loop antenna portion with the fourth half-loop antenna portion. The fourth connecting conductor portion is provided in the direction orthogonal to the loop plane, and the fourth connecting conductor portion connects the fourth half-loop antenna portion with the third loop antenna portion. One end of the first half-loop antenna portion and one end of the second half-loop antenna portion are used as two feeding points.

Sill further, in the above-mentioned antenna apparatus, the small loop antenna element includes first, second and third loop antenna portions provided parallel to the loop plane. The first loop antenna portion includes first and second half-loop antenna portions, each having a half turn. The second loop antenna portion includes third and fourth half-loop antenna portions, each having a half turn. The third loop antenna portion includes fifth and sixth half-loop antenna portions, each having a half turn. The antenna apparatus further includes first, second, third, fourth, fifth, and sixth connecting conductor portions. The first connecting conductor portion is provided in a direction orthogonal to the loop plane, and the first connecting conductor portion connects the first half-loop antenna portion with the third half-loop antenna portion. The second connecting conductor portion is provided in the direction orthogonal to the loop plane, and the second connecting conductor portion connecting the third half-loop antenna portion with the fifth half-loop antenna portion. The third connecting conductor portion is provided in the direction orthogonal to the loop plane, and the third connecting conductor portion connects the second half-loop antenna portion with the fourth half-loop antenna portion. The fourth connecting conductor portion is provided in the direction orthogonal to the loop plane, and the fourth connecting conductor portion connects the fourth half-loop antenna portion with the sixth half-loop antenna portion. The fifth connecting conductor portion is provided in the direction orthogonal to the loop plane, and the fifth connecting conductor portion is connected to the fifth half-loop antenna portion. The sixth connecting conductor portion is provided in the direction orthogonal to the loop plane, and the sixth connecting conductor portion is connected to the sixth half-loop antenna portion. Then, a first loop antenna is configured to include the first, third and fifth half-loop antenna portions and the fifth connecting conductor portion. A second loop antenna is configured to include the second, fourth and sixth half-loop antenna portions and the sixth connecting conductor portion. One end of the first half-loop antenna portion and one end of the fifth connecting conductor portion are used as two feeding points of the first loop antenna. One end of the second half-loop antenna portion and one end of the sixth connecting conductor portion are used as two feeding points of the second loop antenna. Unbalanced signal feeding means is provided in place of the balanced signal feeding means, and the unbalanced signal feeding means feeds two unbalanced wireless signals having a predetermined amplitude difference and a predetermined phase difference respectively, to the first and second loop antennas.

According to the second aspect of the present invention, there is provided an antenna apparatus including the above-mentioned small loop antenna element, and further small loop antenna element. The further small loop antenna element has the same configuration as that of the small loop antenna element. The small loop antenna element and the further small loop antenna element are provided so that their loop planes are orthogonal to each other.

The above-mentioned antenna apparatus further includes switch means for selectively feeding the two balanced wireless signals to either one of the small loop antenna element and the further small loop antenna element.

In addition, in the above-mentioned antenna apparatus, the balanced signal feeding means distributes an unbalanced wireless signal into two unbalanced wireless signals with a phase difference of 90 degrees, thereafter converts one of the distributed unbalanced wireless signals into two balanced wireless signals to feed the two balanced wireless signals to the small loop antenna element. Further, the balanced signal feeding means feeds another one of the distributed unbalanced wireless signals to the further small loop antenna element, thereby radiating a circularly polarized wireless signal.

Further, in the above-mentioned antenna apparatus, the balanced signal feeding means distributes an unbalanced wireless signal into two in-phase or anti-phase unbalanced wireless signals, converts one of the converted unbalanced wireless signals into two balanced wireless signals to feed the two balanced wireless signals to the small loop antenna element. Further, the balanced signal feeding means converts another one of the converted unbalanced wireless signals into two further balanced wireless signals to feed the two further balanced wireless signals to the further small loop antenna element.

Still further, in the above-mentioned antenna apparatus, the balanced signal feeding means distributes an unbalanced wireless signal into two unbalanced wireless signals having a phase difference of +90 degrees or a phase difference of −90 degrees, converts one of the converted unbalanced wireless signals into two balanced wireless signals to feed the two balanced wireless signals to the small loop antenna element. Further, the balanced signal feeding means converts another one of the converted unbalanced wireless signals into two further balanced wireless signals to feed the two further balanced wireless signals to the further small loop antenna element.

According to the third aspect of the present invention, there is provided an antenna system an antenna apparatus for an authentication key including the above-mentioned antenna apparatus, and an antenna apparatus for objective equipment to perform wireless communications with the antenna apparatus for the authentication key. The antenna apparatus for the objective equipment includes two antenna elements having mutually orthogonal polarized waves, and switch means for selecting one of the two antenna elements, and connecting selected one antenna element with a wireless transceiver circuit.

EFFECTS OF THE PRESENT INVENTION

Therefore, according to the antenna apparatus of the present invention, an antenna apparatus capable of obtaining a substantially constant gain and preventing the degradation in the communication quality regardless of the distance between the antenna apparatus and the conductor plate can be provided. Moreover, an antenna apparatus that obtains a communication quality higher than that of the prior art can be provided by increasing the antenna gain of the polarized wave component radiated from the connecting conductor while suppressing the decrease in the antenna gain of the polarized wave component radiated from the small loop antenna element at the time of, for example, communication for authentication. Furthermore, the polarization diversity effect can be obtained even when one polarized wave of both vertically and horizontally polarized waves is largely attenuated.

Moreover, according to the antenna system of the invention, an antenna system having an antenna apparatus for an authentication key and an antenna apparatus for objective equipment, which has a small variation in the antenna gain of the antenna for the authentication key by the distance to the conductor plate and is able to avoid the influence of fading can be provided.

BRIEF DESCRIPTION OF DRAWINGS

FIG. 2(*b*) is a perspective view showing a configuration of a small loop antenna element 105B of a second modified preferred embodiment of the first preferred embodiment;

FIG. 4(*b*) is a block diagram showing a configuration of a feeder circuit 103B that is a second modified preferred embodiment of the feeder circuit 103 of FIG. 3;

FIG. 4(*c*) is a block diagram showing a configuration of a feeder circuit 103C that is a third modified preferred embodiment of the feeder circuit 103 of FIG. 3;

FIG. 5(*b*) is a graph showing an antenna gain of the small loop antenna element 105 in a direction opposite to a direction toward the conductor plate 106 with respect to the distance D;

FIG. 6(*b*) is a graph showing an antenna gain of the linear antenna element 160 in the direction opposite to the direction toward the conductor plate 106 with respect to the distance D;

FIG. 8(*b*) is a graph showing a composite antenna gain in the direction opposite to the direction from the antenna apparatus toward the conductor plate 106 with respect to the distance D when the maximum value of the antenna gain of the vertically polarized wave component of the small loop antenna element 105 of FIG. 1 is smaller than the maximum value of the antenna gain of the horizontally polarized wave component;

FIG. 8(*c*) is a graph showing a composite antenna gain in the direction opposite to the direction from the antenna apparatus toward the conductor plate 106 with respect to the distance D when the maximum value of the antenna gain of the vertically polarized wave component of the small loop antenna element 105 of FIG. 1 is substantially equal to the maximum value of the antenna gain of the horizontally polarized wave component;

FIG. 12(*b*) is a graph showing a composite antenna gain in the direction opposite to the direction from the antenna apparatus toward the conductor plate 106 with respect to the distance D when the maximum value of the antenna gain of the vertically polarized wave component is substantially equal to the maximum value of the antenna gain of the horizontally polarized wave component when a wireless signal is fed to the small loop antenna element 205 of FIG. 10;

FIG. 16(*b*) is a block diagram showing a configuration of a feeder circuit 103F that is a second modified preferred embodiment of the feeder circuit 103D of FIG. 15;

FIG. 16(*c*) is a block diagram showing a configuration of a feeder circuit 103G that is a third modified preferred embodiment of the feeder circuit 103D of FIG. 15;

FIG. 22(*b*) is a block diagram showing a configuration of a feeder circuit 103J that is a second modified preferred embodiment of the feeder circuit 103H of FIG. 21;

FIG. 22(*c*) is a block diagram showing a configuration of a feeder circuit 103K that is a third modified preferred embodiment of the feeder circuit 103H of FIG. 21;

FIG. 25(*b*) is a block diagram showing a configuration of a feeder circuit 103N that is a second modified preferred embodiment of the feeder circuit 103L of FIG. 24;

FIG. 25(*c*) is a block diagram showing a configuration of a feeder circuit 103O that is a third modified preferred embodiment of the feeder circuit 103L of FIG. 24;

FIG. 30(*b*) is a graph showing a frequency characteristic of a phase difference Pd between the wireless signal that flows through the balanced terminal T2 and the wireless signal that flows through the balanced terminal T3 in the balanced-to-unbalanced transformer circuit 103P of FIG. 29;

FIG. 32(*a*) to FIG. 32(*j*) are views showing radiation patterns of the horizontally polarized wave component on the X-Y plane when the amplitude difference Ad between the two wireless signals fed to the small loop antenna element 105 of FIG. 28 is changed from −10 dB to −1 dB;

FIG. 33(*a*) to FIG. 33(*k*) are views showing radiation patterns of the horizontally polarized wave component on the X-Y plane when the amplitude difference Ad between the two wireless signals fed to the small loop antenna element 105 of FIG. 28 is changed from 0 dB to 10 dB;

FIG. 34(*a*) to FIG. 34(*j*) are views showing radiation patterns of the vertically polarized wave component on the X-Y plane when the amplitude difference Ad between the two wireless signals fed to the small loop antenna element 105 of FIG. 28 is changed from −10 dB to −1 dB;

FIG. 35(*a*) to FIG. 35(*k*) are views showing radiation patterns of the vertically polarized wave component on the X-Y plane when the amplitude difference Ad between the two wireless signals fed to the small loop antenna element 105 of FIG. 28 is changed from 0 dB to 10 dB;

FIG. 37(*b*) is a circuit diagram showing a configuration of a polarization switchover circuit 208Aa that is a modified preferred embodiment of the polarization switchover circuit 208A;

FIG. 39(*b*) is a graph showing a composite antenna gain in the direction opposite to the direction from the antenna apparatus toward the conductor plate 106 with respect to the distance D when the maximum value of the antenna gain of the vertically polarized wave component is substantially equal to the maximum value of the antenna gain of the horizontally polarized wave component when a wireless signal is fed to the small loop antenna element 205 of FIG. 36;

FIG. 43(*b*) is a graph showing an average antenna gain of the vertically polarized wave component on the X-Y plane of the small loop antenna element 105A with respect to the length of the connecting conductors 105*da*, 105*db* of FIG. 40;

FIG. 44(*b*) is a graph showing an average antenna gain of the vertically polarized wave component on the X-Y plane of the small loop antenna element 105A with respect to the distance between the connecting conductors 105*da* and 105*db* of FIG. 40;

FIG. 55(*b*) is a graph showing a composite antenna gain in the direction opposite to the direction from the antenna apparatus 100 for the authentication key toward the conductor plate 106 with respect to the distance D between the antenna apparatus 100 for the authentication key and the conductor plate 106 when the maximum value of the antenna gain of the vertically polarized wave component of the small loop antenna element 105 is larger than the maximum value of the antenna gain of the horizontally polarized wave component in the antenna system of FIG. 54;

FIG. 62(*b*) is a graph showing a composite antenna gain in the direction opposite to the direction from the antenna apparatus toward the conductor plate 106 with respect to the distance D between the antenna apparatus and the conductor plate 106 when the maximum value of the antenna gain of the vertically polarized wave component of the small loop antenna element 205C is substantially equal to the maximum value of the antenna gain of the horizontally polarized wave component in a case where wireless signals are fed to the clockwise small loop antenna 205Ca and the counterclockwise small loop antenna 205Cb in the antenna apparatus of FIG. 61;

FIG. 64(*b*) is a graph showing an average antenna gain with respect to the length of a loop return portion when the polarized wave is changed in the small loop antenna element of the first implemental example;

FIG. 64(*c*) is a graph showing an average antenna gain with respect to the length of the loop return portion when the polarized wave is changed in the small loop antenna element of the first implemental example;

FIG. 65(*b*) is a graph showing an average antenna gain with respect to the loop area and the loop interval when the polarized wave is changed in the small loop antenna element of the first implemental example;

FIG. 66(*b*) is a graph showing an average antenna gain with respect to the ratio between the loop area and the length of the loop return portion when the polarized wave is changed in the small loop antenna element of the first implemental example;

FIG. 67(*b*) is a graph showing an average antenna gain on the X-Y plane concerning the vertically polarized wave with respect to the number of turns of the small loop antenna element 105 (small loop antenna element of a helical coil shape) according to the second implemental example of the present preferred embodiment;

FIG. 71(*b*) is a Smith chart showing a first impedance matching method of FIG. 71(*a*);

FIG. 72(*b*) is a Smith chart showing a second impedance matching method of FIG. 72(*a*);

FIG. 73(*b*) is a Smith chart showing a third impedance matching method of FIG. 73(*a*);

FIG. 74(*b*) is a Smith chart showing a fourth impedance matching method of FIG. 74(*a*);

FIG. 76(*b*) is a radio wave propagation characteristic chart showing a received power with respect to the distance D between both the apparatuses 100 and 300 when the antenna heights of both the apparatuses 100 and 300 are set substantially identical in the antenna system provided with the authentication key device 100 and the antenna apparatus 300 for the objective equipment having a half-wavelength dipole antenna of the fifth implemental example of the seventeenth preferred embodiment.

BEST MODE FOR CARRYING OUT THE INVENTION

Figure 1:
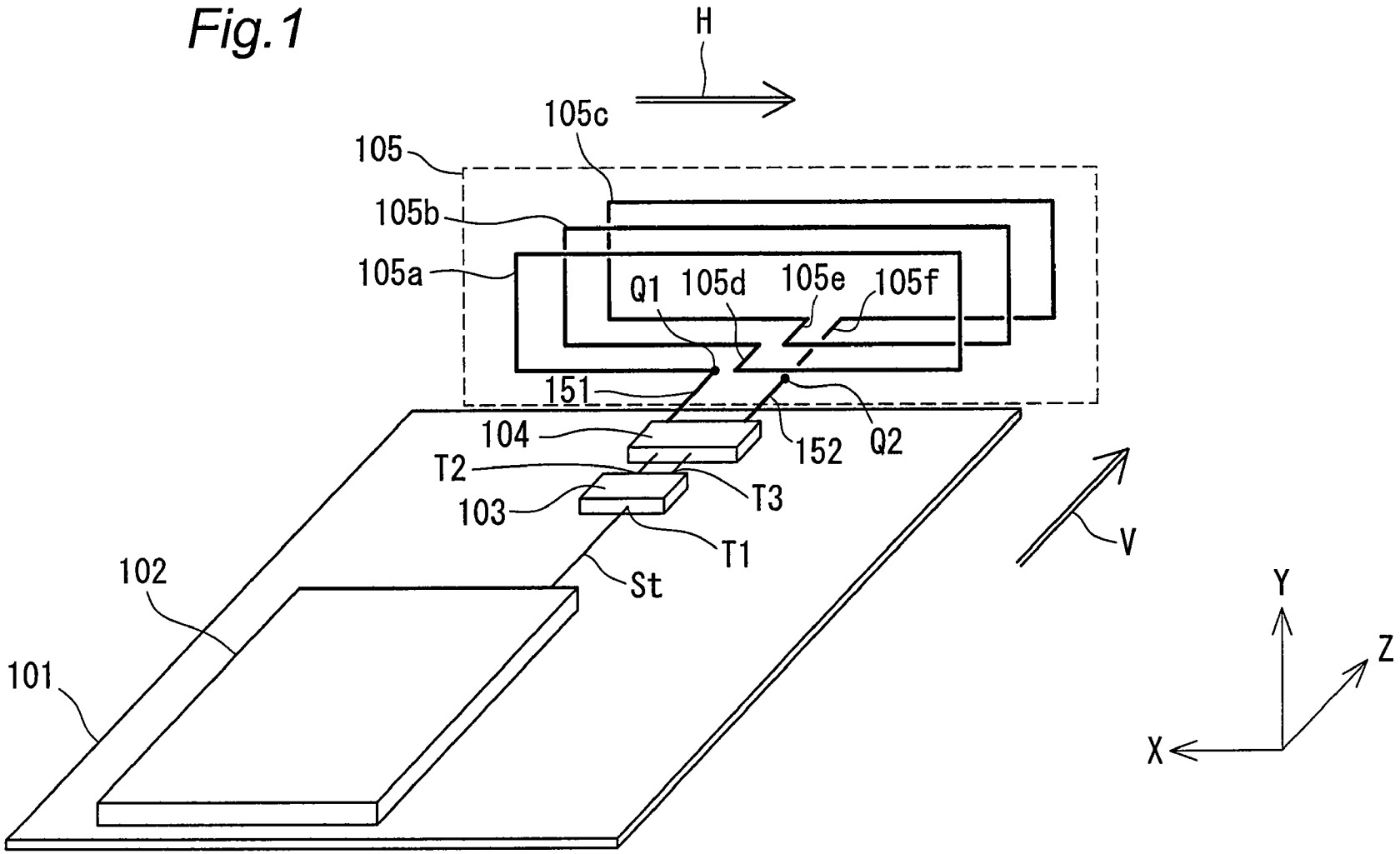
FIG. 1 is a perspective view showing a configuration of an antenna apparatus having a small loop antenna element 105 according to a first preferred embodiment of the invention.

Preferred embodiments of the invention will be described below with reference to the drawings. It is noted that like components are denoted by like reference numerals.

First Preferred Embodiment

FIG. 1 is a perspective view showing a configuration of an antenna apparatus having a small (or minute) loop antenna element 105 according to the first preferred embodiment of the invention. In FIG. 1 and subsequent figures, directions are expressed by a three-dimensional XYZ coordinate system. In this case, the longitudinal direction of a grounding conductor plate 101 is set to the Z-axis direction, its widthwise direction is parallel to the X-axis direction, and a direction perpendicular to the plane of the grounding conductor plate 101 is set to the Y-axis direction. Moreover, in FIG. 1 and the subsequent figures, the direction or the antenna gain of the horizontally polarized wave component is indicated by H, and the direction or the antenna gain of the vertically polarized wave component is indicated by V. Further, St represents an unbalanced transceiving signal containing a transmitted wireless signal and a received wireless signal.

Referring to FIG. 1, a wireless transceiver circuit 102 is provided on a grounding conductor plate 101. By generating an unbalanced transmitted wireless signal and thereafter feeding the same to the small loop antenna element 105 via a feeder circuit 103 and an impedance matching circuit 104, the transmitted wireless signal is transmitted. On the other hand, the received wireless signal received by the small loop antenna element 105 is inputted as an unbalanced received wireless signal via the impedance matching circuit 104 and the feeder circuit 103, and thereafter, predetermined receiving processings such as frequency conversion processing and demodulation processing are performed. It is noted that the wireless transceiver circuit 102 may have at least one of a transmitter circuit and a receiver circuit. Moreover, the grounding conductor plate 101 may be a grounding conductor formed on the back surface of a dielectric substrate or a semiconductor substrate.

The feeder circuit 103 is provided on the grounding conductor plate 101, and an unbalanced wireless signal inputted from the wireless transceiver circuit 102 is converted into two balanced wireless signals that have a phase difference and outputted to the impedance matching circuit 104, while the reverse signal processing is performed. Moreover, the impedance matching circuit 104 is provided on the grounding conductor plate 101 and inserted between the small loop antenna element 105 and the feeder circuit 103. In order to feed a wireless signal to the small loop antenna element 105 with high power efficiency, impedance matching between the small loop antenna element 105 and the feeder circuit 103 is performed.

The small loop antenna element 105 is provided so that the formed loop plane becomes substantially perpendicular to the plane of the grounding conductor plate 101 (i.e., parallel to the X-axis direction) and the loop axis becomes substantially parallel to the Z-axis. Both its ends are used as feeding points Q1 and Q2, and the feeding points Q1 and Q2 are connected to the impedance matching circuit 104 via feed conductors 151 and 152, respectively. In this case, one pair of mutually parallel feed conductors 151 and 152 constitutes a balanced feed cable. Moreover, in order to prevent the radiation of the wireless signal from the small loop antenna element 105 from being shielded by the grounding conductor plate 101, the small loop antenna element 105 is provided projecting from the grounding conductor plate 101. In this case, the small loop antenna element 105 is configured to include the following:

(a) loop antenna portions 105*a*, 105*b* and 105*c*, each having a rectangular shape and one turn;

(b) a connecting conductor 105*d*, which is provided substantially parallel to the Z-axis and connects the loop antenna portion 105*a* with the loop antenna portion 105*b;*

(c) a connecting conductor 105*e*, which is provided substantially parallel to the Z-axis and connects the loop antenna portion 105*b* with the loop antenna portion 105*c*; and (d) a connecting conductor 105*f*, which is provided substantially parallel to the Z-axis and connects the loop antenna portion 105*c* with the feeding point Q2.

The small loop antenna element 105 has, for example, three turns and, for example, a substantially rectangular shape, and its total length is not smaller than 0.01λ, not larger than 0.5λ, preferably not larger than 0.2λ or more preferably not larger than 0.1λ with respect to the wavelength λ of the frequency of the wireless signal used in the wireless transceiver circuit 102, by which a so-called small loop antenna element is configured to include the above arrangement. That is, if the loop antenna element is reduced in size and its total length is made not larger than 0.1 wavelengths, the distribution of a current that flows through the loop conductor comes to have an almost constant value. The loop antenna element in this state is substantially called the small loop antenna element. The small loop antenna element, which is robuster than the small dipole antenna to noise fields and whose effective height can simply be calculated, is therefore used as an antenna for magnetic field measurement (See, for example, Non-Patent Document 1).

Moreover, the outside diameter dimension (the length of one side of a rectangle or the diameter of a circle) is not smaller than 0.01λ, not larger than 0.2λ, preferably not larger than 0.1λ or more preferably not larger than 0.03λ. Further, the small loop antenna element 105, which has a rectangular shape, may have another shape such as a circular shape, an elliptic shape or a polygonal shape. Moreover, the number of turns is not limited to three but allowed to be an arbitrary number of turns, and the loop may have a helical coil shape or a vortical coil shape. The feed conductors 151 and 152 located between the impedance matching circuit 104 and the feeding points Q1, and Q2 should preferably be shorter or allowed to be removed. Moreover, the impedance matching circuit 104 needs not be provided if there is no need of impedance matching.

Figure 2A:
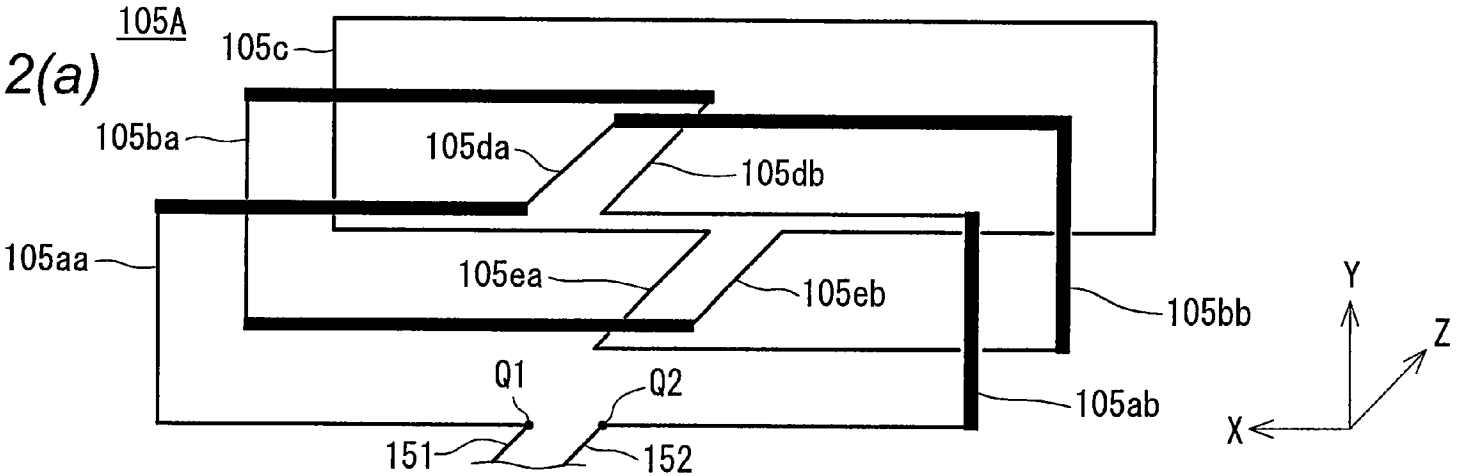
FIG. 2(*a*) is a perspective view showing a configuration of a small loop antenna element 105A of a first modified preferred embodiment of the first preferred embodiment.
Figure 2B:
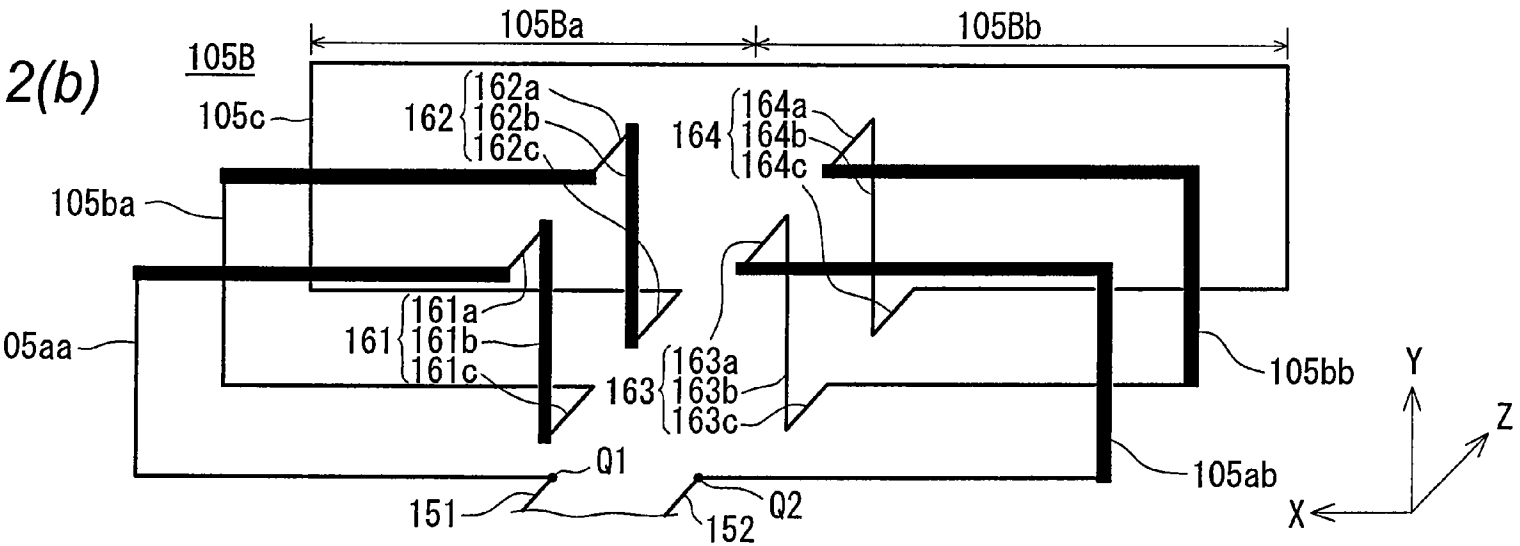

The small loop antenna element 105 of FIG. 1 may be configured to include the small loop antenna elements 105A and 105B of FIG. 2(*a*) or FIG. 2(*b*). FIG. 2(*a*) is a perspective view showing a configuration of a small loop antenna element 105A according to the first modified preferred embodiment of the first preferred embodiment, and FIG. 2(*b*) is a perspective view showing a configuration of a small loop antenna element 105B according to the second modified preferred embodiment of the first preferred embodiment.

The small loop antenna element 105A of FIG. 2(*a*) is configured to include the following:

(a) half-loop antenna portions 105*aa* and 105*ab*, each having half turn and each is configured to include three sides of a substantially rectangular shape and formed on a substantially identical plane substantially parallel to the X axis;

(b) half-loop antenna portions 105*aa* and 105*ab*, each having half turn and each is configured to include three sides of a substantially rectangular shape and formed on a substantially identical plane substantially parallel to the X axis;

(c) a loop antenna portion 105*c*, which has one turn and a rectangular shape that has a loop plane substantially parallel to the X-axis;

(d) a connecting conductor 105*da*, which is provided substantially parallel to the Z-axis and connects the half-loop antenna portion 105*aa* with the half-loop antenna portion 105*bb* substantially at right angles;

(e) a connecting conductor 105*db*, which is provided substantially parallel to the Z-axis and connects the half-loop antenna portion 105*ab* with the half-loop antenna portion 105*ba* substantially at right angles;

(f) a connecting conductor 105*ea*, which is provided substantially parallel to the Z axis and connects the half-loop antenna portion 105*bb* with the loop antenna portion 105*c* substantially at right angles; and (g) a connecting conductor 105*eb*, which is provided substantially parallel to the Z-axis and connects the half-loop antenna portion 105*ba* with the loop antenna portion 105*c* substantially at right angles. That is, the small loop antenna element 105A is constituted by connecting mutually adjacent loops so that the directions of currents flowing through the mutually adjacent loops become identical directions with respect to the central axis of the loops in positions at a substantially equal distance from the two feeding points Q1 and Q2.

The small loop antenna element 105B of FIG. 2(*b*) is configured to include the following:

(a) half-loop antenna portions 105*aa* and 105*ab*, each having half turn and each is configured to include three sides of a substantially rectangular shape and formed on a substantially identical plane substantially parallel to the X axis;

(b) half-loop antenna portions 105*ba* and 105*bb*, each having half turn and each is configured to include three sides of a substantially rectangular shape and formed on a substantially identical plane substantially parallel to the X axis;

(c) a loop antenna portion 105*c*, which has one turn and a rectangular shape that has a loop plane substantially parallel to the X-axis;

(d) a connecting conductor 161, which has a connecting conductor portion 161*a* provided substantially parallel to the Z axis, a connecting conductor portion 161*b* provided substantially parallel to the Y axis, and a connecting conductor portion 161*c* provided substantially parallel to the Z axis, the conductor portions being connected together successively bent at right angles, and connects the half-loop antenna portion 105*aa* with the half-loop antenna portion 105*ba;*

(e) a connecting conductor 162, which has a connecting conductor portion 162*a* provided substantially parallel to the Z axis, a connecting conductor portion 162*b* provided substantially parallel to the Y axis, and a connecting conductor portion 162*c* provided substantially parallel to the Z axis, the conductor portions being connected together successively bent at right angles, and connects the half-loop antenna portion 105*ba* with the loop antenna portion 105*c;*

(f) a connecting conductor 163, which has a connecting conductor portion 163*a* provided substantially parallel to the Z axis, a connecting conductor portion 163*b* provided substantially parallel to the Y axis, and a connecting conductor portion 163*c* provided substantially parallel to the Z axis, the conductor portions being connected together successively bent at right angles, and connects the half-loop antenna portion 105*ab* with the half-loop antenna portion 105*bb;*

(g) a connecting conductor 164, which has a connecting conductor portion 164*a* provided substantially parallel to the Z axis, a connecting conductor portion 164*b* provided substantially parallel to the Y axis, and a connecting conductor portion 164*c* provided substantially parallel to the Z axis, the conductor portions being connected together successively bent at right angles, and connects the half-loop antenna portion 105*bb* with the loop antenna portion 105*c*. That is, the small loop antenna element 105B is constituted by connecting together ends of a clockwise small loop antenna 105Ba and a counterclockwise small loop antenna 105Bb, in which the central axes of the loops are parallel to each other and the winding directions of the loops are mutually opposite directions.

It is noted that the total length of the small loop antenna elements 105A and 105B are small like the length of the small loop antenna element 105.

Figure 3:
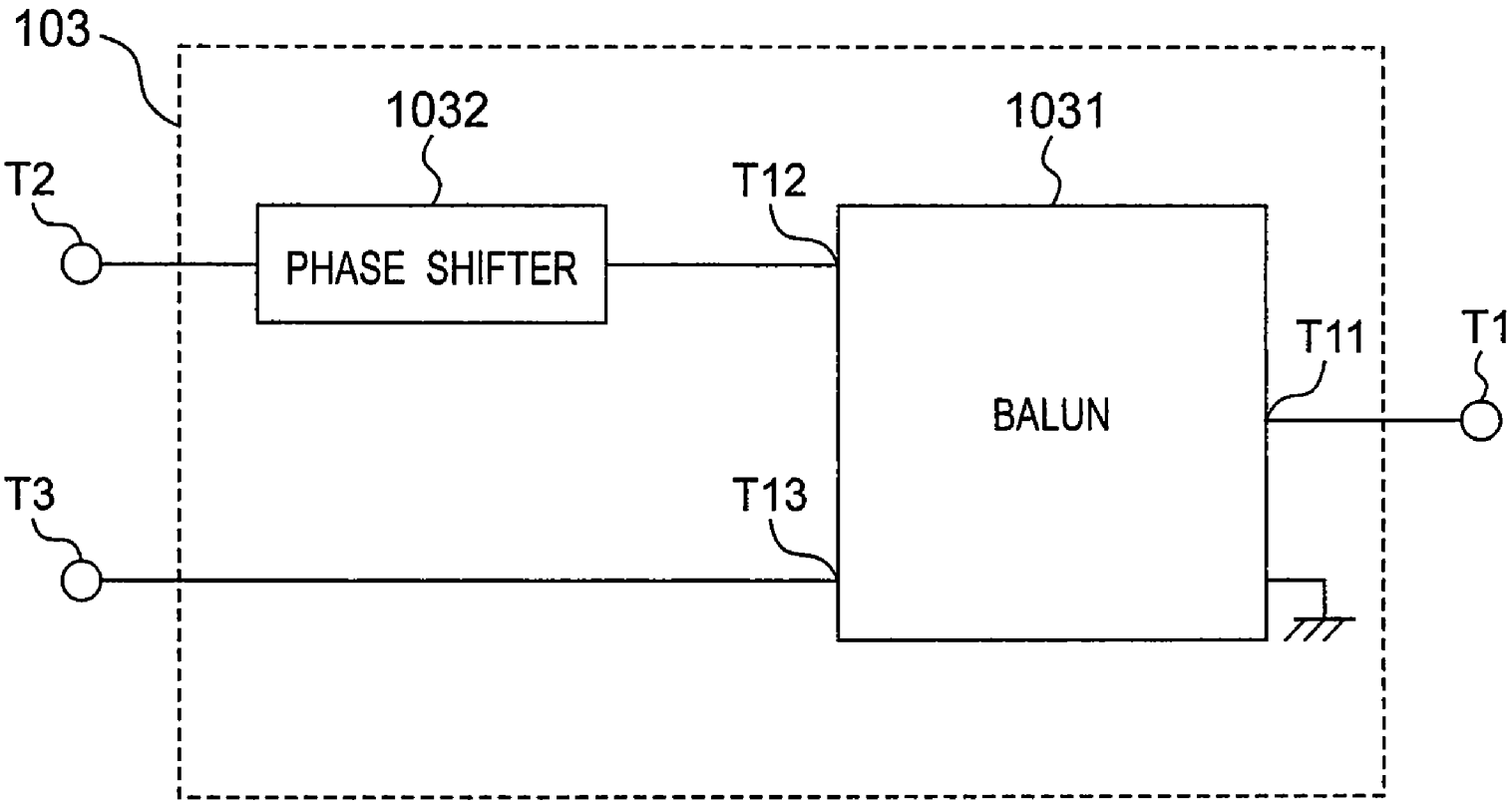
FIG. 3 is a block diagram showing a configuration of the feeder circuit 103 of FIG. 1.

FIG. 3 is a block diagram showing a configuration of the feeder circuit 103 of FIG. 1. Referring to FIG. 3, the feeder circuit 103 is configured to include a balun 1031 and a phase shifter 1032. An unbalanced wireless signal inputted to a terminal T1 is inputted to the balun 1031 via an unbalanced terminal T11, and the balun 1031 converts the inputted unbalanced wireless signal into a balanced wireless signal and outputs the resulting signal via balanced terminals T12 and T13. The wireless signal outputted from the balanced terminal T12 is outputted to the terminal T2 via the phase shifter 1032 that shifts the phase by a predetermined phase shift amount, and the wireless signal outputted from the balanced terminal T13 is outputted as it is to the terminal T3. Therefore, the feeder circuit 103 converts the inputted unbalanced wireless signal into a balanced wireless signal by the balun 1031, i.e., into two wireless signals of which the phase difference is substantially 180 degrees, shifts the obtained phase difference between the two wireless signals from 180 degrees by the phase shifter 1032 and outputs two wireless signals of which the phases are mutually different via the terminals T2 and T3.

Figure 4A:
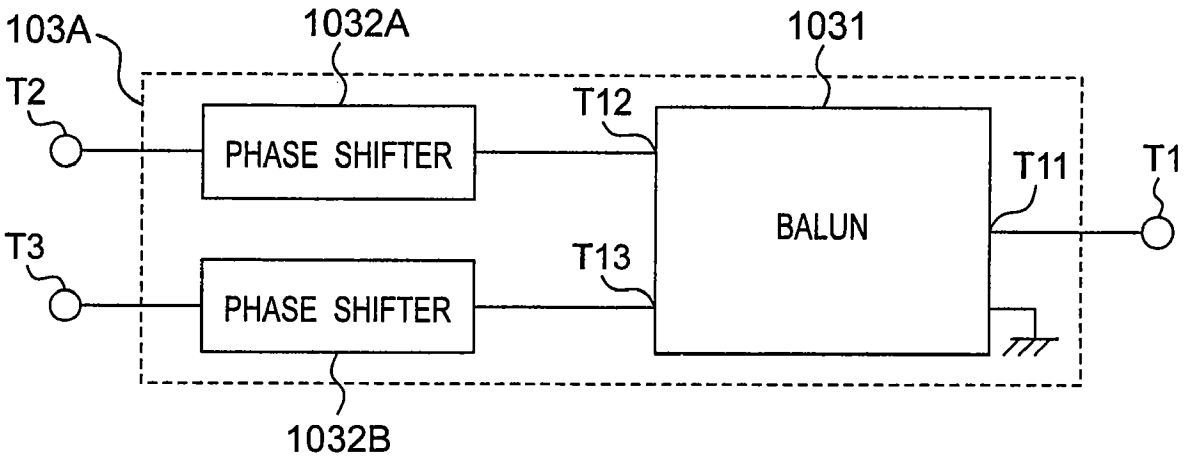
FIG. 4(*a*) is a block diagram showing a configuration of a feeder circuit 103A that is a first modified preferred embodiment of the feeder circuit 103 of FIG. 3.
Figure 4C:
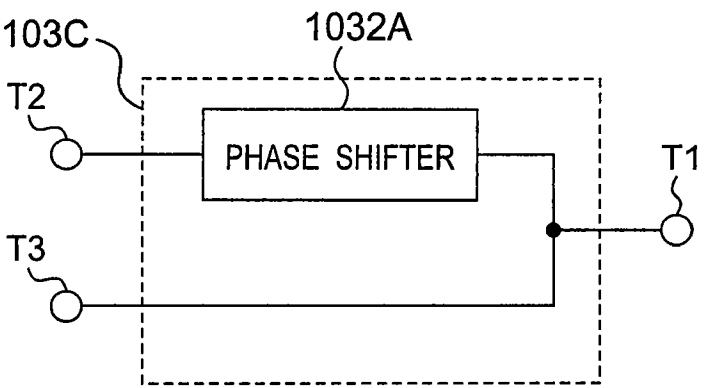
Figure 4B:
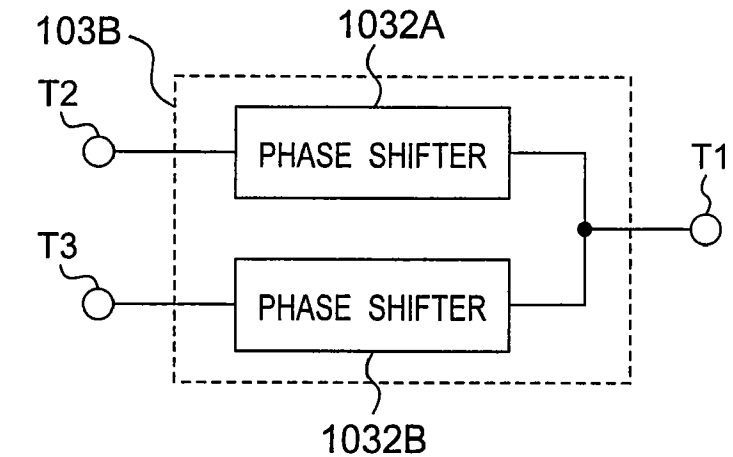

The feeder circuit 103 is not limited to the configuration of FIG. 3 but allowed to be the feeder circuits 103A, 103B and 103C of FIG. 4(*a*), FIG. 4(*b*) or FIG. 4(*c*). FIG. 4(*a*) is a block diagram showing a configuration of the feeder circuit 103A that is the first modified preferred embodiment of the feeder circuit 103 of FIG. 3. FIG. 4(*b*) is a block diagram showing a configuration of the feeder circuit 103B that is the second modified preferred embodiment of the feeder circuit 103 of FIG. 3. FIG. 4(*c*) is a block diagram showing a configuration of the feeder circuit 103C that is the third modified preferred embodiment of the feeder circuit 103 of FIG. 3.

The feeder circuit 103A of FIG. 4(*a*) is configured to include a balun 1031 and two phase shifters 1032A and 1032B that have mutually different amounts of phase shift at the two balanced terminals T12 and T13 of the balun 1031. Moreover, the feeder circuit 103B of FIG. 4(*b*) is configured to include two phase shifters 1032A and 1032B that have mutually different amounts of phase shift and inputs the unbalanced wireless signal inputted via the terminal T1 by distributing them into two. The feeder circuit 103C of FIG. 4(*c*) is configured to include only the phase shifter 1032A inserted between the terminals T1 and T2, and the terminals T1 and T3 are directly connected together.

The operation of the antenna apparatus of FIG. 1 configured as above is described below. Referring to FIG. 1, the transmitted wireless signal outputted from the wireless transceiver circuit 102 is converted into two wireless signals of which the phases are mutually different by the feeder circuit 103 (or 103A, 103B or 103C), thereafter subjected to impedance conversion by the impedance matching circuit 104 and outputted to the loop antenna element 105. On the other hand, the received wireless signal of the radio wave received by the small loop antenna element 105 is subjected to impedance conversion by the impedance matching circuit 104, thereafter converted into an unbalanced wireless signal by the feeder circuit 103 and inputted as a received wireless signal to the wireless transceiver circuit 102.

Figure 5B:
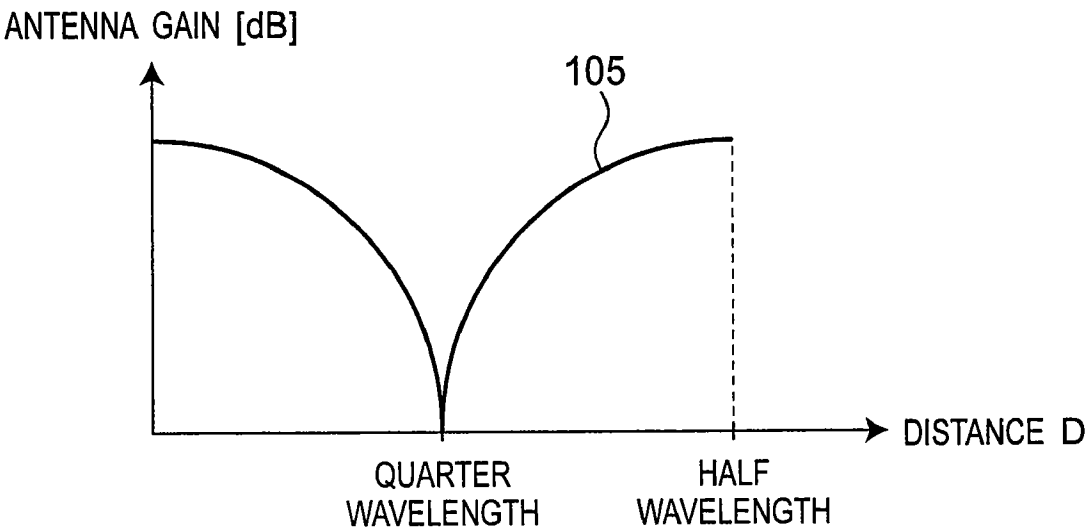
FIG. 5(*a*) is a front view showing a distance D when the small loop antenna element 105 of FIG. 1 is adjacent to a conductor plate 106.
Figure 5A:
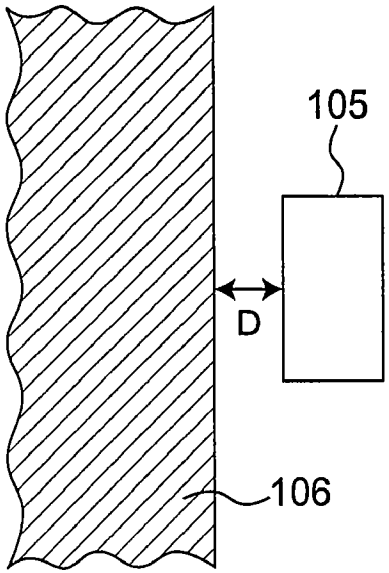

Next, radio wave radiation of the antenna apparatus configured as above is described below. FIG. 5(*a*) is a front view showing a distance D when the small loop antenna element 105 of FIG. 1 is located adjacent to a conductor plate 106, and FIG. 5(*b*) is a graph showing an antenna gain of the small loop antenna element 105 in a direction opposite to a direction toward the conductor plate 106 with respect to the distance D. As apparent from FIG. 5(*b*), the antenna gain is maximized substantially when the small loop antenna element 105 has a loop plane perpendicular to the conductor plane of the conductor plate 106 or when the distance D between the small loop antenna element 105 and the conductor plate 106 is sufficiently shorter than the wavelength. Moreover, the antenna gain is significantly decreased and minimized when the distance D between the small loop antenna element 105 and the conductor plate 106 is an odd number multiple of the quarter wavelength. Further, the gain is maximized when the distance D between the small loop antenna element 105 and the conductor plate 106 is an even number multiple of the quarter wavelength.

Figure 6B:
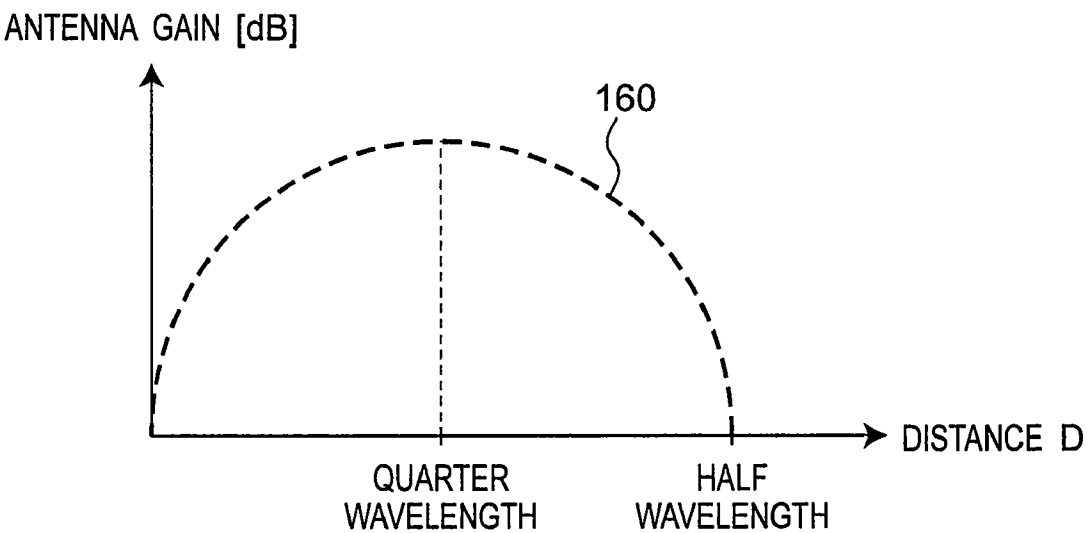
FIG. 6(*a*) is a front view showing a distance D when the linear antenna element 160 of FIG. 1 is adjacent to the conductor plate 106.
Figure 6A:
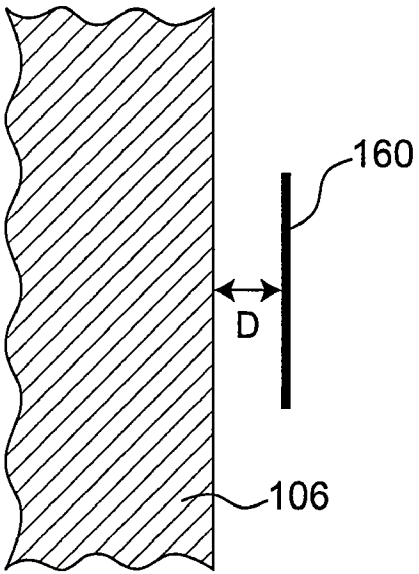

FIG. 6(*a*) is a front view showing a distance D when the linear antenna element 160 of FIG. 1 is adjacent to the conductor plate 106, and FIG. 6(*b*) is a graph showing an antenna gain of the linear antenna element 160 in the direction opposite to the direction toward the conductor plate 106 with respect to the distance D. As apparent from FIGS. 6(*a*) and 6(*b*), the antenna gain is significantly decreased and minimized substantially when the linear antenna element 160 such as a quarter wavelength whip antenna is parallel to the conductor plane of the conductor plate 106 or when the distance D between the linear antenna element 160 and the conductor plate 106 is sufficiently shorter than the wavelength. Moreover, the antenna gain is maximized when the distance D between the linear antenna element 160 and the conductor plate 106 is an odd number multiple of the quarter wavelength. Further, the antenna gain is minimized when the distance D between the linear antenna element 160 and the conductor plate 106 is an even number multiple of the quarter wavelength.

Figure 7:
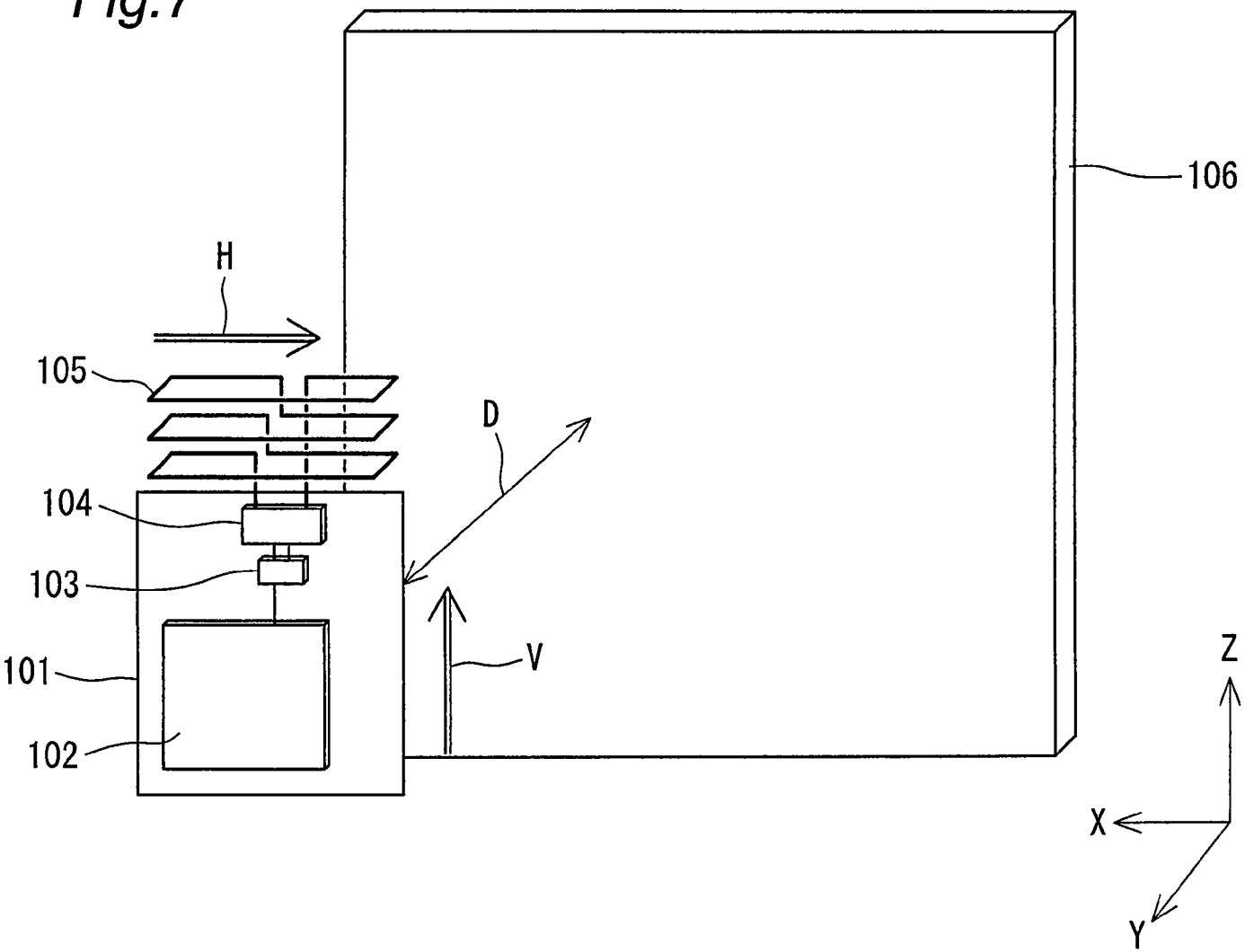
FIG. 7 is a perspective view when the antenna apparatus of FIG. 1 is adjacent to the conductor plate 106, showing a positional relation and the distance D between both of them.

FIG. 7 is a perspective view when the antenna apparatus of FIG. 1 is adjacent to the conductor plate 106, showing a positional relation and the distance D between both of them. The radio wave radiation from the antenna apparatus is configured to include:

(a) radiation of horizontally polarized wave components from loop antenna portions 105*a*, 105*b* and 105*c* of the small loop antenna element 105 provided parallel to the X axis; and (b) radiation of vertically polarized wave components from connecting conductors 105*d*, 105*e* and 105*f* of the small loop antenna element 105 provided parallel to the Z-axis.

In the system of FIG. 7, as shown in, for example, FIG. 32 and FIG. 33 of Patent Document 3, when the antenna apparatus is located adjacent to the conductor plate 106, the antenna gain of the horizontally polarized wave component decreases while the antenna gain of the vertically polarized wave component increases as the distance D increases. Moreover, the antenna gain of the vertically polarized wave component decreases while the antenna gain of the horizontally polarized wave component increases as the distance D decreases.

Figures 8A, 8B, 8C:
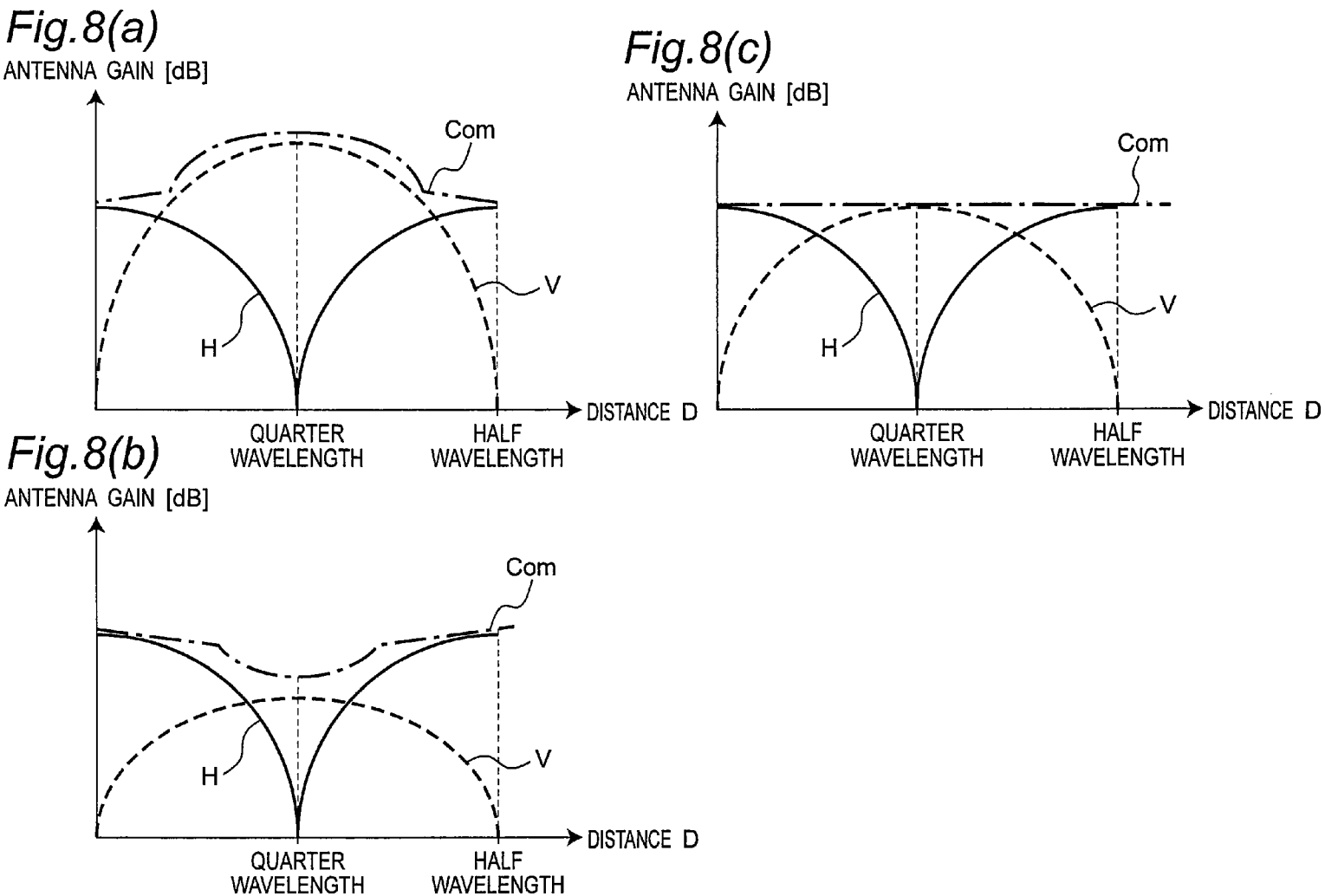
FIG. 8(*a*) is a graph showing a composite antenna gain in the direction opposite to the direction from the antenna apparatus toward the conductor plate 106 with respect to the distance D when the maximum value of the antenna gain of the vertically polarized wave component of the small loop antenna element 105 of FIG. 1 is larger than the maximum value of the antenna gain of the horizontally polarized wave component.

FIG. 8(*a*) is a graph showing a composite antenna gain in the direction opposite to the direction from the antenna apparatus toward the conductor plate 106 with respect to the distance D when the maximum value of the antenna gain of the vertically polarized wave component of the small loop antenna element 105 of FIG. 1 is larger than the maximum value of the antenna gain of the horizontally polarized wave component. FIG. 8(*b*) is a graph showing a composite antenna gain in the direction opposite to the direction from the antenna apparatus toward the conductor plate 106 with respect to the distance D when the maximum value of the antenna gain of the vertically polarized wave component of the small loop antenna element 105 of FIG. 1 is smaller than the maximum value of the antenna gain of the horizontally polarized wave component. FIG. 8(*c*) is a graph showing a composite antenna gain in the direction opposite to the direction from the antenna apparatus toward the conductor plate 106 with respect to the distance D when the maximum value of the antenna gain of the vertically polarized wave component of the small loop antenna element 105 of FIG. 1 is substantially equal to the maximum value of the antenna gain of the horizontally polarized wave component. In FIG. 8(*a*), FIG. 8(*b*), FIG. 8(*c*) and subsequent figures, Com represents the composite antenna gain of the antenna gain of the horizontally polarized wave component and the antenna gain of the vertically polarized wave component.

The composite component of the radio wave radiated from the antenna apparatus is obtained as the vector composite component of the vertically polarized wave component and the horizontally polarized wave component. As shown in FIG. 8(*a*), the antenna gain of the composite component is maximized when the maximum value of the antenna gain of the vertically polarized wave component is higher than the maximum value of the antenna gain of the horizontally polarized wave component and when the distance D between the antenna apparatus and the conductor plate 106 is an odd number multiple of the quarter wavelength. Moreover, as shown in FIG. 8(*b*), the antenna gain of the composite component is minimized when the maximum value of the antenna gain of the vertically polarized wave component is lower than the maximum value of the antenna gain of the horizontally polarized wave component and when the distance between the antenna apparatus and the conductor plate 106 is an odd number multiple of the quarter wavelength. Further, as shown in FIG. 8(*c*), the antenna gain of the composite component becomes substantially constant regardless of the distance D between the antenna apparatus and the conductor plate 106 when the maximum value of the antenna gain of the vertically polarized wave component is substantially identical to the maximum value of the antenna gain of the horizontally polarized wave component. Therefore, by setting such that the antenna gains of the vertically polarized wave component and the horizontally polarized wave component become substantially identical, the antenna gain of the composite component becomes substantially constant regardless of the distance D between the antenna apparatus and the conductor plate 106. In the present preferred embodiment, as described later with reference to FIG. 9, by setting a phase difference between two wireless signals fed to the feeding points Q1 and Q2 of the small loop antenna element 105 to a predetermined value, the antenna gains of the vertically polarized wave component and the horizontally polarized wave component radiated from the antenna apparatus can be set substantially identical.

Figure 9:
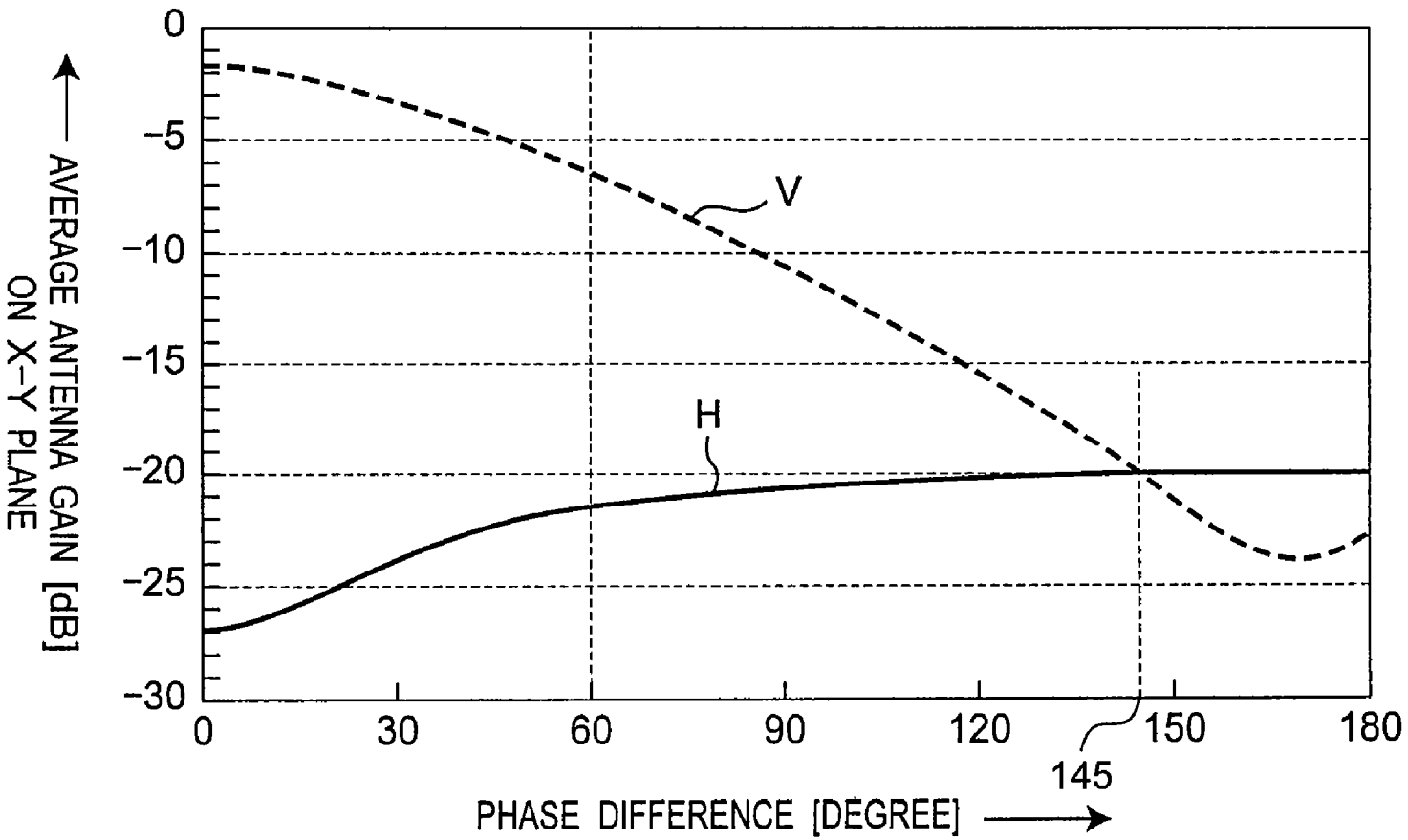
FIG. 9 is a graph showing an average antenna gain on the X-Y plane with respect to a phase difference between two wireless signals fed to the small loop antenna element 105 of FIG. 1.

FIG. 9 is a graph showing an average antenna gain on the X-Y plane with respect to the phase difference between two wireless signals fed to the small loop antenna element 105 of FIG. 1. The antenna gain of FIG. 9 is a calculated value at a frequency of 426 MHz. As apparent from FIG. 9, it can be understood that the antenna gains of the vertically polarized wave component and the horizontally polarized wave component can be set substantially identical by setting the phase difference between the two feed wireless signals to 145 degrees. For example, by setting the phase shift amount of the phase shifter 1032 of FIG. 3 to a predetermined value to set the phase difference between the two wireless signals outputted from feeder circuit 103 so that the antenna gains of the vertically polarized wave component and the horizontally polarized wave component become substantially identical, the antenna gain of the composite component can be made substantially constant regardless of the distance D between the antenna apparatus and the conductor plate 106.

As described above, according to the present preferred embodiment, an antenna apparatus that obtains the substantially constant composite component regardless of the distance D between the antenna apparatus and the conductor plate 106 can be provided by changing the phase shift amount of the phase shifter 1032 so that the antenna gains of the vertically polarized wave component and the horizontally polarized wave component become substantially identical to make the phase difference between the two wireless signals fed to the small loop antenna element 105. Moreover, the radio wave radiated from the small loop antenna element 105 has both the vertically and horizontally polarized wave components as described above and is able to obtain a polarization diversity effect.

Second Preferred Embodiment

Figure 10:
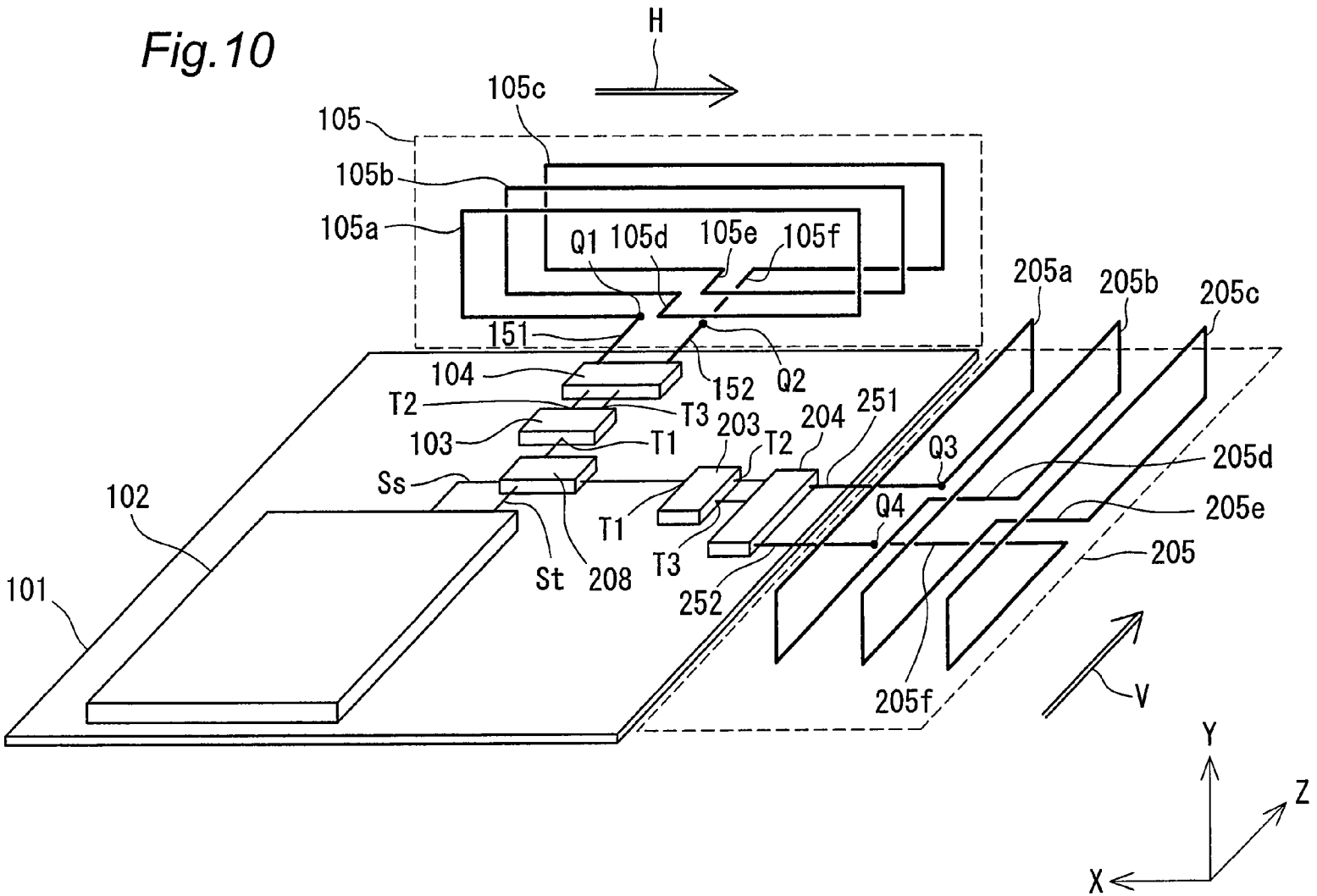
FIG. 10 is a perspective view showing a configuration of an antenna apparatus having small loop antenna elements 105 and 205 according to a second preferred embodiment of the invention.

FIG. 10 is a perspective view showing a configuration of an antenna apparatus having small loop antenna elements 105 and 205 according to the second preferred embodiment of the invention. The antenna apparatus of the second preferred embodiment differs from the antenna apparatus of the first preferred embodiment of FIG. 1 in the following points.

(1) A small loop antenna element 205, which has a configuration similar to that of the small loop antenna element 105 and is provided orthogonal to the small loop antenna element 105, is further provided.

(2) A switch 208, a feeder circuit 203 and an impedance matching circuit 204 are further provided.

(3) The grounding conductor plate 101 preferably has a substantially square shape.

The points of difference are described below in detail.

Referring to FIG. 10, the small loop antenna element 205 is provided so that the formed loop plane becomes substantially perpendicular to the plane of the grounding conductor plate 101 (i.e., parallel to the Z-axis direction) and the loop axis becomes substantially parallel to the X-axis. Both its ends are used as feeding points Q3 and Q4, and the feeding points Q3 and Q4 are connected to the impedance matching circuit 204 via feed conductors 251 and 252, respectively. In this case, one pair of mutually parallel feed conductors 251 and 252 constitutes a balanced feed cable. Moreover, in order to prevent the radiation of the wireless signal from the small loop antenna element 205 from being shield by the grounding conductor plate 101, the small loop antenna element 205 is provided projecting from the grounding conductor plate 101. In this case, the small loop antenna element 205 is configured to include the following:

(a) loop antenna portions 205*a*, 205*b* and 205*c*, each having one turn and a rectangular shape;

(b) a connecting conductor 205*d*, which is provided substantially parallel to the X-axis and connects the loop antenna portion 205*a* with the loop antenna portion 205*b;*

(c) a connecting conductor 205*e*, which is provided substantially parallel to the X axis and connects the loop antenna portion 205*b* with the loop antenna portion 205*c*; and (d) a connecting conductor 205*f*, which is provided substantially parallel to the X-axis and connects the loop antenna portion 205*c* with the feeding point Q4.

It is noted that the small loop antenna element 205 may be the above modified preferred embodiment of the small loop antenna element 105.

Referring to FIG. 10, the feeder circuit 203 has a configuration similar to that of the feeder circuit 103, and the impedance matching circuit 204 has a configuration similar to that of the impedance matching circuit 104. The switch 208 is provided on the grounding conductor plate 101 and connected between the wireless transceiver circuit 102 and the feeder circuits 103 and 203 and connects the wireless transceiver circuits 102 to either one of the feeder circuits 103 and 203 on the basis of a switchover control signal Ss outputted from the wireless transceiver circuit 102.

The operation of the antenna apparatus configured as above is described below. When the feeder circuit 103 is selected by the switch 208, wireless signals are transmitted and received by using the small loop antenna element 105 by the wireless transceiver circuit 102. When the feeder circuit 203 is selected, wireless signals are transmitted and received by using the small loop antenna element 205 by the wireless transceiver circuit 102. Therefore, by switchover between the feed to the small loop antenna element 105 and the small loop antenna element 205 by the switch 208, the polarization of the radio wave can be switched over to allow the antenna diversity to be performed.

Figure 11:
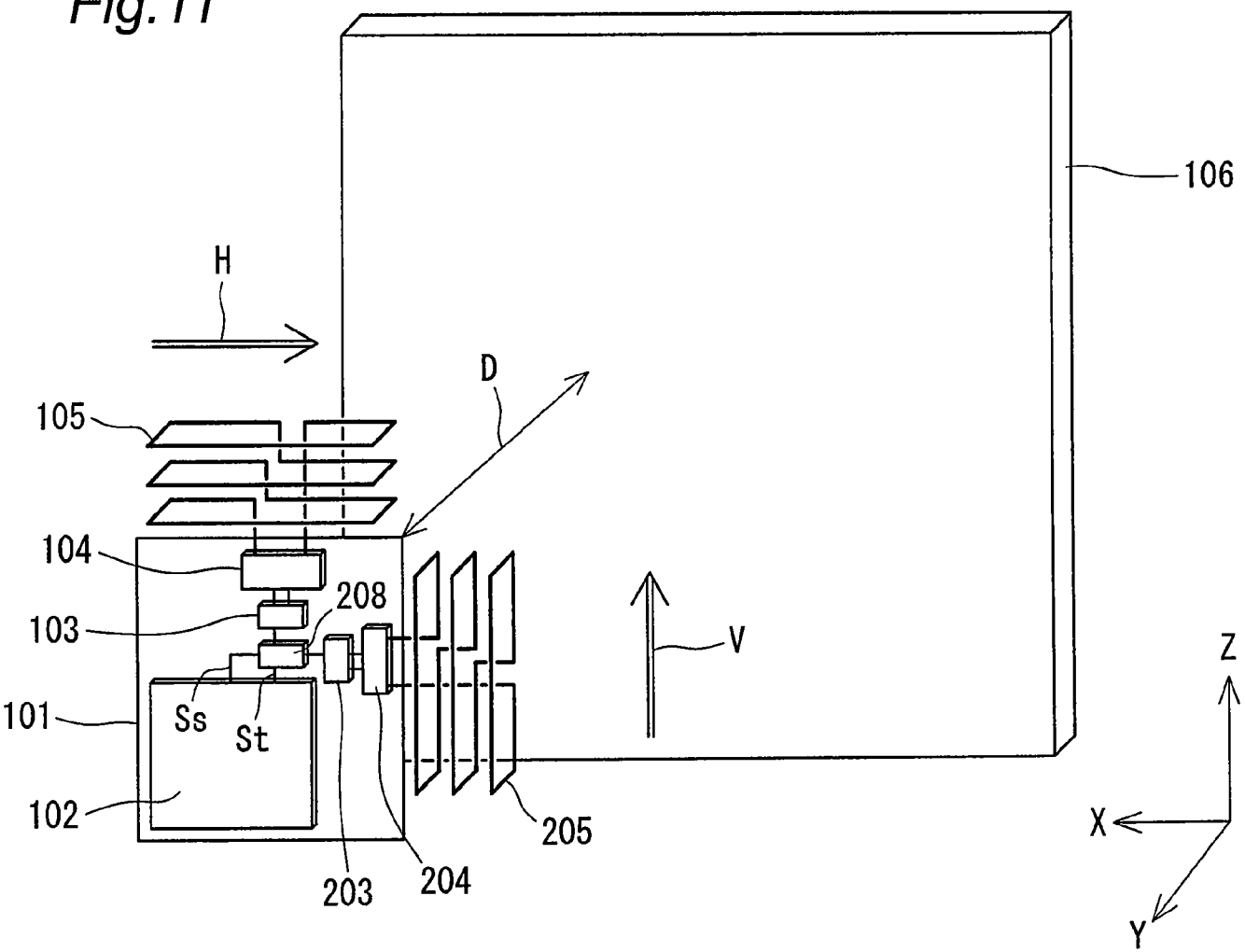
FIG. 11 is a perspective view when the antenna apparatus of FIG. 10 is adjacent to the conductor plate 106, showing a positional relation and the distance D between both of them.

FIG. 11 is a perspective view when the antenna apparatus of FIG. 10 is adjacent to the conductor plate 106, showing a positional relation and the distance D between both of them. The radio wave radiation during feed to the small loop antenna element 105 is similar to that of the first preferred embodiment, and the radio wave radiation during feed to the small loop antenna element 205 is similar to that of the first preferred embodiment except for the polarized wave component.

Figure 12A:
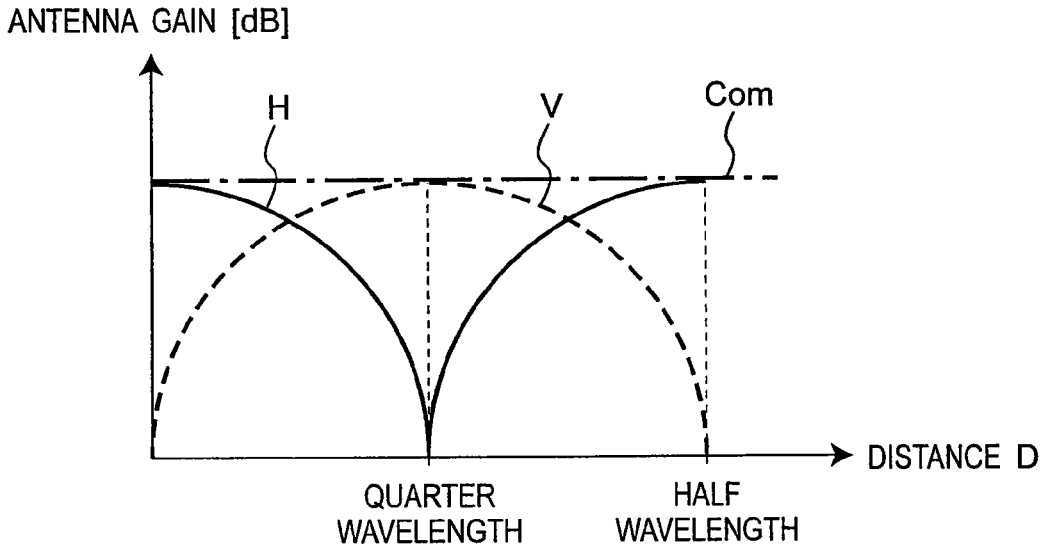
FIG. 12(*a*) is a graph showing a composite antenna gain in the direction opposite to the direction from the antenna apparatus toward the conductor plate 106 with respect to the distance D when the maximum value of the antenna gain of the vertically polarized wave component is substantially equal to the maximum value of the antenna gain of the horizontally polarized wave component when a wireless signal is fed to the small loop antenna element 105 of FIG. 10.
Figure 12B:
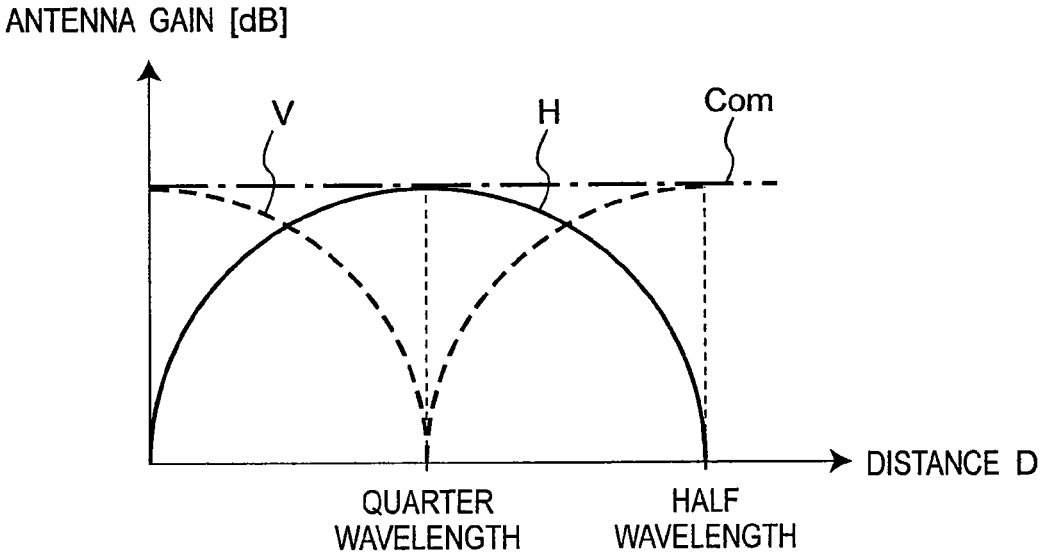

FIG. 12(*a*) is a graph showing a composite antenna gain in the direction opposite to the direction from the antenna apparatus toward the conductor plate 106 with respect to the distance D when the maximum value of the antenna gain of the vertically polarized wave component is substantially equal to the maximum value of the antenna gain of the horizontally polarized wave component when a wireless signal is fed to the small loop antenna element 105 of FIG. 10. FIG. 12(*b*) is a graph showing a composite antenna gain in the direction opposite to the direction from the antenna apparatus toward the conductor plate 106 with respect to the distance D when the maximum value of the antenna gain of the vertically polarized wave component is substantially equal to the maximum value of the antenna gain of the horizontally polarized wave component when a wireless signal is fed to the small loop antenna element 205 of FIG. 10.

As described in the first preferred embodiment, in the case where the phase difference between the two wireless signals fed to the small loop antenna element 105 is changed by the feeder circuit 103 to set the antenna gains of the vertically polarized wave component and the horizontally polarized wave component substantially identical, an antenna gain of a substantially constant composite component is obtained regardless of the distance D between the antenna apparatus and the conductor plate 106 in feeding the small loop antenna element 105 as shown in FIG. 12(*a*). In a manner similar to above, in the case where the phase difference between the two wireless signals fed to the small loop antenna element 205 is changed by the feeder circuit 203 to set the antenna gains of the vertically polarized wave component and the horizontally polarized wave component substantially identical, an antenna gain of a substantially constant composite component is obtained regardless of the distance D between the antenna apparatus and the conductor plate 106 in feeding the small loop antenna element 205 as shown in FIG. 12(*b*). Moreover, as apparent from FIG. 12(*a*) and FIG. 12(*b*), the main polarized wave component (the larger polarized wave component of the two polarized wave components, and so on hereinafter) radiated from the antenna apparatus in feeding the small loop antenna element 105 and the main polarized wave component radiated from the antenna apparatus in feeding the small loop antenna element 205 are orthogonal to each other regardless of the distance D between the antenna apparatus and the conductor plate 106.

As described above, according to the present preferred embodiment, by virtue of the provision of the small loop antenna elements 105 and 205, operational effects similar to those of the first preferred embodiment are therefore produced. In addition, by providing the two small loop antenna elements 105 and 205 so that their loop axes are orthogonal to each other on the X-Y plane, the main polarized wave components radiated from the antenna apparatus in feeding the small loop antenna element 105 and in feeding the small loop antenna element 205 are orthogonal to each other even when one polarized wave component of the vertically and horizontally polarized wave components is largely attenuated in a manner similar to that of such a case that the distance D between the antenna apparatus and the conductor plate 106 is sufficiently shorter with respect to the wavelength or a multiple of the quarter wavelength. Therefore, by switchover between the main polarized wave components by the switch 208, wireless communications can be performed by using the larger main polarized wave component, and the polarization diversity effect can be obtained.

Third Preferred Embodiment

Figure 13:
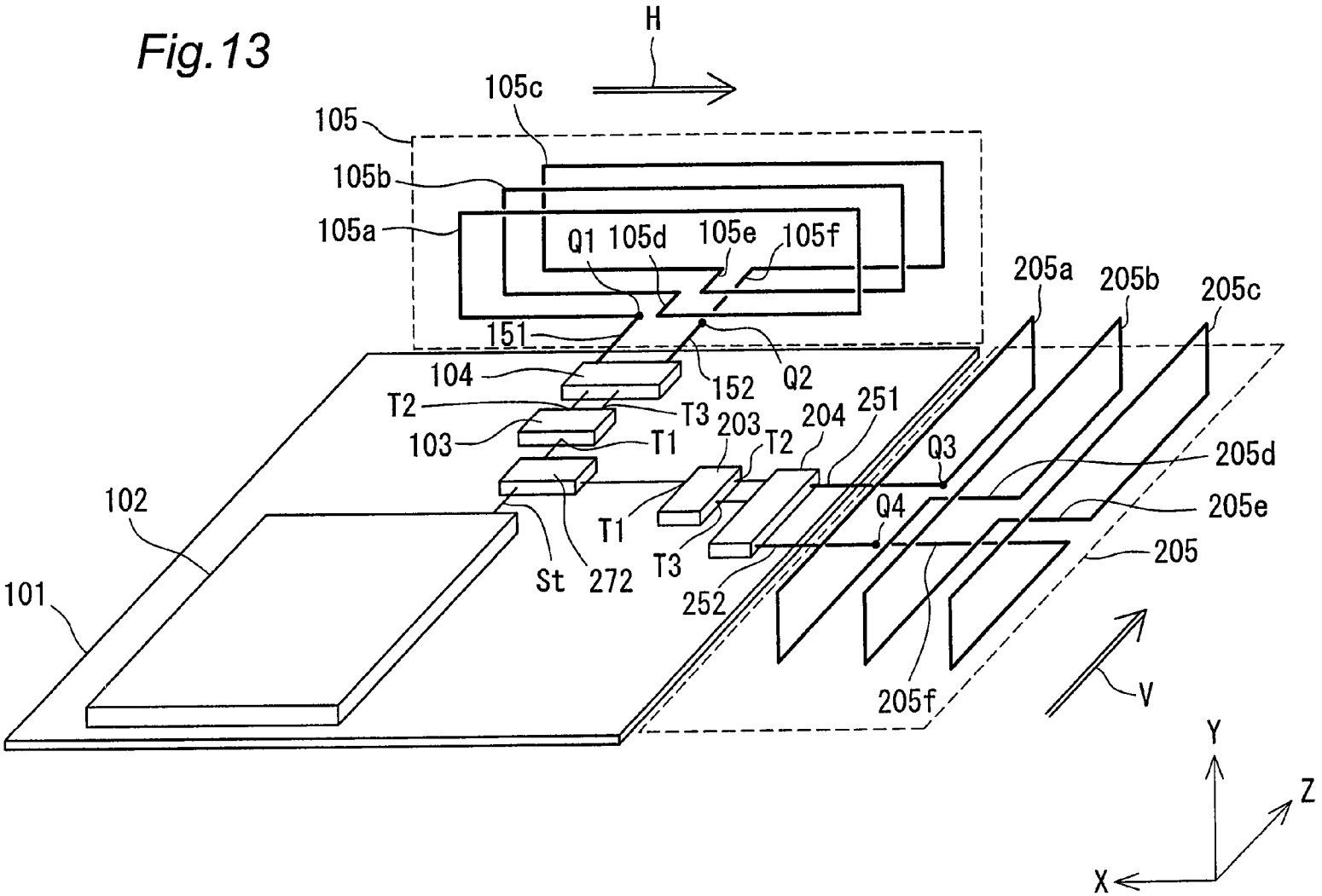
FIG. 13 is a perspective view showing a configuration of an antenna apparatus having small loop antenna elements 105 and 205 according to a third preferred embodiment of the invention.

FIG. 13 is a perspective view showing a configuration of an antenna apparatus having small loop antenna elements 105 and 205 according to the third preferred embodiment of the invention. The antenna apparatus of the third preferred embodiment differs from the antenna apparatus of the second preferred embodiment of FIG. 10 in the following point.

(1) A 90-degree phase difference distributor 272 is provided in place of the switch 208.

The point of difference is described below. The 90-degree phase difference distributor 272 distributes a transmitted wireless signal from the wireless transceiver circuit 102 into two transmitted wireless signals that have a mutual phase difference of 90 degrees, outputs the same to the feeder circuits 103 and 203 and performs processing in the reverse direction for a received wireless signal.

Next, radio wave radiation of the antenna apparatus configured as above is described below. Wireless signals having a phase difference of 90 degrees are fed to the small loop antenna elements 105 and 205 by the 90-degree phase difference distributor 272. Moreover, the polarization plane of the main polarized wave component radiated in feeding the small loop antenna element 105 and the polarization plane of the main polarized wave component radiated in feeding the small loop antenna element 205 are in a mutually orthogonal relation, and both vertically and horizontally polarized waves are generated even if the distance D between the antenna apparatus and the conductor plate 106 changes in a manner similar to that of the second preferred embodiment. Therefore, the antenna apparatus radiates a substantially constant circularly polarized radio wave regardless of the distance D to the conductor plate 106.

As described above, according to the present preferred embodiment, by performing the 90-degree phase difference feed to the small loop antenna elements 105 and 205 by a 90-degree phase difference distributor 272 to radiate the circularly polarized radio wave from the antenna apparatus, a polarization diversity effect can be obtained regardless of the distance D between the antenna apparatus and the conductor plate 106, and the switchover operation of the switch 208 by the switchover control signal Ss from the wireless transceiver circuit 102 can be made unnecessary.

Fourth Preferred Embodiment

Figure 14:
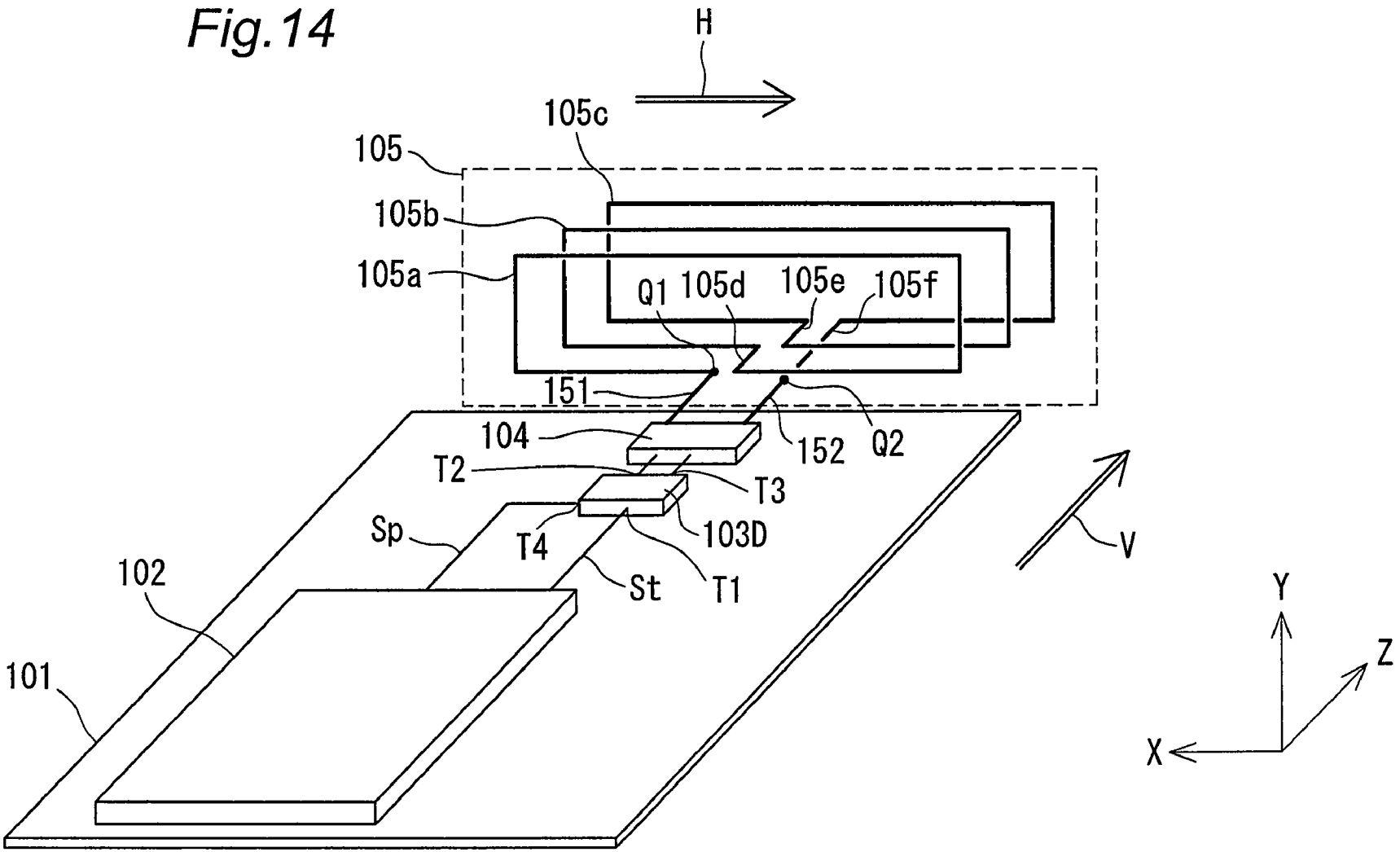
FIG. 14 is a perspective view showing a configuration of an antenna apparatus having a small loop antenna element 105 according to a fourth preferred embodiment of the invention.
Figure 15:
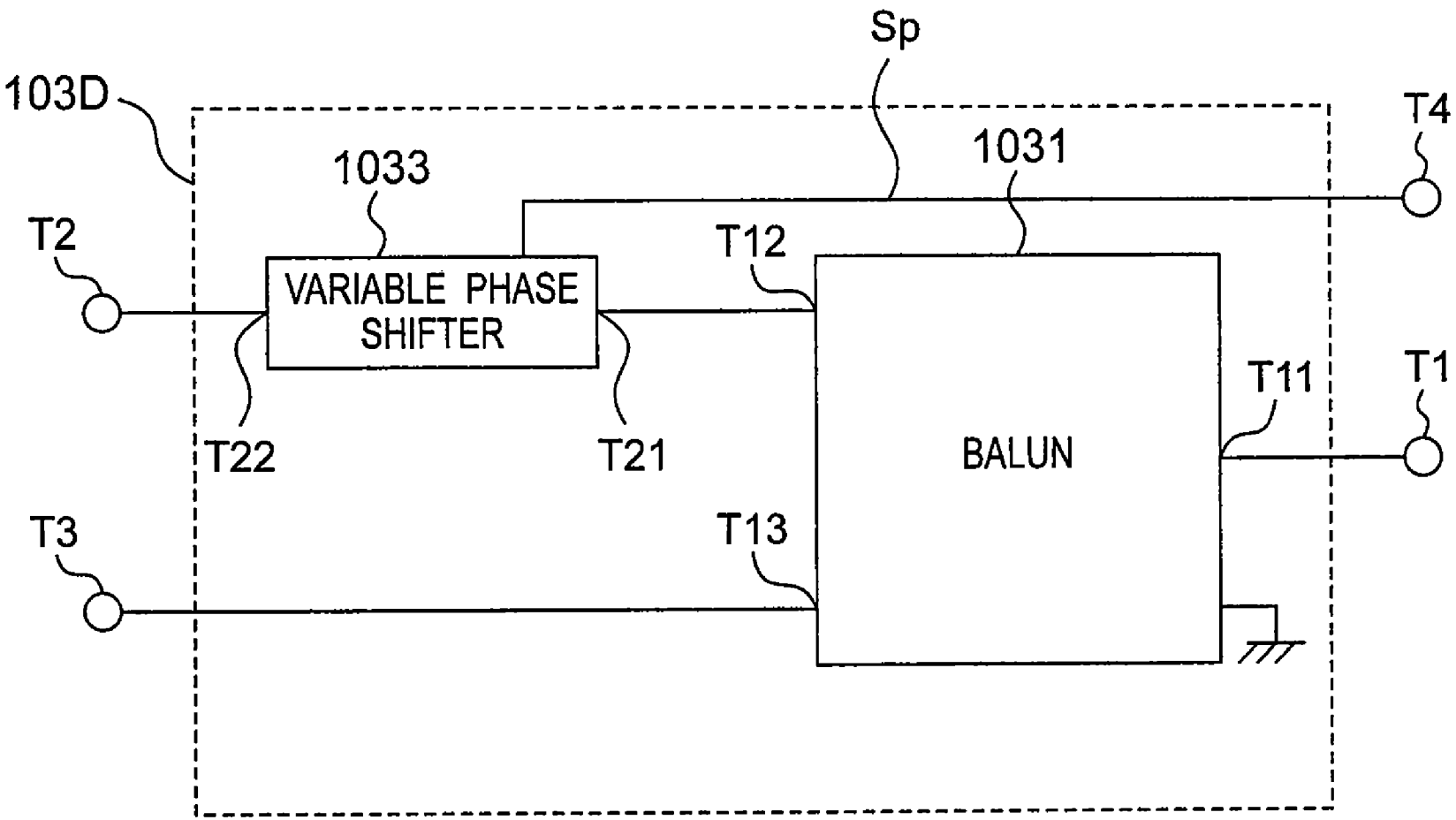
FIG. 15 is a block diagram showing a configuration of the feeder circuit 103D of FIG. 14.

FIG. 14 is a perspective view showing a configuration of an antenna apparatus having a small loop antenna element 105 according to the fourth preferred embodiment of the invention. FIG. 15 is a block diagram showing a configuration of the feeder circuit 103D of FIG. 14. The antenna apparatus of the fourth preferred embodiment differs from the antenna apparatus of the first preferred embodiment of FIG. 1 in the following point.

(1) The feeder circuit 103D is provided in place of the feeder circuit 103. In this case, the feeder circuit 103D is characterized in that the phase shifter 1032 is replaced by a variable phase shifter 1033 as shown in FIG. 15, and the phase shift amount of the variable phase shifter 1033 is controlled on the basis of a phase shift amount control signal Sp from the wireless transceiver circuit 102.

In the antenna apparatus configured as above, the feeder circuit 103D converts an inputted unbalanced wireless signal into two balanced wireless signals that have a phase difference of approximately 180 degrees by a balun 1031 to make the phase difference between the obtained two balanced wireless signals deviate from 180 degrees by a variable phase shifter 1033 and outputs two balanced wireless signals of mutually different phases.

Figure 16A:
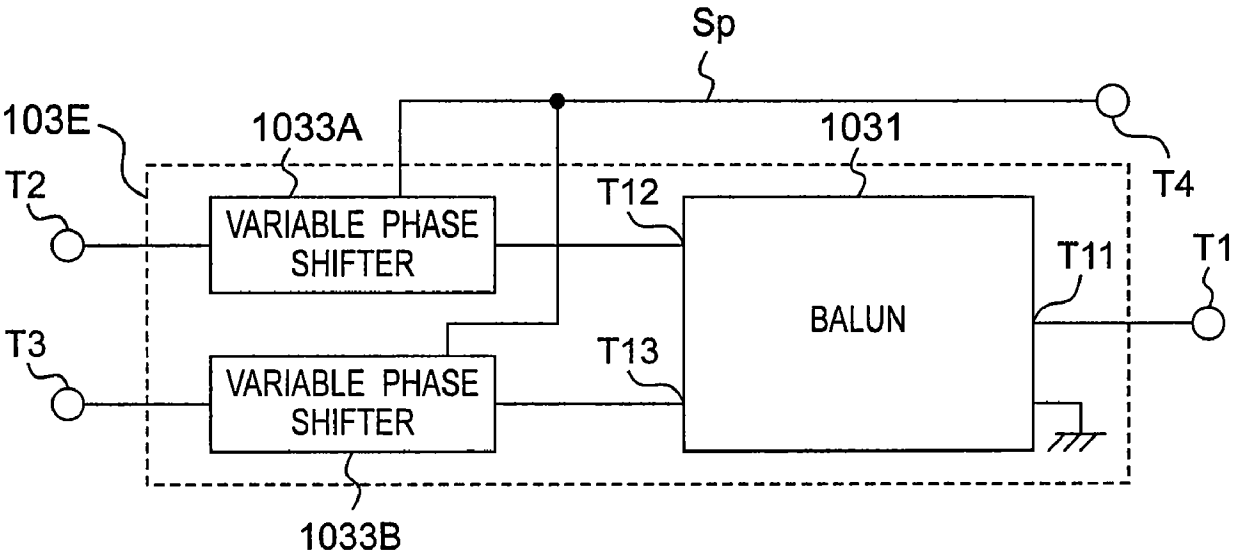
FIG. 16(*a*) is a block diagram showing a configuration of a feeder circuit 103E that is a first modified preferred embodiment of the feeder circuit 103D of FIG. 15.
Figure 16C:
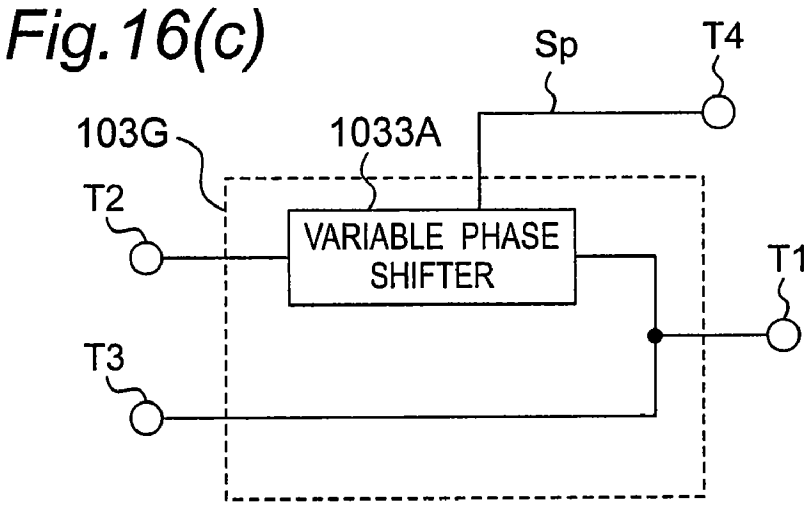
Figure 16B:
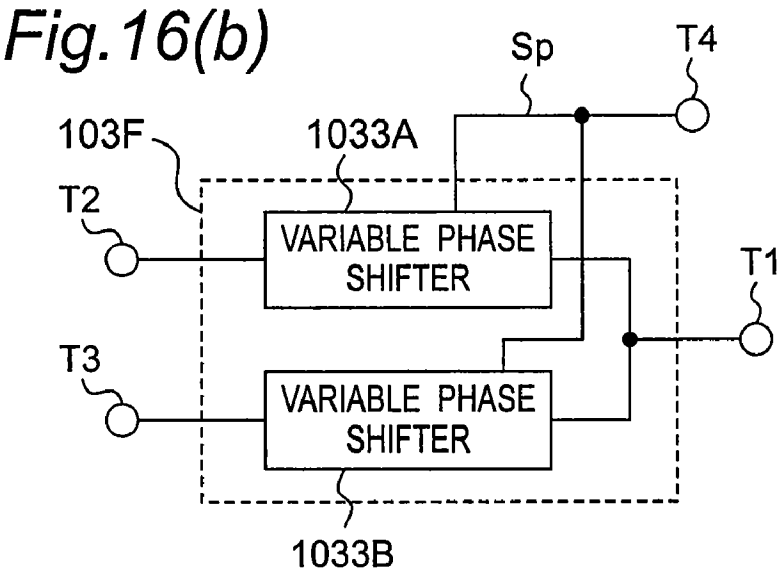

FIG. 16(*a*) is a block diagram showing a configuration of a feeder circuit 103E that is the first modified preferred embodiment of the feeder circuit 103D of FIG. 15. FIG. 16(*b*) is a block diagram showing a configuration of a feeder circuit 103F that is the second modified preferred embodiment of the feeder circuit 103D of FIG. 15. FIG. 16(*c*) is a block diagram showing a configuration of a feeder circuit 103G that is the third modified preferred embodiment of the feeder circuit 103D of FIG. 15. The feeder circuit 103E of FIG. 16(*a*) is configured to include a balun 1031 and two variable phase shifters 1033A and 1033B of which the amounts of phase shift are each controlled by the phase shift amount control signal Sp. Moreover, the feeder circuit 103F of FIG. 16(*b*) is configured to include variable phase shifters 1033A and 1033B, each of which shifts the phases of the inputted unbalanced wireless signal. Further, the feeder circuit 103G of FIG. 16(*c*) has only the variable phase shifter 1033A that shifts the phase of the unbalanced wireless signal inputted via the terminal T1 and outputs the resulting signal via the terminal T2, while the unbalanced wireless signal inputted via the terminal T1 is outputted as it is via the terminal T3.

Figure 17:
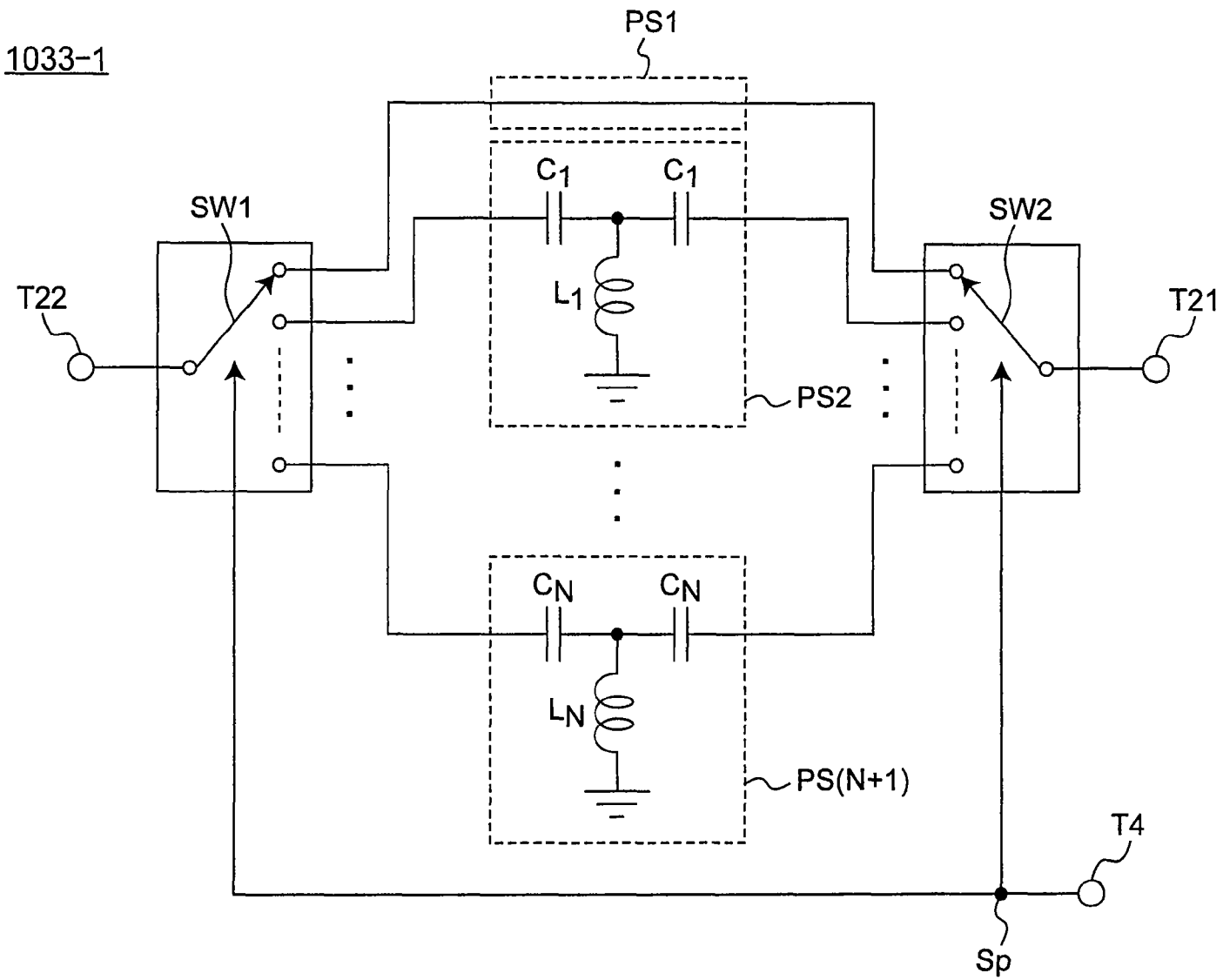
FIG. 17 is a circuit diagram showing a detailed configuration of a variable phase shifter 1033-1 that is a first implemental example of the variable phase shifters 1033, 1033A and 1033B of FIG. 15, FIG. 16(*a*), FIG. 16(*b*) and FIG. 16(*c*)

FIG. 17 is a circuit diagram showing a detailed configuration of a variable phase shifter 1033-1 that is the first implemental example of the variable phase shifters 1033, 1033A and 1033B of FIG. 15, FIG. 16(*a*), FIG. 16(*b*) and FIG. 16(*c*). The variable phase shifter 1033-1 has a phase shift amount of, for example, zero degrees to 90 degrees and includes two switches SW1 and SW2 interposed to select any one of a plurality (N+1) of phase shifters PS1 to PS(N+1) between terminals T21 and T22. The phase shifters PS1 to PS(N+1) are T type phase shifters, each of which is configured to include two capacitors and one inductor. It is noted that the phase shifter PS1 is configured to include a direct connection circuit that has a phase shift amount of zero degrees.

Figure 18:
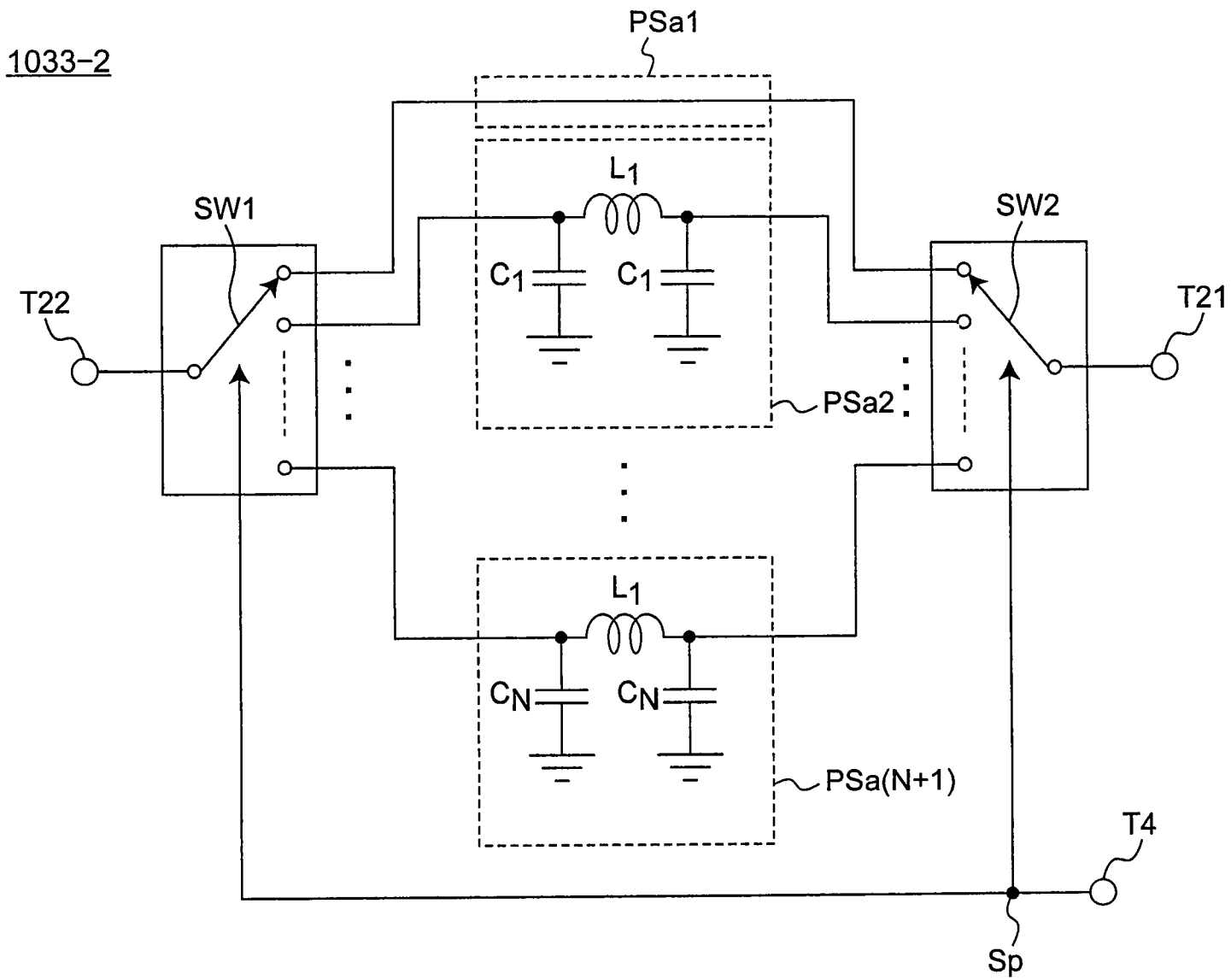
FIG. 18 is a circuit diagram showing a detailed configuration of a variable phase shifter 1033-2 that is a second implemental example of the variable phase shifters 1033, 1033A and 1033B of FIG. 15, FIG. 16(*a*), FIG. 16(*b*) and FIG. 16(*c*)

FIG. 18 is a circuit diagram showing a detailed configuration of a variable phase shifter 1033-2 that is the second implemental example of the variable phase shifters 1033, 1033A and 1033B of FIG. 15, FIG. 16(*a*), FIG. 16(*b*) and FIG. 16(*c*). The variable phase shifter 1033-2 has a phase shift amount of, for example, zero degrees to −90 degrees and includes two switches SW1 and SW2 interposed to select any one of a plurality (N+1) of phase shifters PSa1 to PSa(N+1) between terminals T21 and T22. The phase shifters PSa1 to PSa(N+1) are π type phase shifters, each of which is configured to include two capacitors and one inductor. It is noted that the phase shifter PSa1 is configured to include a direct connection circuit that has a phase shift amount of zero degrees.

The variable phase shifters 1033-1 and 1033-2 of FIG. 17 and FIG. 18, in which the built-in phase shifter circuits can be configured to include the inductor and the capacitors capable of being provided by chip components, are therefore able to reduce the size of the circuits than when the general phase shifter of a delay line switchover system.

The operation of the antenna apparatus configured as above is described below. Radio wave radiation is similar to that of the first preferred embodiment. As apparent from FIG. 9, it can be understood that the antenna gains of the vertically polarized wave component and the horizontally polarized wave component can be set substantially identical by providing a phase difference of 145 degrees between two wireless signals fed to the small loop antenna element 105. With this arrangement, the composite gain can be made constant regardless of the distance D to the conductor plate 106, and the distance measurement accuracy can be improved. Moreover, in order to obtain a high communication quality during authentication communication, it is better to prevent the gain decrease when the conductor plate 106 is located adjacent to the antenna apparatus and to make the gain as high as possible when the conductor plate 106 is located apart from the antenna apparatus. That is, it is better to prevent the gain decrease when the conductor plate is located adjacent and to make the gain of the vertically polarized wave component radiated from the connecting conductor as high as possible within a range in which the gain decrease of the horizontally polarized wave component from the small loop antenna element 105 is small.

As apparent from FIG. 9, by providing a phase difference of about 60 degrees between the two wireless signals fed to the small loop antenna element 105, it is possible to increase the antenna gain of the vertically polarized wave component while suppressing the antenna gain of the horizontally polarized wave component. Moreover, when the antenna apparatus is used in a situation in which the change in the ambience environment of the antenna apparatus is small, a communication quality higher than that of the prior art can be obtained by gradually changing the phase difference between the two wireless signals fed to the loop antenna element 105 and performing authentication communication with a phase difference with which the maximum gain is obtained.

Therefore, by changing the phase shift amount of the variable phase shifter 1033 by the phase shift amount control signal Sp depending on distance measurement and authentication communication to change the phase difference between the two wireless signals fed to the small loop antenna element 105 and to control the antenna gain of both the vertically and horizontally polarized wave components, a distance accuracy and a communication quality higher than those of the prior arts can be made compatible.

As described above, according to the present preferred embodiment, by changing the phase difference between the two wireless signals fed to the small loop antenna element 105 by the phase shift amount control signal Sp during the distance measurement to set the antenna gains of the vertically polarized wave component and the horizontally polarized wave component substantially identical, an antenna apparatus that obtains the antenna gain of a substantially constant composite component can be provided regardless of the distance D between the antenna apparatus and the conductor plate 106. Moreover, by changing the phase difference between the two wireless signals fed to the small loop antenna element 105 by the phase shift amount control signal Sp during authentication communication to increase the antenna gain of the vertically polarized wave component while suppressing the antenna gain decrease in the horizontally polarized wave component, an antenna apparatus that obtains a communication quality higher than that of the prior art can be provided. By changing the phase difference between the two wireless signals fed to the small loop antenna element 105 by the phase shift amount control signal Sp according to the purpose of use, distance accuracy and a communication quality higher than those of the prior arts can be made compatible. Moreover, since the small loop antenna element 105 has both the vertically and horizontally polarized wave components as described above, the polarization diversity effect can be obtained.

Fifth Preferred Embodiment

Figure 19:
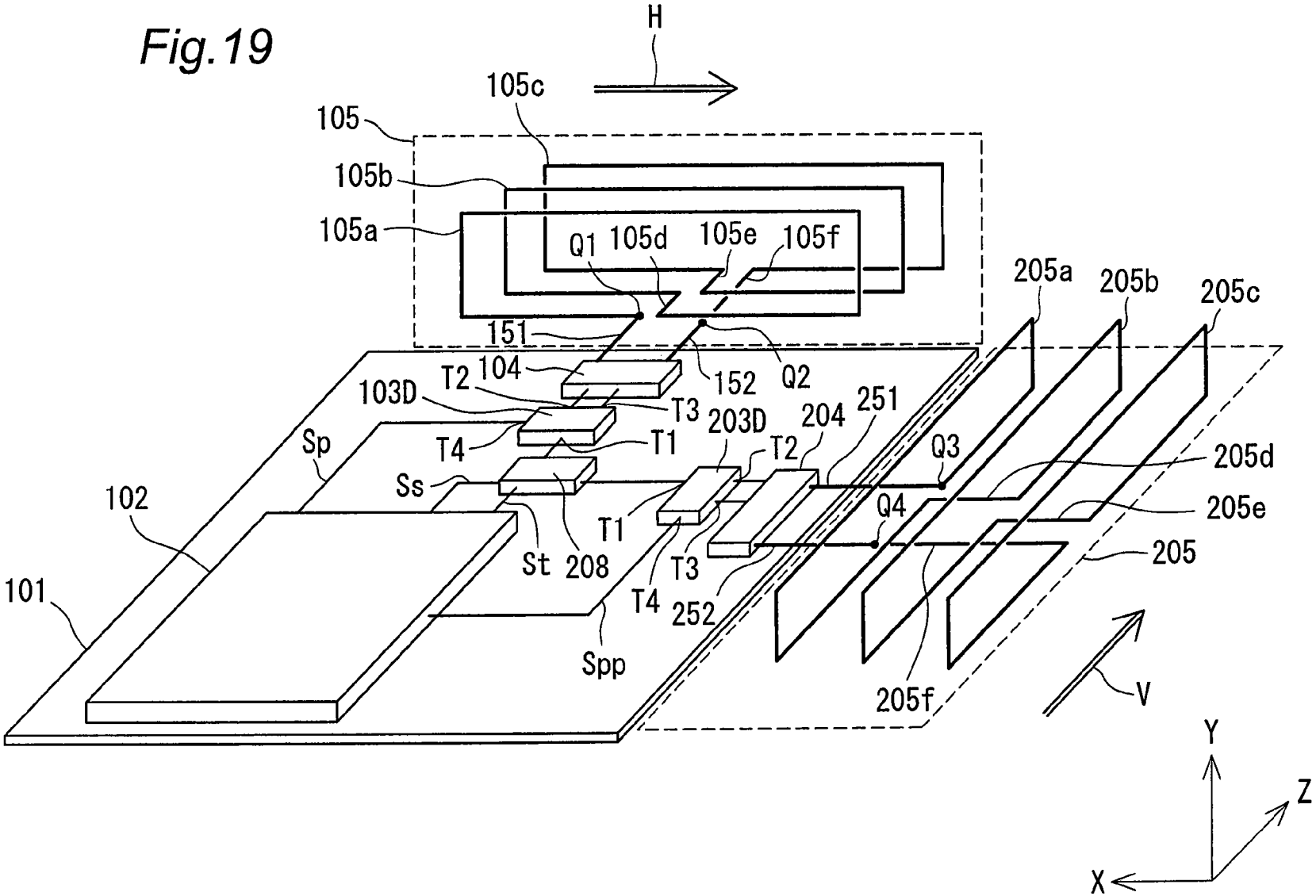
FIG. 19 is a perspective view showing a configuration of an antenna apparatus having small loop antenna elements 105 and 205 according to a fifth preferred embodiment of the invention.

FIG. 19 is a perspective view showing a configuration of an antenna apparatus having small loop antenna elements 105 and 205 according to the fifth preferred embodiment of the invention. The antenna apparatus of the fifth preferred embodiment differs from the second preferred embodiment of FIG. 10 in the following point.

(1) Feeder circuits 103D and 203D of FIG. 15 are provided in place of the feeder circuits 103 and 203, respectively.

The operation of the antenna apparatus configured as above is described below. Radio wave radiation is similar to that of the second preferred embodiment. By changing the phase difference between the two wireless signals fed to the small loop antenna elements 105 and 205 by phase shift amount control signals Sp and Spp depending on distance measurement and the authentication communication to control the antenna gains of both the vertically and horizontally polarized wave components, a distance accuracy and a communication quality higher than those of the prior arts can be made compatible.

As described above, according to the present preferred embodiment, by providing the two small loop antenna elements 105 and 205 in the direction orthogonal to the small loop antenna element 105 on the X-Z plane, polarization planes radiated from the antenna apparatus in feeding the small loop antenna element 105 and in feeding the small loop antenna element 205 are in the orthogonal relation even when one polarized wave of both the vertically and horizontally polarized waves is largely attenuated in a manner similar to that of such a case that the distance D between the antenna apparatus and the conductor plate 106 is sufficiently shorter with respect to the wavelength or a multiple of the quarter wavelength. Therefore, by switchover between the polarization planes by the switch 208, the polarization diversity effect can be obtained. Further, by changing the phase difference between the two wireless signals fed to the small loop antenna elements 105 and 205 by the phase shift amount control signals Sp and Spp depending on distance measurement and authentication communication to control the antenna gains of both the vertically and horizontally polarized wave components, a distance accuracy and a communication quality higher than those of the prior arts can be made compatible.

Sixth Preferred Embodiment

Figure 20:
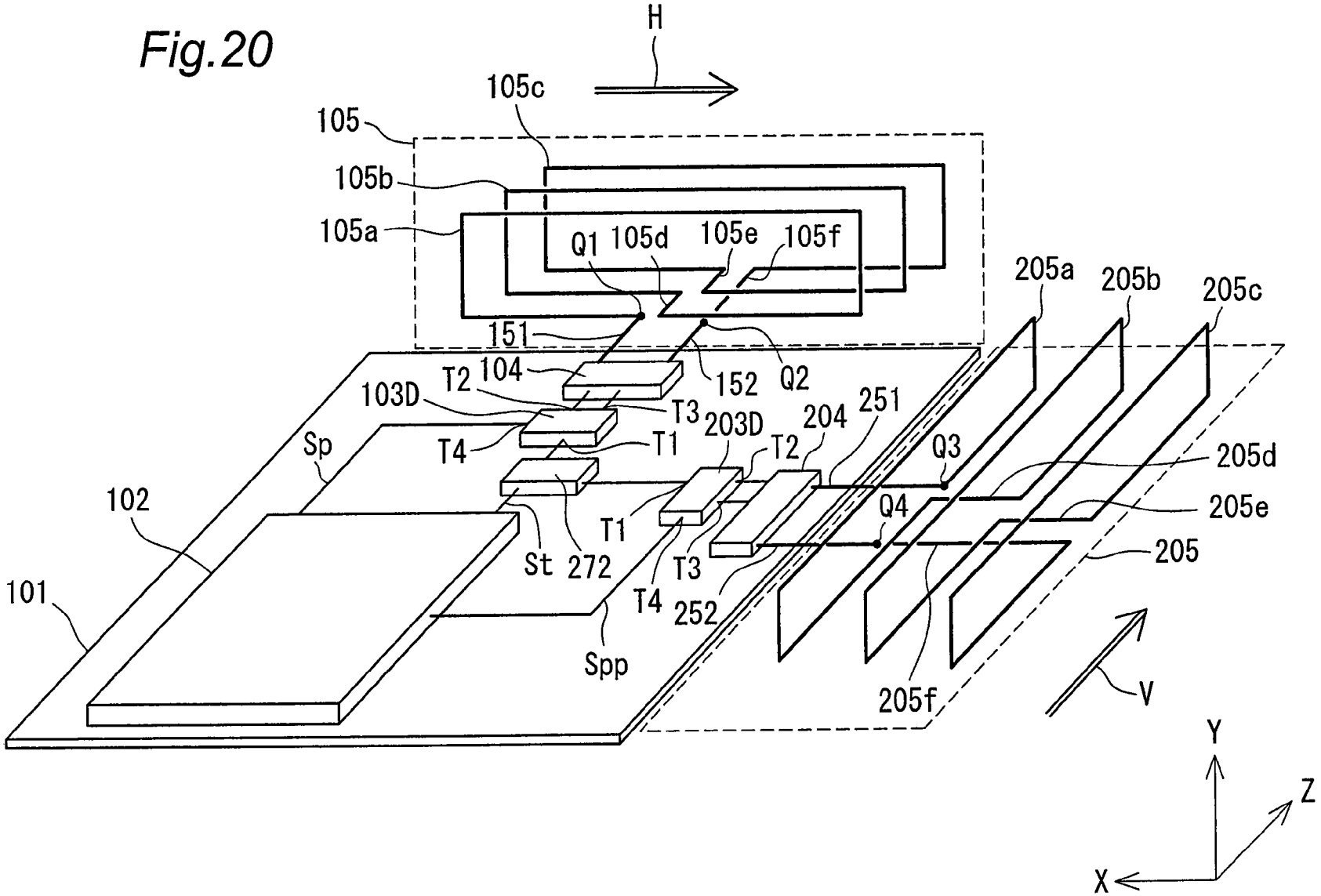
FIG. 20 is a perspective view showing a configuration of an antenna apparatus having small loop antenna elements 105 and 205 according to a sixth preferred embodiment of the invention.

FIG. 20 is a perspective view showing a configuration of an antenna apparatus having small loop antenna elements 105 and 205 according to the sixth preferred embodiment of the invention. The antenna apparatus of the sixth preferred embodiment differs from the antenna apparatus of the third preferred embodiment of FIG. 13 in the following point.

(1) The feeder circuits 103 and 203 are replaced by feeder circuits 103D and 203D of which the phase shift amounts are controlled by the phase shift amount control signals Sp and Spp.

The operation of the antenna apparatus configured as above is described below. Radio wave radiation is similar to that of the third preferred embodiment. By changing the phase difference between the two wireless signals fed to the small loop antenna elements 105 and 205 by the phase shift amount control signals Sp and Spp depending on distance measurement and authentication communication to control the antenna gains of both the vertically and horizontally polarized wave components, a distance accuracy and a communication quality higher than those of the prior arts can be made compatible.

Moreover, by feeding the small loop antenna elements 105 and 205 with a 90-degree phase difference by the 90-degree phase difference distributor 272 to radiate circularly polarized radio waves from the antenna apparatus, the polarization diversity effect can be obtained, and the switchover operation of the switch 208 by the switchover control signal Ss from the wireless transceiver circuit 102 can be made unnecessary. Further, by changing the phase difference between the two wireless signals fed to the small loop antenna elements 105 and 205 by the phase shift amount control signal Sp and Spp depending on distance measurement and the authentication communication to control the antenna gain of both the vertically and horizontally polarized wave components, respectively, a distance accuracy and a communication quality higher than those of the prior arts can be made compatible.

Seventh Preferred Embodiment

Figure 21:
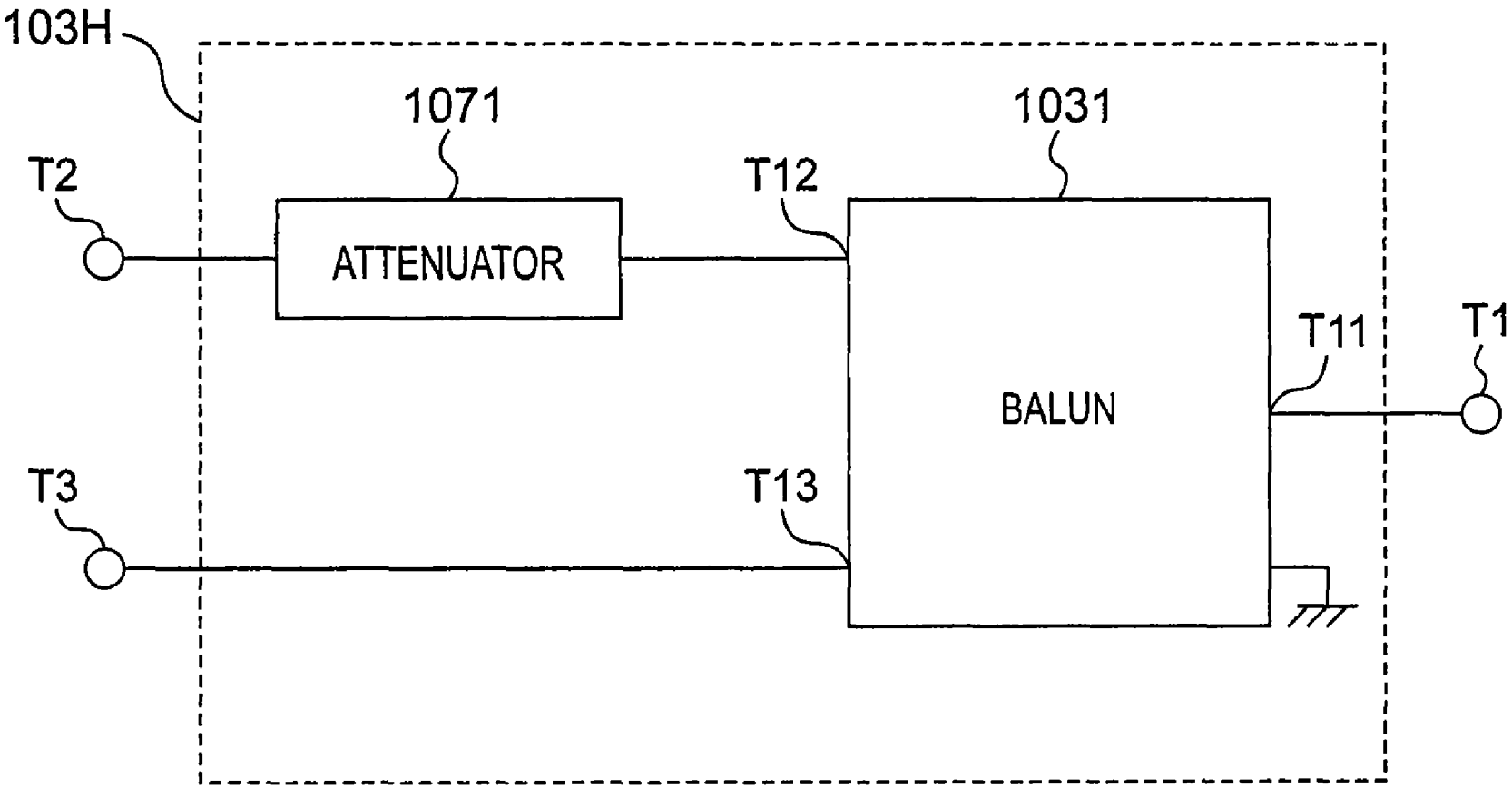
FIG. 21 is a block diagram showing a configuration of a feeder circuit 103H employed in an antenna apparatus having the small loop antenna element 105 (having a configuration similar to that of the antenna apparatus of FIG. 1 except for the feeder circuit 103 of FIG. 1) according to a seventh preferred embodiment of the invention.

FIG. 21 is a block diagram showing a configuration of a feeder circuit 103H employed in an antenna apparatus having the small loop antenna element 105 (having a configuration similar to that of the antenna apparatus of FIG. 1 except for the feeder circuit 103 of FIG. 1) according to the seventh preferred embodiment of the invention. The antenna apparatus of the seventh preferred embodiment is characterized in that the feeder circuit 103H of FIG. 21 is provided in place of the feeder circuit 103 in the antenna apparatus of FIG. 1. The feeder circuit 103H is configured to include a balun 1031 and an attenuator 1071 that takes the place of the phase shifter 1032 of FIG. 3. It is noted that the feeder circuit 103H of FIG. 21 may be a feeder circuit 103I, 103J or 103K of FIG. 22(*a*), FIG. 22(*b*) or FIG. 22(*c*).

Figure 22A:
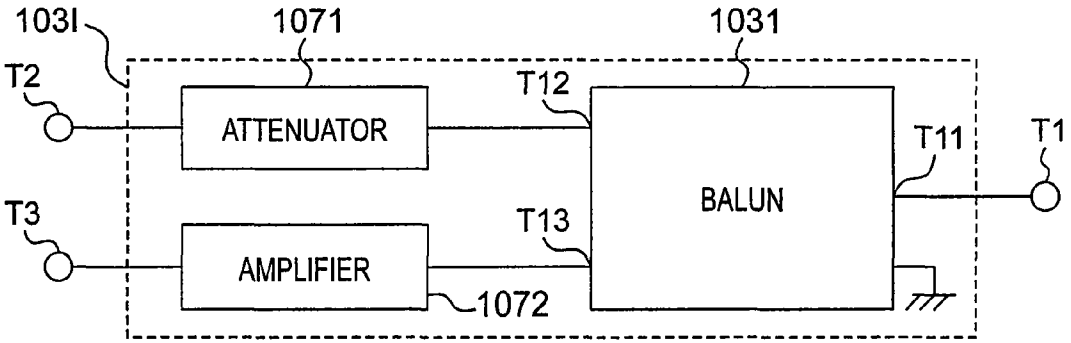
FIG. 22(*a*) is a block diagram showing a configuration of a feeder circuit 103I that is a first modified preferred embodiment of the feeder circuit 103H of FIG. 21.
Figure 22B:
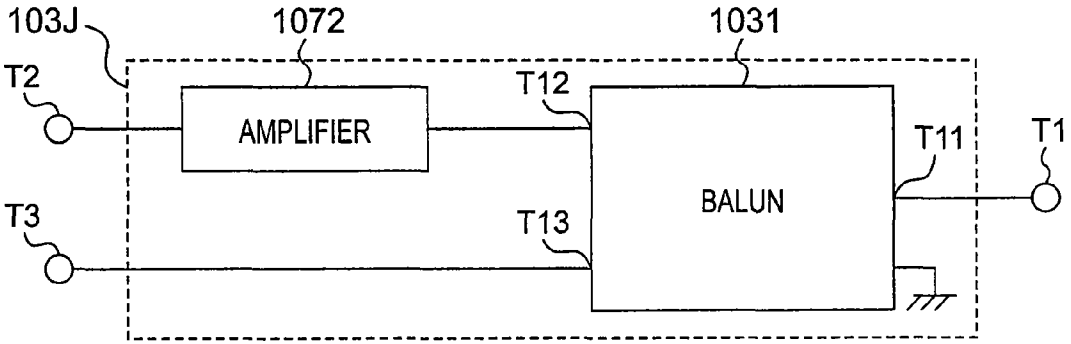
Figure 22C:
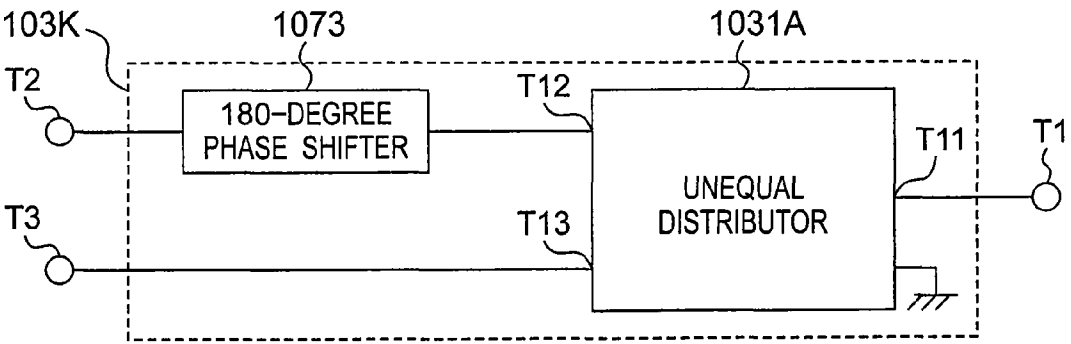

FIG. 22(*a*) is a block diagram showing a configuration of a feeder circuit 103I that is the first modified preferred embodiment of the feeder circuit 103H of FIG. 21. FIG. 22(*b*) is a block diagram showing a configuration of a feeder circuit 103J that is the second modified preferred embodiment of the feeder circuit 103H of FIG. 21. FIG. 22(*c*) is a block diagram showing a configuration of a feeder circuit 103K that is the third modified preferred embodiment of the feeder circuit 103H of FIG. 21. The feeder circuit 103I of FIG. 22(*a*) is configured to include a balun 1031, an attenuator 1071 and an amplifier 1072. Moreover, the feeder circuit 103J of FIG. 22(*b*) is configured to include a balun 1031 and an amplifier 1072. Further, the feeder circuit 103K of FIG. 22(*c*) is configured to include an unequal distributor 1031A that unequally distribute a wireless signal inputted via the terminal T1 and outside the resulting signal, and a 180-degree phase shifter 1073.

The operation of the antenna apparatus configured as above is described below. A transmitted wireless signal outputted from the wireless transceiver circuit 102 is converted into two wireless signals of which the amplitudes are mutually different by the feeder circuit 103H, thereafter subjected to impedance conversion by an impedance matching circuit 104, outputted to the loop antenna element 105 and radiated. Moreover, the radio wave received by the small loop antenna element 105 is subjected to impedance conversion by the impedance matching circuit 104, thereafter converted into an unbalanced wireless signal by the feeder circuit 103H and inputted as a received wireless signal to the wireless transceiver circuit 102.

In the antenna apparatus of the present preferred embodiment, by setting the antenna gains of the vertically polarized wave component and the horizontally polarized wave component substantially identical in a manner similar to that of the antenna apparatus of the first preferred embodiment, the composite component becomes substantially constant regardless of the distance D between the antenna apparatus and the conductor plate 106. By setting the amplitude difference between the two wireless signals fed to the small loop antenna element 105 to a predetermined value, the antenna gains of the vertically polarized wave component and the horizontally polarized wave component radiated from the antenna apparatus can be set substantially identical.

Figure 23:
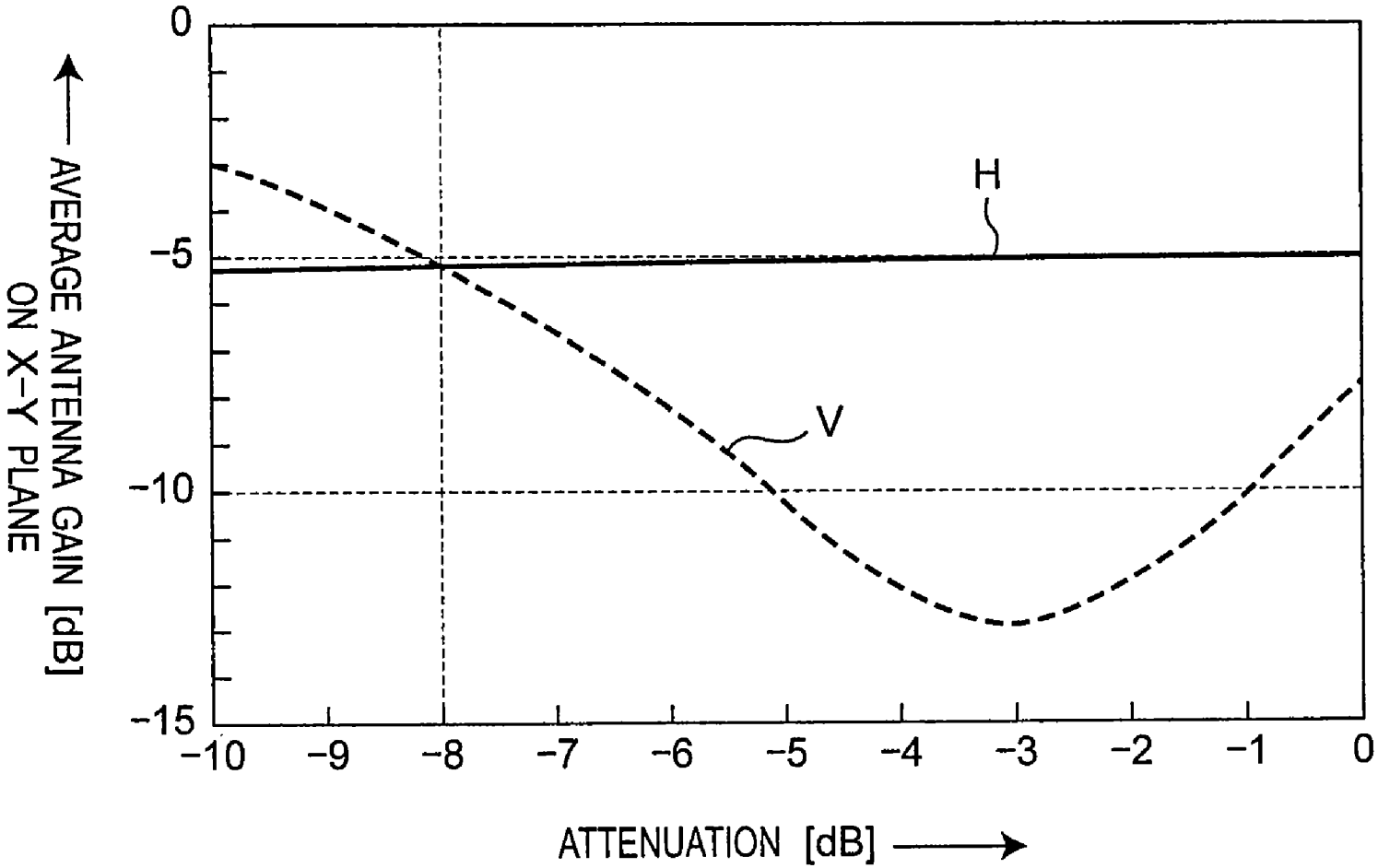
FIG. 23 is a graph showing an average antenna gain on the X-Y plane with respect to the attenuation of an attenuator 1071 of the feeder circuit 103H in the antenna apparatus of the seventh preferred embodiment.

FIG. 23 is a graph showing an average antenna gain on the X-Y plane with respect to the attenuation of an attenuator 1071 of the feeder circuit 103H in the antenna apparatus of the seventh preferred embodiment. FIG. 23 is a graph showing a calculated value at a frequency of 426 MHz. The absolute value of the attenuation of the attenuator 1071 becomes the amplitude difference between the two wireless signals fed to the small loop antenna element 105. As apparent from FIG. 23, it can be understood that the antenna gains of the vertically polarized wave component and the horizontally polarized wave component can be set substantially identical by setting the attenuation of the attenuator 1071 to −8 dB. By setting the attenuation of the attenuator 1071 to the predetermined value to set the amplitude difference between the two wireless signals outputted from the feeder circuit 103 so that the antenna gains of the vertically polarized wave component and the horizontally polarized wave component become substantially identical, the antenna gain of the composite component can be made substantially constant regardless of the distance D between the antenna apparatus and the conductor plate 106.

As described above, according to the present preferred embodiment, by setting the attenuation of the attenuator 1071 to the predetermined value to set the amplitude difference between the two wireless signals fed to the loop antenna element 105 and to set the antenna gains of the vertically polarized wave component and the horizontally polarized wave component substantially identical, an antenna apparatus that obtains the antenna gain of the substantially constant composite component regardless of the distance D between the antenna apparatus and the conductor plate 106 can be provided. Moreover, the small loop antenna element 105 has both the vertically and horizontally polarized wave components as described above and is able to obtain the polarization diversity effect.

Further, it is acceptable to apply the feeder circuit 103H (103I, 103J or 103K) to the configuration of the antenna apparatuses of the second and third preferred embodiments shown in FIG. 10 to FIG. 13.

Eighth Preferred Embodiment

Figure 24:
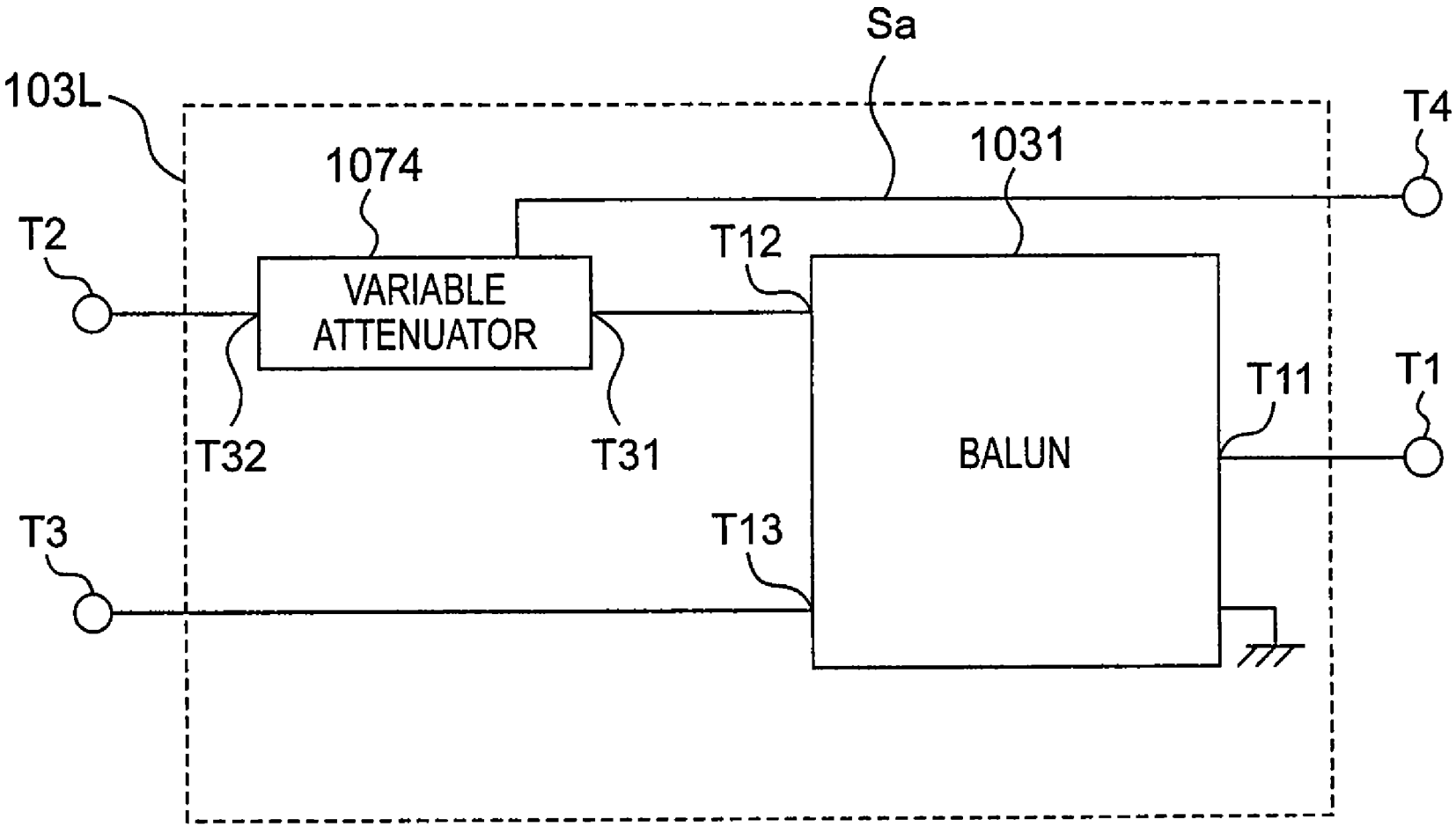
FIG. 24 is a block diagram showing a configuration of a feeder circuit 103L that is a modified preferred embodiment of FIG. 21 according to an eighth preferred embodiment of the invention.

FIG. 24 is a block diagram showing a configuration of a feeder circuit 103L that is a modified preferred embodiment of FIG. 21 according to the eighth preferred embodiment of the invention. The antenna apparatus of the eighth preferred embodiment differs from the antenna apparatus of the seventh preferred embodiment of FIG. 21 in the following point.

(1) A feeder circuit 103L having a variable attenuator 1074 that has an attenuation changed in accordance with an attenuation control signal Sa is provided in place of the feeder circuit 103H that has the attenuator 1071.

Figures 25A, 25B, 25C:
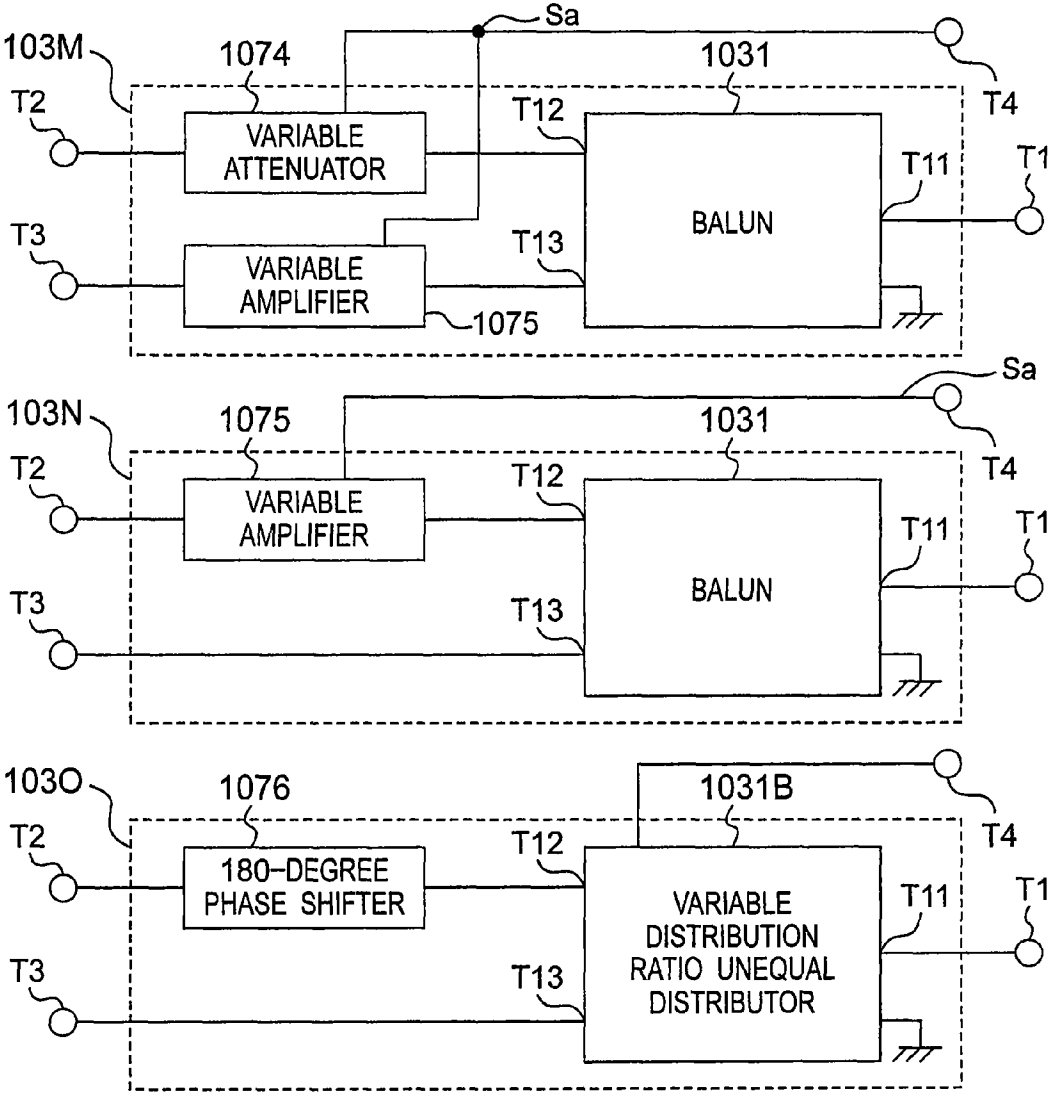
FIG. 25(*a*) is a block diagram showing a configuration of a feeder circuit 103M that is a first modified preferred embodiment of the feeder circuit 103L of FIG. 24.

Moreover, a feeder circuit 103M, 103N or 103O of FIG. 25(*a*), FIG. 25(*b*) or FIG. 25(*c*) may be provided in place of the feeder circuit 103L.

The feeder circuit 103L of FIG. 24 converts an inputted unbalanced wireless signal into two wireless signals that have a phase difference of approximately 180 degrees and an amplitude difference of approximately zero by the balun 1031, converts the obtained amplitude difference between the two wireless signals into two wireless signals of which the amplitudes are mutually different by the variable attenuator 1074 and output the resulting signals. It is noted that the configuration of the feeder circuit 103L is only required to be a circuit that outputs two wireless signals of which the phase difference is approximately 180 degrees and mutually different amplitude and not obliged to have the configuration of FIG. 24.

FIG. 25(*a*) is a block diagram showing a configuration of a feeder circuit 103M that is the first modified preferred embodiment of the feeder circuit 103L of FIG. 24. FIG. 25(*b*) is a block diagram showing a configuration of a feeder circuit 103N that is the second modified preferred embodiment of the feeder circuit 103L of FIG. 24. FIG. 25(*c*) is a block diagram showing a configuration of a feeder circuit 103O that is the third modified preferred embodiment of the feeder circuit 103L of FIG. 24. The feeder circuit 103M of FIG. 25(*a*) is configured to include a balun 1031, a variable attenuator 1074 that has an attenuation changed in accordance with a control signal Sa, and a variable amplifier 1075 that has an amplification changed in accordance with the control signal Sa. Moreover, the feeder circuit 103N of FIG. 25(*b*) is configured to include a balun 1031 and a variable amplifier 1075 that has an amplification changed in accordance with the control signal Sa. Further, the feeder circuit 103O of FIG. 25(*c*) is configured to include a variable distribution ratio unequal distributor 1031B that unequally distributes a wireless signal inputted via the terminal T1 into two wireless signals at a distribution ratio changed in accordance with the control signal Sa and a 180-degree phase shifter 1076.

Figure 26:
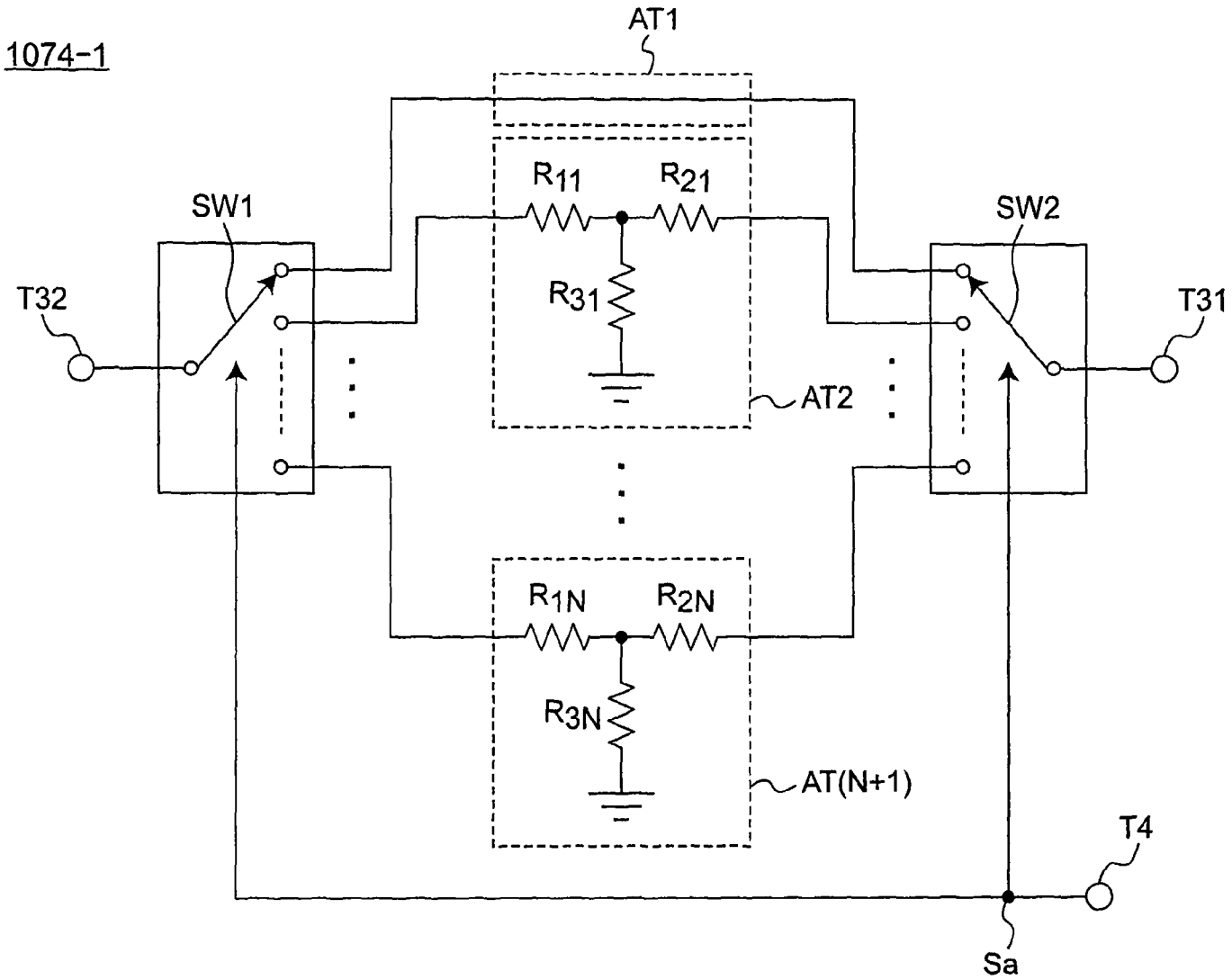
FIG. 26 is a circuit diagram showing a detailed configuration of a variable attenuator 1074-1 that is a first implemental example of the variable attenuator 1074 of FIG. 24, FIG. 25(*a*), FIG. 25(*b*) and FIG. 25(*c*)

FIG. 26 is a circuit diagram showing a detailed configuration of a variable attenuator 1074-1 that is the first implemental example of the variable attenuator 1074 of FIG. 24, FIG. 25(*a*), FIG. 25(*b*) and FIG. 25(*c*). The variable attenuator 1074-1 has an attenuation ranging from, for example, zero to a predetermined value and is configured to include two switches SW1 and SW2 interposed between terminals T31 and T32 to select any one of a plurality (N+1) of attenuators AT1 to AT(N+1). The attenuators AT1 to AT(N+1) are T type attenuators, each of which is configured to include three resistors. It is noted that the attenuator AT1 is configured to include a direct connection circuit that has an attenuation of zero.

Figure 27:
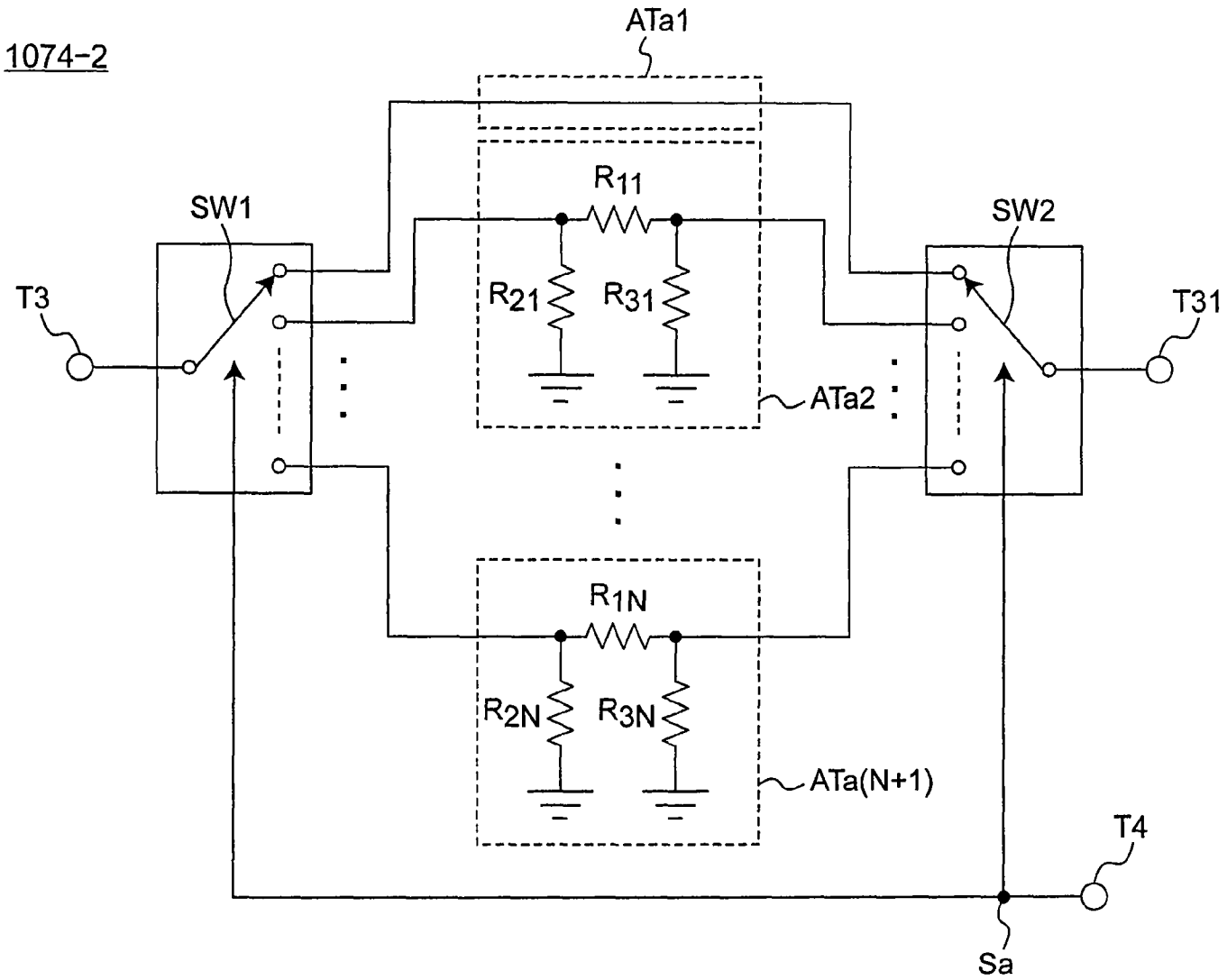
FIG. 27 is a circuit diagram showing a detailed configuration of a variable attenuator 1074-2 that is a second implemental example of the variable attenuator 1074 of FIG. 24, FIG. 25(*a*), FIG. 25(*b*) and FIG. 25(*c*)

FIG. 27 is a circuit diagram showing a detailed configuration of a variable attenuator 1074-2 that is the second implemental example of the variable attenuator 1074 of FIG. 24, FIG. 25(*a*), FIG. 25(*b*) and FIG. 25(*c*). The variable attenuator 1074-2 has an attenuation ranging from, for example, zero to a predetermined value and is configured to include two switches SW1 and SW2 interposed between terminals T31 and T32 to select any one of a plurality (N+1) of attenuators ATa1 to ATa(N+1). The attenuators ATa1 to ATa(N+1) are π type attenuators, each of which is configured to include three resistors. It is noted that the attenuator ATa1 is configured to include a direct connection circuit that has an attenuation of zero.

In the antenna apparatus having the feeder circuit 103L of FIG. 24, radio wave radiation is similar to that of the first preferred embodiment. As apparent from FIG. 23, it can be understood that the antenna gains of the vertically polarized wave component and the horizontally polarized wave component can be made substantially identical by setting the amplitude difference between the two wireless signals fed to small loop antenna element 105 at 8 dB. With this arrangement, the composite gain can be made constant regardless of the distance D to the conductor plate 106, and the distance measurement accuracy can be improved. Moreover, in order to obtain a high communication quality during authentication communication, it is better to prevent the gain decrease when the conductor plate 106 is located adjacent to the antenna apparatus and to make the gain as high as possible when the conductor plate 106 is located apart from the antenna apparatus. That is, it is better to prevent the gain decrease when the conductor plate is located adjacent and to make the antenna gain of the vertically polarized wave component radiated from the connecting conductor as high as possible within a range in which the antenna gain decrease of the horizontally polarized wave component from the small loop antenna element 105 is small.

Moreover, as apparent from FIG. 23, by setting the amplitude difference between the two wireless signals fed to small loop antenna element 105 at 10 dB, the antenna gain of the vertically polarized wave component can be increased while suppressing the antenna gain decrease of the horizontally polarized wave component. Further, when the antenna apparatus is used in a situation in which the change in the ambience environment of the antenna apparatus is small, a communication quality higher than that of the prior art can be obtained by gradually changing the amplitude difference between the two wireless signals fed to the loop antenna element 105 and performing authentication communication with an amplitude difference with which the maximum gain is obtained. By changing the attenuation of the variable attenuator 1074 by the attenuation control signal depending on distance measurement and authentication communication to change the amplitude difference between the two wireless signals fed to the small loop antenna element 105 and to control the antenna gain of both the vertically and horizontally polarized wave components, a distance accuracy and a communication quality higher than those of the prior arts can be made compatible.

As described above, according to the present preferred embodiment, by changing the amplitude difference between the two wireless signals fed to the small loop antenna element 105 by the attenuation control signal during the distance measurement to set the antenna gains of the vertically polarized wave component and the horizontally polarized wave component substantially identical, an antenna apparatus that obtains an antenna gain of a substantially constant composite component can be provided regardless of the distance D between the antenna apparatus and the conductor plate 106.

Moreover, by changing the amplitude difference between the two wireless signals fed to the small loop antenna element 105 during the authentication communication to increase the antenna gain of the vertically polarized wave component while suppressing the antenna gain decrease of the horizontally polarized wave component, an antenna apparatus that obtains a communication quality higher than those of the prior arts can be provided. By changing the amplitude difference between the two wireless signals fed to the small loop antenna element 105 by the attenuation control signal according to the purpose of use, distance accuracy and a communication quality higher than those of the prior arts can be made compatible. Further, the small loop antenna element 105 has both the vertically and horizontally polarized wave components and is able to obtain the polarization diversity effect.

In the antenna apparatus of FIG. 19 and FIG. 20, it is acceptable to provide the feeder circuit 103H of the seventh preferred embodiment or the feeder circuit 103L of the eighth preferred embodiment in place of the feeder circuits 103D and 203D.

Ninth Preferred Embodiment

Figure 28:
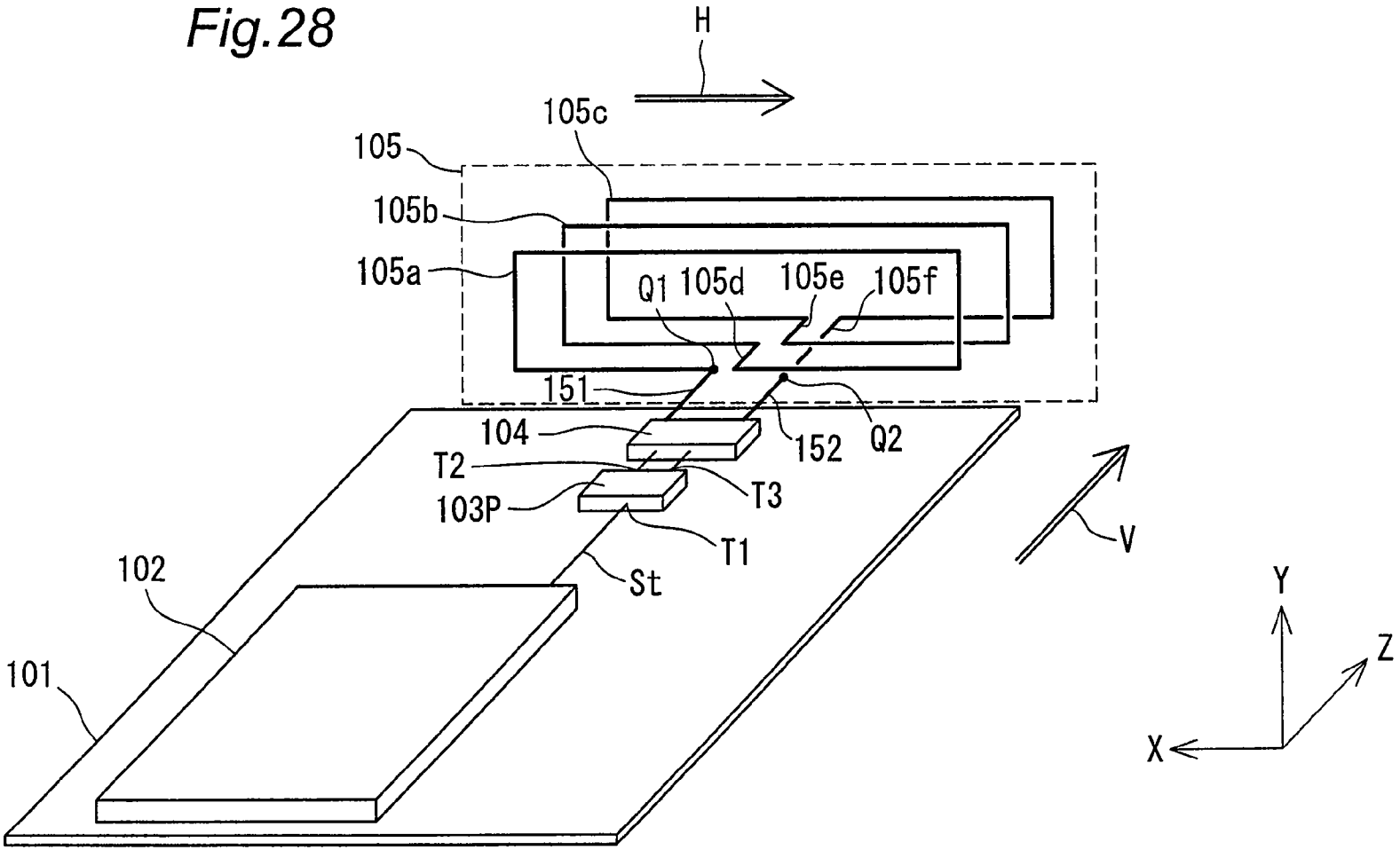
FIG. 28 is a perspective view showing a configuration of an antenna apparatus having a small loop antenna element 105 according to a ninth preferred embodiment of the invention.

FIG. 28 is a perspective view showing a configuration of an antenna apparatus having a small loop antenna element 105 according to the ninth preferred embodiment of the invention. The antenna apparatus of the ninth preferred embodiment differs from the antenna apparatus of the first preferred embodiment of FIG. 1 in the following point.

(1) A balanced-to-unbalanced transformer circuit 103P is provided in place of the feeder circuit 103.

The point of difference is described below.

Referring to FIG. 28, the balanced-to-unbalanced transformer circuit 103P is provided on the grounding conductor plate 101, and an unbalanced terminal T1 is connected to the wireless transceiver circuit 102. Balanced terminals T2 and T3 are connected to an impedance matching circuit 104, and an unbalanced wireless signal from the wireless transceiver circuit 102 is converted into two balanced wireless signals and outputted to the impedance matching circuit 104. It is noted that the configurations of the preferred embodiment and the modified preferred embodiment described above might be applied to the ninth preferred embodiment.

Figure 29:
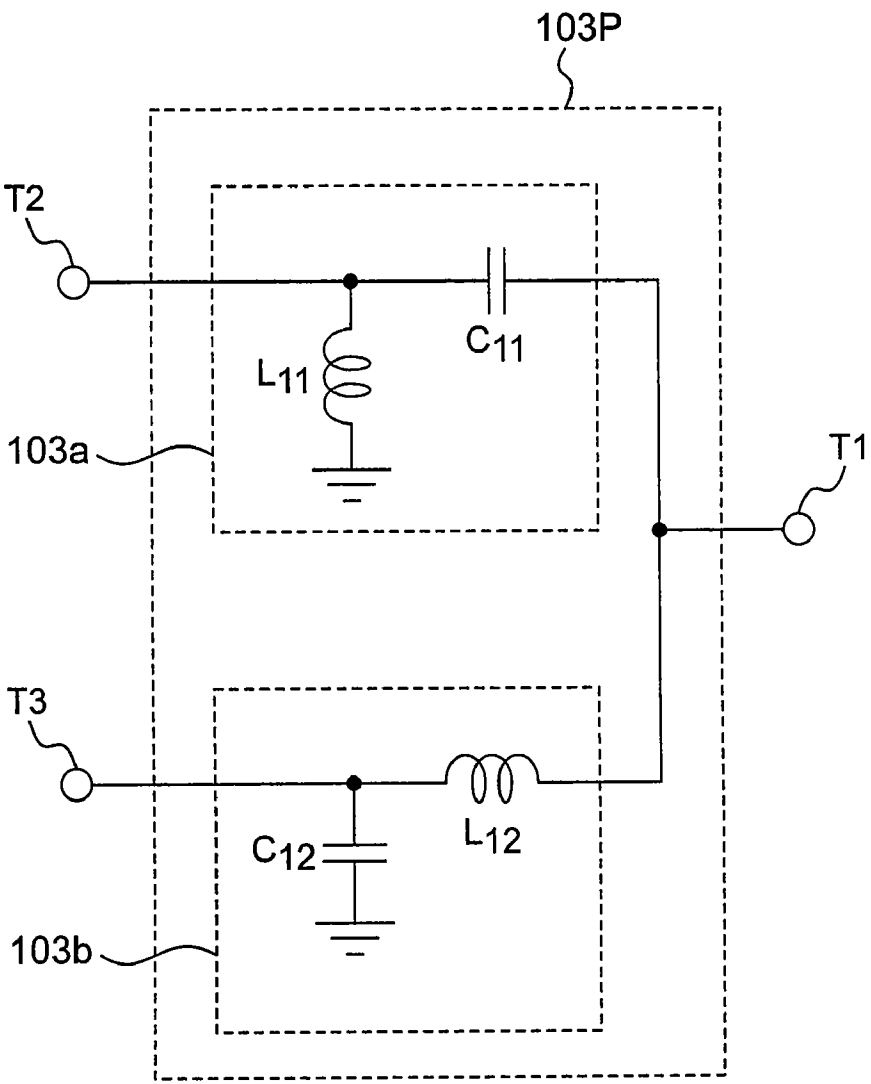
FIG. 29 is a circuit diagram showing a configuration of the balanced-to-unbalanced transformer circuit 103P of FIG. 28.

FIG. 29 is a circuit diagram showing a configuration of the balanced-to-unbalanced transformer circuit 103P of FIG. 28. Referring to FIG. 29, the balanced-to-unbalanced transformer circuit 103P is configured to include a +90-degree phase shifter 103*a* and a −90-degree phase shifter 103*b*. In this case, the +90-degree phase shifter 103*a* is an L-type LC circuit inserted between the unbalanced terminal T1 and the balanced terminal T2, and a wireless signal inputted via the unbalanced terminal T1 is outputted to the balanced terminal T2 with a phase shift of +90 degrees. Moreover, the −90-degree phase shifter 103*b* is an L-type LC circuit inserted between the unbalanced terminal T1 and the balanced terminal T3, and a wireless signal inputted via the unbalanced terminal T1 is outputted to the balanced terminal T3 by a phase shift of −90 degrees. It is noted that the inductors L11 and L12 of the phase shifters 103*a* and 103*b* have an equal inductance L, and the capacitors C11 and C12 have an equal capacitance C. A set frequency fs of the balanced-to-unbalanced transformer circuit 103P is expressed by the following equation:

$$fs = \frac{1}{2\pi\sqrt{LC}}$$

That is, the set frequency fs of the balanced-to-unbalanced transformer circuit 103P is equal to the resonance frequency of the LC circuit configured to include the inductance L and the capacitance C. In general, the inductance L and the capacitance C are set so that the set frequency fs of the balanced-to-unbalanced transformer circuit 103P and the frequency of the radio wave to be transmitted and received by the antenna apparatus become equal to each other. In the present preferred embodiment, the set frequency fs (or resonance frequency) of the balanced-to-unbalanced transformer circuit 103P and the frequency of the radio wave to be transmitted and received are set different from each other.

Figure 30A:
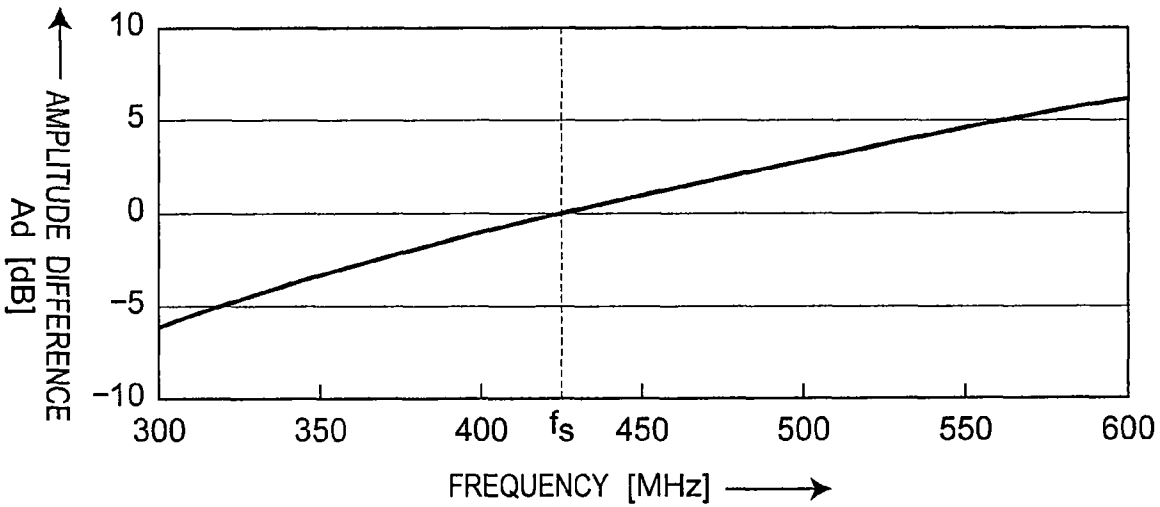
FIG. 30(*a*) is a graph showing a frequency characteristic of an amplitude difference Ad between a wireless signal that flows through a balanced terminal T2 and a wireless signal that flows through a balanced terminal T3 in the balanced-to-unbalanced transformer circuit 103P of FIG. 29.
Figure 30B:
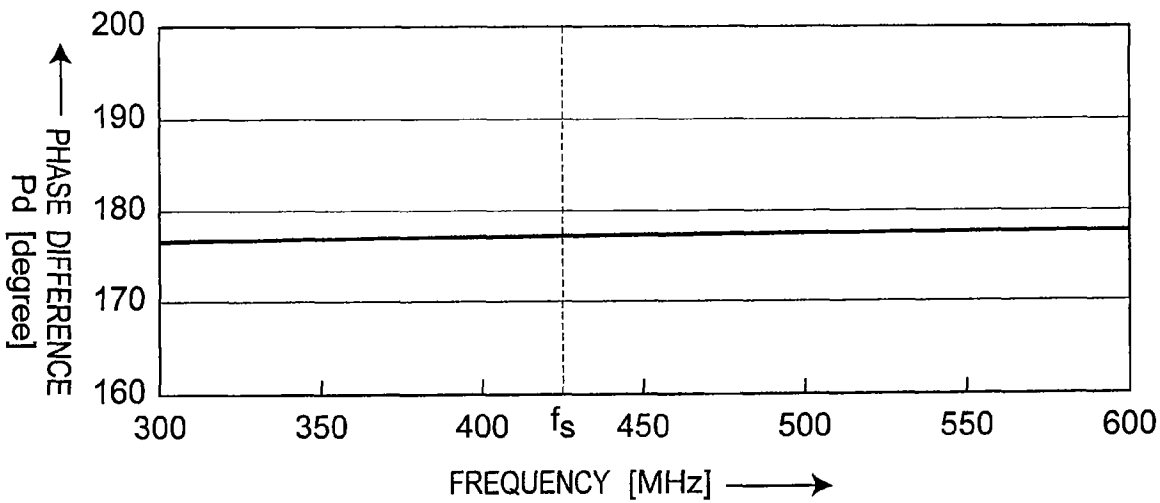

FIG. 30(*a*) is a graph showing a frequency characteristic of an amplitude difference Ad between a wireless signal that flows through the balanced terminal T2 and a wireless signal that flows through the balanced terminal T3 in the balanced-to-unbalanced transformer circuit 103P of FIG. 29. FIG. 30(*b*) is a graph showing a frequency characteristic of a phase difference Pd between the wireless signal that flows through the balanced terminal T2 and the wireless signal that flows through the balanced terminal T3 in the balanced-to-unbalanced transformer circuit 103P of FIG. 29.

As apparent from FIG. 30(*a*), the amplitude difference is 0 dB when the set frequency fs is equal to the frequency of the radio wave to be transmitted and received (indicated by the dashed line in FIG. 30(*a*)), and the amplitude difference Ad increases as separated apart from the frequency of the radio wave to be transmitted and received. Moreover, it can be understood that the amplitude difference Ad [dB] between the balanced terminals T2 and T3 becomes positive (the current amplitude of the connecting conductor 105*f* that is the loop return portion is larger than the current amplitude of the connecting conductor 105*d*, 105*e*) at the frequency of the radio wave to be transmitted and received if the set frequency fs is made lower than the frequency of the radio wave to be transmitted and received by adjusting the inductance L and the capacitance C, and the amplitude difference Ad [dB] between the balanced terminals T2 and T3 becomes negative (the current amplitude of the connecting conductor 105*f* that is the loop return portion is smaller than the current amplitude of the connecting conductor 105*d*, 105*e*) at the frequency of the radio wave to be transmitted and received if the set frequency fs is made higher than the frequency of the radio wave to be transmitted and received.

Moreover, as apparent from FIG. 30(*b*), the phase difference Pd is substantially constant at 180 degrees regardless of the highness of the set frequency fs. The balanced-to-unbalanced transformer circuit 103, of which the circuit can be configured to include an inductor and a capacitor that can be provided by chip components, is therefore allowed to have the circuit reduced in size as compared with the balanced-to-unbalanced transformer circuit provided by a general transformer.

The operation of the antenna apparatus configured as above is similar to that of the first preferred embodiment except for the operation of the balanced-to-unbalanced transformer circuit 103P. Moreover, the radio wave radiation is also similar to that of the first preferred embodiment.

Figure 31:
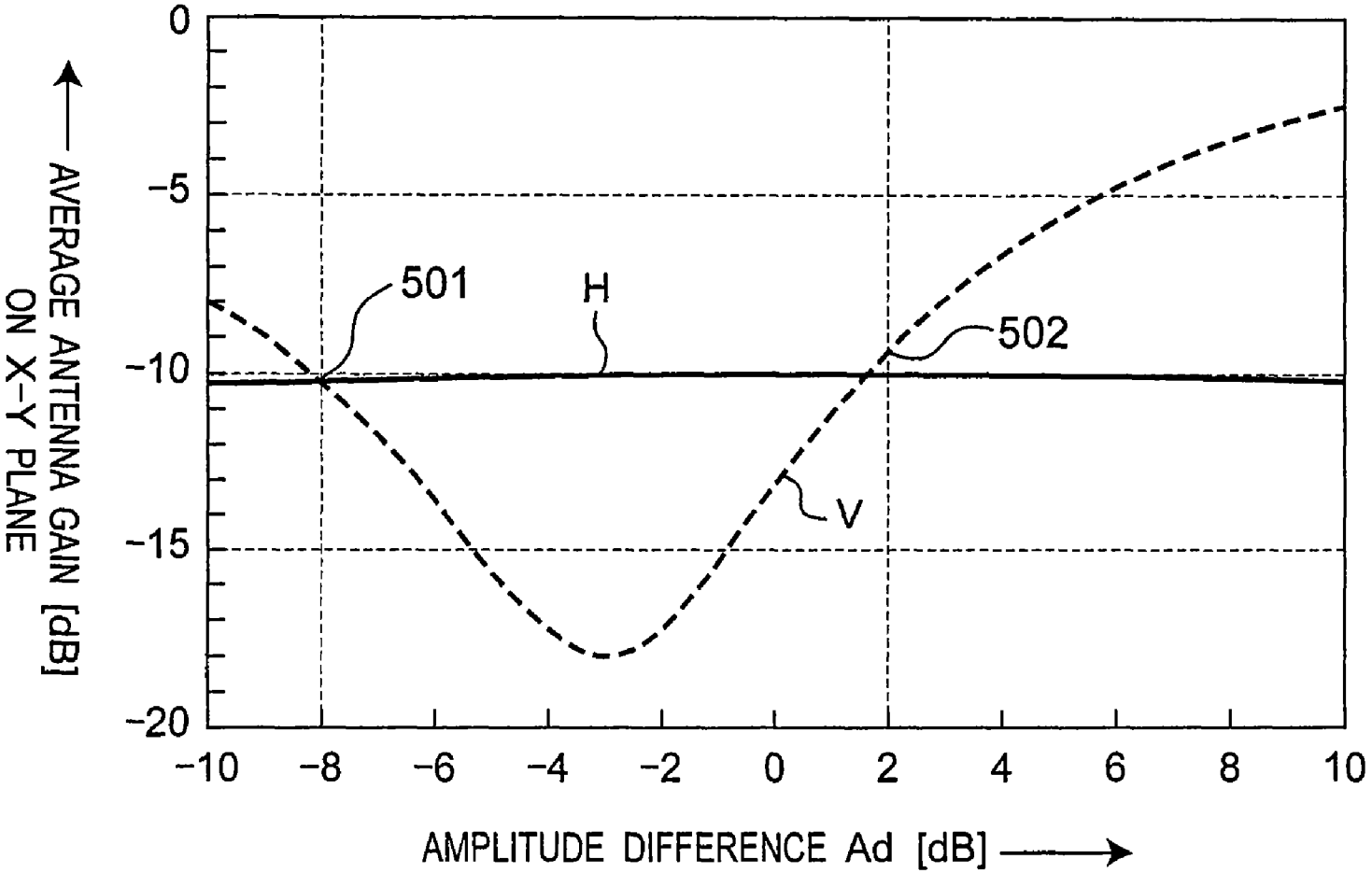
FIG. 31 is a graph showing an average antenna gain on the X-Y plane with respect to the amplitude difference Ad between two wireless signals fed to the small loop antenna element 105 of FIG. 28.

FIG. 31 is a graph showing an average antenna gain on the X-Y plane with respect to the amplitude difference Ad between two wireless signals fed to the small loop antenna element 105 of FIG. 28. The graph of FIG. 31 is a calculated value at a frequency of 426 MHz. Referring to FIG. 31, when the amplitude difference Ad [dB] on the horizontal axis is positive, the current amplitude of the connecting conductor 105*f* that is the loop return portion connected to the feeding point Q2 of the two feeding points Q1 and Q2 is larger than the current amplitude of the connecting conductor 105*d*, 105*e* connected to the feeding point Q1 as described with reference to FIG. 30. Moreover, when the amplitude difference Ad [dB] is negative, the current amplitude of the connecting conductor 105*f* that is the loop return portion connected to the feeding point Q2 is smaller than the current amplitude of the connecting conductor 105*d*, 105*e* connected to the feeding point Q1.

FIG. 32(*a*) to FIG. 33(*j*) are views showing radiation patterns of the horizontally polarized wave component on the X-Y plane when the amplitude difference Ad between the two wireless signals fed to the small loop antenna element 105 of FIG. 28 is changed from −10 dB to −1 dB. FIG. 33(*a*) to FIG. 33(*k*) are views showing radiation patterns of the horizontally polarized wave component on the X-Y plane when the amplitude difference Ad between the two wireless signals fed to the small loop antenna element 105 of FIG. 28 is changed from 0 dB to 10 dB. Further, FIG. 34(*a*) to FIG. 34(*j*) are views showing radiation patterns of the vertically polarized wave component on the X-Y plane when the amplitude difference Ad between the two wireless signals fed to the small loop antenna element 105 of FIG. 28 is changed from −10 dB to −1 dB. Furthermore, FIG. 35(*a*) to FIG. 35(*k*) are views showing radiation patterns of the vertically polarized wave component on the X-Y plane when the amplitude difference Ad between the two wireless signals fed to the small loop antenna element 105 of FIG. 28 is changed from 0 dB to 10 dB.

As apparent from the reference numerals 501 and 502 of FIG. 31, it can be understood that the average gains of the vertically polarized wave component and the horizontally polarized wave component become substantially identical when the amplitude difference Ad becomes −8 dB or 2 dB. Moreover, as apparent from FIG. 32(*a*) to FIG. 32(*j*) and FIG. 33(*a*) to FIG. 33(*k*), it can be understood that the horizontally polarized wave component is omni-directional independently of the amplitude difference Ad, and the antenna gain scarcely changes. Moreover, as apparent from FIG. 34(*a*) to FIG. 34(*j*), the vertically polarized wave component has its directivity changed largely depending on the amplitude difference and becomes omni-directional when the amplitude difference Ad ranges from −10 dB to −1 dB. Further, as apparent from FIG. 35(*a*) to FIG. 35(*k*), only the gain changes with the omni-directivity kept when the amplitude difference ranges from 0 dB to 10 dB.

Taking the above-mentioned FIG. 32 to FIG. 35 into consideration, it can be understood that an antenna apparatus which obtains the antenna gain of a substantially constant composite component can be provided regardless of the distance D between the antenna apparatus and the conductor plate 106 when the amplitude difference Ad is 2 dB. In other words, by increasing the current amplitude of the connecting conductor 105*f* of the loop return portion connected to the feeding point Q2 of the two feeding points Q1 and Q2 of the small loop antenna element 105 to adjust the values of the inductance L and the capacitance C so that the amplitude difference Ad between the signals fed to the two feeding points Q1 and Q2 of the small loop antenna element 105 comes to have a predetermined value and to set the set frequency fs, the antenna gains of the vertically polarized wave component and the horizontally polarized wave component can be set substantially identical with omni-directivity.

As described above, by setting the set frequency of the balanced-to-unbalanced transformer circuit 103P to a value apart from the frequency of the radio wave to be transmitted and received by the antenna apparatus, the amplitude difference Ad between the two wireless signals outputted from the balanced-to-unbalanced transformer circuit 103 can be set so that the antenna gains of the vertically polarized wave component and the horizontally polarized wave component become substantially identical, and the antenna gain of the composite component can be made substantially constant regardless of the distance D between the antenna apparatus and the conductor plate 106. In particular, by setting the set frequency of the balanced-to-unbalanced transformer circuit 103P to the predetermined value to set the amplitude difference Ad between the two wireless signals fed to the loop antenna element 105 for the setting that the antenna gains of the vertically polarized wave component and the horizontally polarized wave component become substantially identical, an antenna apparatus that obtains the antenna gain of the substantially constant composite component regardless of the distance D between the antenna apparatus and the conductor plate 106 can be provided.

Tenth Preferred Embodiment

Figure 36:
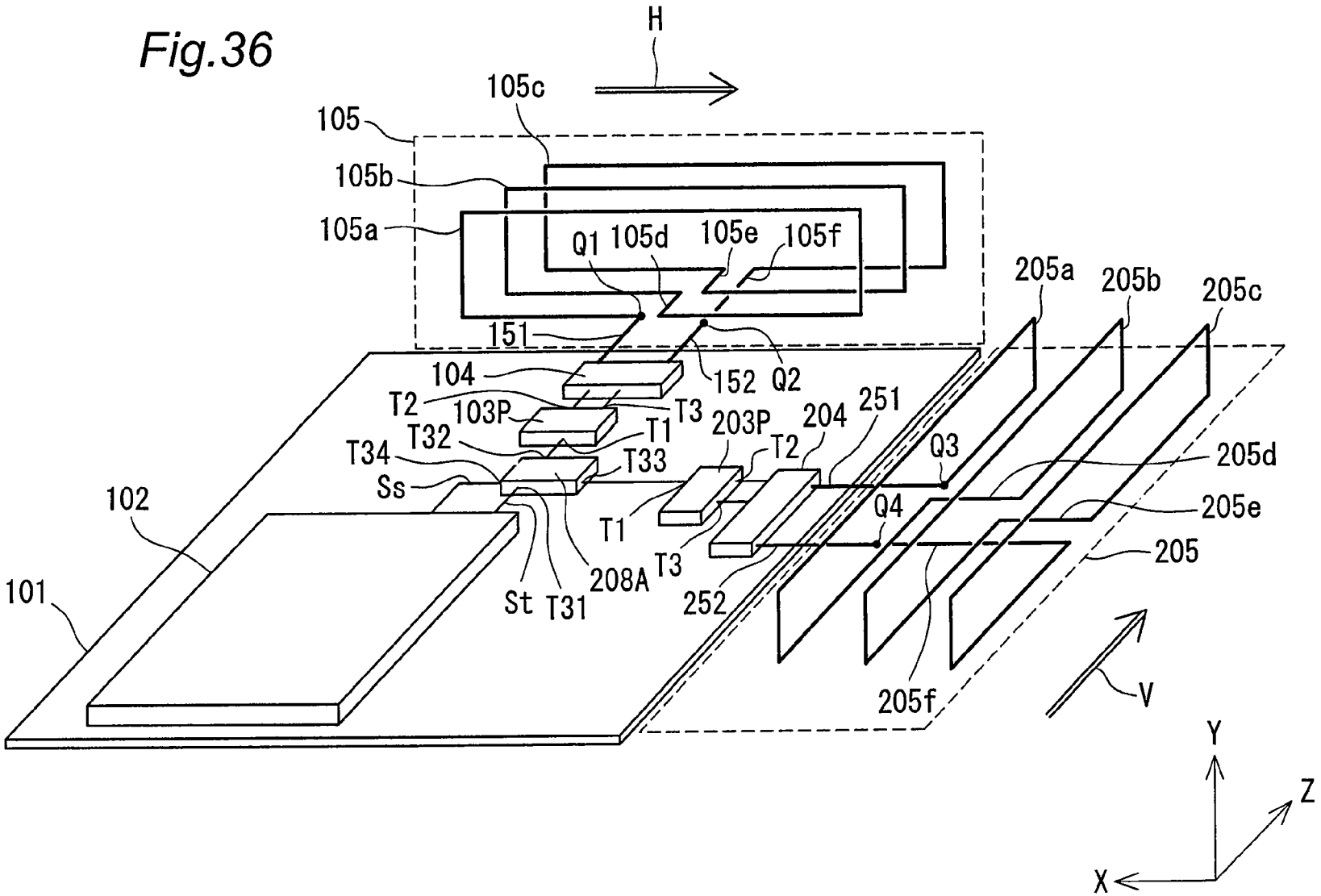
FIG. 36 is a perspective view showing a configuration of an antenna apparatus having small loop antenna elements 105 and 205 according to a tenth preferred embodiment of the invention.

FIG. 36 is a perspective view showing a configuration of an antenna apparatus having small loop antenna elements 105 and 205 according to the tenth preferred embodiment of the invention. The antenna apparatus of the tenth preferred embodiment differs from the antenna apparatus of the second preferred embodiment of FIG. 10 in the following point.

(1) Balanced-to-unbalanced transformer circuits 103P and 203P (the balanced-to-unbalanced transformer circuit 203P has a configuration similar to that of the balanced-to-unbalanced transformer circuit 103P) are provided in place of the feeder circuits 103 and 203, respectively.

Figure 37A:
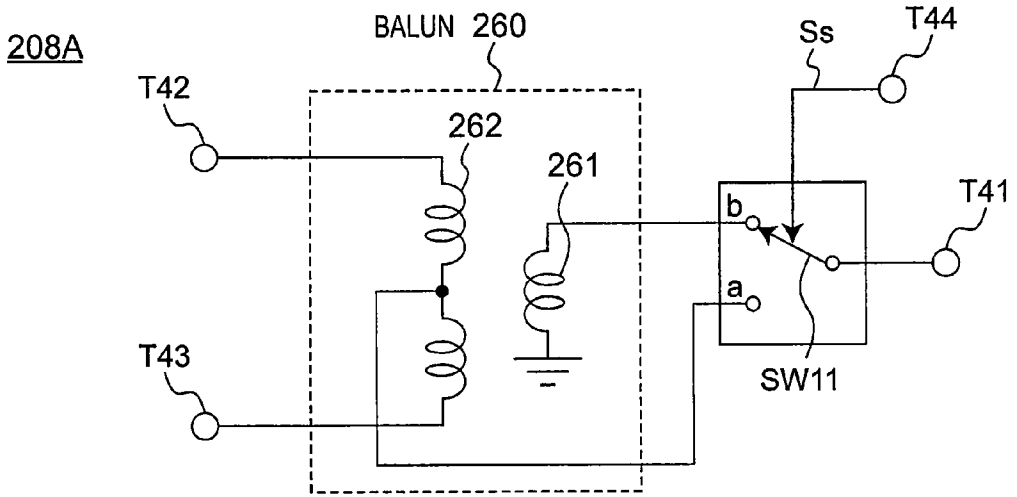
FIG. 37(*a*) is a circuit diagram showing a configuration of a polarization switchover circuit 208A according to a modified preferred embodiment of FIG. 36.
Figure 37B:
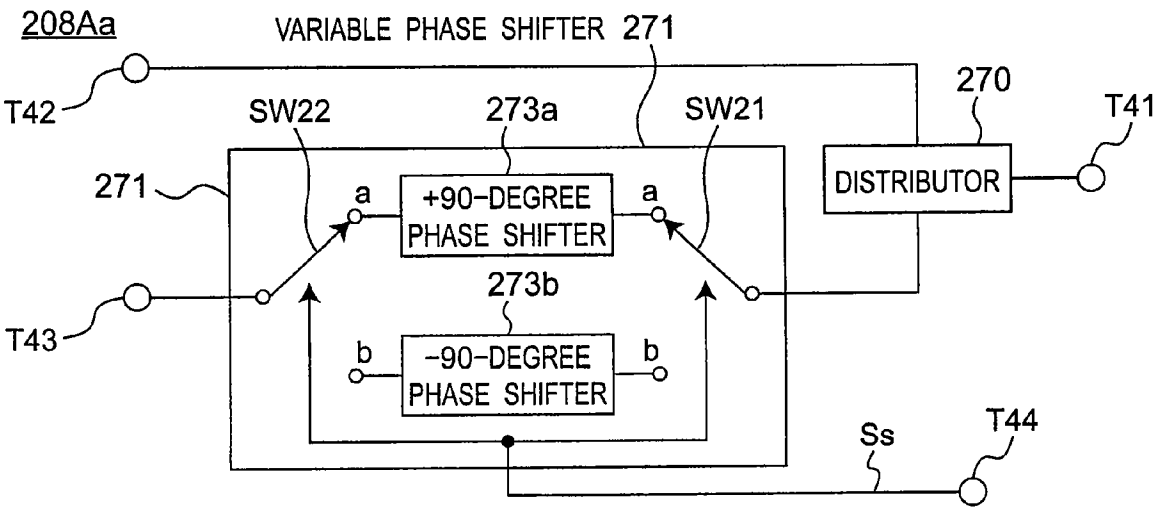

It is acceptable to provide a polarization switchover circuit 208A as shown in FIG. 37(*a*) and FIG. 37(*b*) in place of the switch 208.

FIG. 37(*a*) is a circuit diagram showing a configuration of the polarization switchover circuit 208A according to a modified preferred embodiment of FIG. 36. Referring to FIG. 37(*a*), the polarization switchover circuit 208A is configured to include a switch SW11 for selective switchover to a contact point "a" side or a contact point "b" side on the basis of the switchover control signal Ss inputted via a control signal terminal T44, and a balun 260 that has a primary side coil 261 and a secondary side coil 262. The terminal T41 is connected to one end of the primary side coil 261 of the balun 260 via the contact point "b" side of the switch SW11, and the other end is grounded and connected to a middle point of the secondary side coil 262 of the balun 260 via the contact point "a" side of the switch SW11. Both the ends are connected to respective terminals T42 and T43. The polarization switchover circuit 208A configured as above outputs in phase a wireless signal inputted via the terminal T41 to the terminals T42 and T43 when the switch SW11 is switched to the contact point "a" side or outputs in anti-phase the wireless signal inputted via the terminal T41 to the terminals T42 and T43 when the switch SW11 is switched to the contact point "b" side. That is, the in-phase feed and the anti-phase feed can be selectively switched over by switchover of the switch SW11.

FIG. 37(*b*) is a circuit diagram showing a configuration of a polarization switchover circuit 208Aa that is a modified preferred embodiment of the polarization switchover circuit 208A. Referring to FIG. 37(*b*), a wireless signal inputted via the terminal T41 is distributed into two wireless signals by a distributor 270, and thereafter, one of the wireless signals is outputted to the terminal T42 and outputted to a switch SW21. The switches SW21 and SW22 are switched over to the contact point "a" side or the contact point "b" side on the basis of the switchover control signal Ss inputted via the terminal T44. In the former case, the wireless signal from the distributor 270 is outputted to the terminal T43 via the contact point "a" side of the switch SW21, a +90-degree phase shifter 273*a* and the contact point "a" side of the switch SW22. In the latter case, the wireless signal from the distributor 270 is outputted to the terminal T43 via the contact point "b" side of the switch SW21, a −90-degree phase shifter 273*b* and the contact point "b" side of the switch SW22. The +90-degree phase difference feed and the −90-degree phase difference feed can be selectively switched over by switchover of the switches SW21 and SW22.

Figure 38:
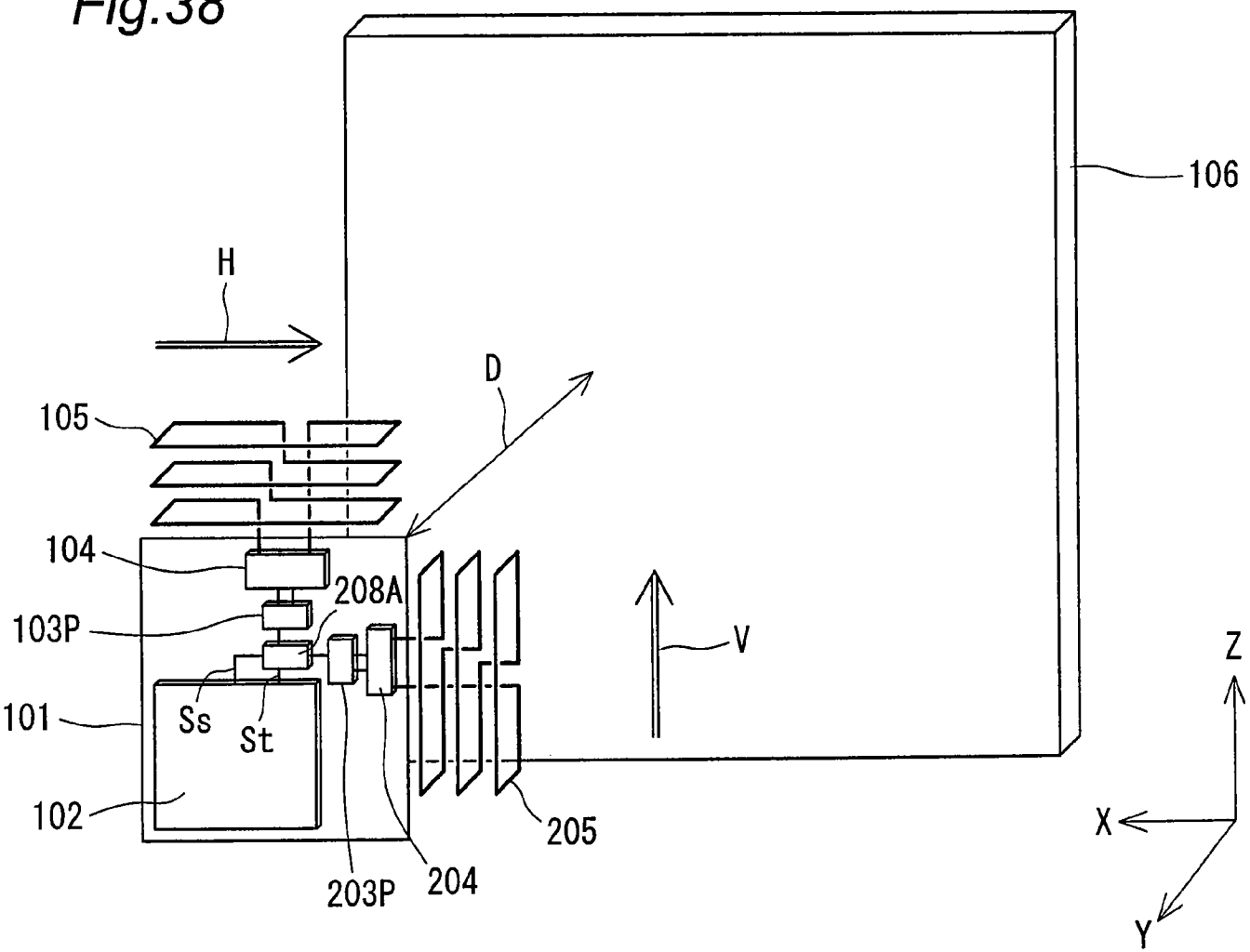
FIG. 38 is a perspective view when the antenna apparatus of FIG. 36 is adjacent to the conductor plate 106, showing a positional relation and the distance D between both of them.

FIG. 38 is a perspective view when the antenna apparatus of FIG. 36 is adjacent to the conductor plate 106, showing a positional relation and the distance D between both of them. The antenna apparatus of the present preferred embodiment operates in a manner similar to that of the second preferred embodiment except for the operation of the polarization switchover circuit 208A.

Figure 39A:
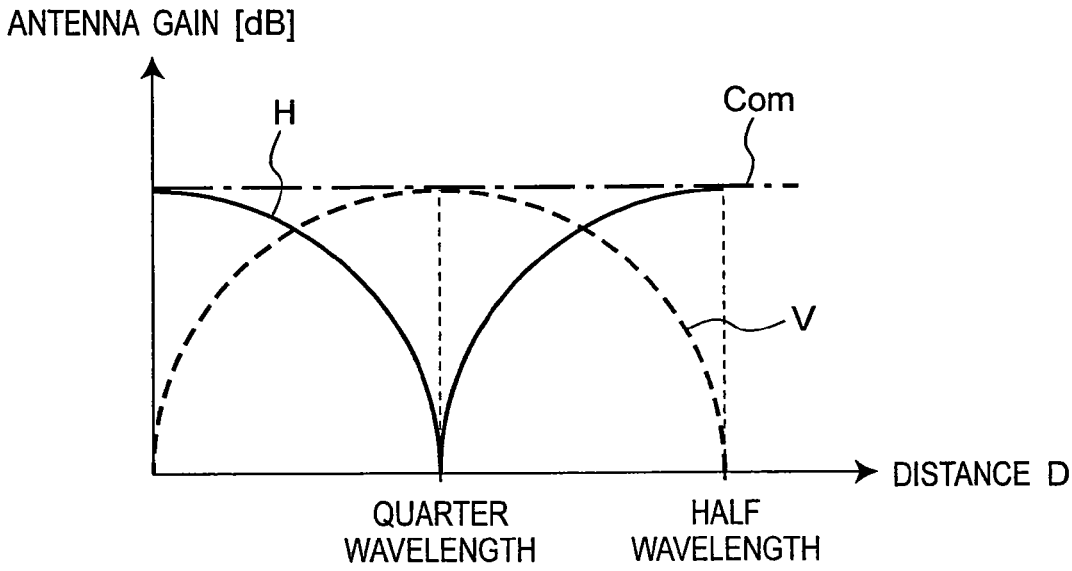
FIG. 39 (*a*) is a graph showing a composite antenna gain in the direction opposite to the direction from the antenna apparatus toward the conductor plate 106 with respect to the distance D when the maximum value of the antenna gain of the vertically polarized wave component is substantially equal to the maximum value of the antenna gain of the horizontally polarized wave component when a wireless signal is fed to the small loop antenna element 105 of FIG. 36.
Figure 39B:
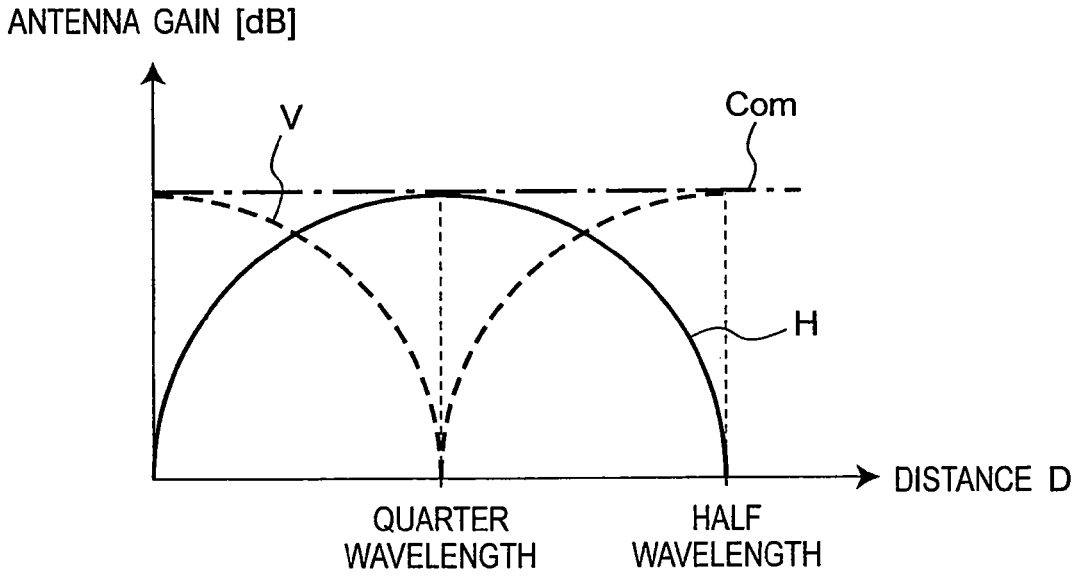

FIG. 39 (*a*) is a graph showing a composite antenna gain in the direction opposite to the direction from the antenna apparatus toward the conductor plate 106 with respect to the distance D when the maximum value of the antenna gain of the vertically polarized wave component is substantially equal to the maximum value of the antenna gain of the horizontally polarized wave component when a wireless signal is fed to the small loop antenna element 105 of FIG. 36. FIG. 39(*b*) is a graph showing a composite antenna gain in the direction opposite to the direction from the antenna apparatus toward the conductor plate 106 with respect to the distance D when the maximum value of the antenna gain of the vertically polarized wave component is substantially equal to the maximum value of the antenna gain of the horizontally polarized wave component when a wireless signal is fed to the small loop antenna element 205 of FIG. 36.

When the set frequency of the balanced-to-unbalanced transformer circuit 103P is set to a predetermined value to set the amplitude difference Ad between the two wireless signals fed to the small loop antenna element 105 and to set the antenna gains of the vertically polarized wave component and the horizontally polarized wave component substantially identical in a manner similar to that of the ninth preferred embodiment, the antenna gain of a substantially constant composite component is obtained regardless of the distance D between the antenna apparatus and the conductor plate 106 in feeding the small loop antenna element 105 as shown in FIG. 39(*a*). In a manner similar to above, when the set frequency of the balanced-to-unbalanced transformer circuit 203P is set to the predetermined value to set the amplitude difference Ad between the two wireless signals fed to the loop antenna element 205 and to set the antenna gains of the vertically polarized wave component and the horizontally polarized wave component substantially identical, the antenna gain of a substantially constant composite component is obtained regardless of the distance D between the antenna apparatus and the conductor plate 106 in feeding the small loop antenna element 205 as shown in FIG. 39(*b*).

Moreover, regardless of the distance D between the antenna apparatus and the conductor plate 106, the polarized wave component radiated from the antenna apparatus in feeding the small loop antenna element 105 and the polarized wave component radiated from the antenna apparatus in feeding the small loop antenna element 205 are in an orthogonal relation. Since the shape of the grounding conductor plate 101 is substantially square and the dimensions of the small loop antenna elements 105 and 205 are substantially same, the antenna gain does not change in feeding the small loop antenna element 105 and in feeding the small loop antenna element 205, and only the polarization changes by 90 degrees, therefore causing no gain variation due to the switchover of feed.

As described above, by providing the small loop antenna element 205 having a configuration similar to that of the small loop antenna element 105 in the direction orthogonal to the small loop antenna element 105 on the X-Z plane, the gain variation due to a polarization plane discordance caused by variation in the communication posture can be suppressed by changing the polarization plane by 90 degrees by switchover of the feed to the small loop antenna elements 105 and 205 by the polarization switchover switch 208A even when one polarized wave of both the vertically and horizontally polarized waves is largely attenuated in a manner similar to that of such a case that the distance D between the antenna apparatus and the conductor plate 106 is sufficiently shorter with respect to the wavelength or a multiple of the quarter wavelength.

Eleventh Preferred Embodiment

Figure 40:
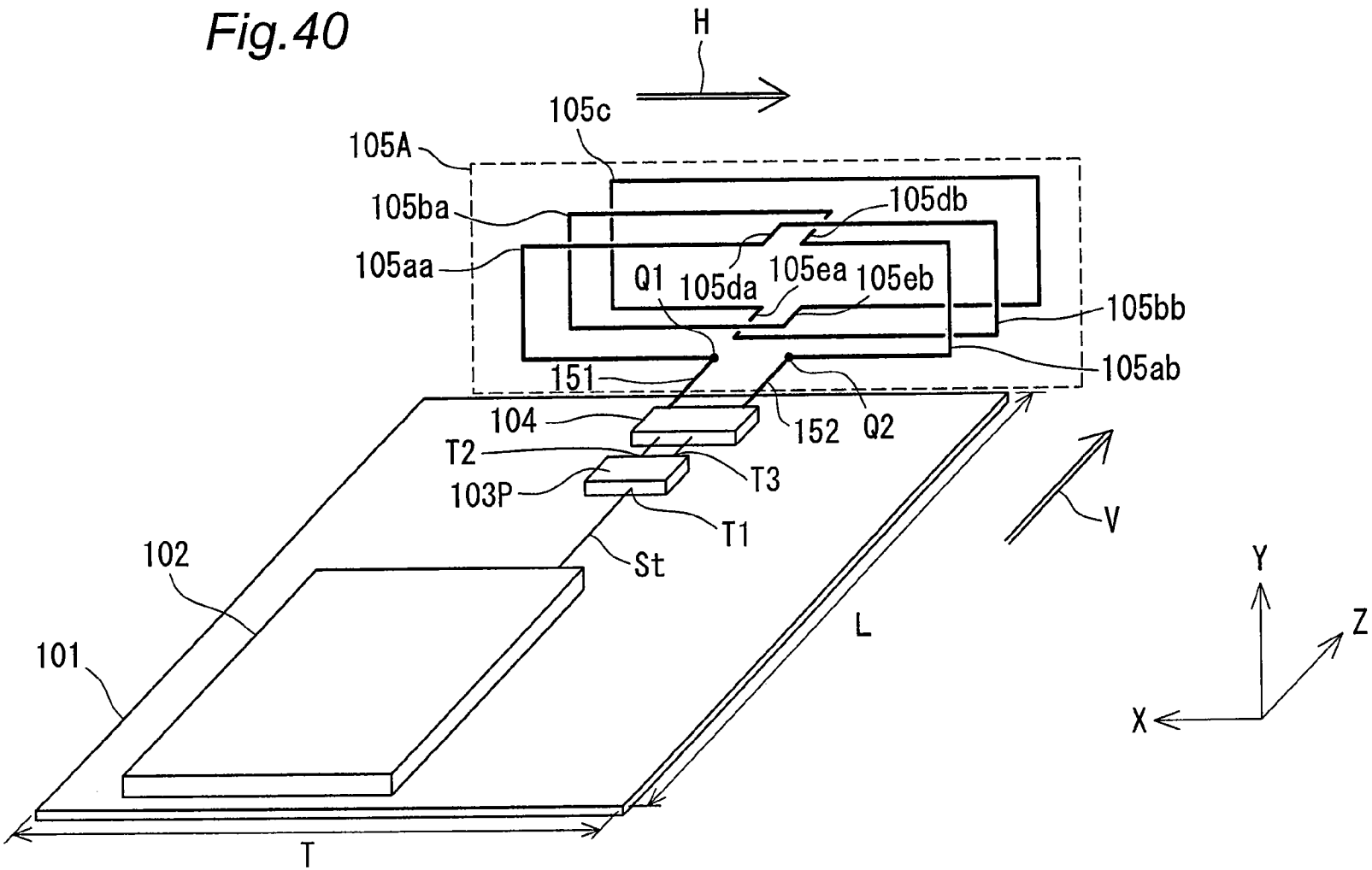
FIG. 40 is a perspective view showing a configuration of an antenna apparatus having a small loop antenna element 105A according to an eleventh preferred embodiment of the invention.

FIG. 40 is a perspective view showing a configuration of an antenna apparatus having a small loop antenna element 105A according to the eleventh preferred embodiment of the invention. The antenna apparatus of the eleventh preferred embodiment differs from the antenna apparatus of the ninth preferred embodiment of FIG. 28 in the following point.

(1) The small loop antenna element 105A is provided in place of the small loop antenna element 105.

The point of difference is described below.

Referring to FIG. 40, the small loop antenna element 105A is configured to include the following:

(a) a half-loop antenna portion 105*aa*, which is the left half of a loop antenna portion 105*a* of one turn having a loop plane in the X-axis direction and a rectangular shape;

(b) a half-loop antenna portion 105*ab*, which is the right half of the loop antenna portion 105*a* of one turn;

(c) a half-loop antenna portion 105*ba*, which is the left half of a loop antenna portion 105*b* of one turn having a loop plane in the X-axis direction and a rectangular shape;

(d) a half-loop antenna portion 105*bb*, which is the right half of the loop antenna portion 105*b* of one turn;

(e) a loop antenna portion 105*c*, which has one turn and a loop plane in the X-axis direction and a rectangular shape;

(f) a connecting conductor 105*da*, which is provided substantially parallel to the Z-axis and connects the half-loop antenna portion 105*aa* with the half-loop antenna portion 105*bb;*

(g) a connecting conductor 105*db*, which is provided substantially parallel to the Z-axis and connects the half-loop antenna portion 105*ab* with the half-loop antenna portion 105*ba;*

(h) a connecting conductor 105*ea*, which is provided substantially parallel to the Z axis and connects the half-loop antenna portion 105*bb* with the loop antenna portion 105*c*; and (i) a connecting conductor 105*eb*, which is provided substantially parallel to the Z-axis and connects the half-loop antenna portion 105*ba* with the loop antenna portion 105*c*.

One end of the half-loop antenna portion 105*aa* is used as the feeding point Q1, and the feeding point Q1 is connected to an impedance matching circuit 104 via a feed conductor 151. Moreover, one end of the half-loop antenna portion 105*ab* is used as the feeding point Q2, and the feeding point Q2 is connected to the impedance matching circuit 104 via a feed conductor 152.

Figure 41:
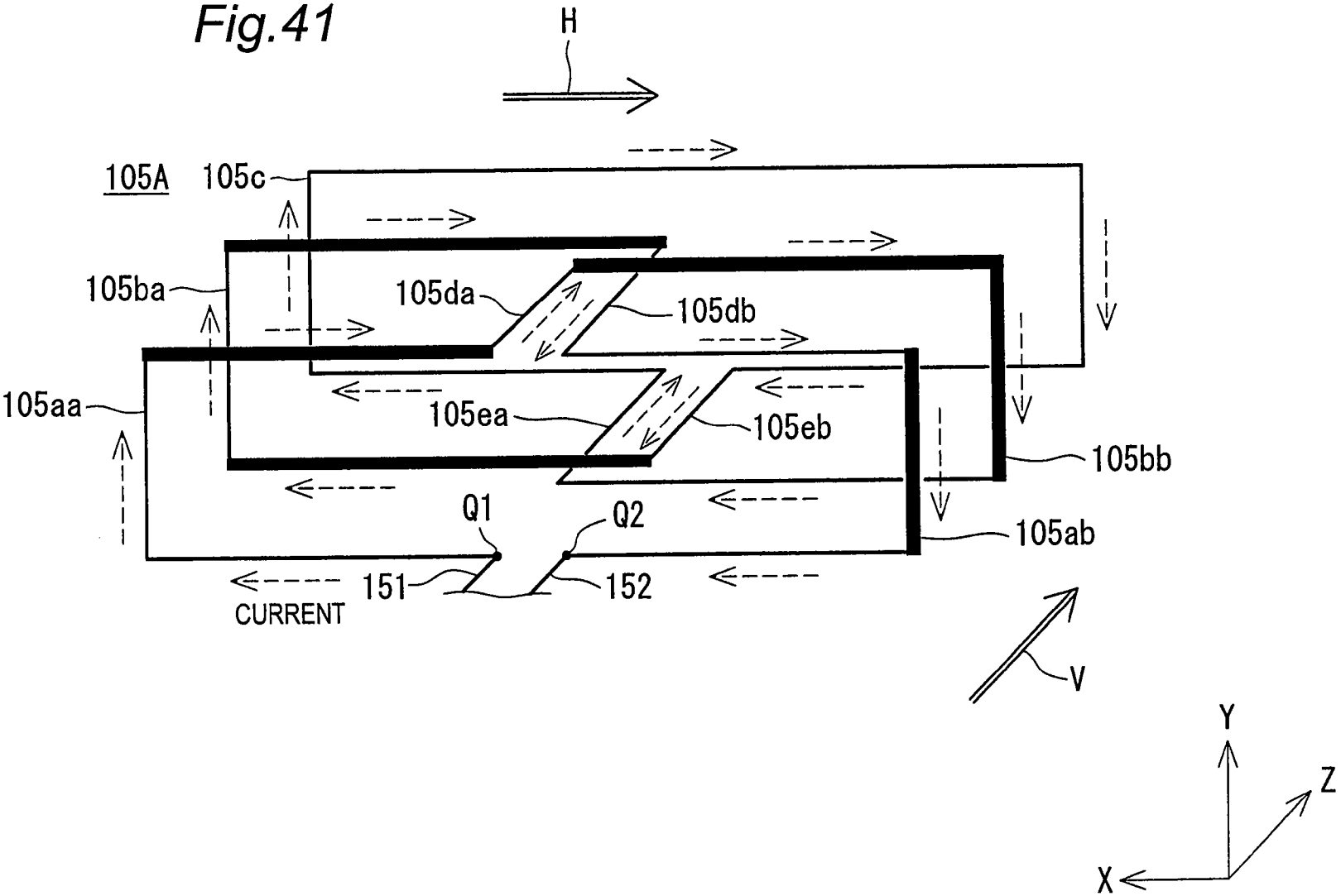
FIG. 41 is a perspective view showing a direction of a current in the small loop antenna element 105A of FIG. 40.

Next, a current flow in the small loop antenna element 105A is described below. FIG. 41 is a perspective view showing a direction of a current in the small loop antenna element 105A of FIG. 40. As apparent from FIG. 41, mutually identical currents flow through the half-loop antenna portions 105*aa* and 105*ba* and the left half of the loop antenna portion 105*c*, and mutually identical currents flow through the half-loop antenna portions 105*ab* and 105*bb* and the right half of the loop antenna portion 105*c*. Moreover, two half-loop antenna portions are connected to one pair of the connecting conductors 105*da* and 105*db* so as to be intersected on each other in positions substantially at an equal distance from the two feeding points Q1 and Q2, and therefore, mutually anti-phase currents flow. Further, two half-loop antenna portions are connected to one pair of the connecting conductors 105*ea* and 105*eb* so as to be intersected on each other in positions substantially at an equal distance from the two feeding points Q1 and Q2, and therefore, mutually anti-phase currents flow.

Therefore, the radiation of the antenna apparatus of the present preferred embodiment is configured to include:

(a) radiation of horizontally polarized wave components from the half-loop antenna portions 105*aa*, 105*ab*, 105*ba*, 105*bb* and 105*c* provided parallel to the X axis; and (b) radiation of vertically polarized wave components from the connecting conductors 105*da*, 105*db*, 105*ea* and 105*eb* provided parallel to the Z-axis.

Figure 42:
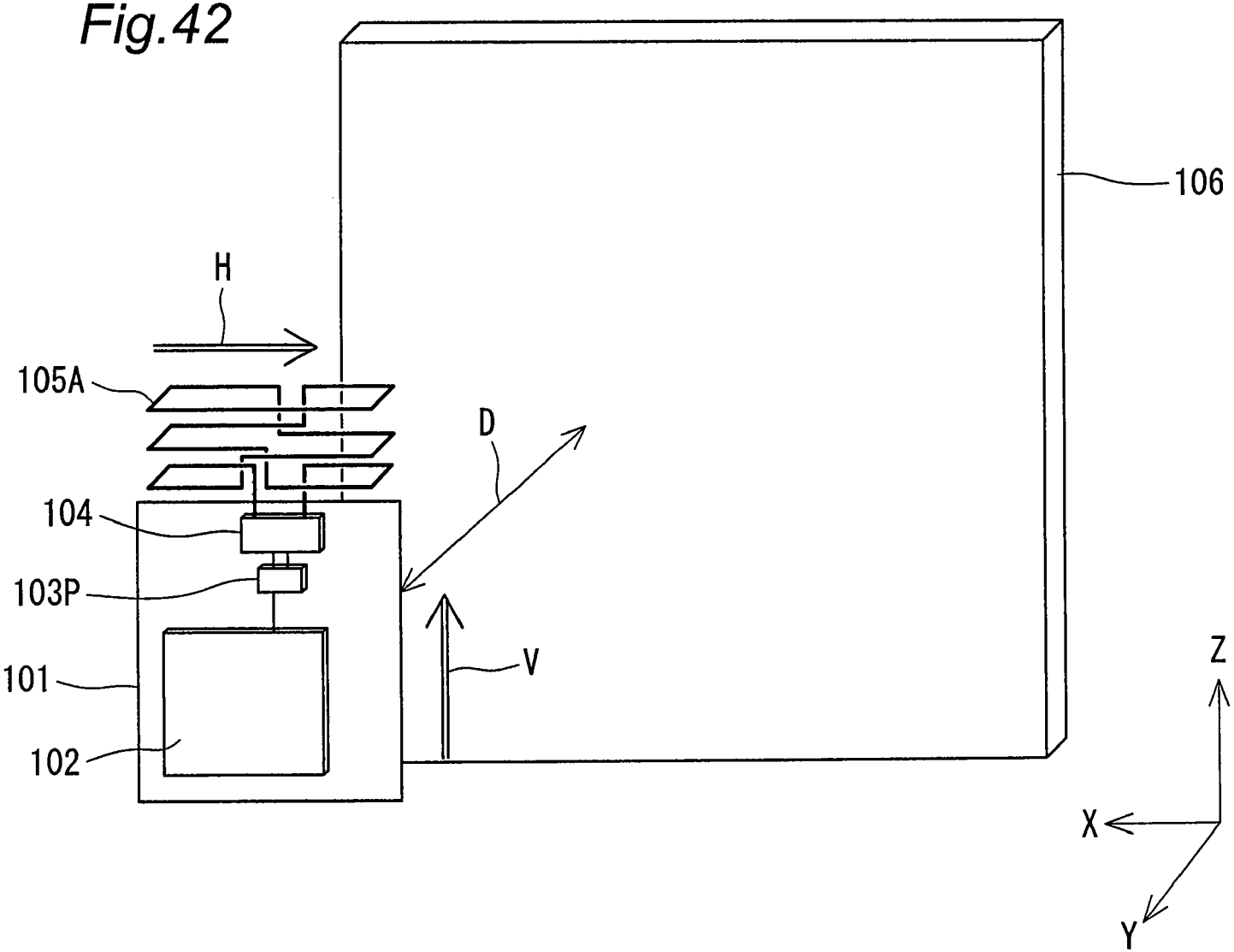
FIG. 42 is a perspective view when the antenna apparatus of FIG. 40 is adjacent to the conductor plate 106, showing a positional relation and the distance D between both of them.

FIG. 42 is a perspective view when the antenna apparatus of FIG. 40 is adjacent to the conductor plate 106, showing a positional relation and the distance D between both of them. Referring to FIG. 42, radio wave radiation from the antenna apparatus contains the radiation of the horizontally polarized wave component parallel to the X axis and the vertically polarized wave component parallel to the Z axis from the small loop antenna element 105A as described above. In the present preferred embodiment, with regard to the radiation of the vertically polarized wave component, the antenna gain of the vertically polarized wave component is largely decreased and minimized when the distance D between the antenna apparatus and the conductor plate 106 is sufficiently shorter with respect to the wavelength in a manner similar to that of FIG. 6(*b*). When the distance D between the antenna apparatus and the conductor plate 106 is an odd number multiple of the quarter wavelength, the antenna gain of the vertically polarized wave component is maximized. When the distance D between the antenna apparatus and the conductor plate 106 is an even number multiple of the quarter wavelength, the antenna gain of the vertically polarized wave component is largely decreased and minimized. Moreover, with regard to the radiation of the horizontally polarized wave component, the antenna gain of the horizontally polarized wave component is maximized when the distance D between the antenna apparatus and the conductor plate 106 is sufficiently shorter with respect to the wavelength in a manner similar to that of FIG. 5(*b*). When the distance D between the antenna apparatus and the conductor plate 106 is an odd number multiple of the quarter wavelength, the antenna gain of the horizontally polarized wave component is largely decreased and maximized. When the distance D between the antenna apparatus and the conductor plate 106 is an even number multiple of the quarter wavelength, the antenna gain of the horizontally polarized wave component is maximized. Therefore, operation is performed in the case where the antenna apparatus is located adjacent to the conductor plate 106 in a manner that the antenna gain of the vertically polarized wave component increases when the antenna gain of the horizontally polarized wave component decreases, and the antenna gain of the horizontally polarized wave component increases when the antenna gain of the vertically polarized wave component decreases.

Figure 43A:
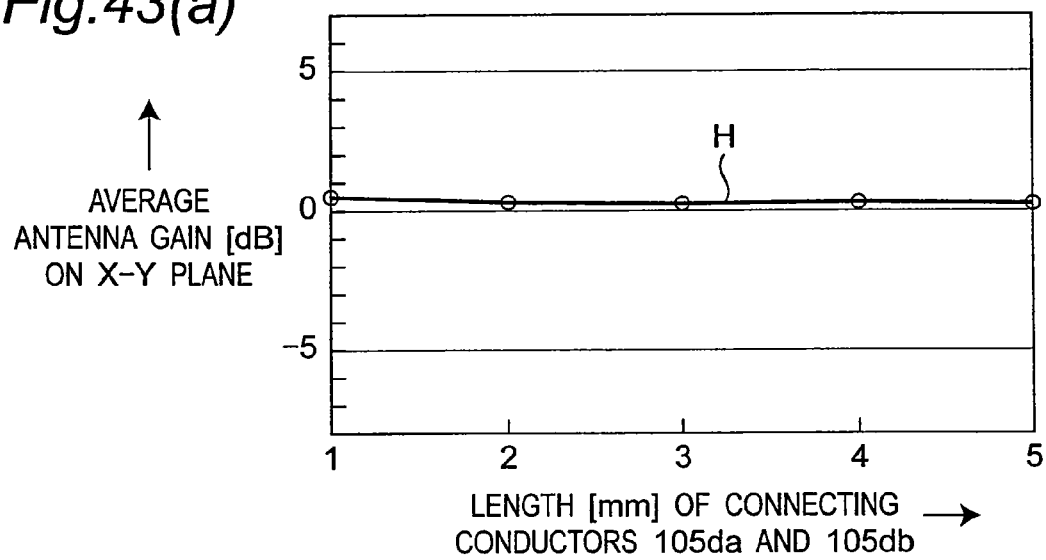
FIG. 43(*a*) is a graph showing an average antenna gain of the horizontally polarized wave component on the X-Y plane of the small loop antenna element 105A with respect to the length of the connecting conductors 105*da*, 105*db* of FIG. 40.
Figure 43B:
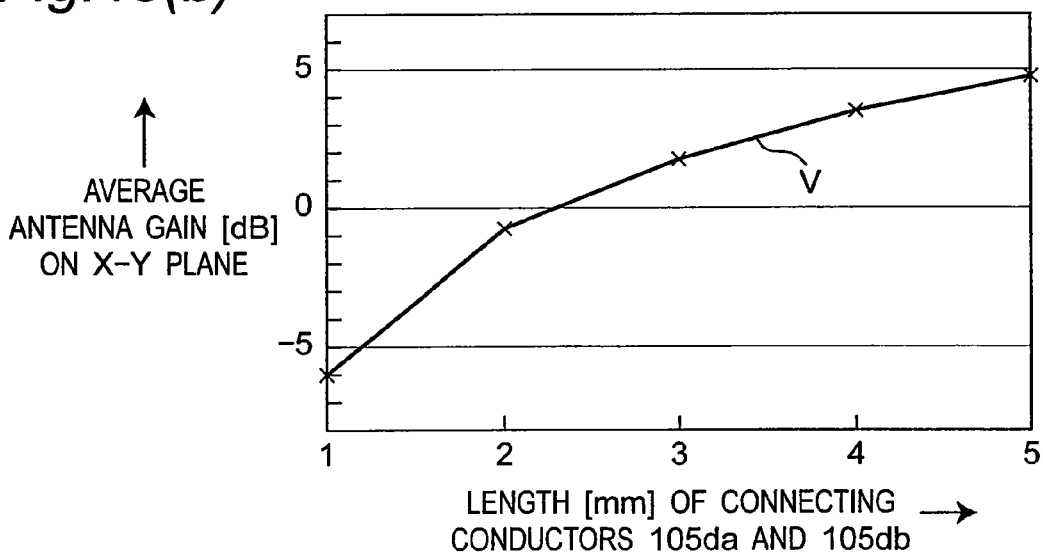
Figure 44A:
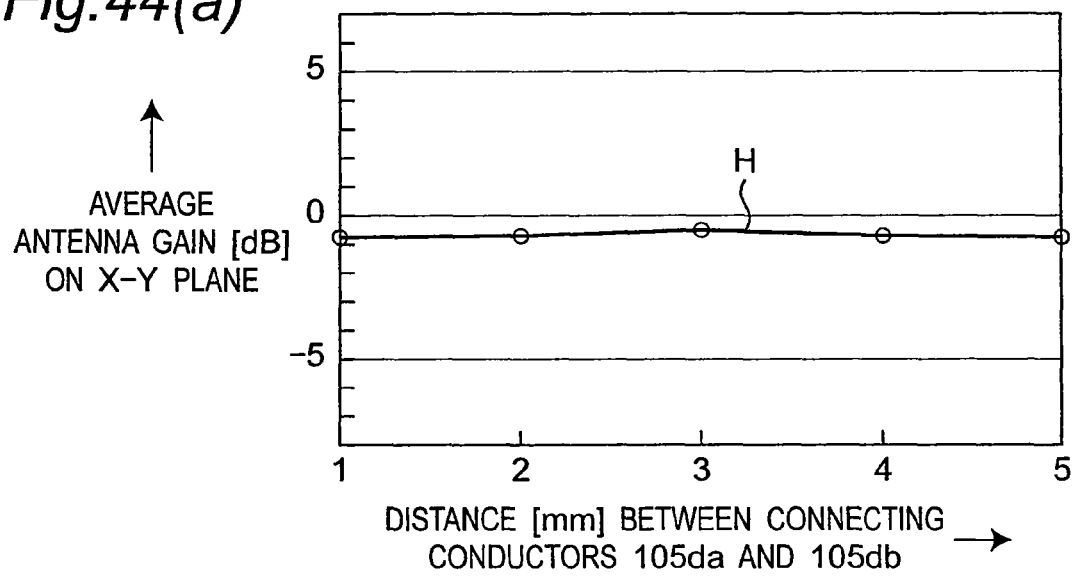
FIG. 44(*a*) is a graph showing an average antenna gain of the horizontally polarized wave component on the X-Y plane of the small loop antenna element 105A with respect to a distance between the connecting conductors 105*da* and 105*db* of FIG. 40.
Figure 44B:
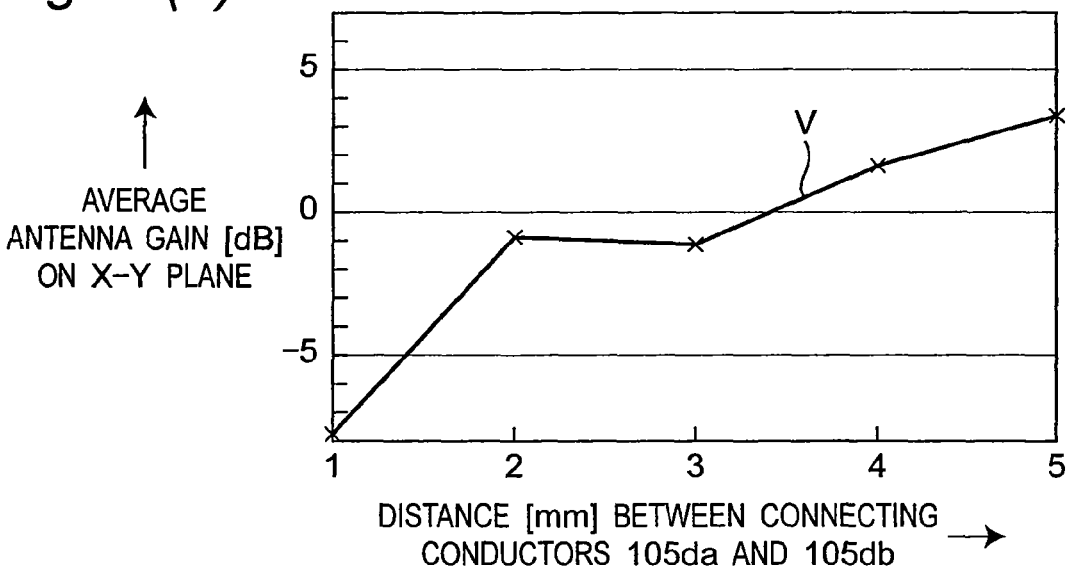

FIG. 43(*a*) is a graph showing an average antenna gain of the horizontally polarized wave component on the X-Y plane of the small loop antenna element 105A with respect to the length of the connecting conductors 105*da*, 105*db* (or 105*ea*, 105*eb*) of FIG. 40. FIG. 43(*b*) is a graph showing an average antenna gain of the vertically polarized wave component on the X-Y plane of the small loop antenna element 105A with respect to the length of the connecting conductors 105*da*, 105*db* (or 105*ea*, 105*eb*) of FIG. 40. FIG. 44(*a*) is a graph showing an average antenna gain of the horizontally polarized wave component on the X-Y plane of the small loop antenna element 105A with respect to a distance between the connecting conductors 105*da* and 105*db* (or between the connecting conductors 105*ea* and 105*eb*) of FIG. 40. FIG. 44(*b*) is a graph showing an average antenna gain of the vertically polarized wave component on the X-Y plane of the small loop antenna element 105A with respect to the distance between the connecting conductors 105*da* and 105*db* (or between the connecting conductors 105*ea* and 105*eb*) of FIG. 40. These graphs were calculated at a frequency of 426 MHz.

As apparent from FIG. 43(*a*), FIG. 43(*b*), FIG. 44(*a*) and FIG. 44(*b*), when the length of each of the connecting conductors (105*da*, 105*db*, 105*ea*, 105*eb*) or a distance between the one pair of connecting conductors (between 105*da* and 105*db* or between 105*ea* and 105*eb*) increases, a current canceling effect of radio wave radiations from the connecting conductors due to mutually anti-phase currents of the one pair of connecting conductors (between 105*da* and 105*db* or between 105*ea* and 105*eb*) is reduced, and the radio wave radiations from the connecting conductors increase. Therefore, the horizontally polarized wave component is substantially constant, whereas the vertically polarized wave component increases. That is, by setting the length of each of the connecting conductors (105*da*, 105*db*, 105*ea*, 105*eb*) and the distance between one pair of connecting conductors (between 105*da* and 105*db* or between 105*ea* and 105*eb*) to respective predetermined values, the antenna gains of the vertically polarized wave component and the horizontally polarized wave component can be set substantially identical.

As described above, by suppressing the radiation caused by a magnetic current directly flowing from the small loop antenna element 105A to the grounding conductor plate 101, the current having intense radio wave radiation and difficulties in adjustment and depending largely on the size and the shape of the grounding conductor plate 101, by the balanced-to-unbalanced transformer circuit 103P and setting the dimensions of portions of the small loop antenna element 105A to predetermined values, an antenna apparatus that obtains the antenna gain of a constant composite polarized wave component regardless of the distance D between the antenna apparatus and the conductor plate 106 can be provided. Moreover, the polarized wave components radiated from the connecting conductors 105*da*, 105*db*, 105*ea* and 105*eb* and the polarized wave components radiated from the half-loop antenna portions 105*aa*, 105*ab*, 105*ba* and 105*bb* and the loop antenna portion 105*c* are in a mutually orthogonal relation. Therefore, both the vertically and horizontally polarized wave components are provided, and the polarization diversity effect can be obtained.

Twelfth Preferred Embodiment

Figure 45:
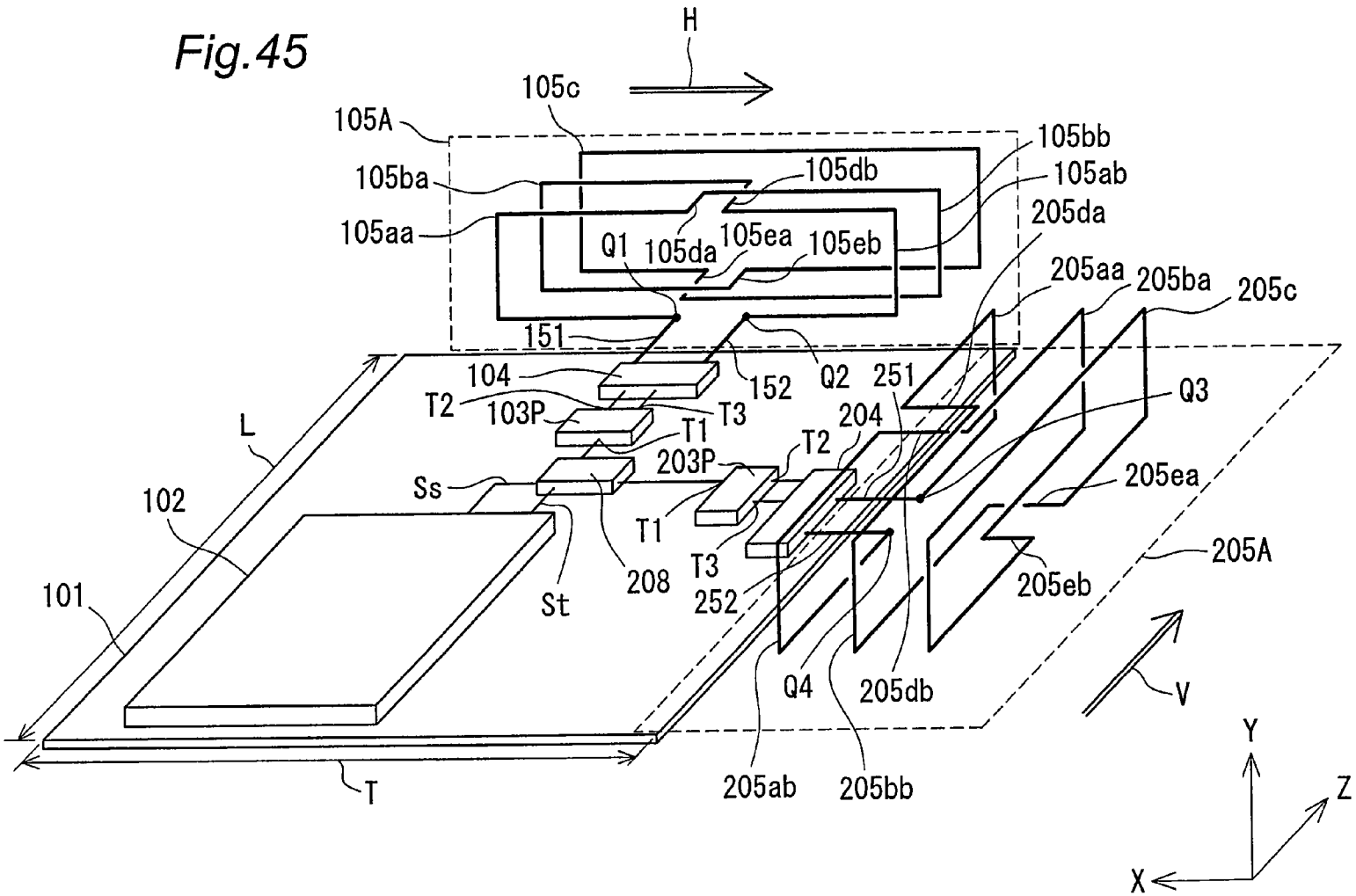
FIG. 45 is a perspective view showing a configuration of an antenna apparatus having small loop antenna elements 105A and 205A according to a twelfth preferred embodiment of the invention.

FIG. 45 is a perspective view showing a configuration of an antenna apparatus having small loop antenna elements 105A and 205A according to the twelfth preferred embodiment of the invention. The antenna apparatus of the twelfth preferred embodiment differs from the antenna apparatus of the second preferred embodiment of FIG. 10 in the following points.

(1) A small loop antenna element 105A is provided in place of the small loop antenna element 105.

(2) A small loop antenna element 205A is provided in place of the small loop antenna element 205.

(3) A balanced-to-unbalanced transformer circuit 103P is provided in place of the feeder circuit 103.

(4) A balanced-to-unbalanced transformer circuit 203P is provided in place of the feeder circuit 203.

Referring to FIG. 45, the small loop antenna element 205A is configured to include the following:

(a) a half-loop antenna portion 205*aa*, which is the left half of a loop antenna portion 205*a* of one turn having a loop plane in the Z-axis direction and a rectangular shape;

(b) a half-loop antenna portion 205*ab*, which is the right half of the loop antenna portion 205*a* of one turn;

(c) A half-loop antenna portion 205*ba*, which is the left half of a loop antenna portion 205*b* of one turn having a loop plane in the Z-axis direction and a rectangular shape;

(d) A half-loop antenna portion 205*bb*, which is the right half of the loop antenna portion 205*b* of one turn;

(e) A loop antenna portion 205*c*, which has one turn and a loop plane in the Z-axis direction and a rectangular shape;

(f) a connecting conductor 205*da*, which is provided substantially parallel to the X-axis and connects the half-loop antenna portion 205*aa* with the half-loop antenna portion 205*bb;*

(g) a connecting conductor 205*db*, which is provided substantially parallel to the X-axis and connects the half-loop antenna portion 205*ab* with the half-loop antenna portion 205*ba;*

(h) a connecting conductor 205*ea*, which is provided substantially parallel to the X axis and connects the half-loop antenna portion 205*bb* with the loop antenna portion 205*c*; and (i) a connecting conductor 205*eb*, which is provided substantially parallel to the X-axis and connects the half-loop antenna portion 205*ba* with the loop antenna portion 205*c*.

One end of the half-loop antenna portion 205*aa* is used as a feeding point Q3, and the feeding point Q3 is connected to an impedance matching circuit 204 via a feed conductor 251. Moreover, one end of the half-loop antenna portion 205*ab* is used as a feeding point Q4, and the feeding point Q4 is connected to the impedance matching circuit 204 via a feed conductor 252. In the present preferred embodiment, antenna diversity is achieved by switchover of feed to the small loop antenna element 105A and the small loop antenna element 205A provided orthogonal to each other by the switch 208.

Figure 46:
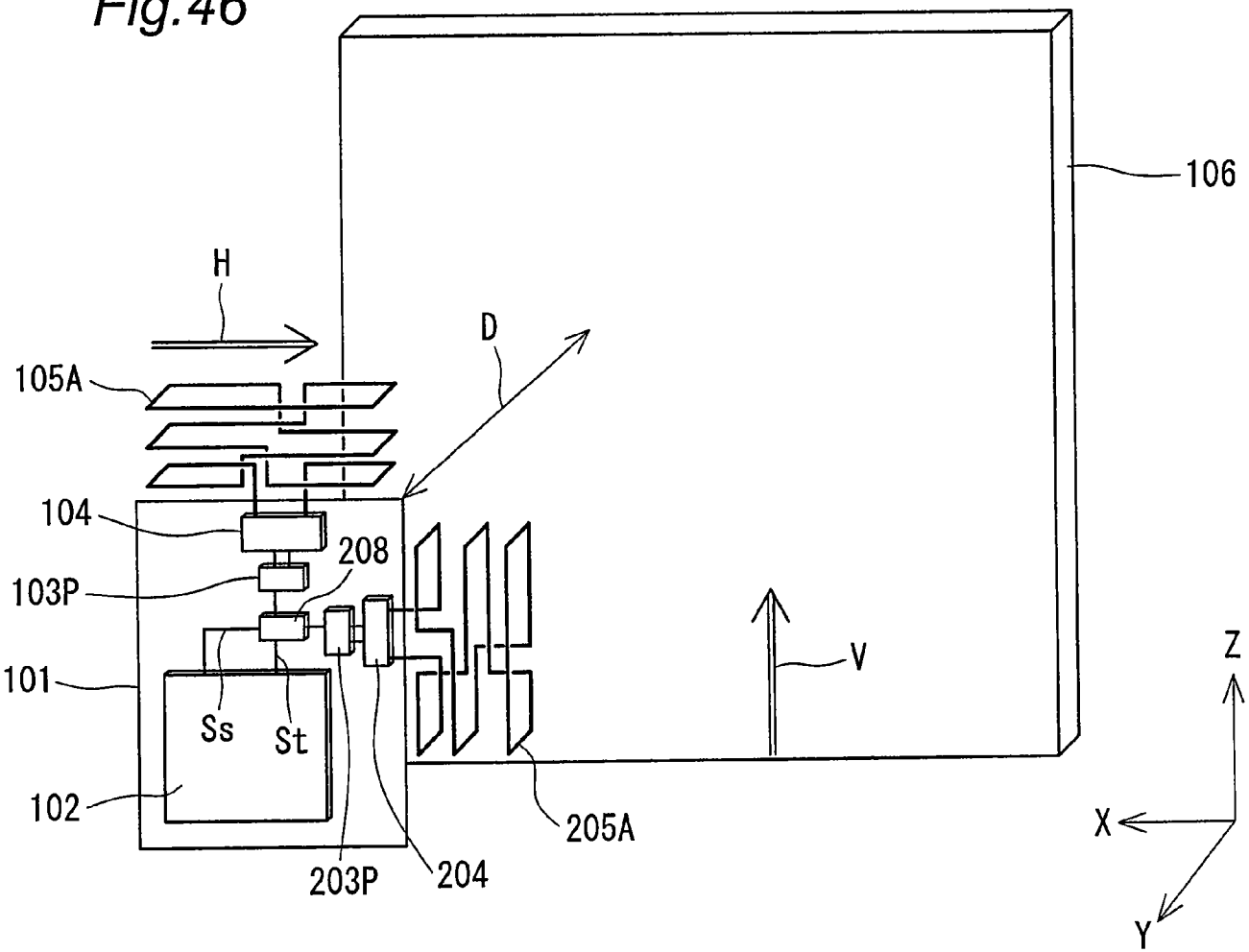
FIG. 46 is a perspective view when the antenna apparatus of FIG. 45 is adjacent to the conductor plate 106, showing a positional relation and the distance D between both of them.

FIG. 46 is a perspective view when the antenna apparatus of FIG. 45 is adjacent to the conductor plate 106, showing a positional relation and the distance D between both of them. Referring to FIG. 46, radio wave radiation in feeding the small loop antenna element 105A is similar to that of the eleventh preferred embodiment. With regard to the radio wave radiation in feeding the small loop antenna element 205A, since the small loop antenna element 205A is provided in the direction orthogonal to the small loop antenna element 105A on the X-Z plane, radio wave radiations from the connecting conductors 205*da*, 205*db*, 205*ea* and 205*eb* are achieved by horizontally polarized waves, and radio wave radiations from the half-loop antenna elements 205*aa*, 205*ab*, 205*ba*, 205*bb* and 205*c* are achieved by vertically polarized waves.

In a manner similar to that of the eleventh preferred embodiment, when the dimensions of portions of the small loop antenna element 105A are set to predetermined values and the antenna gains of the vertically polarized wave component and the horizontally polarized wave component are set substantially identical, the antenna gain of a constant composite polarized wave component is obtained regardless of the distance D between the antenna apparatus and the conductor plate 106 in feeding the small loop antenna element 105A. In a manner similar to above, when the dimensions of portions of the small loop antenna element 205A are set to predetermined values and the antenna gains of the vertically polarized wave component and the horizontally polarized wave component are set substantially identical, an antenna gain of a constant composite polarized wave component is obtained regardless of the distance D between the antenna apparatus and the conductor plate 106 in feeding the small loop antenna element 205. Moreover, regardless of the distance D between the antenna apparatus and the conductor plate 106, the polarized wave component radiated from the antenna apparatus in feeding the small loop antenna element 105A and the polarized wave component radiated from the antenna apparatus in feeding the small loop antenna element 205A are in an orthogonal relation.

As described above, according to the present preferred embodiment, the antenna gain of the constant composite polarized wave component can be obtained regardless of the distance D between the antenna apparatus and the conductor plate 106. Further, by providing the small loop antenna element 205A that has the configuration similar to that of the small loop antenna element 105A in the direction orthogonal to the small loop antenna element 105A on the X-Z plane, the polarization diversity effect can be obtained since the polarization planes of the small loop antenna element 105A and the small loop antenna element 205A are in the orthogonal relation even when one polarized wave of both the vertically and horizontally polarized waves is largely attenuated in a manner similar to that of such a case that the distance D between the antenna apparatus and the conductor plate 106 is sufficiently shorter with respect to the wavelength or a multiple of the quarter wavelength.

Thirteenth Preferred Embodiment

Figure 47:
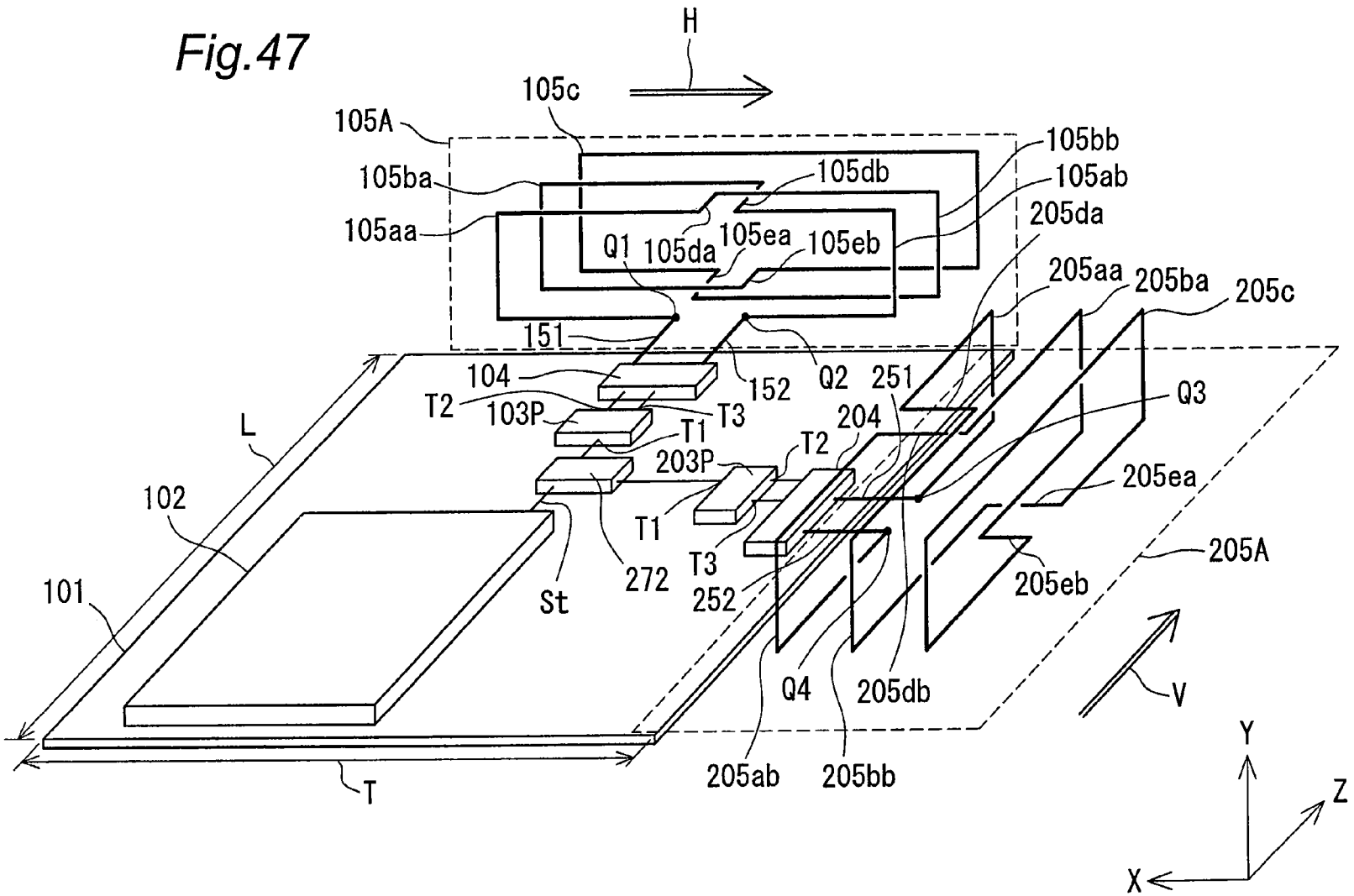
FIG. 47 is a perspective view showing a configuration of an antenna apparatus having small loop antenna elements 105A and 205A according to a thirteenth preferred embodiment of the invention.

FIG. 47 is a perspective view showing a configuration of an antenna apparatus having small loop antenna elements 105A and 205A according to the thirteenth preferred embodiment of the invention. The antenna apparatus of the thirteenth preferred embodiment differs from the antenna apparatus of the twelfth preferred embodiment of FIG. 45 in the following point.

(1) A 90-degree phase difference distributor 272 is provided in place of the switch 208.

In the antenna apparatus configured as above, the small loop antenna elements 105A and 205A are fed with a phase difference of 90 degrees by the 90-degree phase difference distributor 272. Moreover, the polarization planes of the small loop antenna element 105A and the small loop antenna element 205A are in an orthogonal relation, and a vertically polarized wave component and a horizontally polarized wave component are generated even if the distance D between the small loop antenna elements 105A, 205A and the conductor plate 106 is changed. Therefore, the antenna apparatus radiates a constant circularly polarized radio wave regardless of the distance D to the conductor plate 106.

As described above, according to the present preferred embodiment, the polarization diversity effect can be obtained regardless of the distance D between the antenna apparatus and the conductor plate 106, and further the switchover operation of the switch 208 by the control signal from the wireless transceiver circuit 102 can be made unnecessary.

Fourteenth Preferred Embodiment

Figure 48:
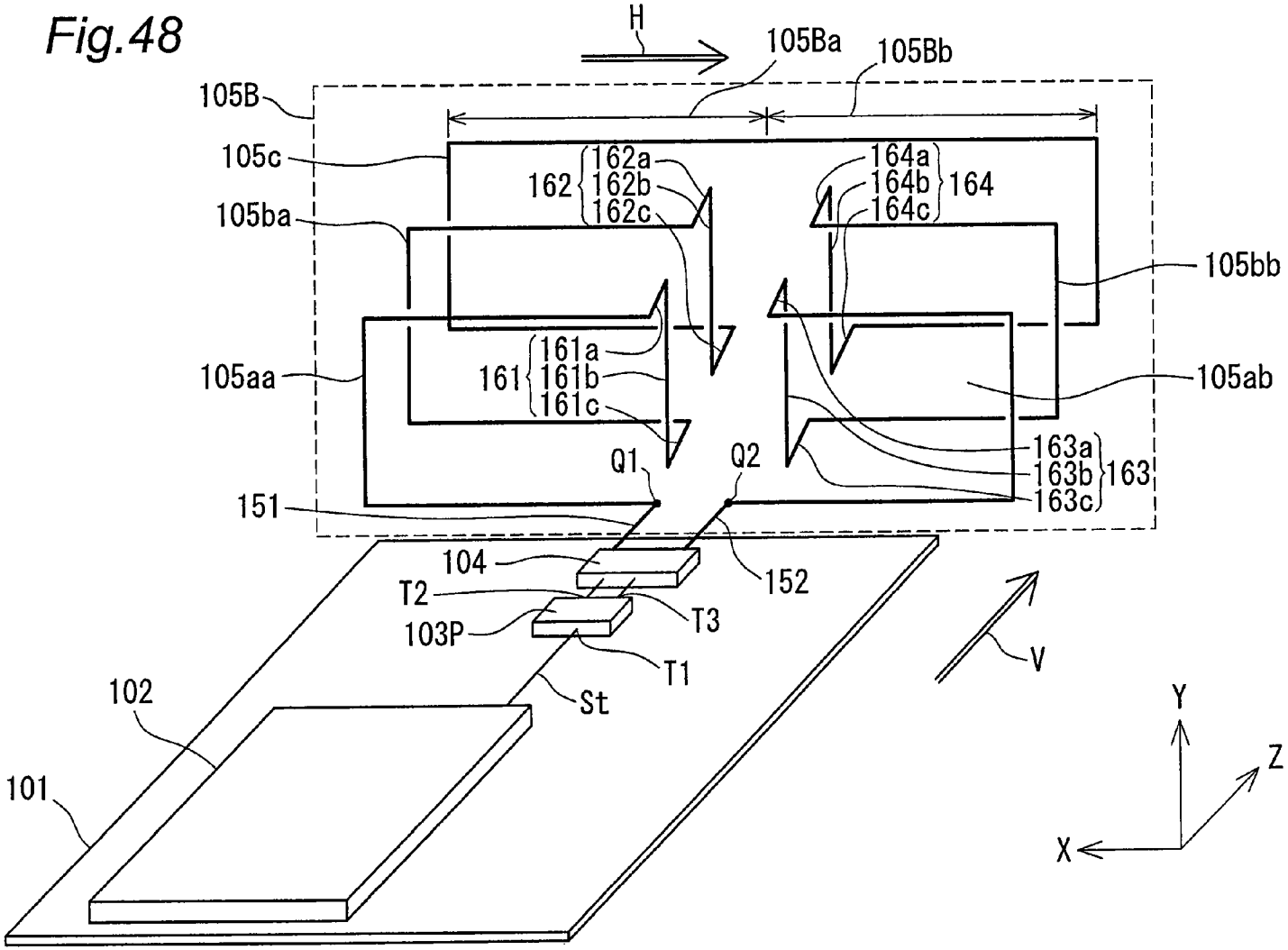
FIG. 48 is a perspective view showing a configuration of an antenna apparatus having a small loop antenna element 105B according to a fourteenth preferred embodiment of the invention.

FIG. 48 is a perspective view showing a configuration of an antenna apparatus having a small loop antenna element 105B according to the fourteenth preferred embodiment of the invention. The antenna apparatus of the fourteenth preferred embodiment differs from the antenna apparatus of the eleventh preferred embodiment of FIG. 40 in the following point.

(1) The small loop antenna element 105B of FIG. 2(*b*) is provided in place of the small loop antenna element 105A.

The point of difference is described below.

Referring to FIG. 48, one end of the half-loop antenna portion 105*aa* is used as the feeding point Q1, and the feeding point Q1 is connected to the impedance matching circuit 104 via the feed conductor 151. Moreover, one end of the half-loop antenna portion 105*ab* is used as the feeding point Q2, and the feeding point Q2 is connected to the impedance matching circuit 104 via the feed conductor 152. The antenna element 105B is configured to include a clockwise small loop antenna 105Ba and a counterclockwise small loop antenna 105Bb, in which the center axes of their loops are parallel to each other and the winding directions of the loops are in mutually opposite directions, and the leading ends of the small loop antennas 105Ba and 105Bb are connected together.

Figure 49:
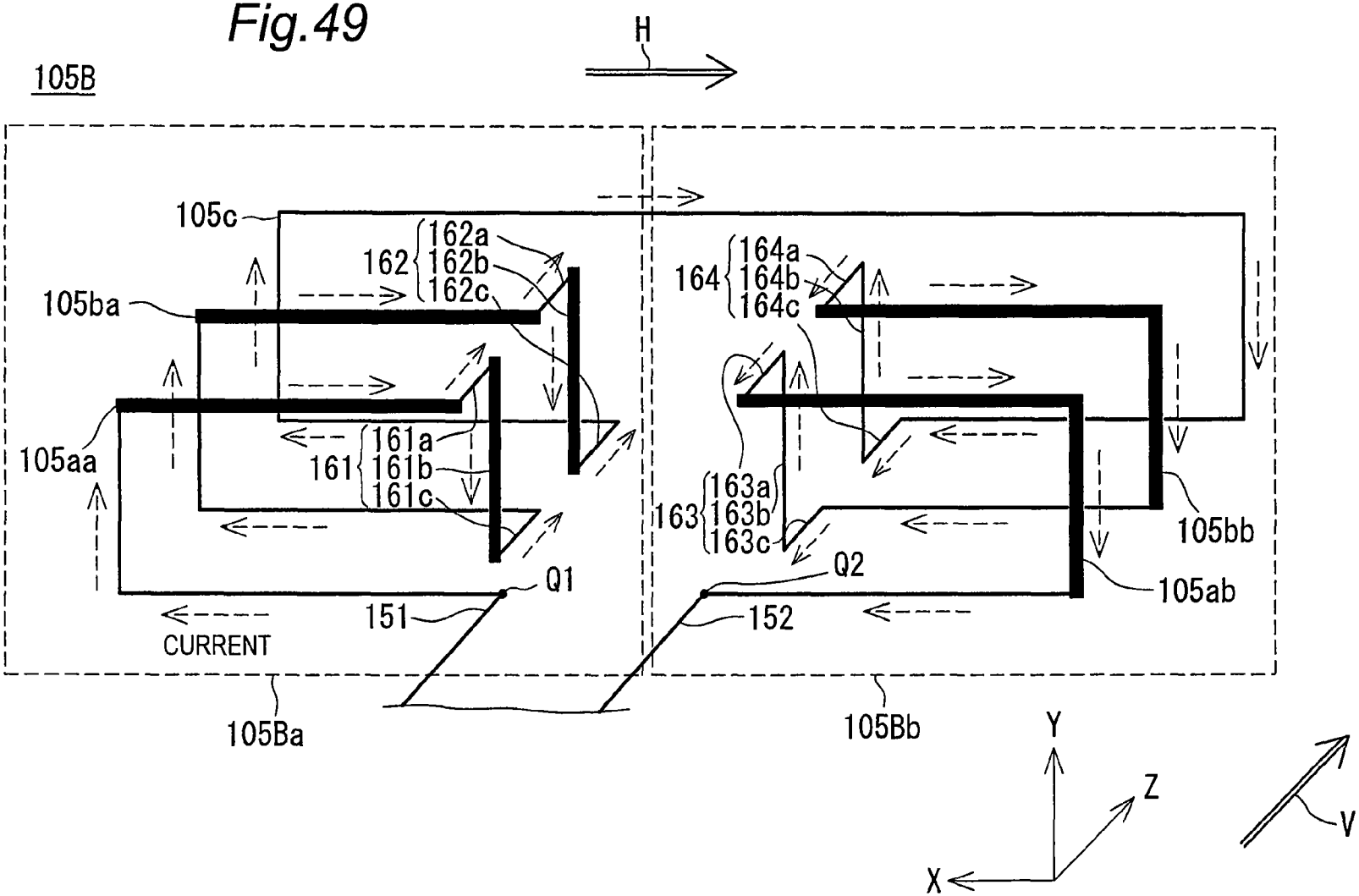
FIG. 49 is a perspective view showing a direction of a current in the small loop antenna element 105B of FIG. 48.

FIG. 49 is a perspective view showing a direction of a current in the small loop antenna element 105B of FIG. 48. As apparent from FIG. 49, clockwise currents flow in all of the half-loop antenna portions 105*aa*, 105*ab*, 105*ba*, 105*bb* and the loop antenna portion 105*c*. Moreover, mutually anti-phase currents flow through one pair of connecting conductors 161 and 163 and one pair of connecting conductors 162 and 164.

Figure 50:
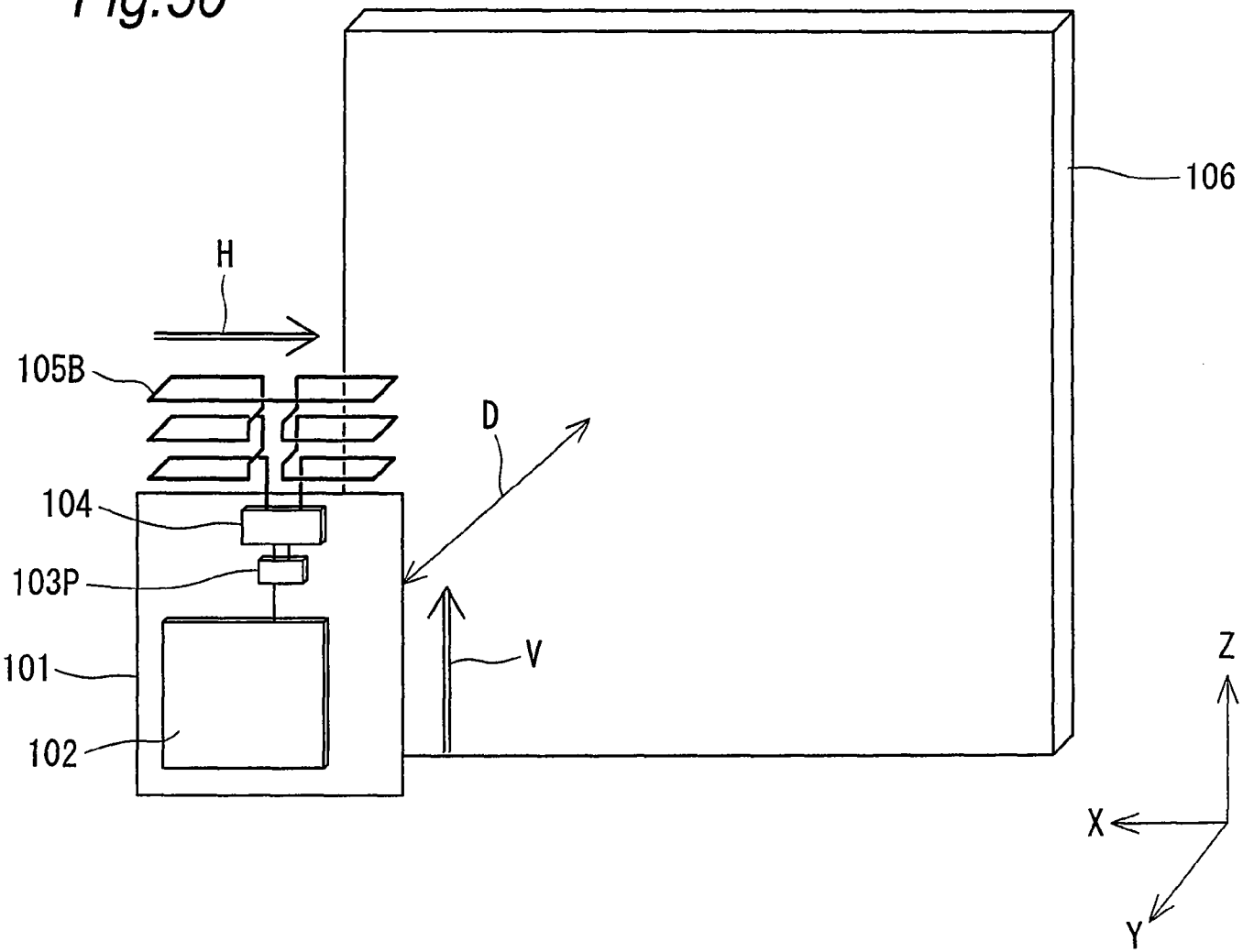
FIG. 50 is a perspective view when the antenna apparatus of FIG. 48 is adjacent to the conductor plate 106, showing a positional relation and the distance D between both of them.

FIG. 50 is a perspective view when the antenna apparatus of FIG. 48 is adjacent to the conductor plate 106, showing a positional relation and the distance D between both of them. Radio wave radiation from the antenna apparatus having the small loop antenna element 105B is configured to include:

(a) radiation of a horizontally polarized wave component from the half-loop antenna portions 105*aa*, 105*ab*, 105*ba*, 105*bb* of the small loop antenna element 105B, which are provided parallel to the X axis, and the loop antenna portion 105*c*; and (b) radiation of a vertically polarized wave component from the connecting conductors 161 to 164, which are provided parallel to the Z-axis, of the small loop antenna element 105B.

In addition, with regard to the radiation of the vertically polarized wave component of the present preferred embodiment, the antenna gain of the vertically polarized wave component is largely decreased and minimized when the distance D between the antenna apparatus and the conductor plate 106 is sufficiently shorter with respect to the wavelength in a manner similar to that of the preferred embodiment described above. When the distance D between the antenna apparatus and the conductor plate 106 is an odd number multiple of the quarter wavelength, the antenna gain of the vertically polarized wave component is maximized. When the distance D between the antenna apparatus and the conductor plate 106 is an even number multiple of the quarter wavelength, the antenna gain of the vertically polarized wave component is largely decreased and minimized.

Moreover, with regard to the radiation of the horizontally polarized wave component, the antenna gain of the horizontally polarized wave component is maximized when the distance D between the antenna apparatus and the conductor plate 106 is sufficiently shorter with respect to the wavelength in a manner similar to that of the preferred embodiment described above. When the distance D between the antenna apparatus and the conductor plate 106 is an odd number multiple of the quarter wavelength, the antenna gain of the horizontally polarized wave component is largely decreased and minimized. When the distance D between the antenna apparatus and the conductor plate 106 is an even number multiple of the quarter wavelength, the antenna gain of the horizontally polarized wave component is maximized. Therefore, operation is performed in the case where the antenna apparatus is located adjacent to the conductor plate 106 in a manner that the antenna gain of the vertically polarized wave component increases when the antenna gain of the horizontally polarized wave component decreases, and the antenna gain of the horizontally polarized wave component increases when the antenna gain of the vertically polarized wave component decreases.

In the present preferred embodiment, by setting the antenna gains of the vertically polarized wave component and the horizontally polarized wave component substantially identical, the composite component becomes substantially constant regardless of the distance D between the antenna apparatus and the conductor plate 106. Since the antenna element 105B is balancedly fed by the balanced-to-unbalanced transformer circuit 103P, radiation caused by a current that flows from the antenna element 105B directly to the grounding conductor plate 101 is very small. Since radio wave radiation from the grounding conductor plate 101 is constituted mainly of radiation caused by a current induced in the grounding conductor plate 101 by radio wave radiation from the antenna element 105, the radio wave radiation from the grounding conductor plate 101 is smaller than the radio wave radiation from the antenna element 105. The radio wave radiation from the entire antenna apparatus is constituted mainly of the radiation by the antenna element 105B.

Therefore, by setting the dimensions of portions of the antenna element 105B to predetermined values, the antenna gains of the vertically polarized wave component and the horizontally polarized wave component radiated from the antenna apparatus can be set substantially identical. Radio wave radiations from the connecting conductors 161 and 162 increase because the mutual canceling effect of the radiations due to the flow of the mutually anti-phase currents is reduced when the length of the connecting conductors 161, 162 or a distance between the connecting conductors 161, 163 increases. That is, the vertically polarized wave component increases while the horizontally polarized wave component radiated from the antenna apparatus is kept substantially constant. The same thing can be said for the connecting conductors 163 and 164. By setting the length of the connecting conductors 161 to 164, the distance between the connecting conductors 161 and 163 and the distance between the connecting conductors 162 and 164 to predetermined values, the antenna gains of the vertically polarized wave component and the horizontally polarized wave component can be set substantially identical.

As described above, according to the present preferred embodiment, by suppressing the radiation caused by the current directly flowing from the antenna element 105B to the grounding conductor plate 101, the current having intense radio wave radiation and difficulties in adjustment and depending largely on the size and the shape of the grounding conductor plate 101, by the balanced-to-unbalanced transformer circuit 103P and setting the dimensions of portions of the antenna element 105B to predetermined values, an antenna apparatus that obtains the antenna gain of a constant composite component regardless of the distance D between the antenna apparatus and the conductor plate 106 can be provided. Moreover, the polarized wave components radiated from the connecting conductors 161 to 164 and the polarized wave components radiated from the half-loop antenna portions 105*aa*, 105*ab*, 105*ba* and 105*bb* and the loop antenna portion 105*c* are in an orthogonal relation. Therefore, both the vertically and horizontally polarized wave components are provided, and the polarization diversity effect can be obtained.

Fifteenth Preferred Embodiment

Figure 51:
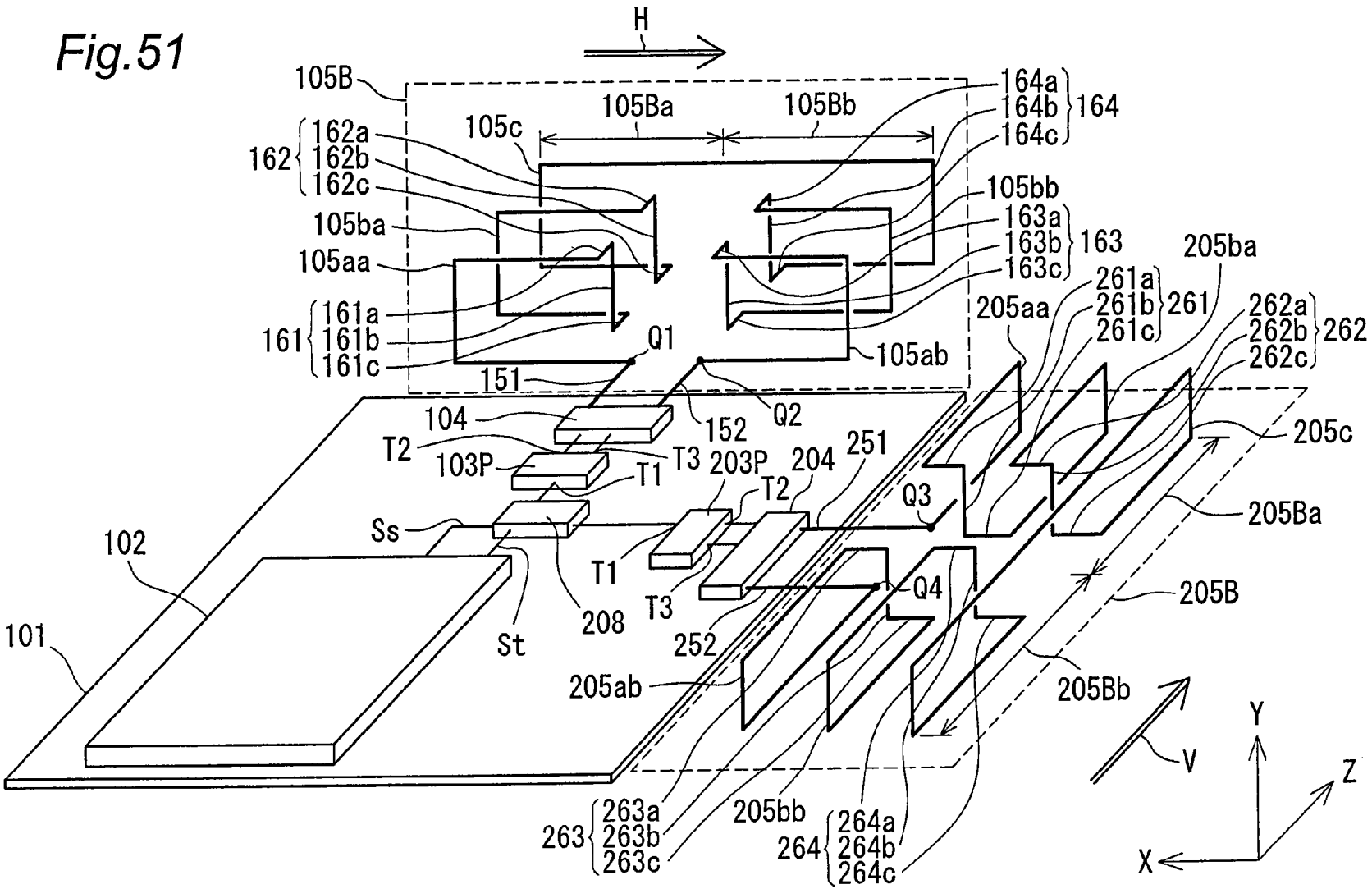
FIG. 51 is a perspective view showing a configuration of an antenna apparatus having small loop antenna elements 105B and 205B according to a fifteenth preferred embodiment of the invention.

FIG. 51 is a perspective view showing a configuration of an antenna apparatus having small loop antenna elements 105B and 205B according to the fifteenth preferred embodiment of the invention. The antenna apparatus of the fifteenth preferred embodiment differs from the antenna apparatus of the twelfth preferred embodiment of FIG. 45 in the following points.

(1) A small loop antenna element 105B is provided in place of the small loop antenna element 105A.

(2) A small loop antenna element 205B is provided in place of the small loop antenna element 205A.

The points of difference are described below.

Referring to FIG. 51, in a manner similar to that of the small loop antenna element 105B of FIG. 2(*b*), the small loop antenna element 205B is configured to include:

(a) half-loop antenna portions 205*aa* and 205*ab*, each having half turn and each is configured to include three sides of a substantially rectangular shape and formed on a substantially identical plane substantially parallel to the Z axis;

(b) half-loop antenna portions 205*ba* and 205*bb*, each having half turn and each is configured to include three sides of a substantially rectangular shape and formed on a substantially identical plane substantially parallel to the Z axis;

(c) a loop antenna portion 205*c*, which has one turn and a loop plane substantially parallel to the Z-axis and a rectangular shape;

(d) a connecting conductor 261 that includes a connecting conductor portion 261*a* provided substantially parallel to the X axis, a connecting conductor portion 261*b* provided substantially parallel to the Y axis, and a connecting conductor portion 261*c* provided substantially parallel to the X axis, which are connected together and bent successively substantially at right angles, and connects the half-loop antenna portion 205*aa* with the half-loop antenna portion 205*ba;*

(e) a connecting conductor 262 that includes a connecting conductor portion 262*a* provided substantially parallel to the X axis, a connecting conductor portion 262*b* provided substantially parallel to the Y axis, and a connecting conductor portion 262*c* provided substantially parallel to the X axis, which are connected together and bent successively substantially at right angles, and connects the half-loop antenna portion 205*ba* with the loop antenna portion 205*c;*

(f) a connecting conductor 263 that includes a connecting conductor portion 263*a* provided substantially parallel to the X axis, a connecting conductor portion 263*b* provided substantially parallel to the Y axis, and a connecting conductor portion 263*c* provided substantially parallel to the X axis, which are connected together and bent successively substantially at right angles, and connects the half-loop antenna portion 205*ab* with the half-loop antenna portion 205*bb*; and (g) a connecting conductor 264 that includes a connecting conductor portion 264*a* provided substantially parallel to the X axis, a connecting conductor portion 264*b* provided substantially parallel to the Y axis, and a connecting conductor portion 264*c* provided substantially parallel to the X axis, which are connected together and bent successively substantially at right angles, and connects the half-loop antenna portion 205*bb* with the loop antenna portion 205*c*. That is, the small loop antenna element 205B is configured to include a clockwise small loop antenna 105Ba and a counterclockwise small loop antenna 105Bb, in which the center axes of their loops are parallel to each other and the winding directions of the loops are in mutually opposite directions with their leading ends connected together.

In the antenna apparatus configured as above, antenna diversity is achieved by switchover of feed to the small loop antenna element 105B and the small loop antenna element 205B by the switch 208.

Figure 52:
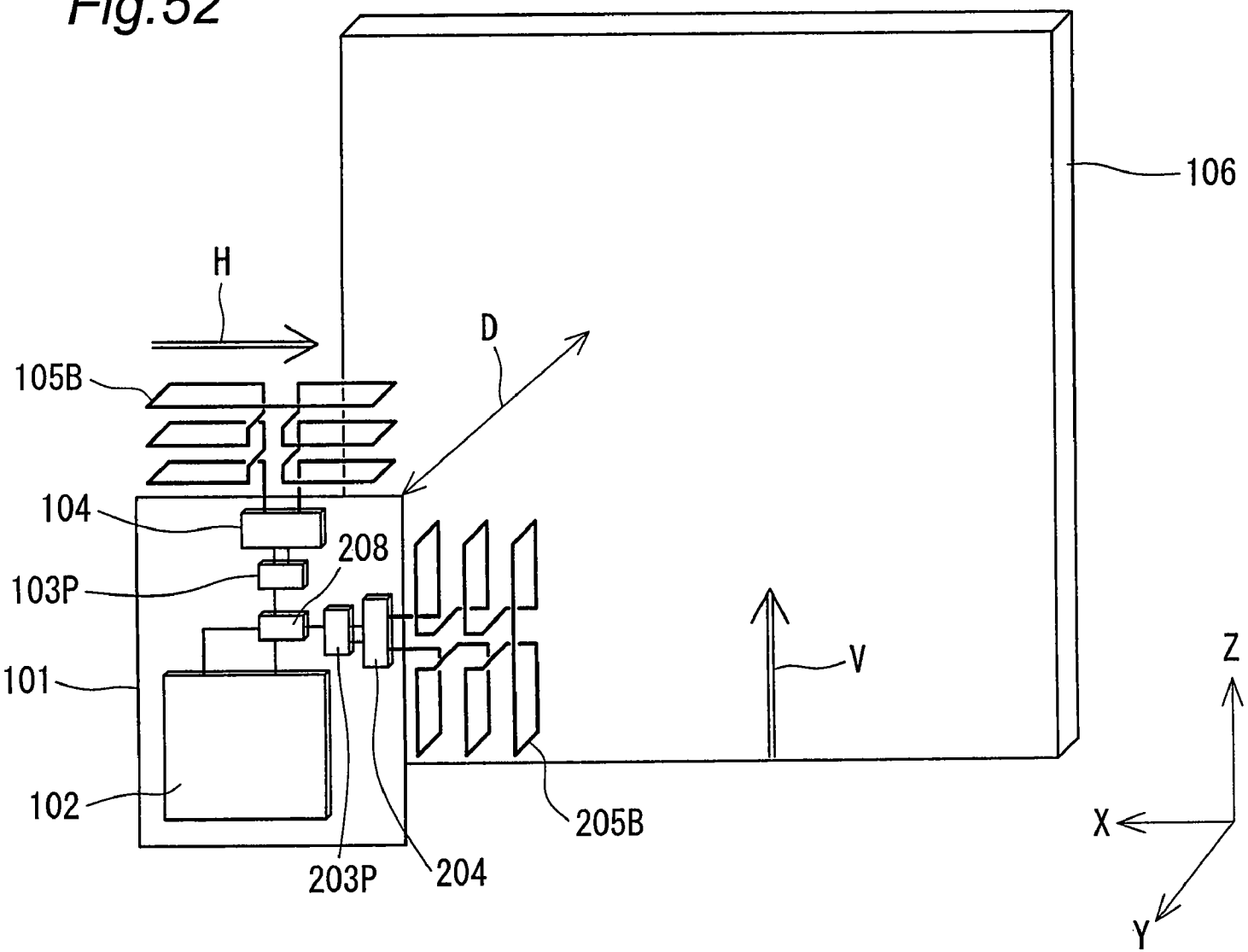
FIG. 52 is a perspective view when the antenna apparatus of FIG. 51 is adjacent to the conductor plate 106, showing a positional relation and the distance D between both of them.

FIG. 52 is a perspective view when the antenna apparatus of FIG. 51 is adjacent to the conductor plate 106, showing a positional relation and the distance D between both of them. Referring to FIG. 52, radio wave radiation in feeding the small loop antenna element 105B is similar to that of the fourteenth preferred embodiment. Moreover, with regard to radio wave radiation in feeding the small loop antenna element 205B, since the small loop antenna element 205B is provided in the direction orthogonal to the small loop antenna element 105B on the X-Z plane, radio wave radiations from the connecting conductors 261 to 264 are effected by horizontally polarized waves. Moreover, radio wave radiations from the half-loop antenna portions 205*aa*, 205*ab*, 205*ba*, 205*bb* and the loop antenna portion 205*c* are effected by vertically polarized waves.

In a manner similar to that of the fourteenth preferred embodiment, when the dimensions of portions of the small loop antenna element 105B are set to predetermined values to set the antenna gains of the vertically polarized wave component and the horizontally polarized wave component substantially identical, the antenna gain of a substantially constant composite component is obtained regardless of the distance D between the antenna apparatus and the conductor plate 106 in feeding the small loop antenna element 105B. In a manner similar to above, when the dimensions of portions of the small loop antenna element 205B are set to predetermined values to set the antenna gains of the vertically polarized wave component and the horizontally polarized wave component substantially identical, an antenna gain of a substantially constant composite component is obtained regardless of the distance D between the antenna apparatus and the conductor plate 106 in feeding the small loop antenna element 205B. Moreover, regardless of the distance D between the antenna apparatus and the conductor plate 106, the polarized wave component radiated from the antenna apparatus in feeding the small loop antenna element 105B and the polarized wave component radiated from the antenna apparatus in feeding the small loop antenna element 205B are in an orthogonal relation.

As described above, according to the present preferred embodiment, the antenna gain of a substantially constant composite component can be obtained regardless of the distance D between the antenna apparatus and the conductor plate 106. Further, by providing the small loop antenna element 205B having the configuration similar to that of the small loop antenna element 105B in the direction orthogonal to the small loop antenna element 105B on the X-Z plane, the polarization diversity effect can be obtained since the polarization planes of the small loop antenna elements 105B and 205A are in the mutually orthogonal relation even when one polarized wave of both the vertically and horizontally polarized waves is largely attenuated in a manner similar to that of such a case that the distance D between the antenna apparatus and the conductor plate 106 is sufficiently shorter with respect to the wavelength or a multiple of the quarter wavelength.

Sixteenth Preferred Embodiment

Figure 53:
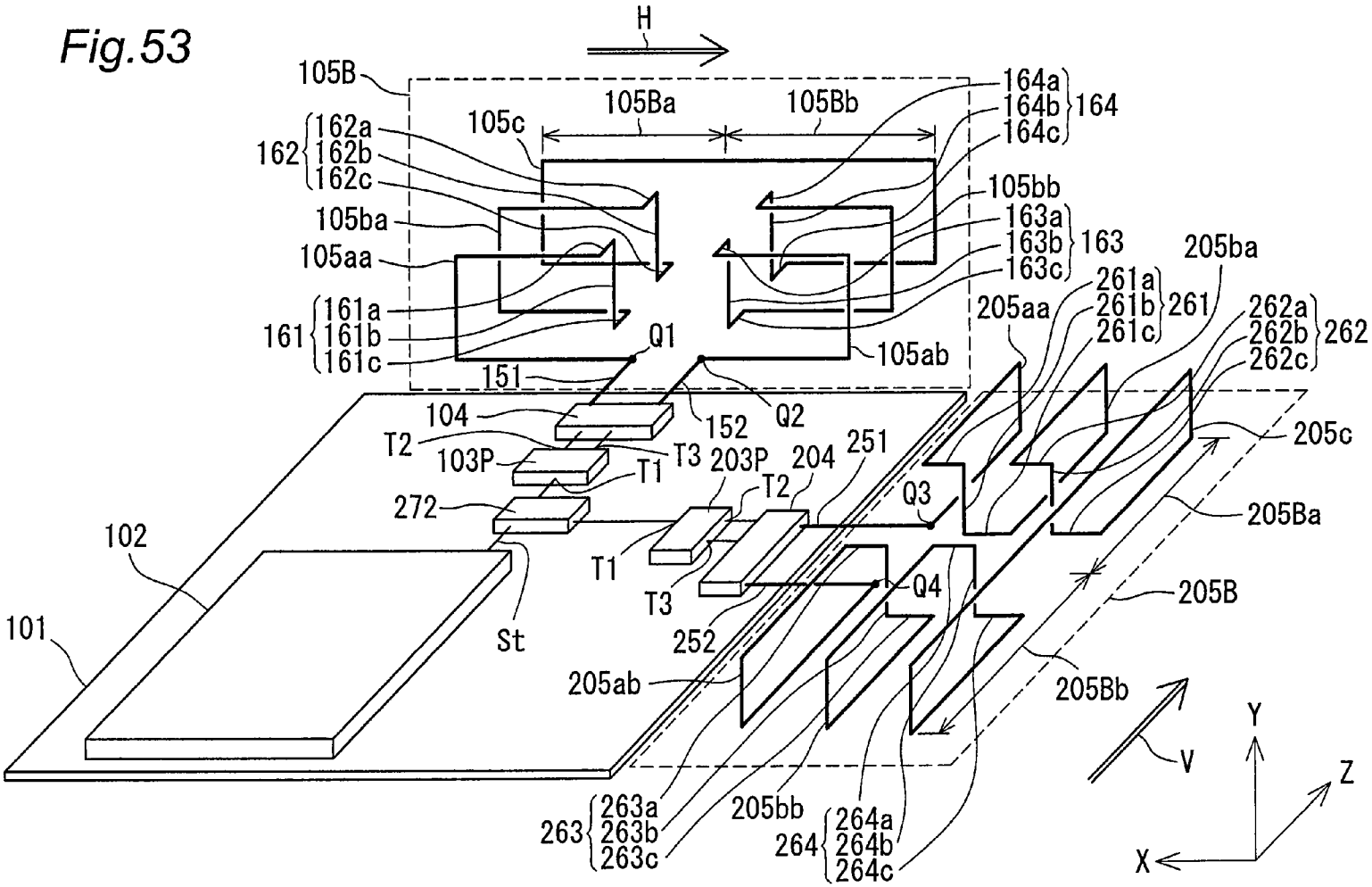
FIG. 53 is a perspective view showing a configuration of an antenna apparatus having small loop antenna elements 105B and 205B according to a sixteenth preferred embodiment of the invention.

FIG. 53 is a perspective view showing a configuration of an antenna apparatus having small loop antenna elements 105B and 205B according to the sixteenth preferred embodiment of the invention. The antenna apparatus of the sixteenth preferred embodiment differs from the antenna apparatus of the fifteenth preferred embodiment of FIG. 51 in the following point.

(1) A 90-degree phase difference distributor 272 is provided in place of the switch 208.

The antenna apparatus configured as above has operational effects similar to those of the antenna apparatus of the thirteenth preferred embodiment of FIG. 47 except for the operation of the small loop antenna elements 105B and 205B. Therefore, according to the present preferred embodiment, the polarization diversity effect can be obtained regardless of the distance D between the antenna apparatus and the conductor plate 106, and the switchover operation of the switch 208 by the control signal from the wireless transceiver circuit 102 can be made unnecessary.

Seventeenth Preferred Embodiment

Figure 54:
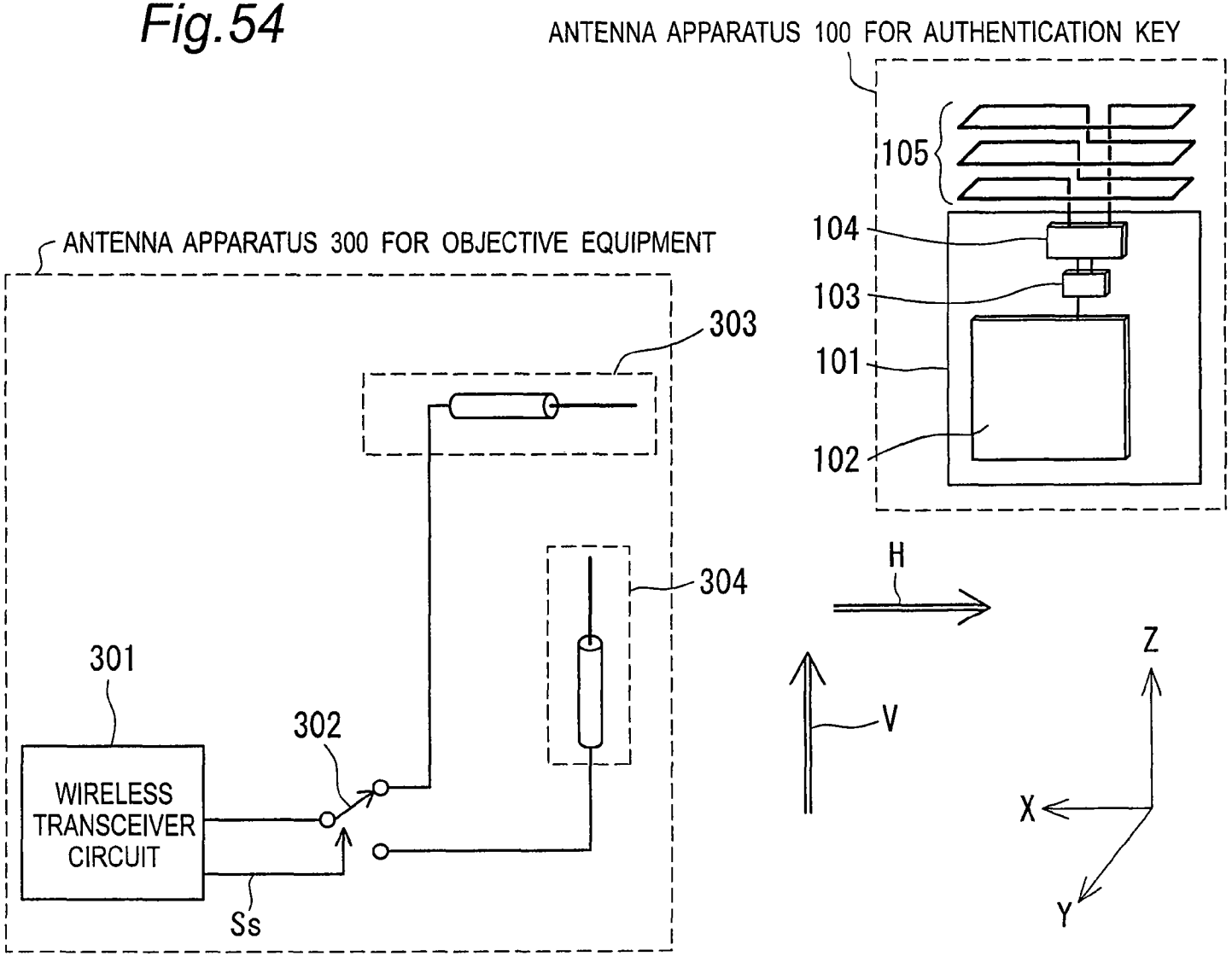
FIG. 54 is a perspective view and a block diagram showing a configuration of an antenna system having an antenna apparatus 100 for an authentication key and an antenna apparatus 300 for objective equipment according to a seventeenth preferred embodiment of the invention.

FIG. 54 is a perspective view and a block diagram showing a configuration of an antenna system having an antenna apparatus 100 for an authentication key and an antenna apparatus 300 for objective equipment according to a seventeenth preferred embodiment of the invention. Referring to FIG. 54, the antenna system is configured to include the antenna apparatus 100 for the authentication key and the antenna apparatus 300 for the objective equipment. The antenna apparatus 100 for the authentication key is, for example, the antenna apparatus of the first preferred embodiment or allowed to be an antenna apparatus of another preferred embodiment having a wireless communication function owned by the user. The antenna apparatus 300 for the objective equipment has a wireless communication function and performs wireless communications with the antenna apparatus 100 for the authentication key. The antenna apparatus 300 for the objective equipment is configured to include a wireless transceiver circuit 301, a horizontal polarization antenna 303, a vertical polarization antenna 304, and a switch 302 for selective switchover between the antennas 303 and 304 according to the switchover control signal Ss. It is noted that the operation when the conductor plate 106 is located adjacent to the antenna apparatus 100 for the authentication key is similar to that of the first preferred embodiment.

Figure 55A:
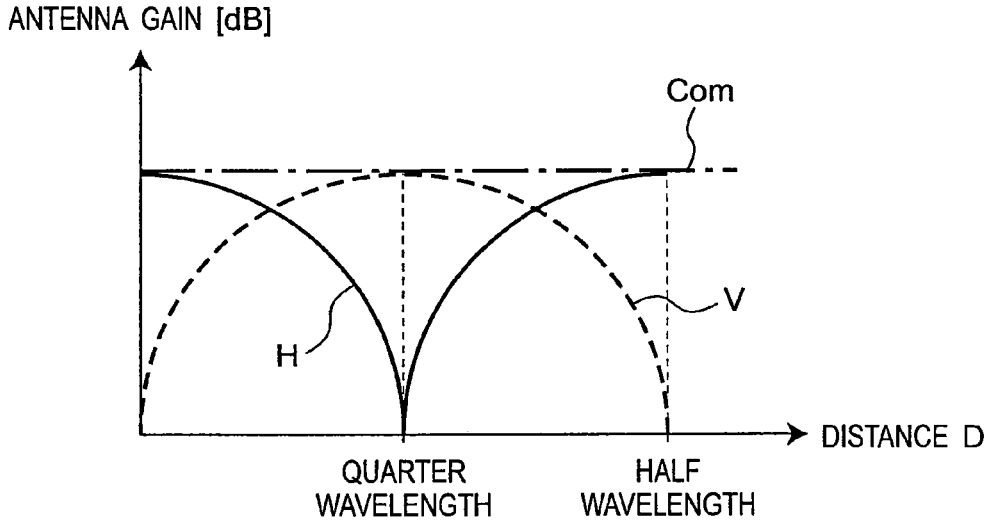
FIG. 55(*a*) is a graph showing a composite antenna gain in the direction opposite to the direction from the antenna apparatus 100 for the authentication key toward the conductor plate 106 with respect to the distance D between the antenna apparatus 100 for the authentication key and the conductor plate 106 when the maximum value of the antenna gain of the vertically polarized wave component of the small loop antenna element 105 is substantially equal to the maximum value of the antenna gain of the horizontally polarized wave component in the antenna system of FIG. 54.
Figure 55B:
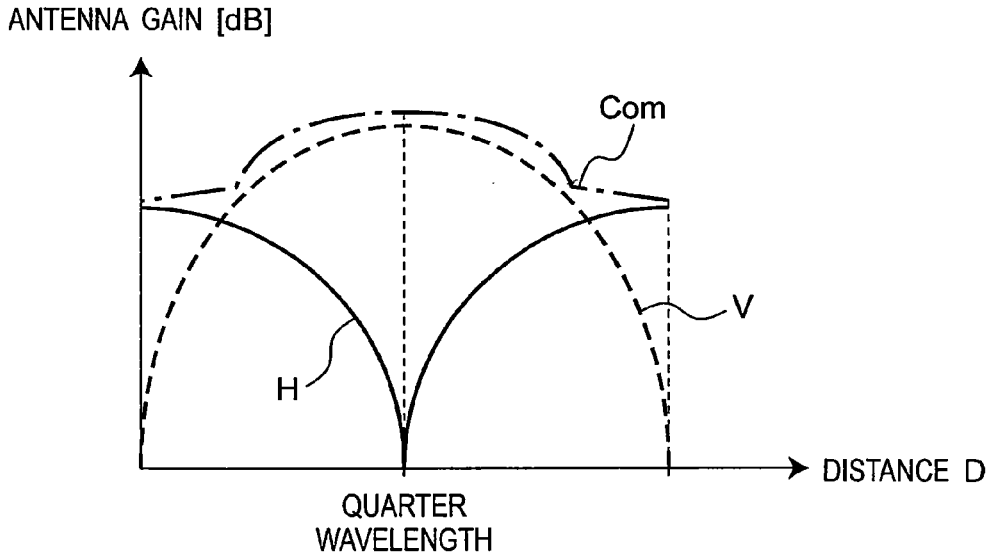

FIG. 55(*a*) is a graph showing a composite antenna gain in the direction opposite to the direction from the antenna apparatus 100 for the authentication key toward the conductor plate 106 with respect to the distance D between the antenna apparatus 100 for the authentication key and the conductor plate 106 when the maximum value of the antenna gain of the vertically polarized wave component of the small loop antenna element 105 is substantially equal to the maximum value of the antenna gain of the horizontally polarized wave component in the antenna system of FIG. 54. FIG. 55(*b*) is a graph showing a composite antenna gain in the direction opposite to the direction from the antenna apparatus 100 for the authentication key toward the conductor plate 106 with respect to the distance D between the antenna apparatus 100 for the authentication key and the conductor plate 106 when the maximum value of the antenna gain of the vertically polarized wave component of the small loop antenna element 105 is larger than the maximum value of the antenna gain of the horizontally polarized wave component in the antenna system of FIG. 54. It is noted that a composite component Com radiated from the antenna apparatus 100 for the authentication key is obtained as the vector composite component of the vertically polarized wave component and the horizontally polarized wave component.

As apparent from FIG. 55(*a*), in the case where the antenna gain of the vertically polarized wave component is higher than the antenna gain of the horizontally polarized wave component, the antenna gain of the composite component is maximized when a distance between the antenna apparatus 100 for the authentication key and the conductor plate 106 is an odd number multiple of the quarter wavelength. Moreover, as shown in FIG. 55(*b*), when the maximum value of the antenna gain of the vertically polarized wave component is substantially identical to the maximum value of the antenna gain of the horizontally polarized wave component, the antenna gain of the composite component becomes substantially constant regardless of the distance between the antenna apparatus 100 for the authentication key and the conductor plate 106.

The total length of the small loop antenna element 105 is not larger than one wavelength of the radio waves that are transmitted and received and operates as a small loop antenna, and therefore, the gain is very small. When unbalanced feed to the small loop antenna element 105 is performed, radio wave radiation caused by a magnetic current from the grounding conductor plate 101 is larger than radio wave radiation from the small loop antenna element 105, and the relation between the distance D from the antenna apparatus 100 for the authentication key to the conductor plate 106 and the antenna gain of the antenna apparatus 100 for the authentication key in the direction opposite to the conductor plate 106 becomes similar to that of FIG. 55(*b*). When balanced feed to the small loop antenna element 105 is performed, the radio wave radiation from the grounding conductor plate 101 decreases, and the radio wave radiation from the small loop antenna element 105 and the radio wave radiation from the grounding conductor plate 101 become substantially identical. The relation between the distance D between the antenna apparatus 100 for the authentication key and the conductor plate 106 and the gain of the antenna apparatus 100 for the authentication key in the direction opposite to the conductor plate 106 becomes similar to that of FIG. 55 (*a*).

In the antenna apparatus 100 for the authentication key, by performing the balanced feed to the small loop antenna element 105 by using the feeder circuit 103 that has the balun 1031, the gains of the vertically polarized wave component and the horizontally polarized wave component become substantially identical in the small loop antenna element 105, and the antenna gain of the composite component can be made substantially constant regardless of the distance D between the antenna apparatus 100 for the authentication key and the conductor plate 106.

In the antenna apparatus 300 for the objective equipment of FIG. 54, the wireless transceiver circuit 301 generates and outputs a transmitted wireless signal and demodulates the inputted received wireless signal. The wireless transceiver circuit 301 may be provided by only a transmitter circuit or a receiver circuit. Moreover, the wireless transceiver circuit 301 outputs a switchover control signal Ss for controlling the switch 302. The switch 302 connects the wireless transceiver circuit 301 to one of the horizontal polarization antenna 303 and the vertical polarization antenna 304 on the basis of the switchover control signal Ss. It is acceptable to use a signal distributor or a signal combiner in place of the switch 302. The horizontal polarization antenna 303 is a linear antenna of, for example, a sleeve antenna or a dipole antenna and is provided parallel to the X-axis. The vertical polarization antenna 304 is a linear antenna of, for example, a sleeve antenna or a dipole antenna and is provided parallel to the Z-axis.

In the antenna apparatus 300 for the objective equipment configured as above, the antenna diversity is achieved by, for example, selective switchover between the wireless signal of the radio wave from antenna apparatus 100 for the authentication key received by the horizontal polarization antenna 303 and the wireless signal of the radio wave from antenna apparatus 100 for the authentication key received by the vertical polarization antenna 304 by using the switch 302 so that the wireless signal having the larger received power of them is received.

The polarized wave component radiated from the antenna apparatus 100 for the authentication key changes depending on the distance D to the conductor plate 106. When the distance D to the conductor plate 106 is sufficiently shorter with respect to the wavelength or a multiple of the quarter wavelength, either one of the vertically polarized wave and the horizontally polarized wave is intensely radiated. That is, when the polarized wave component of the radio wave that can be received by the antenna apparatus 300 for the objective equipment and the polarized wave component of the radio wave radiated from the antenna apparatus 100 for the authentication key do not coincide with each other, the antenna gain of the antenna apparatus 100 for the authentication key deteriorates. Radio waves of both the vertically and horizontally polarized waves can be received by providing the horizontal polarization antenna 303 and the vertical polarization antenna 304 for the antenna apparatus 300 for the objective equipment, and a radio wave of a substantially constant intensity can be received regardless of the distance D between the antenna apparatus 100 for the authentication key and the conductor plate 106.

As described above, according to the present preferred embodiment, by performing the balanced feed to the small loop antenna element 105 by using the feeder circuit 103 that has the balun 1031 to make the radiation of the horizontally polarized wave component and the radiation of the vertically polarized wave component from the small loop antenna element 105 substantially identical, the gain variation of the antenna apparatus 100 for the authentication key due to the distance D to the conductor plate 106 can be reduced. Moreover, by providing the horizontal polarization antenna 303 and the vertical polarization antenna 304 for the antenna apparatus 300 for the objective equipment, the antenna apparatus 300 for the objective equipment can receive a radio wave with a constant intensity even if the polarized wave component radiated from the antenna apparatus 100 for the authentication key is changed by a change in the distance D to the conductor plate 106. The deterioration in the antenna gain of the antenna apparatus 100 for the authentication key due to a polarized wave component disagreement between the antenna apparatus 300 for the objective equipment and the antenna apparatus 100 for the authentication key can be prevented. Moreover, by providing the horizontal polarization antenna 303 and the vertical polarization antenna 304 for the antenna apparatus 300 for the objective equipment, the polarization diversity effect can be obtained, and the influence of fading can be avoided.

As described above, according to the present preferred embodiment, an antenna system having the antenna apparatus 100 for the authentication key and the antenna apparatus 300 for the objective equipment, which has a small gain variation of the antenna for the authentication key due to the distance D to the conductor plate 106 and includes and is able to avoid the influence of fading can be provided. Accordingly, for example, the antenna system of the present invention can be applied to an antenna system configured to include, for example, equipment that needs to secure security by the distance.

Eighteenth Preferred Embodiment

Figure 56:
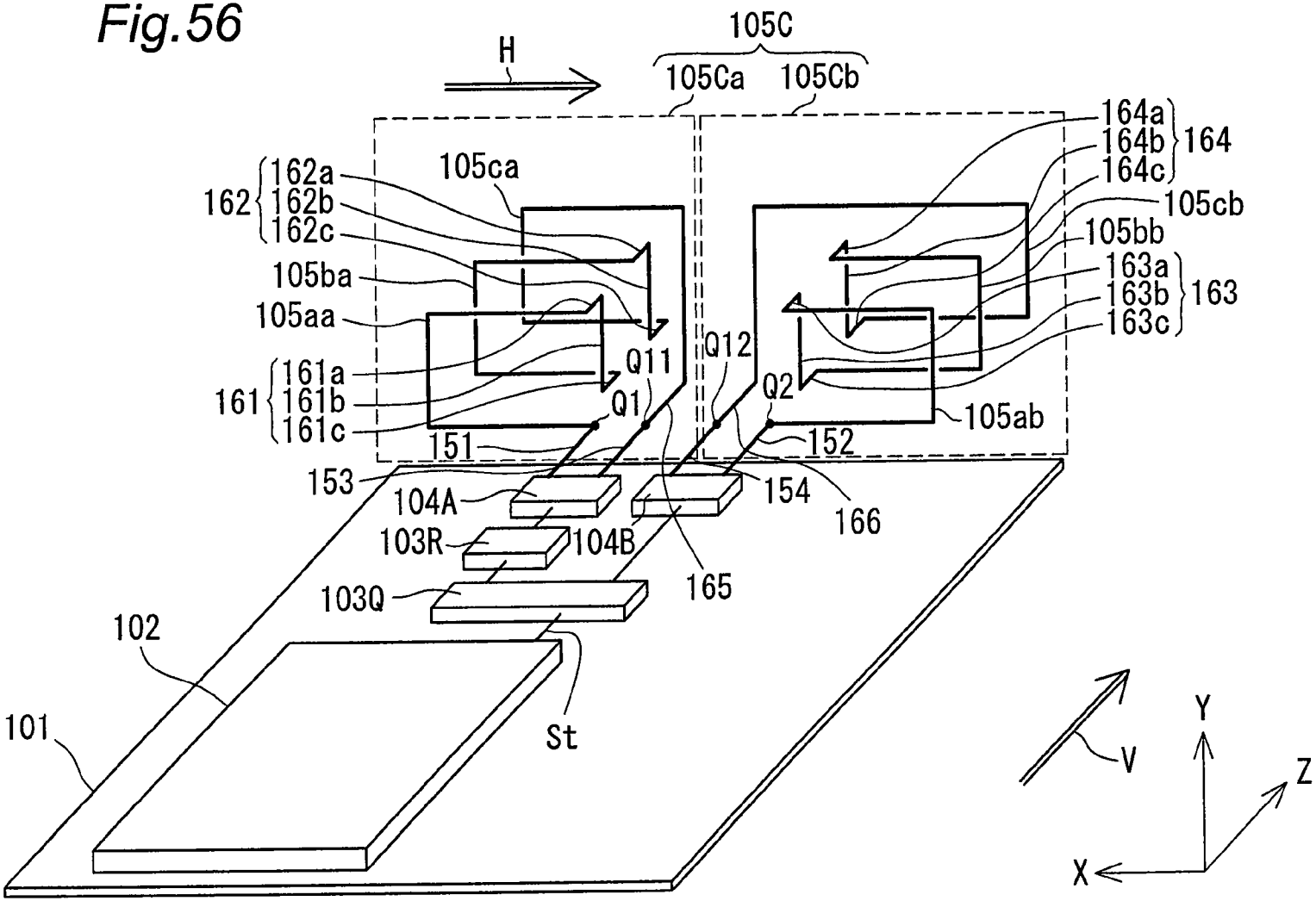
FIG. 56 is a perspective view showing a configuration of an antenna apparatus having a small loop antenna element 105C according to an eighteenth preferred embodiment of the invention.

FIG. 56 is a perspective view showing a configuration of an antenna apparatus having a small loop antenna element 105C according to the eighteenth preferred embodiment of the invention. The antenna apparatus of the eighteenth preferred embodiment differs from the antenna apparatus of the fourteenth preferred embodiment of FIG. 48 in the following points.

(1) A small loop antenna element 105C is provided in place of the small loop antenna element 105B.

(2) A distributor 103Q, an amplitude-to-phase converter 103R and impedance matching circuits 104A and 104B are provided in place of the balanced-to-unbalanced transformer circuit 103P and the impedance matching circuit 104.

The points of difference are described below.

Referring to FIG. 56, the small loop antenna element 105C differs from the small loop antenna element 105B in the following points.

(a) The loop antenna portion 105*c* is divided into two portions of a half-loop antenna portion 105*ca* of the left half and a loop antenna portion 105*cb* of the right half.

(b) The half-loop antenna portion 105*ca* is wound by one turn and subsequently connected to a feeding point Q11 via a connecting conductor 165 that is substantially parallel to the Z axis, and the feeding point Q11 is connected to the impedance matching circuit 104A via a feed conductor 153. It is noted that the feeding point Q1 at one end of the half-loop antenna portion 105*aa* is connected to the impedance matching circuit 104A via a feed conductor 151.

(c) The half-loop antenna portion 105*cb* is wound by one turn and subsequently connected to a feeding point Q12 via a connecting conductor 166 that is substantially parallel to the Z axis, and the feeding point Q12 is connected to the impedance matching circuit 104B via a feed conductor 154. It is noted that the feeding point Q2 at one end of the half-loop antenna portion 105*ab* is connected to the impedance matching circuit 104B via a feed conductor 152. The impedance matching circuits 104A and 104B have an impedance matching function of the impedance matching circuit 104 of FIG. 1 and apply an unbalanced wireless signal to the feeding points Q1, Q2, Q11 and Q12 of the small loop antenna element 105C.

(d) A clockwise small loop antenna 105Ca of the left half is configured to include the half-loop antenna portions 105*aa*, 105*ba* and 105*ca*, and a counterclockwise small loop antenna 105Cb of the right half is configured to include the half-loop antenna portions 105*ab*, 105*bb* and 105*cb*. That is, the small loop antenna element 105C is configured to include the clockwise small loop antenna 105Ca and the counterclockwise small loop antenna 105Cb.

Referring to FIG. 56, the distributor 103Q distributes a transmitted wireless signal from the wireless transceiver circuit 102 into two and outputs the resulting signals to the amplitude-to-phase converter 103R and the impedance matching circuit 104B. The amplitude-to-phase converter 103R has a variable amplitude function and a phase shifting function, converts at least one of the amplitude and the phase of the inputted wireless signal into a predetermined value and outputs the value to the impedance matching circuit 104A.

In the present preferred embodiment, when a balanced feed to the clockwise small loop antenna 105Ca and the counterclockwise small loop antenna 105Cb is performed (modified preferred embodiment), the impedance matching circuits 104A and 104B perform unbalanced-to-balanced transform processing besides the impedance matching processing. The clockwise small loop antenna 105Ca is constituted by being helically wound in the clockwise direction with its loop plane made substantially perpendicular to the plane of the grounding conductor plate 101, and the two feeding points Q1 and Q11 are connected to the impedance matching circuit 104A. Moreover, the counterclockwise small loop antenna 105Cb is constituted by being helically wound in the counterclockwise direction with its loop plane made substantially perpendicular to the plane of the grounding conductor plate 101, and the two feeding points Q2 and Q12 are connected to the impedance matching circuit 104B. It is noted that each of the clockwise small loop antenna 105Ca and the counterclockwise small loop antenna 105Cb has a length that is a small length similar to that of the small loop antenna element 105 of FIG. 1.

Figure 57:
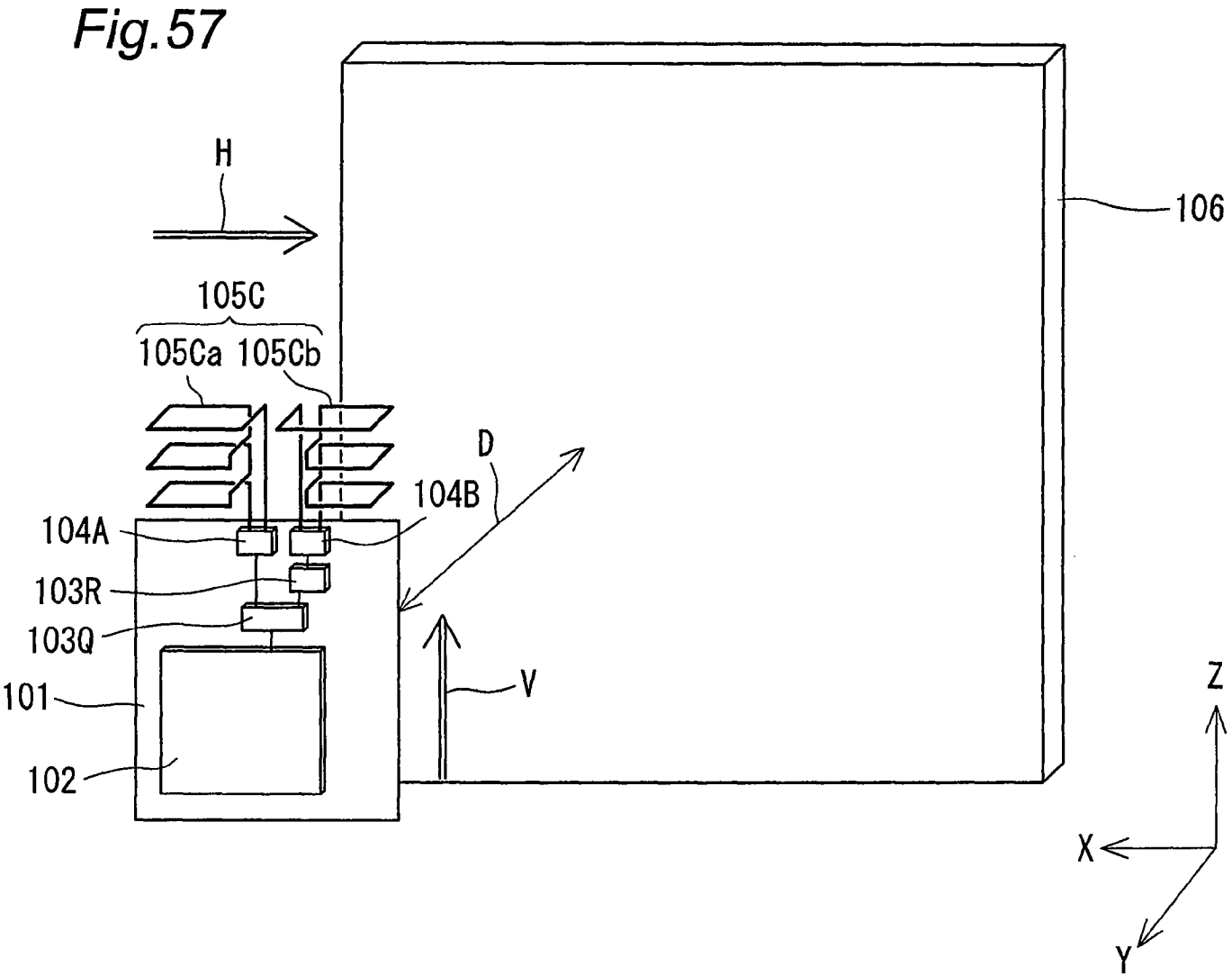
FIG. 57 is a perspective view when the antenna apparatus of FIG. 56 is adjacent to the conductor plate 106, showing a positional relation and the distance D between both of them.

FIG. 57 is a perspective view when the antenna apparatus of FIG. 56 is adjacent to the conductor plate 106, showing a positional relation and the distance D between both of them. Radio wave from the antenna apparatus is radiated from the clockwise small loop antenna 105Ca and the counterclockwise small loop antenna 105Cb and configured to include:

(1) a vertically polarized wave component caused by a current that flows in the Z-axis direction at the connecting conductors 161 to 166; and (2) a horizontally polarized wave component caused by currents that flow in a loop shape in the X-axis direction and the Y-axis direction of the half-loop antenna portions 105*aa*, 105*ab*, 105*ba*, 105*bb*, 105*ca* and 105*cb*.

As shown in FIG. 57, when the conductor plate 106 is located adjacent to the antenna apparatus in the Y-axis direction, a portion in the Z-axis direction in which the vertically polarized wave component is radiated becomes parallel to the conductor plate 106. Therefore, with regard to the relation between the distance D from the antenna apparatus to the conductor plate 106 and the antenna gain of the vertically polarized wave component of the antenna apparatus in the direction opposite to the conductor plate 106, the antenna gain of the vertically polarized wave component is largely decreased and minimized when the distance D between the antenna apparatus and the conductor plate 106 is sufficiently shorter with respect to the wavelength in a manner similar to that of FIG. 6(*b*) of the first preferred embodiment. When the distance D between the antenna apparatus and the conductor plate 106 is an odd number multiple of the quarter wavelength, the antenna gain of the vertically polarized wave component is maximized. When the distance D between the antenna apparatus and the conductor plate 106 is an even number multiple of the quarter wavelength, the antenna gain of the vertically polarized wave component is largely decreased and minimized.

Moreover, portions in the X-axis direction and the Y-axis direction in which the horizontally polarized wave component is radiated have a loop plane formed perpendicular to the conductor plate 106. Therefore, with regard to the relation between the distance D from the antenna apparatus to the conductor plate 106 and the antenna gain of the horizontally polarized wave component of the antenna apparatus in the direction opposite to the conductor plate 106, the antenna gain of the horizontally polarized wave component is maximized when the distance D between the antenna apparatus and the conductor plate 106 is sufficiently shorter with respect to the wavelength in a manner similar to that of FIG. 5(*b*) of the first preferred embodiment. When the distance D between the antenna apparatus and the conductor plate 106 is an odd number multiple of the quarter wavelength, the antenna gain of the horizontally polarized wave component is largely decreased and minimized. Further, when the distance D between the antenna apparatus and the conductor plate 106 is an even number multiple of the quarter wavelength, the antenna gain of the horizontally polarized wave component is maximized. Therefore, operation is performed in the case where the antenna apparatus is located adjacent to the conductor plate 106 in a manner that the antenna gain of the vertically polarized wave component increases when the antenna gain of the horizontally polarized wave component decreases, and the antenna gain of the horizontally polarized wave component increases when the antenna gain of the vertically polarized wave component decreases.

Figure 58:
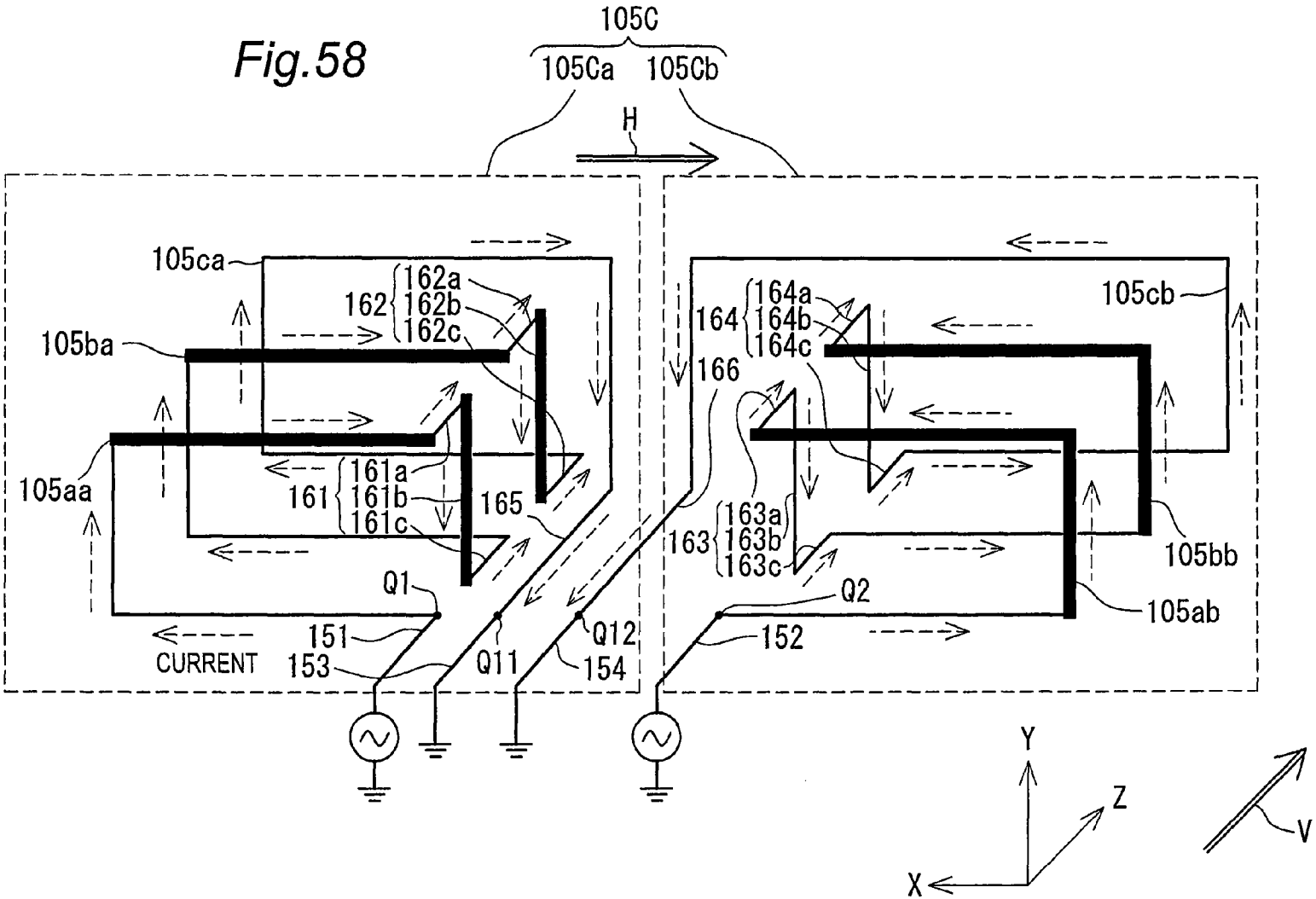
FIG. 58 is a perspective view showing a direction of a current in the small loop antenna element 105C when wireless signals are unbalancedly fed in phase to the clockwise small loop antenna 105Ca and the counterclockwise small loop antenna 105Cb of FIG. 56.

FIG. 58 is a perspective view showing a direction of a current in the small loop antenna element 105C when wireless signals are unbalancedly fed in phase to the clockwise small loop antenna 105Ca and the counterclockwise small loop antenna 105Cb of FIG. 56. As apparent from FIG. 58, in the case of in-phase feed, currents flowing through the loops formed of the clockwise small loop antenna 105Ca and the counterclockwise small loop antenna 105Cb, or the portions that radiate the horizontally polarized wave have mutually opposite rotational directions, and therefore, the horizontally polarized wave component decreases. Moreover, currents flowing through the portions in the Z-axis direction of the clockwise small loop antenna 105Ca and the counterclockwise small loop antenna 105Cb, or the portions that radiate the vertically polarized wave have a mutually identical direction, and therefore, the vertically polarized wave component increases.

Figure 59:
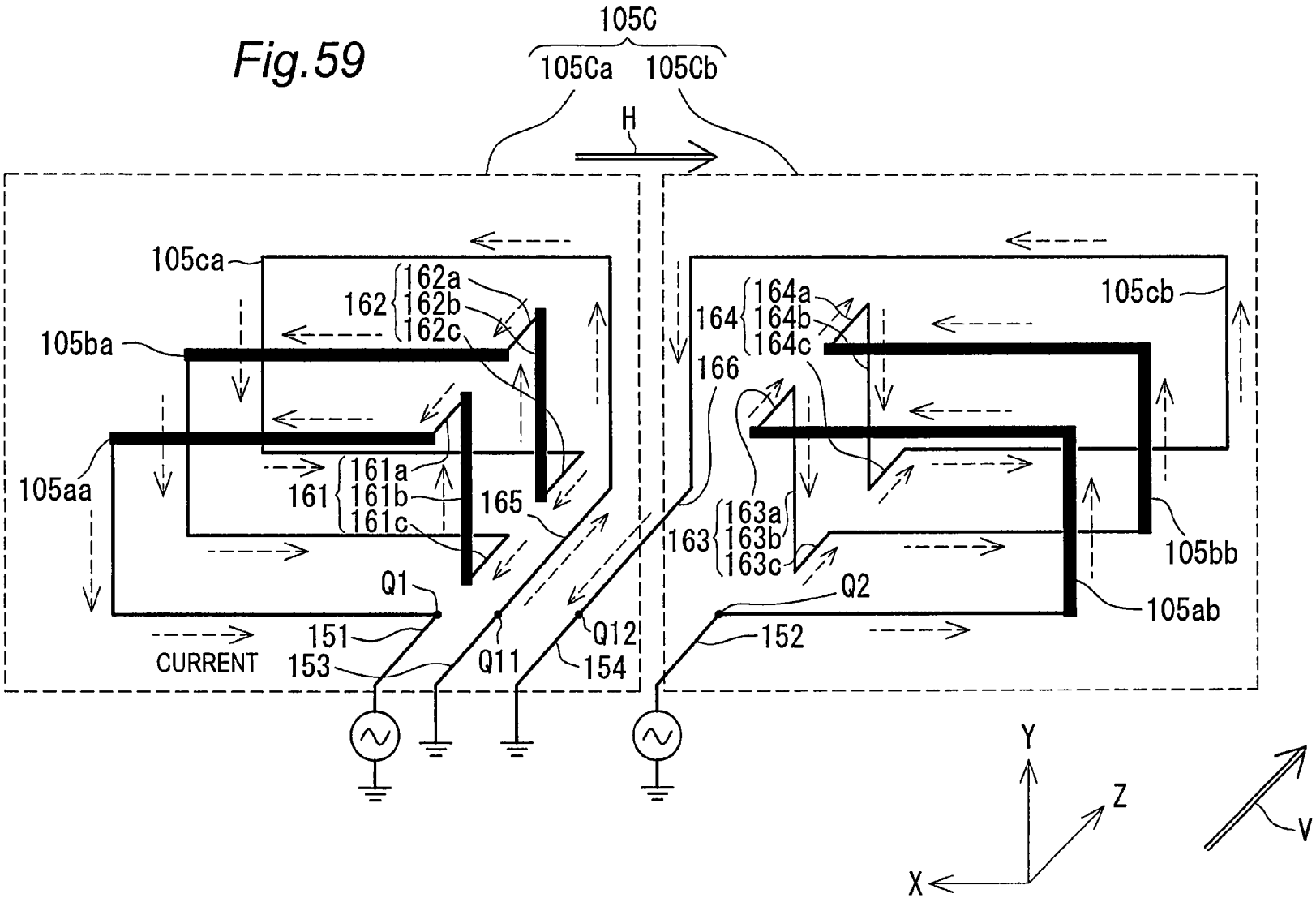
FIG. 59 is a perspective view showing a direction of a current in the small loop antenna element 105C when wireless signals are unbalancedly fed in anti-phase to the clockwise small loop antenna 105Ca and the counterclockwise small loop antenna 105Cb of FIG. 56.

FIG. 59 is a perspective view showing a direction of a current in the small loop antenna element 105C when wireless signals are unbalancedly fed in anti-phase to the clockwise small loop antenna 105Ca and the counterclockwise small loop antenna 105Cb of FIG. 56. As apparent from FIG. 59, in the case of anti-phase feed, the connecting conductors 165 and 166 are fed short-circuited to the grounding conductor plate 101.

Figure 60:
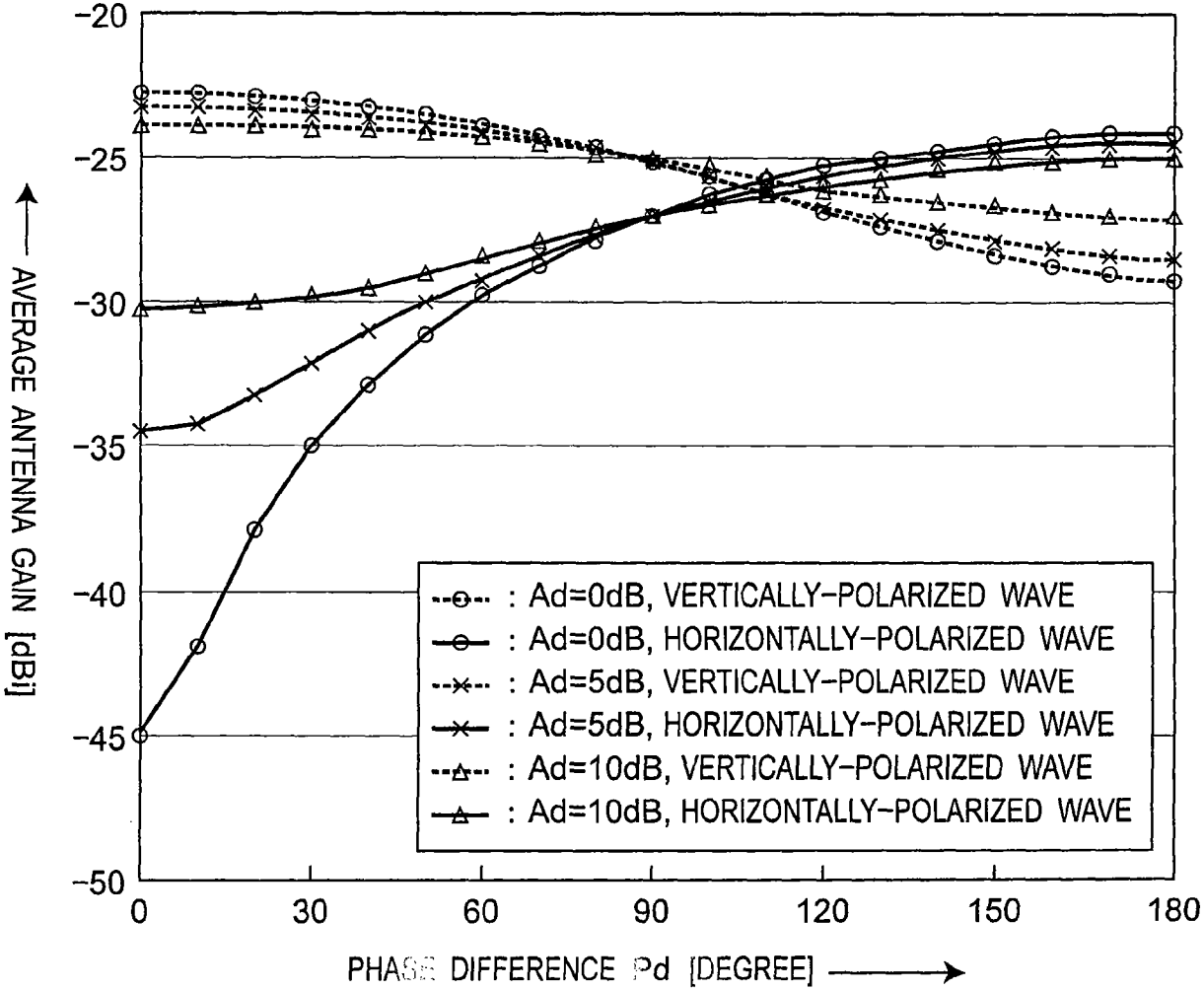
FIG. 60 is a graph showing an average antenna gain on the X-Y plane of the horizontally polarized wave component and the vertically polarized wave component with respect to a phase difference between two wireless signals applied to the clockwise small loop antenna 105Ca and the counterclockwise small loop antenna 105Cb of the small loop antenna element 105C of FIG. 56.

FIG. 60 is a graph showing an average antenna gain on the X-Y plane of the horizontally polarized wave component and the vertically polarized wave component with respect to a phase difference between two wireless signals applied to the clockwise small loop antenna 105Ca and the counterclockwise small loop antenna 105Cb of the small loop antenna element 105C of FIG. 56. The graph shows calculated values at a frequency of 426 MHz. As apparent from FIG. 60, it can be understood that, the antenna gains of the vertically polarized wave component and the horizontally polarized wave component can be changed by changing at least one of the phase difference Pd and the amplitude difference Ad between two wireless signals fed to the clockwise small loop antenna 105Ca and the counterclockwise small loop antenna 105Cb, and the polarized wave components can be adjusted substantially identical by setting the phase difference Pd to about 110 degrees.

As described above, according to the present preferred embodiment, by setting the phase difference Pd and the amplitude difference Ad between the two wireless signals fed to the clockwise small loop antenna 105Ca and the counterclockwise small loop antenna 105Cb to predetermined values, the antenna gains of the vertically polarized wave component and the horizontally polarized wave component can be set so as to become substantially identical, and this allows the provision of an antenna apparatus that obtains the antenna gain of a substantially constant composite component regardless of the distance D between the antenna apparatus and the conductor plate 106.

Nineteenth Preferred Embodiment

Figure 61:
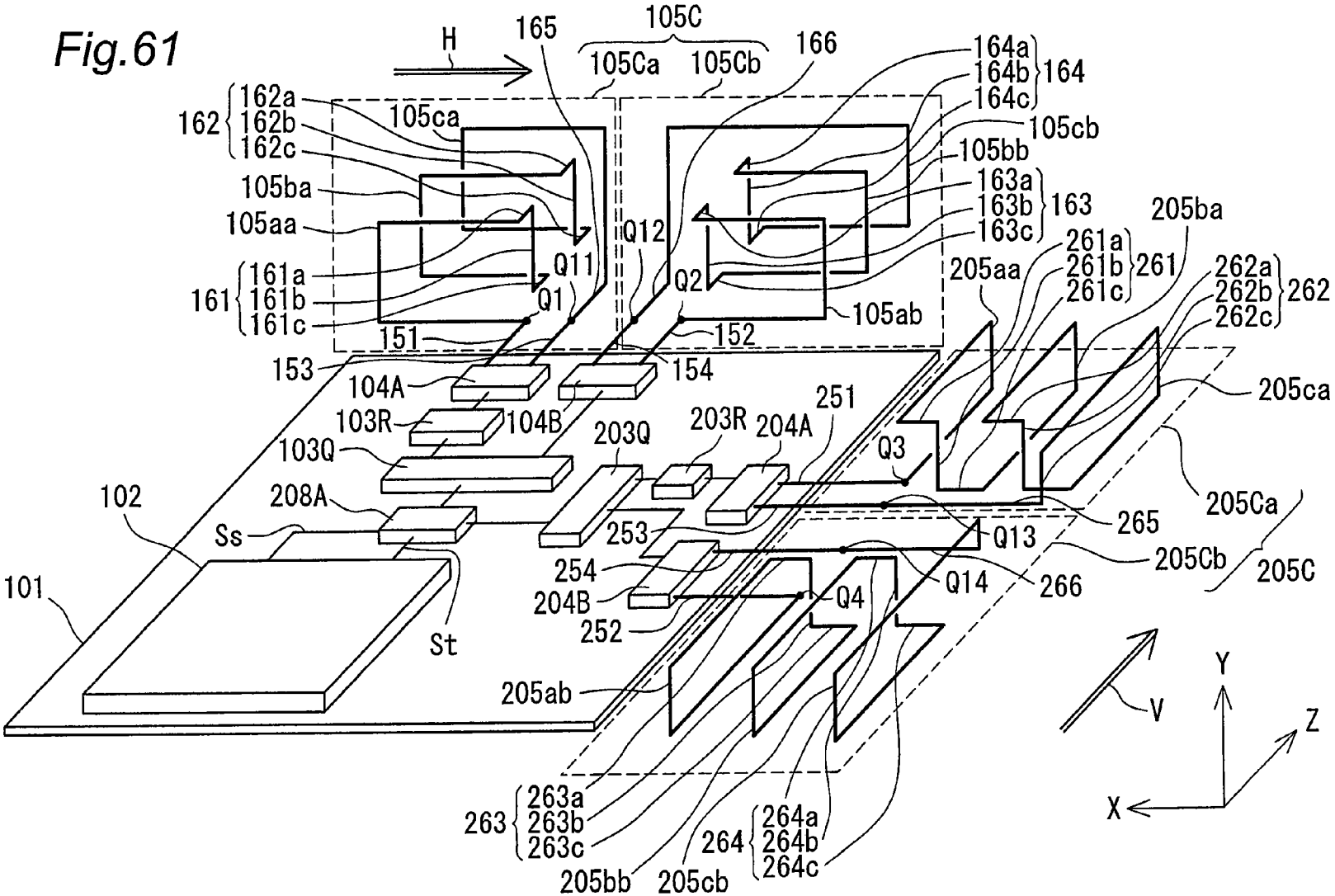
FIG. 61 is a perspective view showing a configuration of an antenna apparatus having small loop antenna elements 105C and 205C according to a nineteenth preferred embodiment of the invention.

FIG. 61 is a perspective view showing a configuration of an antenna apparatus having small loop antenna elements 105C and 205C according to the nineteenth preferred embodiment of the invention. The antenna apparatus of the nineteenth preferred embodiment differs from the antenna apparatus of the fifteenth preferred embodiment of FIG. 51 in the following points.

(1) A small loop antenna element 105C is provided in place of the small loop antenna element 105B.

(2) A small loop antenna element 205C, which has a configuration similar to that of the small loop antenna element 105C and in which the small loop antenna element 105C and its loop axis become orthogonal to each other is provided in place of the small loop antenna element 205B.

(3) A distributor 103Q, an amplitude-to-phase converter 103R, and impedance matching circuits 104A and 104B are provided in place of the balanced-to-unbalanced transformer circuit 103P and the impedance matching circuit 104.

(4) A distributor 203Q, an amplitude-to-phase converter 203R and impedance matching circuits 204A and 204B, which have configurations similar to those of the distributor 103Q, the amplitude-to-phase converter 103R and the impedance matching circuits 104A and 104B, are provided in place of the balanced-to-unbalanced transformer circuit 203P and the impedance matching circuit 204.

(5) The polarization switchover circuit 208A of FIG. 36 is provided in place of the switch 208.

The points of difference are described below.

Referring to FIG. 61, the small loop antenna element 205C is configured to include half-loop antenna portions 205*aa*, 205*ab*, 205*ba*, 205*bb*, 205*ca*, 205*cb* and connecting conductors 261 to 266 and has feeding points Q3, Q13, Q4 and Q14. The feeding points Q3 and Q13 are connected to the impedance matching circuit 204A via feed conductors 251 and 253, respectively, and the feeding points Q4 and Q14 are connected to an impedance matching circuit 204B via the feed conductors 252 and 254, respectively. Further, the distributor 203Q distributes the transmitted wireless signal inputted from the wireless transceiver circuit 102 via the polarization switchover circuit 208A into two and outputs the resulting signals to the amplitude-to-phase converter 203R and the impedance matching circuit 204B. The amplitude-to-phase converter 203R converts at least one of the amplitude and the phase of the inputted wireless signal into a predetermined value and outputs the value to the impedance matching circuit 204A.

Figure 62A:
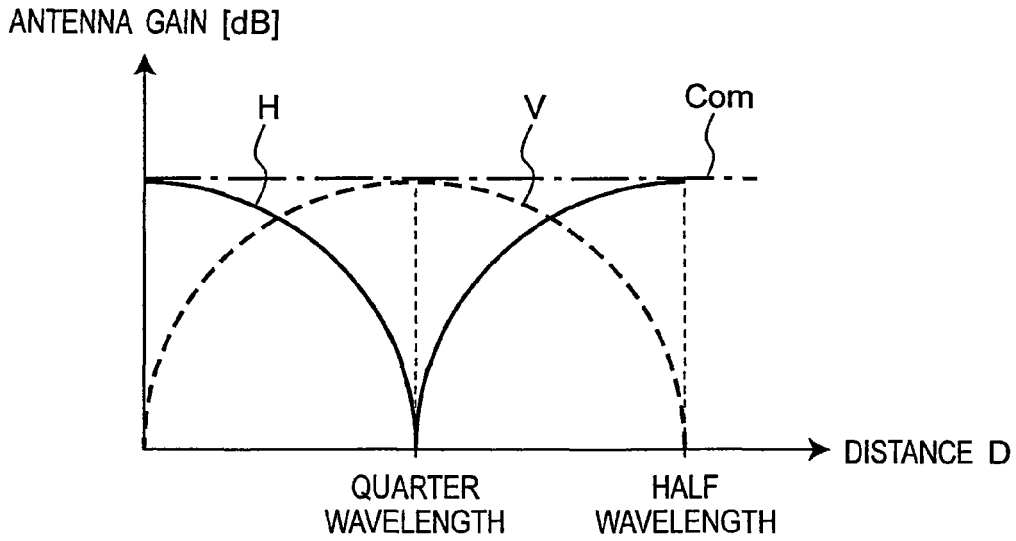
FIG. 62(*a*) is a graph showing a composite antenna gain in the direction opposite to the direction from the antenna apparatus toward the conductor plate 106 with respect to the distance D between the antenna apparatus and the conductor plate 106 when the maximum value of the antenna gain of the vertically polarized wave component of the small loop antenna element 105C is substantially equal to the maximum value of the antenna gain of the horizontally polarized wave component in a case where wireless signals are fed to the clockwise small loop antenna 105Ca and the counterclockwise small loop antenna 105Cb in the antenna apparatus of FIG. 61.
Figure 62B:
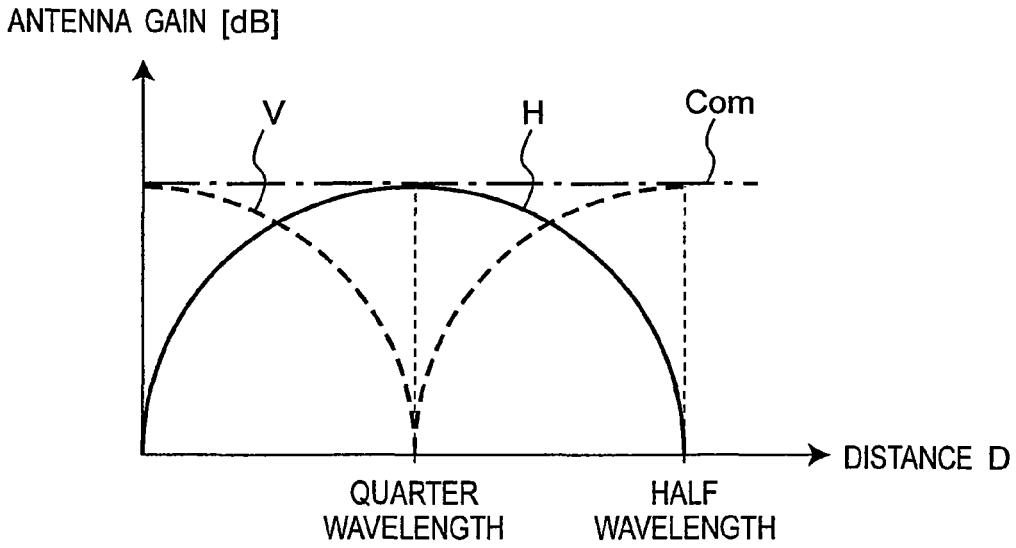

FIG. 62(*a*) is a graph showing a composite antenna gain in the direction opposite to the direction from the antenna apparatus toward the conductor plate 106 with respect to the distance D between the antenna apparatus and the conductor plate 106 when the maximum value of the antenna gain of the vertically polarized wave component of the small loop antenna element 105C is substantially equal to the maximum value of the antenna gain of the horizontally polarized wave component in a case where wireless signals are fed to the clockwise small loop antenna 105Ca and the counterclockwise small loop antenna 105Cb in the antenna apparatus of FIG. 61. FIG. 62(*b*) is a graph showing a composite antenna gain in the direction opposite to the direction from the antenna apparatus toward the conductor plate 106 with respect to the distance D between the antenna apparatus and the conductor plate 106 when the maximum value of the antenna gain of the vertically polarized wave component of the small loop antenna element 205C is substantially equal to the maximum value of the antenna gain of the horizontally polarized wave component in a case where wireless signals are fed to the clockwise small loop antenna 205Ca and the counterclockwise small loop antenna 205Cb in the antenna apparatus of FIG. 61.

In a manner similar to that of the eighteenth preferred embodiment, when the antenna gains of the vertically polarized wave component and the horizontally polarized wave component are set substantially identical by setting the phase difference and the amplitude difference between the two wireless signals fed to the clockwise small loop antenna 105Ca and the counterclockwise small loop antenna 105Cb to predetermined values, the antenna gain of a substantially constant composite component is obtained regardless of the distance D between the antenna apparatus and the conductor plate 106 in feeding the clockwise small loop antenna 105Ca and counterclockwise small loop antenna 105Cb as shown in FIG. 62(*a*). In a manner similar to above, when the antenna gains of the vertically polarized wave component and the horizontally polarized wave component are set substantially identical by setting the phase difference and the amplitude difference between the two wireless signals fed to the clockwise small loop antenna 205Ca and the counterclockwise small loop antenna 205Cb to predetermined values, the antenna gain of a substantially constant composite component can be obtained regardless of the distance D between the antenna apparatus and the conductor plate 106 in feeding the clockwise small loop antenna 205Ca and counterclockwise small loop antenna 205Cb as shown in FIG. 62(*b*). Moreover, the polarized wave component radiated from the antenna apparatus in feeding the clockwise small loop antenna 105Ca and the counterclockwise small loop antenna 105Cb regardless of the distance D between the antenna apparatus and the conductor plate 106 and the polarized wave component radiated from the antenna apparatus in feeding the clockwise small loop antenna 205Ca and counterclockwise small loop antenna 205Cb are in an orthogonal relation.

The shape of the grounding conductor plate 101 is substantially square, and the clockwise small loop antenna 105Ca and the clockwise small loop antenna apparatus 205Ca have substantially the same dimensions as those of the counterclockwise small loop antenna 105Cb and the counterclockwise small loop antenna apparatus 205Cb, respectively. Therefore, the antenna gain does not change between feeding the clockwise small loop antenna 105Ca and the counterclockwise small loop antenna 105Cb and feeding the clockwise small loop antenna apparatus 205Ca and the counterclockwise small loop antenna apparatus 205Cb, and only the polarization changes by 90 degrees. Therefore, no gain variation is caused by the polarization switchover by the polarization switchover circuit 208A.

As described above, according to the present preferred embodiment, by providing the clockwise small loop antenna 205Ca and the counterclockwise small loop antenna 205Cb having the configurations similar to those of the clockwise small loop antenna 105Ca and the counterclockwise small loop antenna 105Cb in the direction orthogonal to the clockwise small loop antenna 105Ca and the counterclockwise small loop antenna 105Cb on the X-Z plane, the gain variation due to the polarization plane discordance caused by the variation in the communication posture can be suppressed by changing the polarization plane by 90 degrees by switchover between feeding the clockwise small loop antenna 105Ca and the counterclockwise small loop antenna 105Cb and feeding between the clockwise small loop antenna 205Ca and the counterclockwise small loop antenna apparatus 205Cb by the polarization switchover circuit 208A even when one of the polarized wave of the vertically and horizontally polarized waves is largely attenuated in a manner similar to that of such a case that the distance D between the antenna apparatus and the conductor plate 106 is sufficiently shorter with respect to the wavelength or a multiple of the quarter wavelength.

First Implemental Example

In the first implemental example, a simulation and the result of a radiative change with respect to the loop interval are described below.

Figure 63:
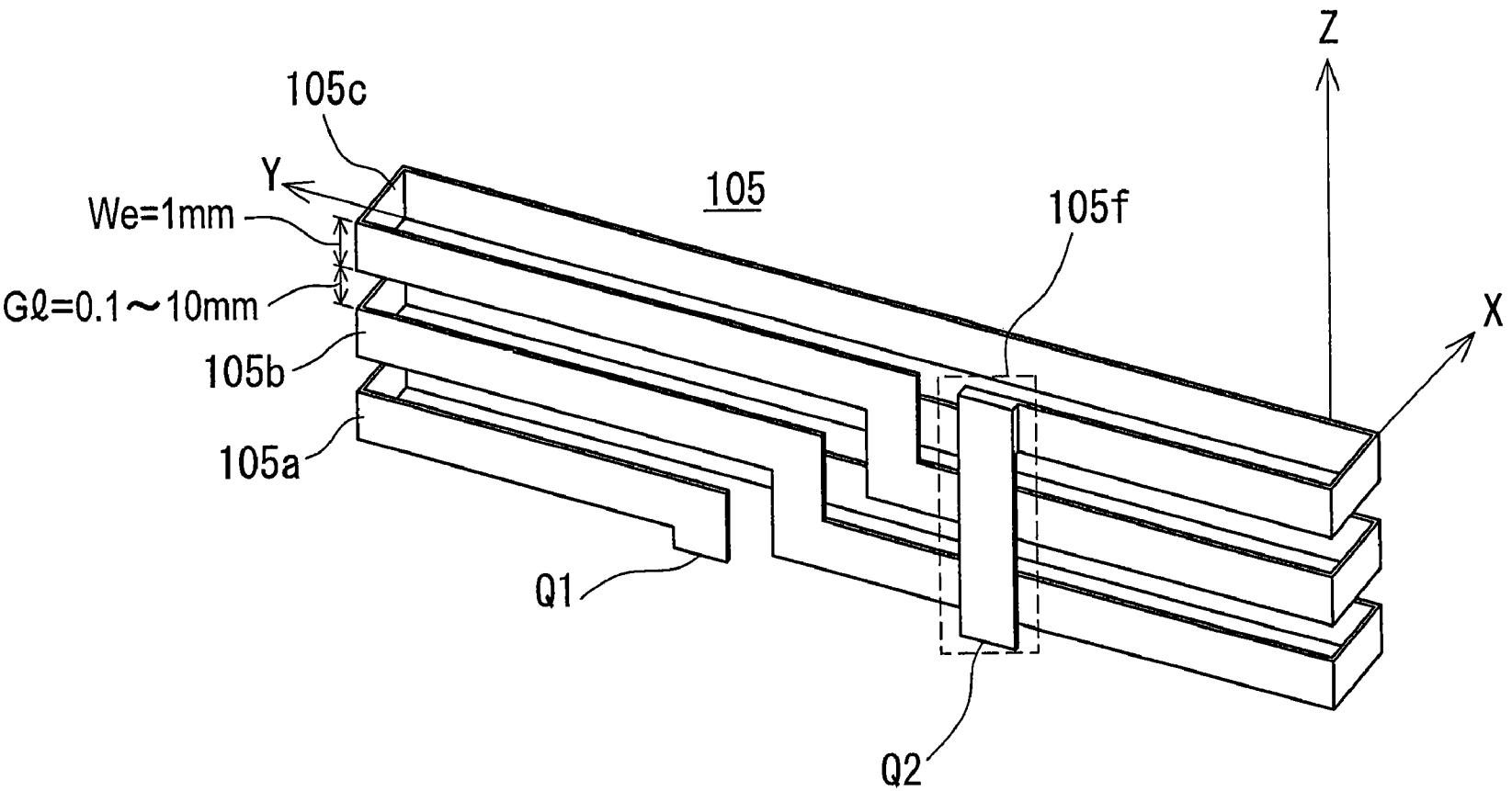
FIG. 63 is a perspective view showing a simulation of a radiative change with respect to a loop interval and the configuration of a small loop antenna element 105 for obtaining the result in a first implemental example of the present preferred embodiment.

FIG. 63 is a perspective view showing a simulation of a radiative change with respect to the loop interval and the configuration of a small loop antenna element 105 for obtaining the result in the first implemental example of the present preferred embodiment. Referring to FIG. 63, the reference numeral 105*f* denotes a connecting conductor that is a so-called loop return portion of the small loop antenna element 105, We denotes the element width of the small loop antenna element 105, and G1 denotes the loop interval.

Figure 64A:
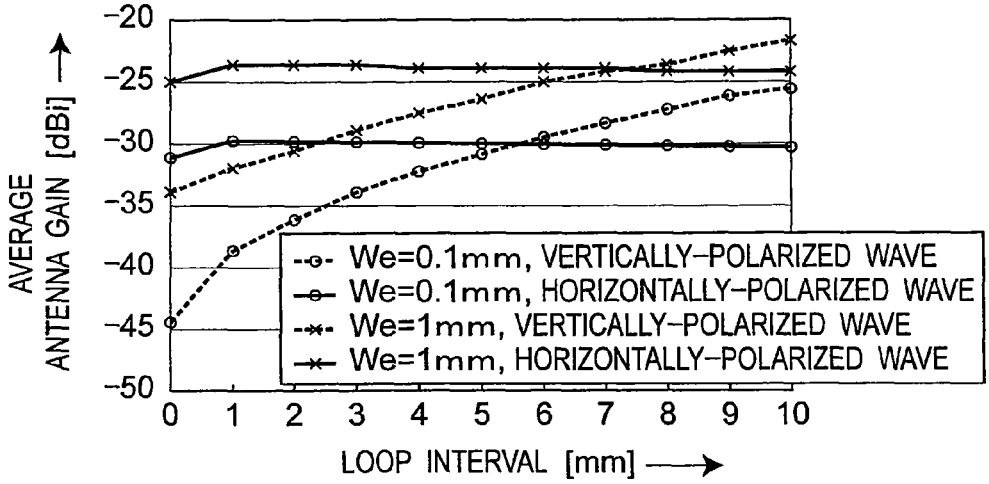
FIG. 64(*a*) is a graph showing an average antenna gain with respect to a loop interval when an element width We and a polarized wave are changed in the small loop antenna element of the first implemental example.
Figure 64B:
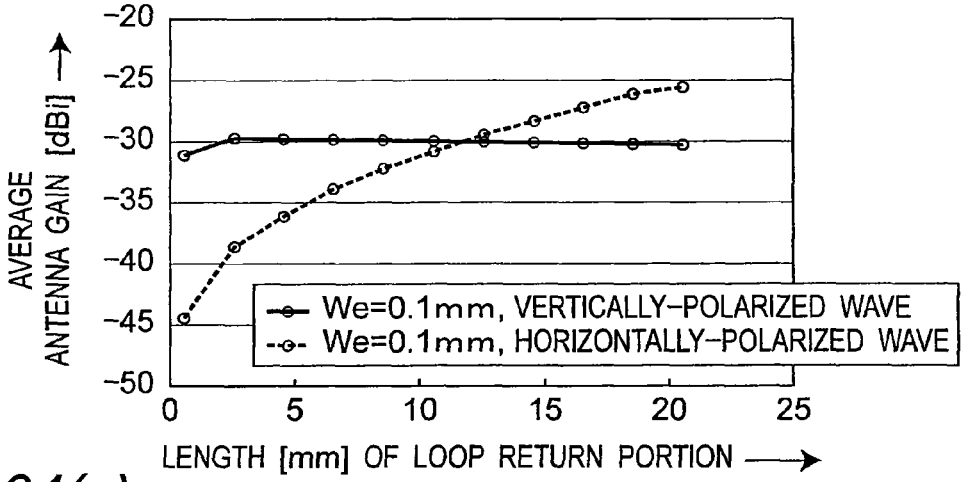
Figure 64C:
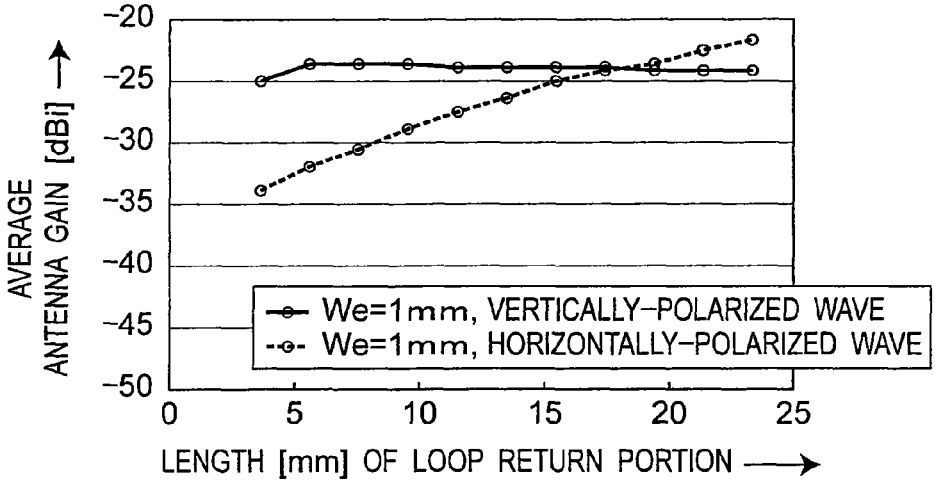
Figure 65A:
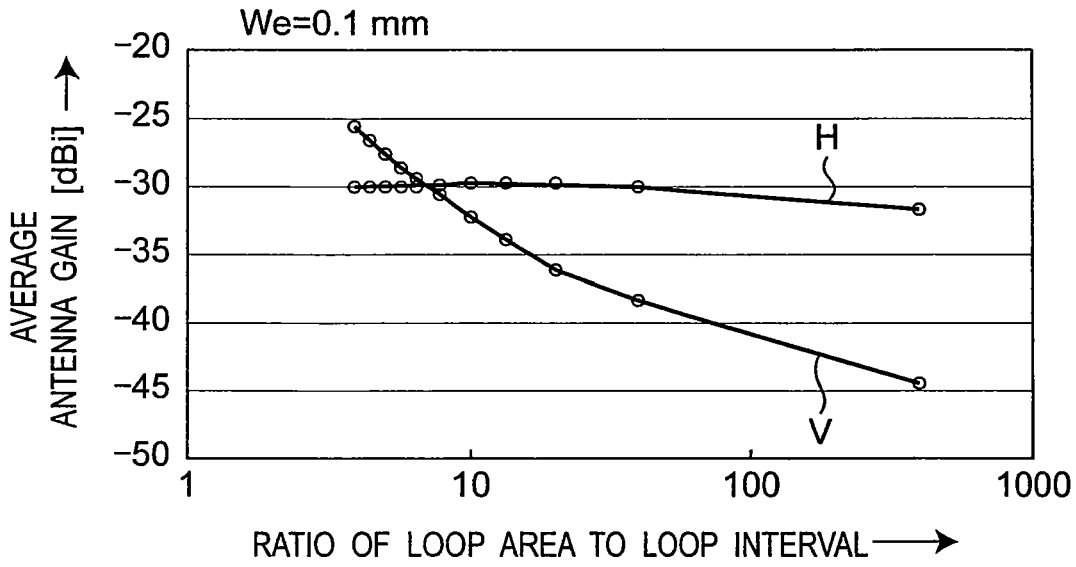
FIG. 65(*a*) is a graph showing an average antenna gain with respect to a ratio between a loop area and a loop interval when the polarized wave is changed in the small loop antenna element of the first implemental example.
Figure 65B:
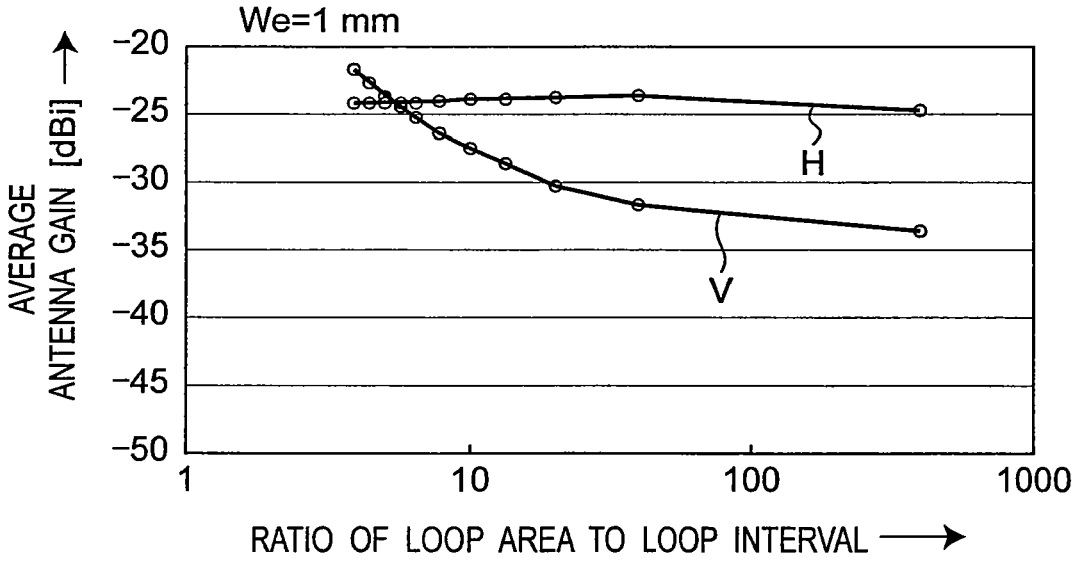
Figure 66A:
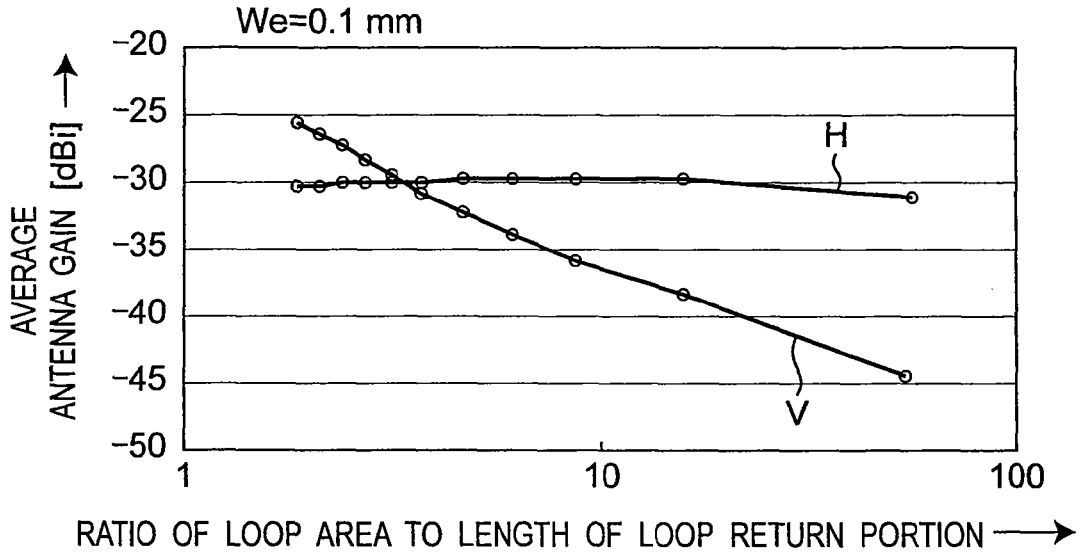
FIG. 66(*a*) is a graph showing an average antenna gain with respect to a ratio between the loop area and the length of the loop return portion when the polarized wave is changed in the small loop antenna element of the first implemental example.
Figure 66B:
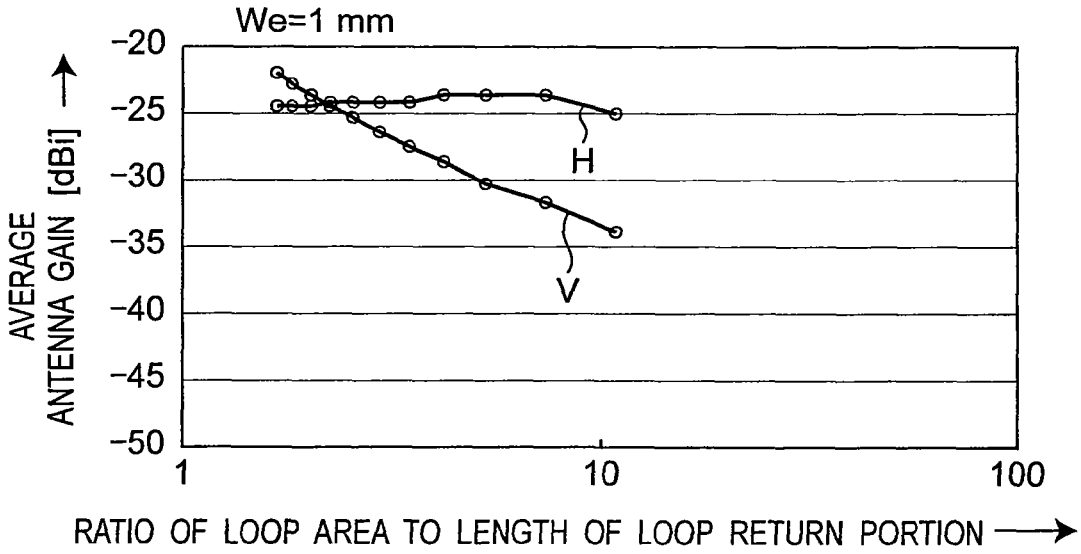

FIG. 64(*a*) is a graph showing an average antenna gain with respect to a loop interval when an element width We and a polarized wave are changed in the small loop antenna element of the first implemental example. FIG. 64(*b*) is a graph showing an average antenna gain with respect to the length of a loop return portion when the polarized wave is changed in the small loop antenna element of the first implemental example. FIG. 64(*c*) is a graph showing an average antenna gain with respect to the length of the loop return portion when the polarized wave is changed in the small loop antenna element of the first implemental example. FIG. 65(*a*) is a graph showing an average antenna gain with respect to a ratio between a loop area and a loop interval when the polarized wave is changed in the small loop antenna element of the first implemental example. FIG. 65(*b*) is a graph showing an average antenna gain with respect to the loop area and the loop interval when the polarized wave is changed in the small loop antenna element of the first implemental example. Further, FIG. 66(*a*) is a graph showing an average antenna gain with respect to a ratio between the loop area and the length of the loop return portion when the polarized wave is changed in the small loop antenna element of the first implemental example. FIG. 66(*b*) is a graph showing an average antenna gain with respect to the ratio between the loop area and the length of the loop return portion when the polarized wave is changed in the small loop antenna element of the first implemental example.

As apparent from FIG. 64(*a*), when the loop area is fixed, the horizontally polarized wave component H is constant, and only the vertically polarized wave component V monotonously increases as the loop interval increases. Moreover, as apparent from FIG. 65(*a*) and FIG. 65(*b*), the horizontally polarized wave component H and the vertically polarized wave component V become substantially identical when a ratio of the loop area to the loop interval is about six to seven, which is most preferable. For example, the loop interval cannot be sufficiently provided due to a mechanical restriction and the vertically polarized wave component V is smaller than the horizontally polarized wave component H, the vertically polarized wave component V can be increased by changing the phase difference and the amplitude difference of unbalanced feed. Furthermore, as apparent from FIG. 64(*a*), the horizontally polarized wave component H is constant when the loop interval increases, and a monotonous change in the vertically polarized wave component V does not change even if the element width is changed. Moreover, since an increase in the radiation efficiency due to the element width differs depending on the small loop antenna and the linear antenna, it can be understood that the ratio of the horizontally polarized wave component H to the vertically polarized wave component V cannot be expressed simply by the ratio of the loop area to the loop return portion.

Second Implemental Example

In the second implemental example, a method for adjusting the horizontally polarized wave component and the vertically polarized wave component by the number of turns of the helical winding small loop antenna element 105 is described below.

Figure 67A:
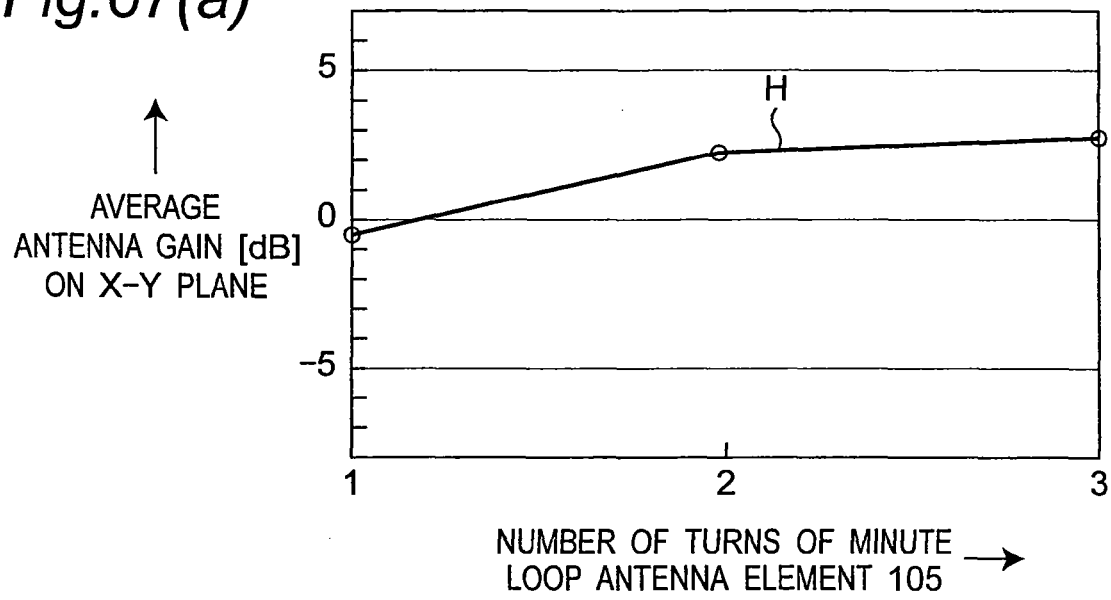
FIG. 67(*a*) is a graph showing an average antenna gain on the X-Y plane concerning the horizontally polarized wave with respect to the number of turns of a small loop antenna element 105 (small loop antenna element of a helical coil shape) according to a second implemental example of the present preferred embodiment.
Figure 67B:
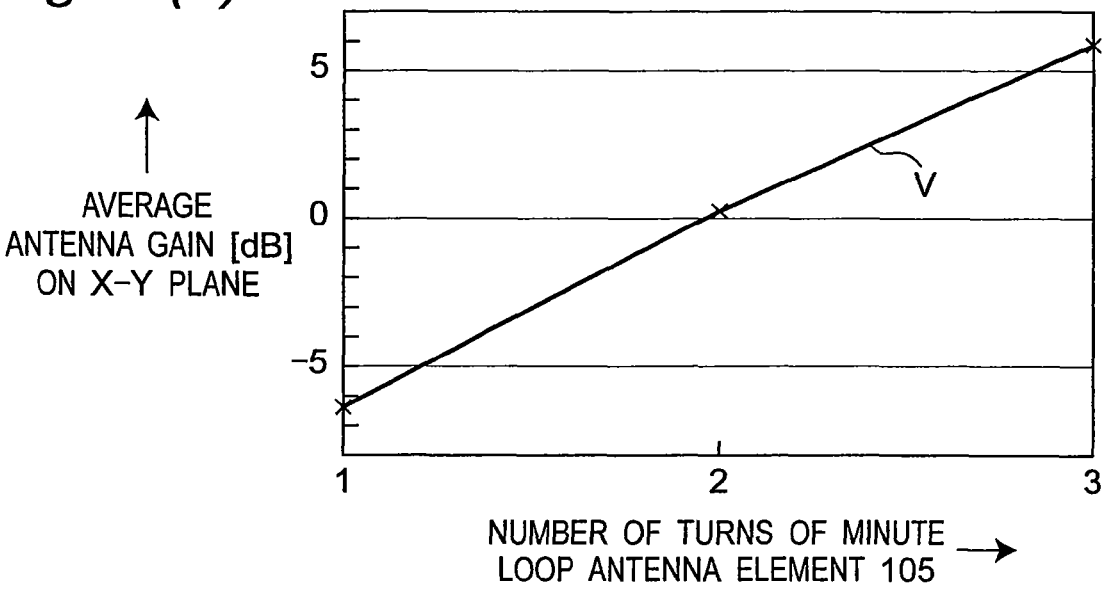

FIG. 67(*a*) is a graph showing an average antenna gain on the X-Y plane concerning the horizontally polarized wave with respect to the number of turns of a small loop antenna element 105 (small loop antenna element of a helical coil shape) according to the second implemental example of the present preferred embodiment. FIG. 67(*b*) is a graph showing an average antenna gain on the X-Y plane concerning the vertically polarized wave with respect to the number of turns of the small loop antenna element 105 (small loop antenna element of a helical coil shape) according to the second implemental example of the present preferred embodiment. As apparent from FIG. 67(*a*) and FIG. 67(*b*), a balance between the horizontally polarized wave component and the vertically polarized wave component can be adjusted by changing the number of turns of the small loop antenna element 105.

Third Implemental Example

In the third implemental example, a case where both the amplitude difference Ad and the phase difference Pd are changed in the small loop antenna element 105 of the first to third preferred embodiments is described below.

Figure 68:
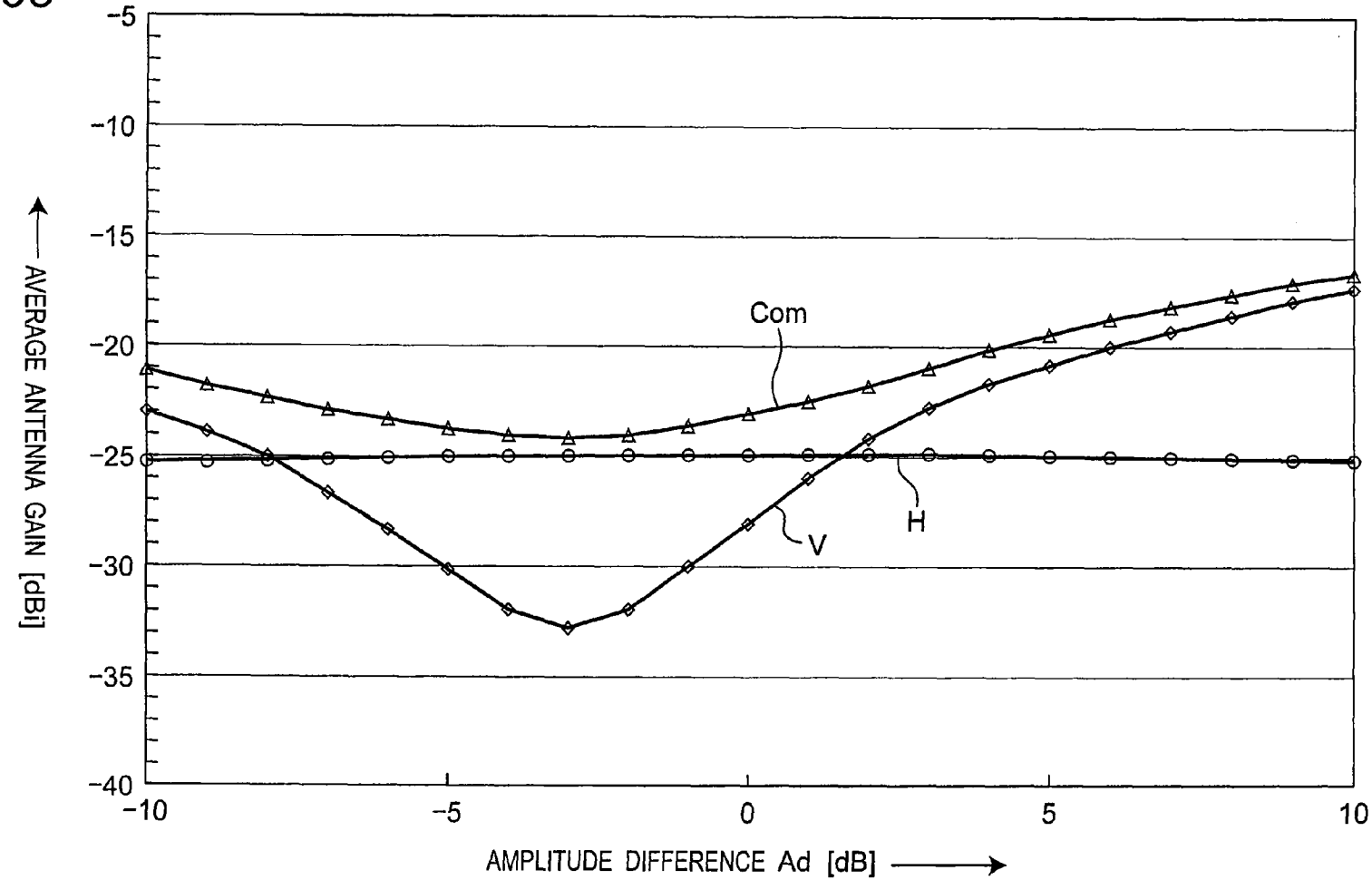
FIG. 68 is a graph showing an average antenna gain with respect to the amplitude difference Ad in a small loop antenna element according to a third implemental example of the first to third preferred embodiments.
Figure 69:
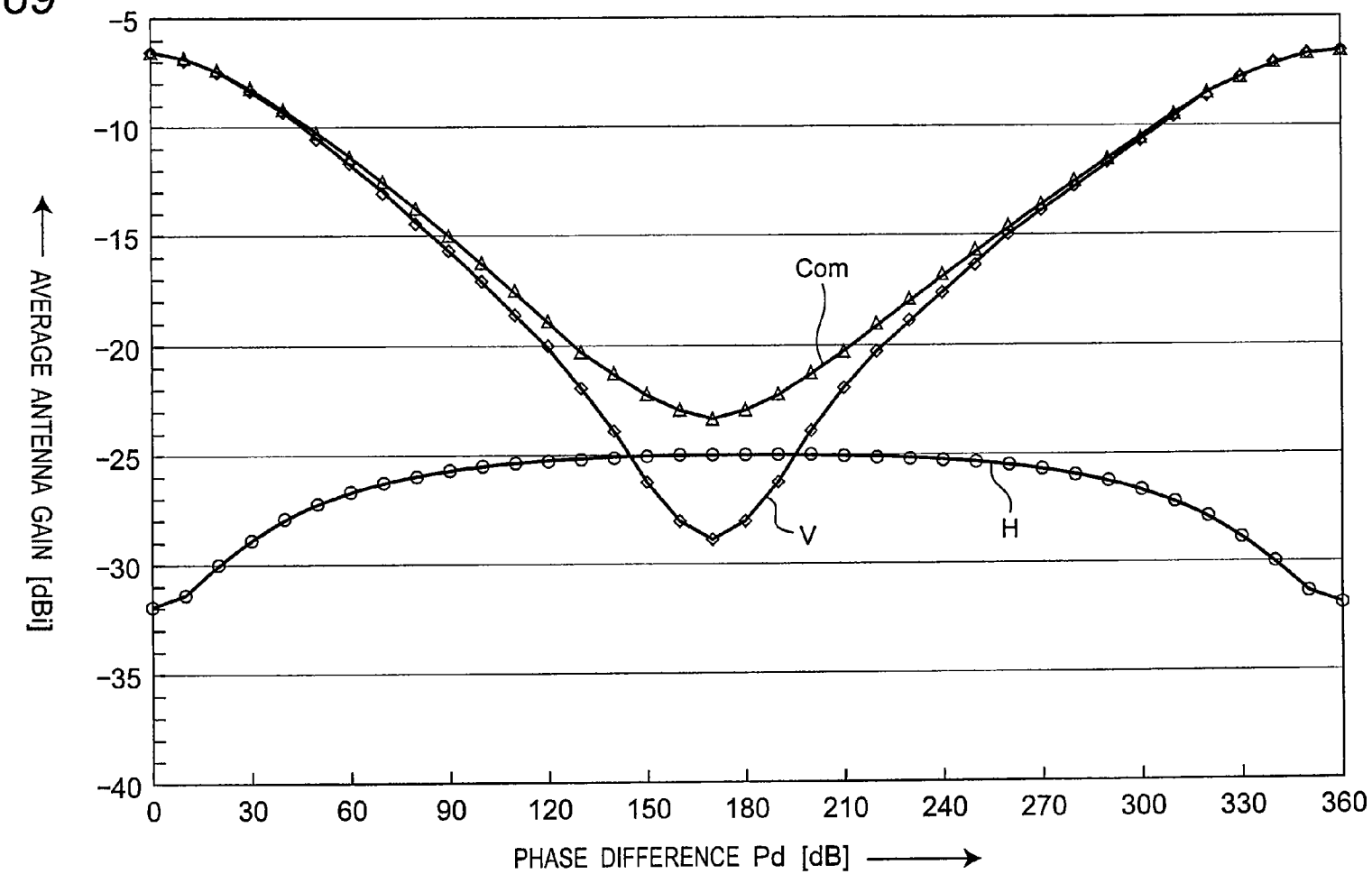
FIG. 69 is a graph showing an average antenna gain with respect to the phase difference Pd in the small loop antenna element of the third implemental example of the first to third preferred embodiments.
Figure 70:
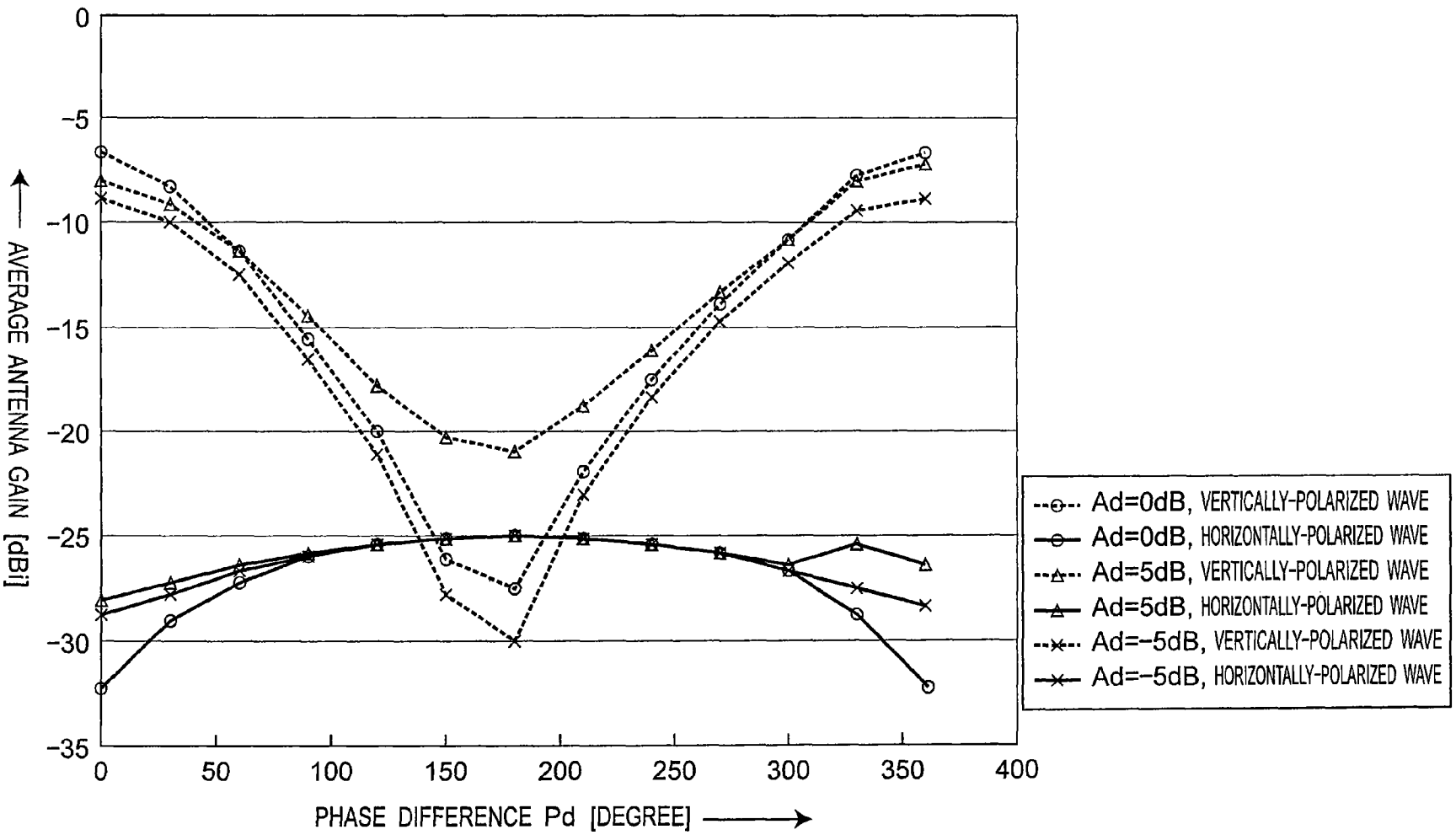
FIG. 70 is a graph showing an average antenna gain with respect to the phase difference Pd when the amplitude difference Ad and the polarized wave are changed in the small loop antenna element of the third implemental example of the first to third preferred embodiments.

FIG. 68 is a graph showing an average antenna gain with respect to the amplitude difference Ad in a small loop antenna element according to the third implemental example of the first to third preferred embodiments. FIG. 69 is a graph showing an average antenna gain with respect to the phase difference Pd in the small loop antenna element of the third implemental example of the first to third preferred embodiments. Further, FIG. 70 is a graph showing an average antenna gain with respect to the phase difference Pd when the amplitude difference Ad and the polarized wave are changed in the small loop antenna element of the third implemental example of the first to third preferred embodiments. As apparent from FIG. 68 to FIG. 70, the average antenna gain of each of the polarized wave components can be changed by changing at least one of the amplitude difference Ad and the phase difference Pd.

Fourth Implemental Example

In the fourth implemental example, various impedance matching methods of the impedance matching circuit 104 are described below. Since the small loop antenna element 105 has a small radiation resistance, an impedance matching circuit 104 of a very small loss is necessary. When an inductor, which has a loss larger than that of a capacitor, is employed in the impedance matching circuit 104, the radiation efficiency deteriorates, and the antenna gain is largely decreased. Therefore, it is preferable to use the impedance matching method described below.

Figure 71A:
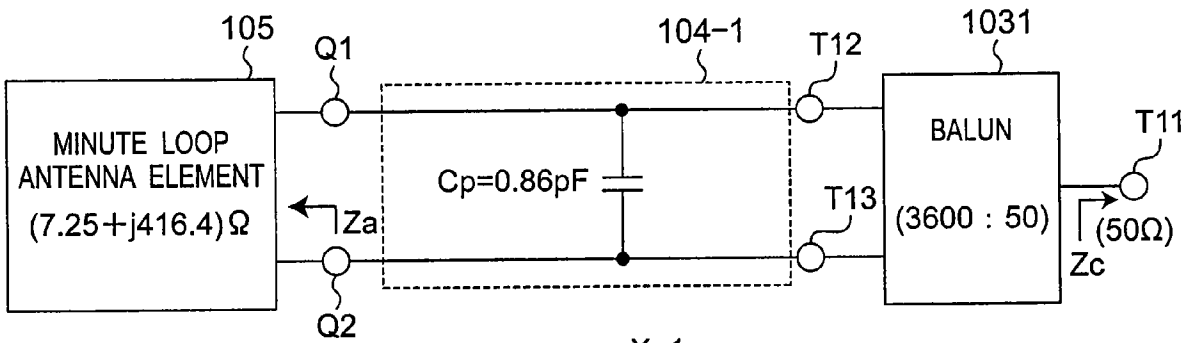
FIG. 71(*a*) is a circuit diagram showing a configuration of an impedance matching circuit 104-1 using a first impedance matching method according to a fourth implemental example of the present preferred embodiment.
Figure 71B:
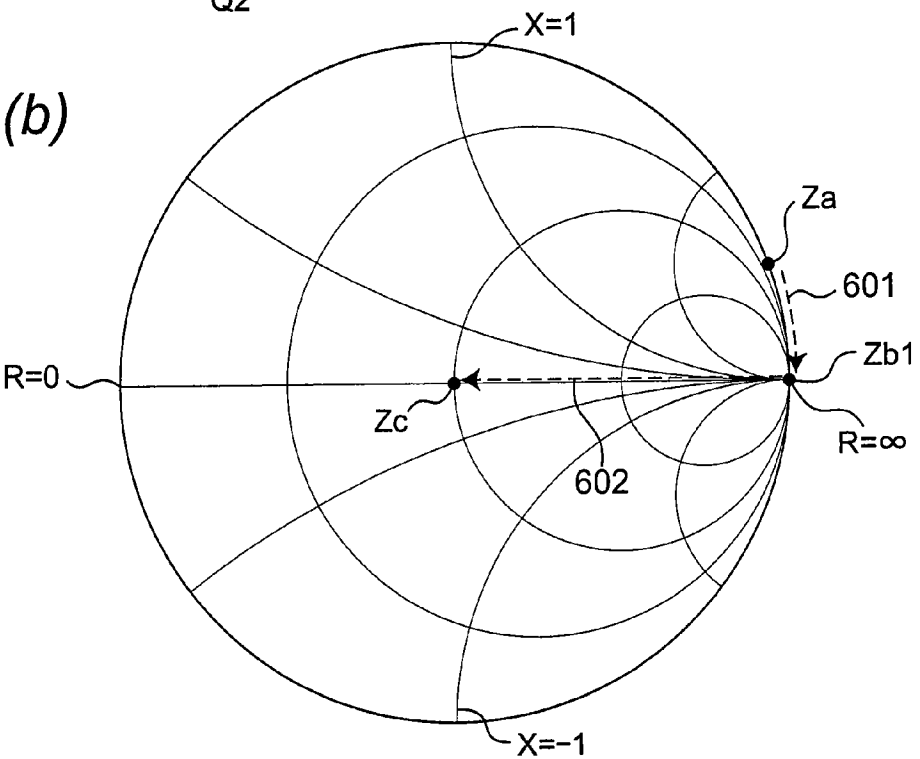

FIG. 71(*a*) is a circuit diagram showing a configuration of an impedance matching circuit 104-1 using a first impedance matching method according to the fourth implemental example of the present preferred embodiment. FIG. 71(*b*) is a Smith chart showing a first impedance matching method of FIG. 71(*a*). Referring to FIG. 71(*a*), an impedance matching circuit 104-1 is configured to include a parallel capacitor Cp. As shown in FIG. 71(*b*), an input impedance Za of the small loop antenna element 105 is formed into an impedance Zb1 by parallel resonance with the imaginary part of the impedance made zero by a parallel capacitor Cp (601), and thereafter, impedance matching to the input impedance Zc can be achieved by impedance conversion of a balun 1031 (602).

Figure 72A:
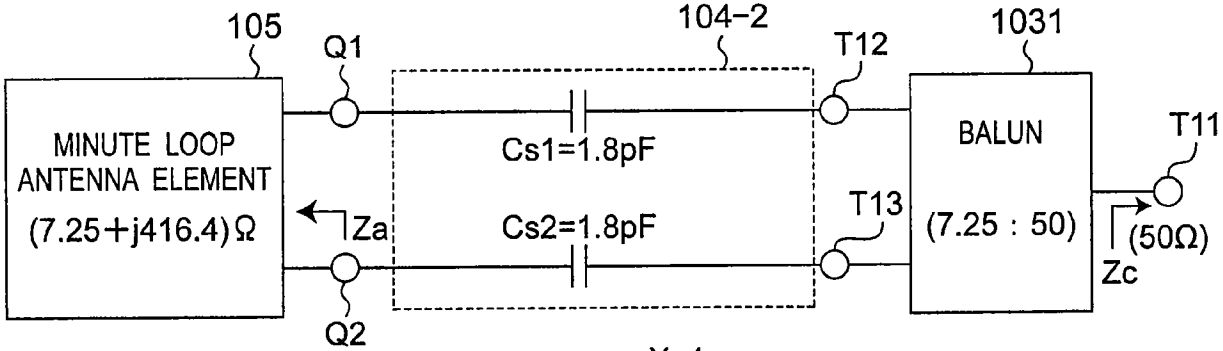
FIG. 72(*a*) is a circuit diagram showing a configuration of an impedance matching circuit 104-2 using a second impedance matching method of the fourth implemental example of the present preferred embodiment.
Figure 72B:
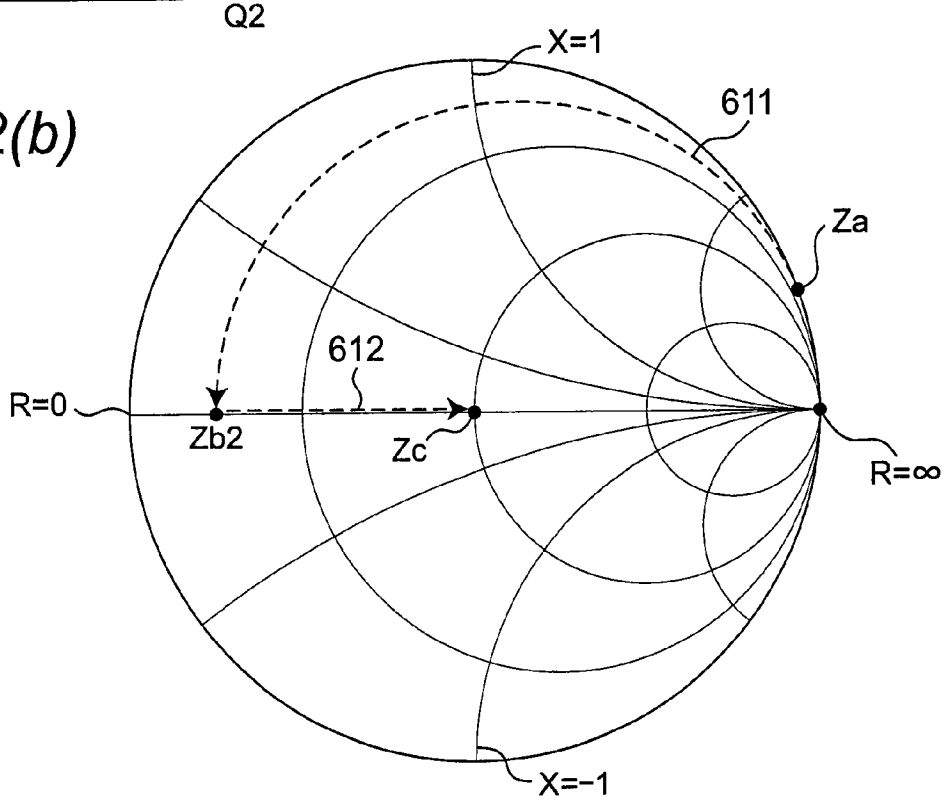

FIG. 72(*a*) is a circuit diagram showing a configuration of an impedance matching circuit 104-2 using a second impedance matching method of the fourth implemental example of the present preferred embodiment. FIG. 72(*b*) is a Smith chart showing a second impedance matching method of FIG. 72(*a*). Referring to FIG. 72(*a*), an impedance matching circuit 104-2 is configured to include two series capacitors Cs1 and Cs2. As shown in FIG. 72(*b*), an input impedance Za of the small loop antenna element 105 is formed into an impedance Zb2 by series resonance with the imaginary part of the impedance made zero by the two series capacitors Cs1 and Cs2 (611), and thereafter, impedance matching to the input impedance Za can be achieved by impedance conversion of a balun 1031 (612).

Figure 73A:
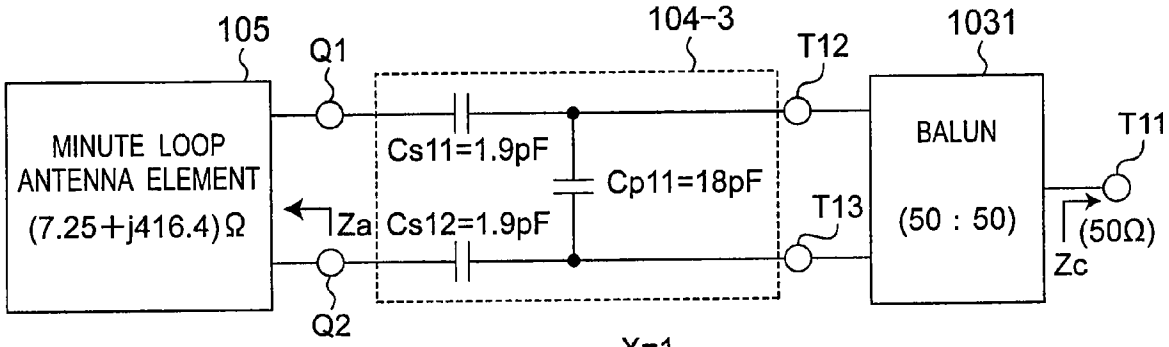
FIG. 73(*a*) is a circuit diagram showing a configuration of an impedance matching circuit 104-3 using a third impedance matching method of the fourth implemental example of the present preferred embodiment.
Figure 73B:
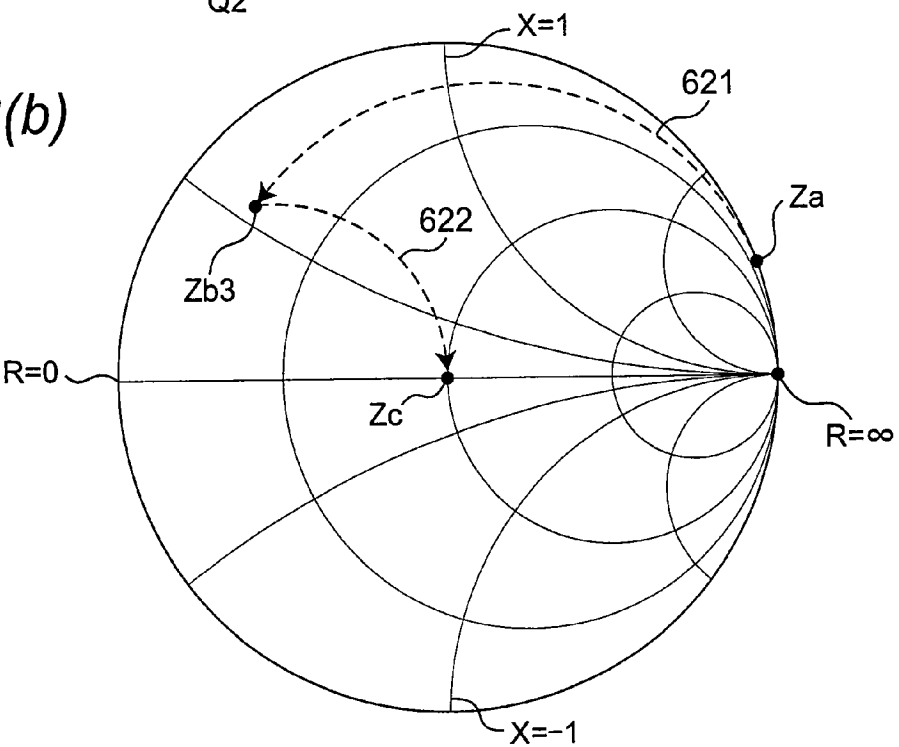

FIG. 73(*a*) is a circuit diagram showing a configuration of an impedance matching circuit 104-3 using a third impedance matching method of the fourth implemental example of the present preferred embodiment. FIG. 73(*b*) is a Smith chart showing a third impedance matching method of FIG. 73(*a*). Referring to FIG. 73(*a*), an impedance matching circuit 104-3 is configured to include a parallel capacitor Cp11 and two series capacitors Cs11 and Cs12. As shown in FIG. 73(*b*), an input impedance Za of the small loop antenna element 105 is formed into an impedance Zb3 by impedance conversion by the two series capacitors Cs11 and Cs12 (631), and thereafter, impedance matching to an impedance Zc can be achieved by the parallel capacitor Cp11 (632). It is noted that the balun 1031 may be eliminated.

Figure 74A:
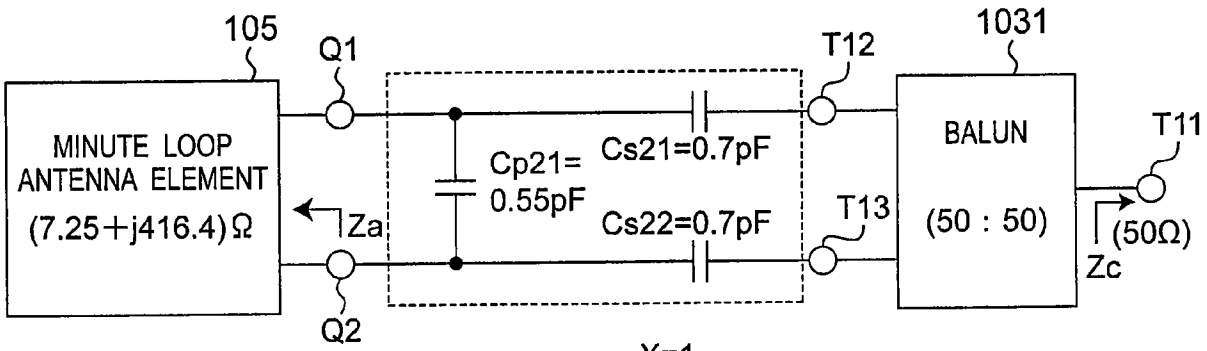
FIG. 74(*a*) is a circuit diagram showing a configuration of an impedance matching circuit 104-4 using a fourth impedance matching method of the fourth implemental example of the present preferred embodiment.
Figure 74B:
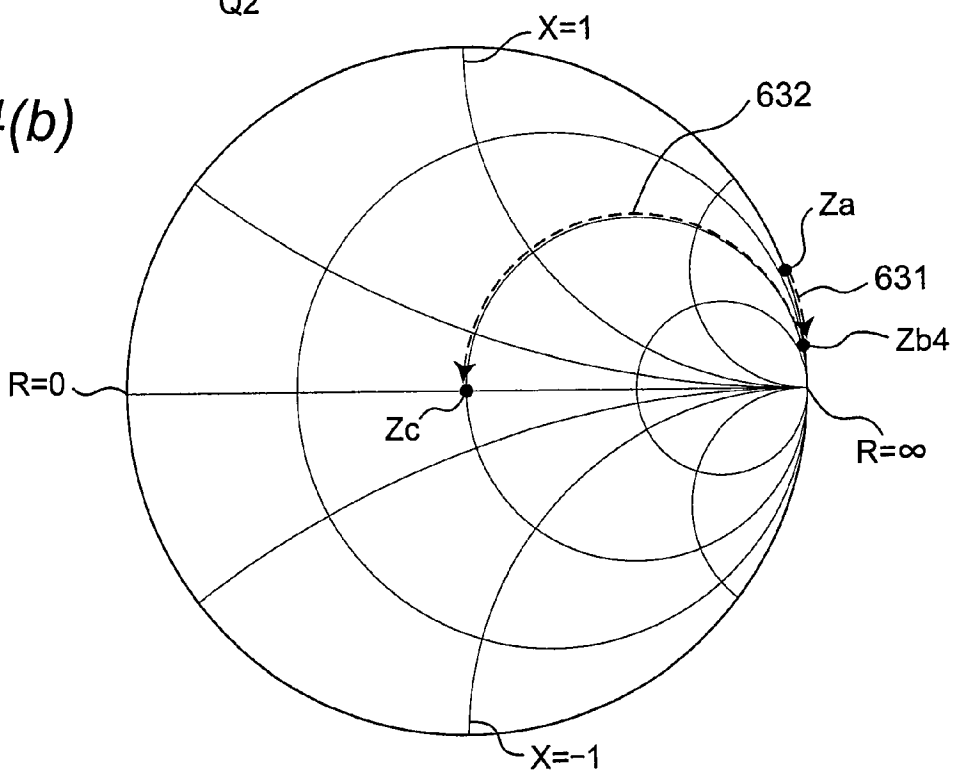

FIG. 74(*a*) is a circuit diagram showing a configuration of an impedance matching circuit 104-4 using a fourth impedance matching method of the fourth implemental example of the present preferred embodiment. FIG. 74(*b*) is a Smith chart showing a fourth impedance matching method of FIG. 74(*a*). Referring to FIG. 74(*a*), an impedance matching circuit 104-4 is configured to include a parallel capacitor Cp21 and two series capacitors Cs21 and Cs22. As shown in FIG. 74(*b*), input impedance Za of the small loop antenna element 105 is formed into impedance Zb4 by impedance conversion by the parallel capacitor Cp21 (631), and thereafter, impedance conversion to the impedance Zc can be achieved by the series capacitors Cs21 and Cs22 (632). It is noted that the balun 1031 may be eliminated.

Figure 75:
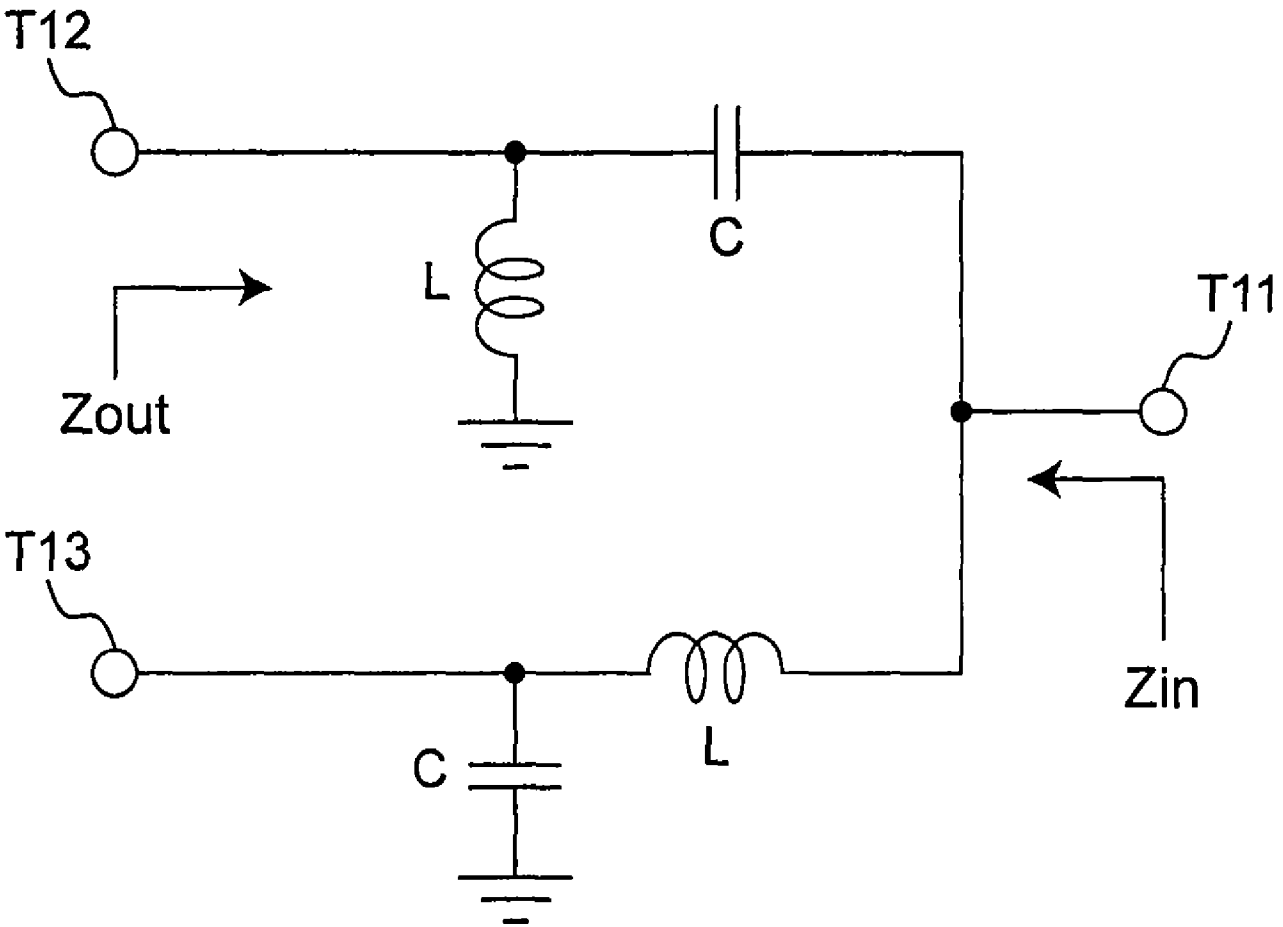
FIG. 75 is a circuit diagram showing a configuration of the balun 1031 of FIG. 71 to FIG. 74 of the fourth implemental example of the present preferred embodiment.

FIG. 75 is a circuit diagram showing a configuration of the balun 1031 of FIG. 71 to FIG. 74 of the fourth implemental example of the present preferred embodiment. Referring to FIG. 75, it is assumed that Zout is balanced side impedance and Zin is unbalanced side impedance. In this case, a set frequency of the balun is expressed by the following equations:

$$L = \frac{\sqrt{Zin \cdot Zout}}{\omega}$$

$$C = \frac{1}{\omega\sqrt{Zin \cdot Zout}}$$

$$\omega = \frac{1}{\sqrt{L \cdot C}}$$

$$f = \frac{1}{2\pi\sqrt{L \cdot C}}$$

$$\frac{L}{C} = Zin \cdot Zout$$

In the above fourth implemental example, the following modified preferred embodiment can be employed. That is, the following method can be used as a method for generating a phase difference at the feeding points Q1 and Q2 described in FIGS. 3 and 4.

(A) A phase difference can be given by making the capacitance values of the series capacitors Cs1 and Cs2 of FIG. 72 so that the values satisfy not Cs1=Cs2 but Cs1≠Cs2 (e.g., Cs1>Cs2).

(B) A phase difference can be given by making the capacitance values of the series capacitors Cs11 and Cs12 of FIG. 73 so that the values satisfy not Cs11=Cs12 but Cs11≠Cs12 (e.g., Cs11>Cs12).

Fifth Implemental Example

In the fifth implemental example, an optimal height of the antenna in the antenna system of the seventeenth preferred embodiment is described below.

Figure 76A:
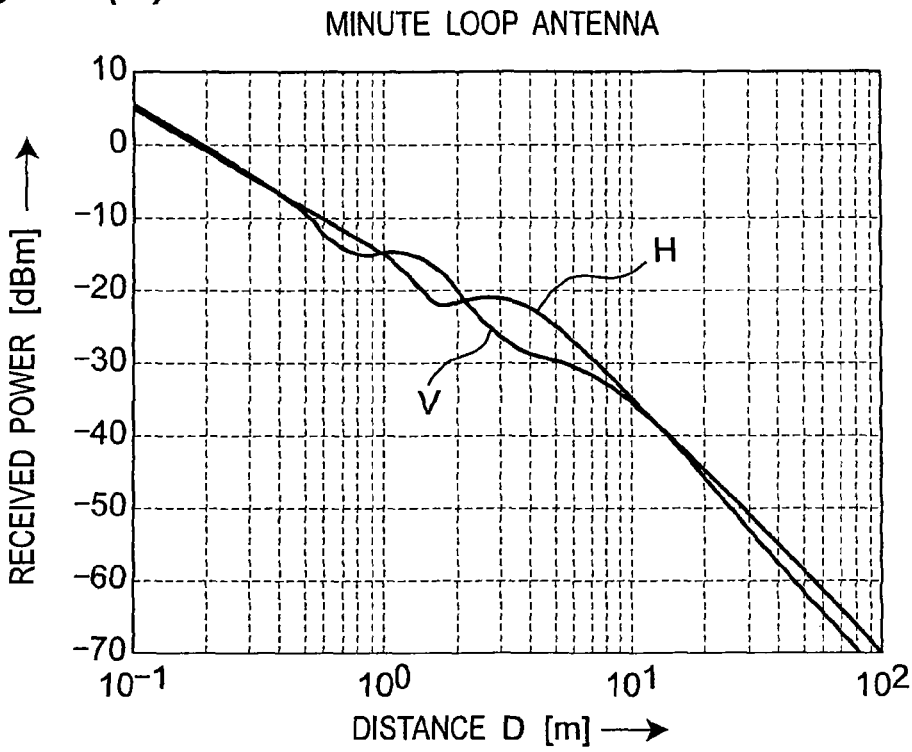
FIG. 76(*a*) is a radio wave propagation characteristic chart showing a received power with respect to a distance D between both apparatuses 100 and 300 when the antenna heights of both the apparatuses 100 and 300 are set substantially identical in an antenna system provided with an authentication key device 100 and the antenna apparatus 300 for the objective equipment having a small loop antenna element 105 according to a fifth implemental example of the seventeenth preferred embodiment.
Figure 76B:
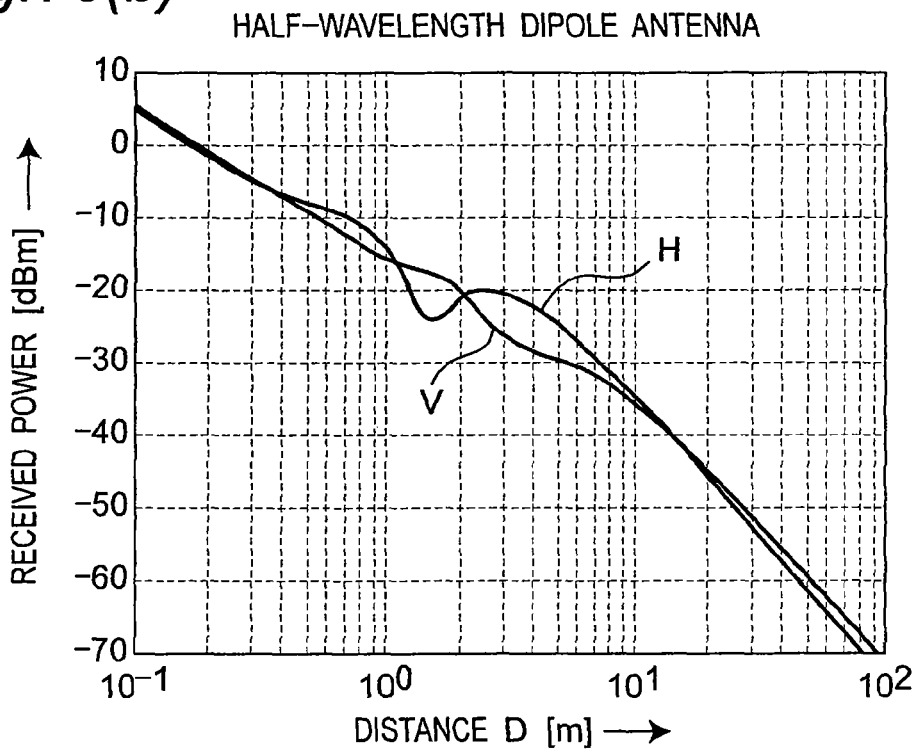

FIG. 76(*a*) is a radio wave propagation characteristic chart showing a received power with respect to a distance D between both apparatuses 100 and 300 when the antenna heights of both the apparatuses 100 and 300 are set substantially identical in an antenna system provided with an authentication key device 100 and the antenna apparatus 300 for the objective equipment having a small loop antenna element 105 according to the fifth implemental example of the seventeenth preferred embodiment. FIG. 76(*b*) is a radio wave propagation characteristic chart showing a received power with respect to the distance D between both the apparatuses 100 and 300 when the antenna heights of both the apparatuses 100 and 300 are set substantially identical in the antenna system provided with the authentication key device 100 and the antenna apparatus 300 for the objective equipment having a half-wavelength dipole antenna of the fifth implemental example of the seventeenth preferred embodiment. These characteristics are obtained by an active tag system at 400 MHz for use in a personal computer takeout management system, a schoolchild watching system, a keyless entry system or the like.

As apparent from FIG. 76(*a*) and FIG. 76(*b*), with regard to the height of the antenna, least influence of the directivity is received at equal height in both transmission and reception, and this is preferable. Moreover, less influence of reflected waves is received when there is a null point in a direction toward the ground. Furthermore, the vertically polarized wave receives less influence of reflected waves. Moreover, when a linear antenna is used, it is appropriate for distance detection to use a vertical polarization antenna of which the antenna height is substantially identical in transmission and reception. This is because the influence of the directivity is not received and the influence of the reflected waves is smallest due to the fact that the null point effect of the antenna and the coefficient of reflection of the vertically polarized wave are small. Moreover, when a small loop antenna apparatus is used, it is appropriate for distance detection when the antenna for transmission and reception has a substantially identical height, and there is not so much difference ascribed to the polarization plane.

SUMMARY OF THE PREFERRED EMBODIMENTS

The above preferred embodiments can be categorized into the following three groups:

<Group 1> One small loop antenna element: The first, seventh to ninth, eleventh, fourteenth and eighteenth preferred embodiments;

<Group 2> Mutually orthogonal two small loop antenna elements: The second to sixth, tenth, twelfth to thirteenth, fifteenth to seventeenth and nineteenth preferred embodiments; and <Group 3> Antenna system: seventeenth preferred embodiment.

In Group 1, the constituent elements in the other preferred embodiments of the same group might be combined together in each preferred embodiment. Moreover, in Group 2, each of the small loop antenna elements of Group 1 can be used, and the constituent elements in the other preferred embodiments of the same group might be combined together. Furthermore, in Group 3, each of the small loop antenna elements of Group 1 can be used.

INDUSTRIAL UTILIABILITY

As described above, according to the antenna apparatus of the invention, an antenna apparatus capable of obtaining a substantially constant gain regardless of the distance between the antenna apparatus and the conductor plate and preventing the degradation in the communication quality can be provided. Moreover, for example, by increasing the antenna gain of the polarized wave component radiated from the connecting conductor while suppressing the antenna gain decrease in the polarized wave component radiated from the small loop antenna element during the authentication communication, an antenna apparatus that obtains a communication quality higher than those of the prior arts can be provided. Furthermore, even when one polarized wave of both the vertically and horizontally polarized waves is largely attenuated, the polarization diversity effect can be obtained. Therefore, the antenna apparatus of the invention can be applied as an antenna apparatus mounted on, for example, equipment of which the security needs to be secured by the distance.

Moreover, according to the antenna system of the invention, the antenna apparatus in which the variation in the antenna gain of the authentication key depending on the distance to the conductor plate is small and which has the antenna apparatus for the authentication key and the antenna apparatus for the objective equipment capable of avoiding the influence of fading can be provided.

The invention claimed is:

1. An antenna apparatus comprising:

a small loop antenna element having predetermined small dimensions and two feeding points; and a balanced signal feeding device configured to feed two balanced signals having a predetermined amplitude difference and a predetermined phase difference therebetween, respectively to two feeding points of the small loop antenna element, wherein the small loop antenna element comprises:

a plurality of loop antenna portions having a predetermined loop plane and radiating a first polarized wave component parallel to the loop plane; and at least one connecting conductor provided in a direction perpendicular to the loop plane, the connecting conductor connecting the plurality of loop antenna portions and radiating a second polarized wave component orthogonal to the first polarized wave component, and a setting device configured to substantially equalize maximum values of antenna gains that the first polarized wave component and the second polarized wave component exhibit respectively when a distance between the antenna apparatus and a conductor plate is changed in the vicinity of the conductor plate, thereby making a composite of the first polarized wave component and the second polarized wave component substantially constant regardless of a change of the distance.

2. The antenna apparatus as claimed in claim 1, wherein the setting device adjusts at least one of the amplitude difference and the phase difference, so as to substantially equalize the maximum values of the antenna gains that the first and second polarized wave component and the second polarized wave component exhibit respectively when the distance is changed.

3. The antenna apparatus as claimed in claim 1, wherein the setting device comprises a controller configured to control at least one of the amplitude difference and the phase difference, so as to substantially equalize the maximum values of the antenna gains that the first polarized wave component and the antenna gain of the second polarized wave component exhibit respectively as the distance is changed.

4. The antenna apparatus as claimed in claim 1, wherein the setting device adjusts at least one of a dimension of the small loop antenna element, a number of turns of the small loop antenna element and an interval between the loop antenna portions, so as to substantially equalize the maximum values of the antenna gains that the first polarized wave component and the second polarized wave component exhibit respectively as the distance is changed.

5. The antenna apparatus as claimed in claim 1, wherein the small loop antenna element comprises first, second and third loop antenna portions provided parallel to the loop plane, the first loop antenna portion comprises first and second half-loop antenna portions, each having a half turn, wherein the second loop antenna portion comprises third and fourth half-loop antenna portions, each having a half turn, wherein the third loop antenna portion has one turn, wherein the antenna apparatus further comprises:

a first connecting conductor portion provided in a direction orthogonal to the loop plane, the first connecting conductor portion connecting the first half-loop antenna portion with the fourth half-loop antenna portion;

a second connecting conductor portion provided in the direction orthogonal to the loop plane, the second connecting conductor portion connecting the second half-loop antenna portion with the third half-loop antenna portion;

a third connecting conductor portion provided in the direction orthogonal to the loop plane, the third connecting conductor portion connecting the third loop antenna portion with the fourth half-loop antenna portion; and a fourth connecting conductor portion provided in the direction orthogonal to the loop plane, the fourth connecting conductor portion connecting the third loop antenna portion with the third half-loop antenna portion, and wherein one end of the first half-loop antenna portion and one end of the second half-loop antenna portion constitute the two feeding points.

6. The antenna apparatus as claimed in claim 1, wherein the small loop antenna element comprises first, second and third loop antenna portions provided parallel to the loop plane, wherein the first loop antenna portion comprises first and second half-loop antenna portions, each having a half turn, wherein the second loop antenna portion comprises third and fourth half-loop antenna portions, each having a half turn, wherein the third loop antenna portion has one turn, wherein the antenna apparatus comprises:

a first connecting conductor portion provided in a direction orthogonal to the loop plane, the first connecting conductor portion connecting the first half-loop antenna portion with the third half-loop antenna portion;

a second connecting conductor portion provided in the direction orthogonal to the loop plane, the second connecting conductor portion connecting the third half-loop antenna portion with the third loop antenna portion;

a third connecting conductor portion provided in the direction orthogonal to the loop plane, the third connecting conductor portion connecting the second half-loop antenna portion with the fourth half-loop antenna portion; and a fourth connecting conductor portion provided in the direction orthogonal to the loop plane, the fourth connecting conductor portion connecting the fourth half-loop antenna portion with the third loop antenna portion, and wherein one end of the first half-loop antenna portion and one end of the second half-loop antenna portion constitute the two feeding points.

7. The antenna apparatus as claimed in claim 1, wherein the small loop antenna element comprises first, second and third loop antenna portions provided parallel to the loop plane, wherein the first loop antenna portion comprises first and second half-loop antenna portions, each having a half turn, wherein the second loop antenna portion comprises third and fourth half-loop antenna portions, each having a half turn, wherein the third loop antenna portion comprises fifth and sixth half-loop antenna portions, each having a half turn, wherein the antenna apparatus further comprises:

a first connecting conductor portion provided in a direction orthogonal to the loop plane, the first connecting conductor portion connecting the first half-loop antenna portion with the third half-loop antenna portion;

a second connecting conductor portion provided in the direction orthogonal to the loop plane, the second connecting conductor portion connecting the third half-loop antenna portion with the fifth half-loop antenna portion;

a third connecting conductor portion provided in the direction orthogonal to the loop plane, the third connecting conductor portion connecting the second half-loop antenna portion with the fourth half-loop antenna portion;

a fourth connecting conductor portion provided in the direction orthogonal to the loop plane, the fourth connecting conductor portion connecting the fourth half-loop antenna portion with the sixth half-loop antenna portion, a fifth connecting conductor portion provided in the direction orthogonal to the loop plane, the fifth connecting conductor portion being connected to the fifth half-loop antenna portion; and a sixth connecting conductor portion provided in the direction orthogonal to the loop plane, the sixth connecting conductor portion being connected to the sixth half-loop antenna portion, wherein a first loop antenna is configured to include the first, third and fifth half-loop antenna portions and the fifth connecting conductor portion, wherein a second loop antenna is configured to include the second, fourth and sixth half-loop antenna portions and the sixth connecting conductor portion, wherein one end of the first half-loop antenna portion and one end of the fifth connecting conductor portion constitute the two feeding points for the first loop antenna, wherein one end of the second half-loop antenna portion and one end of the sixth connecting conductor portion constitute the two feeding points for the second loop antenna, wherein an unbalanced signal feeding device is provided in place of the balanced signal feeding device, and wherein the unbalanced signal feeding device feeds two unbalanced signals having a predetermined amplitude difference and a predetermined phase difference therebetween, respectively to the first and second loop antennas.

8. An antenna apparatus comprising:

a first small loop antenna element having predetermined small dimensions and two feeding points; and a second small loop antenna element configured similarly to the first small loop antenna element, wherein each of the first and second small loop antenna elements comprises:

a plurality of loop antenna portions having a predetermined loop plane and radiating a first polarized wave component parallel to the loop plane; and at least one connecting conductor provided in a direction perpendicular to the loop plane, the connecting conductor connecting the plurality of loop antenna portions, and radiating a second polarized wave component orthogonal to the first polarized wave component, and a setting device configured to substantially equalize maximum values of antenna gains that the first polarized wave component and the second polarized wave component exhibit respectively when a distance between the antenna apparatus and a conductor plate is changed in the vicinity of the conductor plate, thereby making a composite of the first polarized wave component and the second polarized wave component substantially constant regardless of a change of the distance, wherein the first small loop antenna element and the second small loop antenna element are provided so that their loop planes are orthogonal to each other.

9. The antenna apparatus as claimed in claim 8, further comprising a switch device configured to feed two balanced signals selectively to either one of the first small loop antenna element and the second small loop antenna element.

10. The antenna apparatus as claimed in claim 8, further comprising a balanced signal feeding device configured to split an unbalanced signal into two unbalanced wireless signals with a phase difference of 90 degrees therebetween and convert one of the split unbalanced signals into two balanced signals, the balanced signal feeding device feeding the two balanced wireless signals to the first small loop antenna element, while feeding the other of the split unbalanced signals to the second small loop antenna element, thereby radiating a circularly polarized wireless signal.

11. The antenna apparatus as claimed in claim 8, further comprising a balanced signal feeding device configured to split an unbalanced signal into two in-phase or anti-phase unbalanced signals and convert one of the split unbalanced signals into two balanced wireless signals, the balanced signal feeding device feeding the two balanced signals to the first small loop antenna element, while converting the other of the split unbalanced signals into another set of two balanced signals and feeding said another set of two balanced signals to the second small loop antenna element.

12. The antenna apparatus as claimed in claim 8, further comprising a balanced signal feeding device configured to split an unbalanced signal into two unbalanced signals having a phase difference of +90 degrees or a phase difference of −90 degrees therebetween and convert one of the split unbalanced signals into two balanced signals, the balanced signal feeding device feeding the two balanced signals to the first small loop antenna element, while converting the other of the split unbalanced signals into another set of two balanced signals and feeding said another set of two balanced signals to the second small loop antenna element.

13. An antenna system comprising:

a first antenna apparatus used for an authentication key; and a second antenna apparatus configured to perform wireless communications with the first antenna apparatus, wherein the first antenna apparatus comprises:

a small loop antenna element having predetermined small dimensions and two feeding points; and a balanced signal feeding device configured to feed two balanced signals having a predetermined amplitude difference and a predetermined phase difference therebetween, respectively to the two feeding points of the small loop antenna element, wherein the small loop antenna element comprises:

a plurality of loop antenna portions having a predetermined loop plane and radiating a first polarized wave component parallel to the loop plane; and at least one connecting conductor provided in a direction perpendicular to the loop plane, the connecting conductor connecting the plurality of loop antenna portions and radiating a second polarized wave component orthogonal to the first polarized wave component, and a setting device configured to substantially equalize maximum values of antenna gains that the first polarized wave component and the second polarized wave component exhibit respectively when a distance between the antenna apparatus and a conductor plate is changed in the vicinity of the conductor plate, thereby making a composite of the first polarized wave component and the second polarized wave component substantially constant regardless of a change of the distance, wherein the second antenna apparatus comprises:

two antenna elements having mutually orthogonal polarized waves; and a switch device configured to select one of the two antenna elements and connect a selected one of the two antenna elements with a wireless transceiver circuit.

* * * * *